US011591175B2

(12) United States Patent
Nakamura et al.

(10) Patent No.: US 11,591,175 B2
(45) Date of Patent: Feb. 28, 2023

(54) SHEET FEEDER, CONTROL METHOD OF SHEET FEEDER, AND STORAGE MEDIUM

(71) Applicant: CANON DENSHI KABUSHIKI KAISHA, Chichibu (JP)

(72) Inventors: Tadashi Nakamura, Saitama-ken (JP); Yoshihiro Taniike, Tokyo (JP); Shigeru Kosuda, Saitama-ken (JP); Toru Sakai, Saitama-ken (JP); Toshio Ohki, Tokyo (JP); Masanori Tamai, Tokyo (JP); Sadayuki Kaneko, Tokyo (JP); Masamune Tokizawa, Tokyo (JP)

(73) Assignee: Canon Denshi Kabushiki Kaisha, Chichibu (JP)

( * ) Notice: Subject to any disclaimer, the term of this patent is extended or adjusted under 35 U.S.C. 154(b) by 146 days.

(21) Appl. No.: 16/911,620

(22) Filed: Jun. 25, 2020

(65) Prior Publication Data

US 2020/0324991 A1 Oct. 15, 2020

Related U.S. Application Data

(63) Continuation of application No. PCT/JP2018/030870, filed on Aug. 21, 2018.

(30) Foreign Application Priority Data

Dec. 26, 2017 (JP) ..... JP2017-249598
Dec. 27, 2017 (JP) ..... JP2017-252049
(Continued)

(51) Int. Cl.
*B65H 7/02* (2006.01)
*B65H 7/14* (2006.01)
(Continued)

(52) U.S. Cl.
CPC ..... *B65H 9/002* (2013.01); *B65H 5/062* (2013.01); *B65H 7/14* (2013.01); *B65H 7/18* (2013.01); *B65H 7/20* (2013.01)

(58) Field of Classification Search
CPC . B65H 7/14; B65H 7/02; B65H 9/002; B65H 5/062; B65H 5/34; B65H 2511/108;
(Continued)

(56) References Cited

U.S. PATENT DOCUMENTS 7,292,819 B2 11/2007 Ueda
8,864,130 B2 10/2014 Umi et al.
(Continued)

FOREIGN PATENT DOCUMENTS

JP 06-9110 A 1/1994
JP 09-278196 A 10/1997
(Continued)

OTHER PUBLICATIONS

English Translation of JP 06-009110.
(Continued)

*Primary Examiner* — Luis A Gonzalez
(74) *Attorney, Agent, or Firm* — Venable LLP

(57) ABSTRACT

In a case where feeding of a subsequent sheet by a feed roller is started after the trailing edge of a preceding sheet is detected by a post-registration sensor, a control unit of a sheet feeder controls the feed roller to rotate at a first feeding speed, and in a case where the leading edge of the subsequent sheet has passed through a nip position between the feed roller and a separation roller, the control unit controls the feed roller to rotate at a second feeding speed.

9 Claims, 71 Drawing Sheets

(30) Foreign Application Priority Data

| | | |
|---|---|---|
| Apr. 6, 2018 | (JP) | JP2018-074167 |
| Apr. 27, 2018 | (JP) | JP2018-087469 |
| Aug. 8, 2018 | (JP) | JP2018-149180 |

(51) Int. Cl.

| | |
|---|---|
| ***B65H 7/18*** | (2006.01) |
| ***B65H 3/06*** | (2006.01) |
| ***B65H 3/52*** | (2006.01) |
| ***B65H 9/00*** | (2006.01) |
| ***B65H 5/06*** | (2006.01) |
| ***B65H 7/20*** | (2006.01) |

(58) Field of Classification Search
CPC .. B65H 2511/10; B65H 2511/50; B65H 7/18; B65H 7/20; B65H 2513/10; B65H 2513/50; B65H 2513/512; B65H 3/06; B65H 3/0684
See application file for complete search history.

(56) References Cited

U.S. PATENT DOCUMENTS

| | | | | |
|---|---|---|---|---|
| 8,864,271 | B2 | 10/2014 | Abe | |
| 8,894,060 | B2 | 11/2014 | Takamori | |
| 9,927,753 | B2 | 3/2018 | Takahashi et al. | |
| 2015/0028533 | A1* | 1/2015 | Kato | B65H 7/14 271/3.16 |
| 2015/0239695 | A1* | 8/2015 | Noda | B65H 7/14 271/265.01 |
| 2017/0066261 | A1 | 3/2017 | Nishida | |
| 2017/0166412 | A1* | 6/2017 | Kawamura | B65H 7/18 |
| 2019/0119058 | A1* | 4/2019 | Chiba | B65H 7/02 |

FOREIGN PATENT DOCUMENTS

| | | | |
|---|---|---|---|
| JP | 10-250862 | A | 9/1998 |
| JP | 2008-265996 | A | 11/2008 |
| JP | 2013-119439 | A | 6/2013 |
| JP | 2013-209196 | A | 10/2013 |
| JP | 2014-045256 | A | 3/2014 |
| JP | 2014-119432 | A | 6/2014 |
| JP | 2014-125347 | A | 7/2014 |
| JP | 2014-181109 | A | 9/2014 |
| JP | 2016-020279 | A | 2/2016 |
| JP | 2017-095190 | A | 6/2017 |

OTHER PUBLICATIONS

Extended European Search Report dated Jun. 9, 2021, issued in European Patent Application No. 18893908.6.
International Search Report and Written Opinion dated Oct. 30, 2018, in International Application No. PCT/JP2018/030870.
Office Action dated May 16, 2022, in Japanese Patent Application No. 2018-074167.
Office Action dated May 24, 2022, in Japanese Patent Application No. 2018-149180.
Machine English Translation of JP 2016-020279.

* cited by examiner (7)

(8)

(8)'

(9),(10)

(4)

(4)'

(5)

(6)

(a)

(b)

(a)

(b)

(a)

(b)

x COMPONENT = a1 × cosθ2−b1 × sinθ2
y COMPONENT = a1 × sinθ2+b1 × cosθ2

(a)

(b)

SHEET FEEDER, CONTROL METHOD OF SHEET FEEDER, AND STORAGE MEDIUM

CROSS-REFERENCE TO RELATED APPLICATION(S)

This application is a continuation of International Patent Application No. PCT/JP2018/030870 filed on Aug. 21, 2018, which claims priority to and the benefit of Japanese Patent Application No. 2017-249598 filed on Dec. 26, 2017, Japanese Patent Application No. 2017-252049 filed on Dec. 27, 2017, Japanese Patent Application No. 2018-074167 filed on Apr. 6, 2018, Japanese Patent Application No. 2018-087469 filed on Apr. 27, 2018, and Japanese Patent Application No. 2018-149180 filed on Aug. 8, 2018, the entire disclosures of which are incorporated herein by reference.

BACKGROUND OF THE INVENTION

Field of the Invention

The present invention relates to a feed technique for a document sensitive to a load, for example, thin paper, a slip, old paper (history book), an already wrinkled document, an already folded document, or a broken document in a sheet feeder capable of feeding a sheet.

Description of the Related Art

In a conventional sheet feeder, when continuously feeding a plurality of sheets, every time one sheet is fed, an operation of moving a pickup roller (for example, 4 in FIG. 1 to be described later) to a sheet take-in position, bringing it into contact with the sheet, and rotating it, and then moving it to a retreat position is repeated. However, if the sheet is thin paper or the like with low stiffness, jam may occur between a separation roller pair (for example, 6 and 7 in FIG. 1) and the pickup roller.

As a jam measure for a sheet such as thin paper, Japanese Patent Laid-Open No. 6-9110 has been proposed. In Japanese Patent Laid-Open No. 6-9110, a pre-registration sensor (for example, 32 in FIG. 1 to be described later) detects the trailing edge of a precedingly fed sheet. After that, if the pre-registration sensor does not detect the leading edge of the next sheet after the elapse of a specific time, the pickup roller is brought into contact with the sheet and rotated. There has been proposed a technique of feeding a sheet while minimizing use of the pickup roller in this way.

The technique of Japanese Patent Laid-Open No. 6-9110 has an effect to certain extent as a jam measure for a sheet such as thin paper with low rigidity (to be referred to as "stiffness" hereinafter). On the other hand, in some cases, the sheet may be caught by a feed roller that constitutes the separation roller pair to cause jam.

As described above, in the conventional technique, if a sheet to be fed is thin paper or the like with low stiffness, jam may occur on the feed roller.

The present invention has been made to solve the above-described problem. It is an object of the present invention to provide a mechanism capable of making jam less likely to occur in feeding even if a sheet to be fed is thin paper or the like with low stiffness.

SUMMARY OF THE INVENTION

The present invention has been made in consideration of the above-described problem. According to one aspect of the present invention, there is provided a sheet feeder comprising: a feed roller configured to feed a sheet along a conveyance path; a separation roller configured to form a nip with the feed roller and separate the sheet fed by the feed roller from other sheets; a first sheet detection sensor arranged on a downstream side of the conveyance path with respect to the feed roller in the conveyance path, and configured to detect that the sheet has reached; and a control unit configured to control rotation of the feed roller, wherein in a case where starting feeding of a subsequent sheet by the feed roller after reaching of a trailing edge of a preceding sheet is detected by the first sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed.

According to another aspect of the present invention, there is provided a control method of a sheet feeder including: a feed roller configured to feed a sheet along a conveyance path; a separation roller configured to form a nip with the feed roller and separate the sheet fed by the feed roller from other sheets; a first sheet detection sensor arranged on a downstream side of the conveyance path with respect to the feed roller in the conveyance path, and configured to detect that a sheet has reached; and a control unit configured to control rotation of the feed roller, the control method comprising: in a case where starting feeding of a subsequent sheet by the feed roller after reaching of a trailing edge of a preceding sheet is detected by the first sheet detection sensor, controlling, by the control unit, the feed roller to rotate at a first feeding speed; and upon determining that a leading edge of the subsequent sheet has passed through the nip, controlling, by the control unit, the feed roller to rotate at a second feeding speed higher than the first feeding speed.

According to still another aspect of the present invention, there is provided a non-transitory computer-readable storage medium storing a computer program for causing a processor of a sheet feeder to function as a control unit of the sheet feeder, the sheet feeder comprising: a feed roller configured to feed a sheet along a conveyance path; a separation roller configured to form a nip with the feed roller and separate the sheet fed by the feed roller from other sheets; a first sheet detection sensor arranged on a downstream side of the conveyance path with respect to the feed roller in the conveyance path, and configured to detect that the sheet has reached; and the control unit configured to control rotation of the feed roller, wherein in a case where starting feeding of a subsequent sheet by the feed roller after reaching of a trailing edge of a preceding sheet is detected by the first sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed.

Further features of the present invention will become apparent from the following description of exemplary embodiments (with reference to the attached drawings).

DESCRIPTION OF THE EMBODIMENTS

First Embodiment

A sheet conveyance apparatus including a sheet feeder according to the first embodiment of the present invention will be described first.

Figure 1:
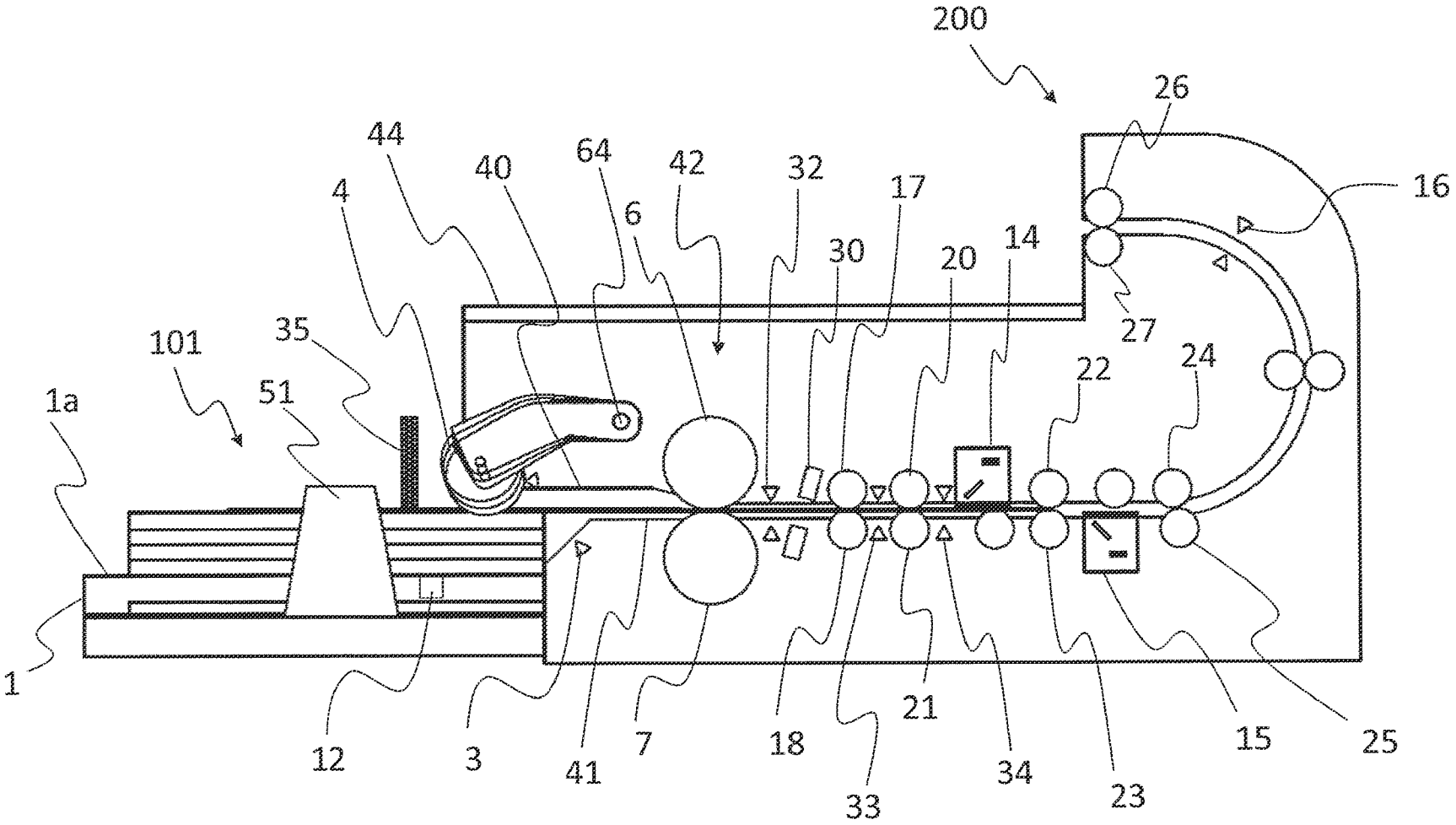
FIG. 1 is a partial sectional view of a sheet conveyance apparatus including a sheet feeder according to the first embodiment.

FIG. 1 is a partial sectional view schematically showing the configuration of a sheet conveyance apparatus (image reading apparatus) including a sheet feeder according to the first embodiment of the present invention.

Figure 2:
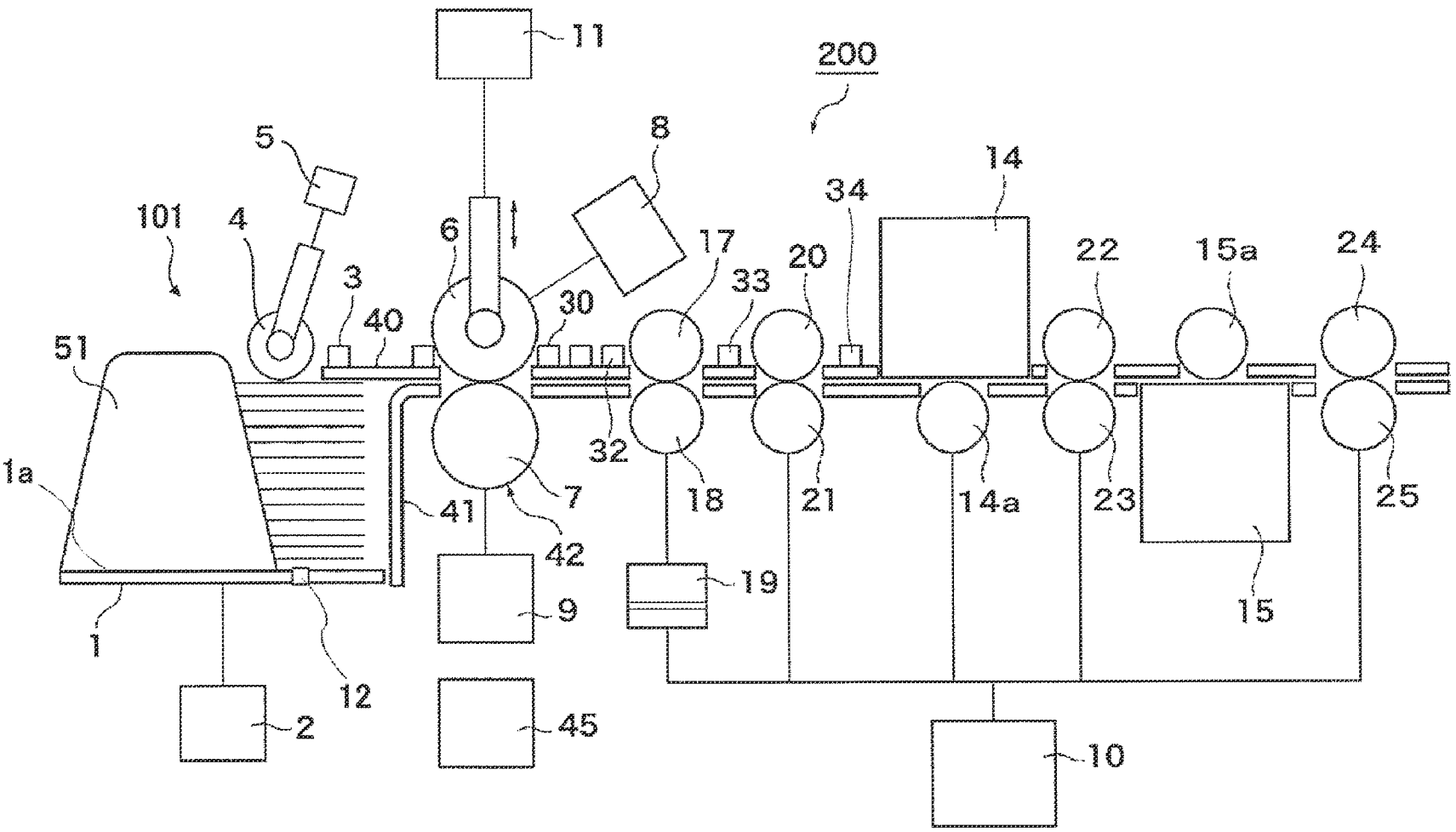
FIG. 2 is a view schematically showing the configuration of the main part of the sheet conveyance apparatus.

FIG. 2 is a view schematically showing the configuration of the main part of the sheet conveyance apparatus shown in FIG. 1.

A case in which the sheet conveyance apparatus according to the present invention is applied to an image reading apparatus will be described here as an example. However, the sheet conveyance apparatus can also be applied to various kinds of sheet conveyance apparatuses such as an apparatus including a document conveyance system, such as a printing apparatus (printer or the like) for printing on a sheet and a multi-function peripheral that combines an image reading apparatus and a printing apparatus.

As shown in FIGS. 1 and 2, a sheet conveyance apparatus 200 according to this embodiment includes a sheet take-in device (sheet feeder) 101.

A plurality of sheets are stacked on a sheet stacker (sheet placement table) 1, and the sheet stacker 1 is configured to move up and down. A sheet stacker drive motor 2 moves the sheet stacker 1 up and down. A sheet detection sensor 3 detects that a sheet stacked on the sheet stacker 1 is located at a sheet take-in position. A sheet stacking detection sensor 12 detects that a sheet is stacked on a sheet stacking surface 1*a* of the sheet stacker 1. A document jumping detection sensor 35 includes a plurality of sensors arranged in a direction orthogonal to the sheet stacking surface 1*a*, and detects jumping of a sheet stacked on the sheet stacker 1. For example, the document jumping detection sensor 35 can detect jumping of a document, which occurs when, for example, a stapled document is stacked on the sheet stacker 1 and fed. This enables control of, for example, stopping feeding of the stapled document.

A pickup roller 4 (take-in means) as an example of a sheet pickup unit feeds a sheet on the sheet stacker 1 from the sheet stacker 1. A pickup roller drive motor 5 rotates the pickup roller 4 in a direction (take-in direction) of taking in the sheet. The state shown in FIG. 2 is a state in which the sheet upper surface is located at the sheet take-in position, and the take-in of the sheet starts when the pickup roller 4 is rotated. In addition, the pickup roller 4 can be driven and moved by a driving unit (not shown) to the sheet take-in position shown in FIG. 2 and a retreat position (not shown) on the upper side of the sheet take-in position. The pickup roller 4 is moved to the sheet take-in position when taking a sheet in, and moved to the retreat position when the take-in is ended. In the example shown in FIG. 1, the pickup roller 4 pivots about a rotation center 64 of the pickup roller, which is provided on the downstream side of the pickup roller 4 in the conveyance direction. Hence, when the pickup roller 4 comes into contact with the sheet, the sheet can readily be pushed in the conveyance direction.

A rotation instruction of the pickup roller 4 and a moving instruction to the sheet take-in position or the retreat position are issued by a control unit 45. The control unit 45 includes a CPU, a ROM, a RAM, and the like (none are shown). The CPU executes programs stored in the ROM, thereby implementing various kinds of control. Additionally, the pickup roller 4 carries an auxiliary role to reliably perform separation/feeding by a separation roller pair 42 to be described later. When a sheet on the sheet stacker 1 is fed by the pickup roller 4 to the nip portion of the separation roller pair 42, separation/feeding by the separation roller pair 42 can reliably be performed.

In the separation roller pair 42, a feed roller 6 is driven by a feed motor 8 to rotate in a direction (feeding direction) of feeding the sheet to the downstream side in the conveyance direction. A separation roller 7 always receives a rotating force of rotating in a direction of pushing back the sheet to the upstream side in the conveyance direction from a separation motor 9 via a torque limiter (slip clutch) (not shown).

When one sheet exists between the feed roller 6 and the separation roller 7, the rotating force in a direction of feeding the sheet to the downstream side by the frictional force between the separation roller 7 and the sheet fed to the downstream side by the feed roller 6 is larger than the upper limit value of the rotating force transmitted by the above-described torque limiter in the direction in which the separation roller 7 pushes back the sheet to the upstream side. For this reason, the separation roller 7 rotates following the feed roller 6 (rotates together).

On the other hand, if a plurality of sheets exist between the feed roller 6 and the separation roller 7, the separation roller 7 receives, from the roller shaft, rotation in the direction of pushing back the sheets to the upstream side, thereby preventing sheets other than the sheet at the uppermost position from being conveyed to the downstream side.

In this way, by the function of the feed roller 6 to feed a sheet to the downstream side and the function of the separation roller 7 to prevent a sheet from being conveyed to the downstream side, even if sheets are fed in an overlapping state to the nip portion (the contact portion between the feed roller 6 and the separation roller 7) formed between the feed roller 6 and the separation roller 7, only the sheet at the uppermost position is fed to the downstream side, and the remaining sheets are not conveyed to the downstream side. Hence, the sheets in the overlapping state are separated and fed.

The feed roller 6 and the separation roller 7 form a pair of separation roller pairs 42 (sheet separation portion). Note that in this embodiment, the separation roller pair 42 is used. Instead of the separation roller pair 42, a separation belt/roller pair formed by changing one of the separation roller and the feed roller to a belt may be used. Alternatively, the separation roller may be replaced with a separation pad, and the pad may be brought into contact with a sheet to prevent a plurality of sheets from being conveyed to the downstream side. Instead of rotating the separation roller 7, it may be used in contact with the sheet, like a separation pad.

By the sheet pickup unit formed by the thus configured pickup roller 4, feed roller 6, separation roller 7, and the like, the sheets stacked on the sheet stacker 1 are separated one by one and taken into the sheet conveyance apparatus 200.

In addition, when a multiple feed detection sensor 30 is provided at a position where the separated sheet passes (that is, on the downstream side of the separation roller pair 42), it can be detected whether the sheets are separated one by one by the sheet separation portion. In this embodiment, a detection device using ultrasonic wave transmitting and receiving portions is used as the multiple feed detection sensor 30, and multiple feed can be detected based on the attenuation amount of an ultrasonic wave between the transmitting and receiving portions across the conveyance path. Note that the multiple feed detection sensor 30 can also be used as a sensor configured to detect a sheet that has reached a predetermined position (a position corresponding to between the ultrasonic wave transmitting and receiving portions) of the conveyance path.

A conveyance motor 10 drives other rollers (sheet conveyance unit) to convey the separated sheet to an image reading position where the image of the sheet is read by image reading sensors 14 and 15 and further convey the sheet to a discharge position. Also, the conveyance motor 10 drives the rollers to change the sheet conveyance speed in accordance with a speed optimum for sheet reading and settings such as the resolution of the sheet.

A nip gap adjusting motor 11 adjusts the gap between the feed roller 6 and the separation roller 7 or a contact force (nip pressure) of the feed roller 6 contacting the separation roller 7 via a sheet. This can adjust the gap adapted for the thickness of the sheet or the contact force and separate the sheet.

A registration clutch 19 transmits the rotation driving force of the conveyance motor 10 to a registration roller 18 (sheet conveyance unit) or blocks the transmission. By stopping the rotation of a first registration roller pair formed by the registration rollers 17 and 18, the leading edge of the fed sheet is made to abut against the nip portion of the registration roller pair to correct skewing of the sheet.

A second registration roller pair formed by registration rollers 20 and 21, a conveyance roller pair formed by conveyance rollers 22 and 23, a conveyance roller pair formed by conveyance rollers 24 and 25, and a discharge roller pair formed by discharge rollers 26 and 27 convey the sheet to a discharge stacking unit 44. A discharge sensor 16 detects the passing of the conveyed sheet. After the discharge sensor 16 detects the trailing edge of the sheet, a discharge brake for reducing the rotation speed of the discharge roller pair (26 and 27) is applied, thereby preventing the discharged sheet from popping out and improving the discharge alignment property. Two guide plates including an upper guide plate 40 and a lower guide plate 41 guide the sheet conveyed by the separation roller pair, the registration roller pairs, the conveyance roller pairs, and the discharge roller pair.

A pre-registration sensor 32 (fourth sheet detection sensor) is arranged on the upstream side of the registration roller pair (17 and 18), and detects the fed sheet. A post-registration sensor 34 (first sheet detection sensor) is arranged on the downstream side of the registration roller pair (20 and 21), and detects the conveyed sheet. Furthermore, a middle-registration sensor 33 (third sheet detection sensor) is arranged on the downstream side of the registration roller pair (17 and 18) and on the upstream side of the registration roller pair (20 and 21), and detects the conveyed sheet.

When the post-registration sensor 34 detects the sheet, the control unit 45 issues an image reading instruction to the image reading sensors 14 and 15, and the image of the conveyed sheet is read. Note that reference numerals 14*a* and 15*a* denote platen rollers. The image of the sheet read by the image reading sensors 14 and 15 is transmitted to an external apparatus such as an information processing apparatus via an interface unit (not shown).

An example of the control operation of the pickup roller 4 at the time of execution of a thin paper mode (predetermined specific mode), which is performed by the control unit 45 according to the first embodiment will be described next with reference to FIG. 3.

Figure 3:
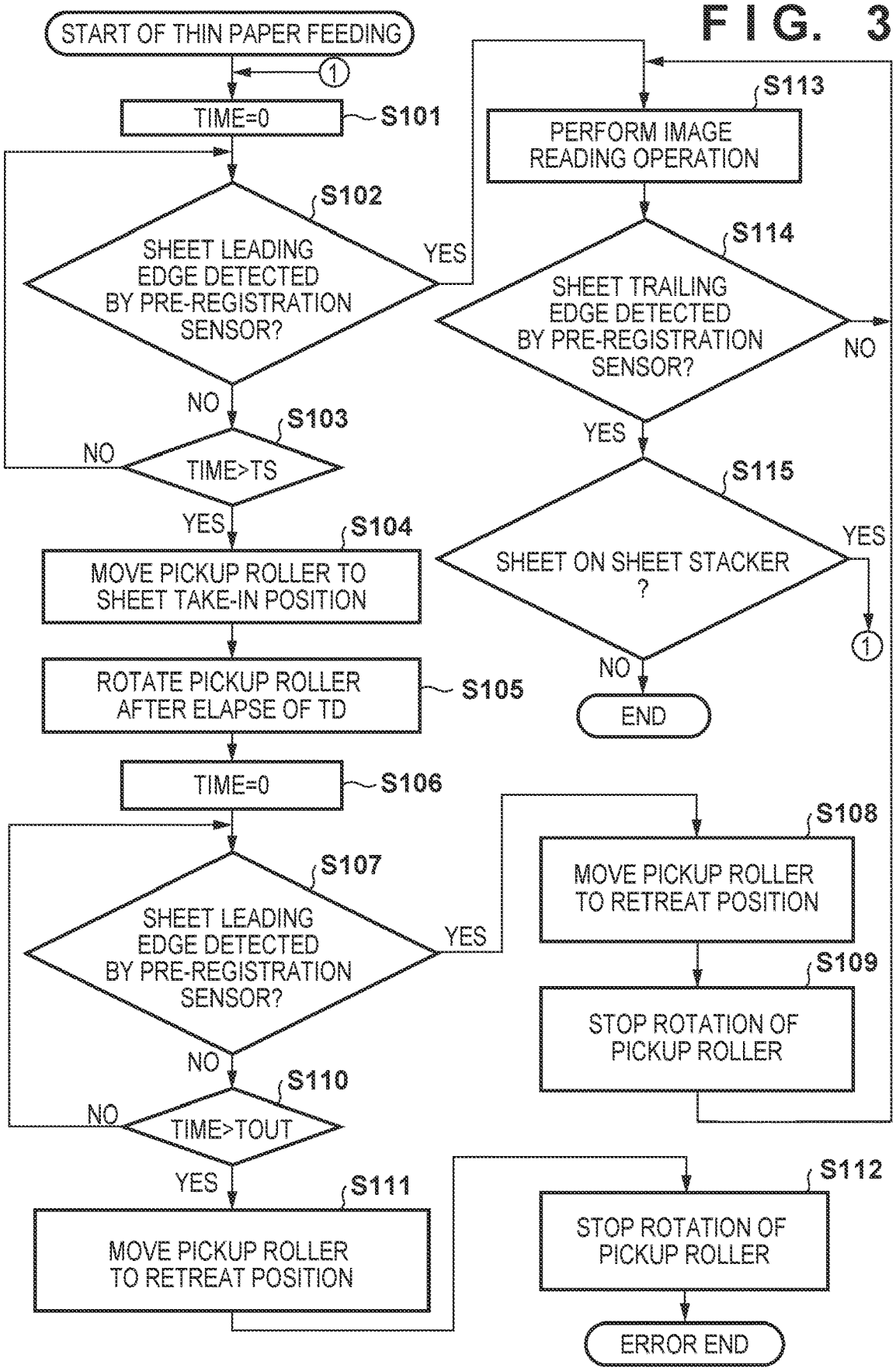
FIG. 3 is a flowchart showing a control operation in a thin paper mode according to the first embodiment.

FIG. 3 is a flowchart for explaining an example of the control operation in the thin paper mode (to be also referred to as a "thin paper conveyance mode" hereinafter), which is performed by the control unit 45 according to the first embodiment. That is, the processing shown in this flowchart is implemented when the CPU (not shown) of the control unit 45 executes a program stored in the ROM. Note that the thin paper mode can be set from an operation unit (not shown) or an information processing apparatus (personal computer or the like) communicably connected to the sheet conveyance apparatus 200.

When a feeding operation in the thin paper mode is started, the control unit 45 drives the feed roller 6 and starts measuring time (measurement time (TIME)=0) (step S101).

Next, in step S102, the control unit 45 checks the pre-registration sensor 32 and determines whether the pre-registration sensor 32 detects a sheet leading edge.

Upon determining that the pre-registration sensor 32 does not detect a sheet leading edge (NO in step S102), the control unit 45 advances the process to step S103.

In step S103, the control unit 45 determines whether the measurement time (TIME) has exceeded a specific time (TS). Upon determining that the measurement time (TIME) has not exceeded the specific time (TS) (NO in step S103), the control unit 45 returns the process to step S102.

On the other hand, upon determining that the measurement time (TIME) has exceeded the specific time (TS) (YES in step S103), that is, if a sheet leading edge is not detected by the pre-registration sensor 32 even if the measurement time (TIME) has reached the specific time (TS), the control unit 45 advances the process to step S104.

In step S104, the control unit 45 moves the pickup roller 4 to the sheet take-in position and brings the pickup roller into contact with the sheet.

Further, in step S105, the control unit 45 rotates the pickup roller 4 after the elapse of a specific time (TD) to be described later. Hence, the pickup roller 4 feeds the sheet to the feed roller 6.

Next, in step S106, the control unit 45 starts measuring time again (measurement time (TIME)=0).

In step S107, the control unit 45 checks the pre-registration sensor 32 and determines whether a sheet leading edge is detected by the pre-registration sensor 32.

Upon determining that the pre-registration sensor 32 does not detect a sheet leading edge (NO in step S107), the control unit 45 advances the process to step S110.

In step S110, the control unit 45 determines whether the measurement time (TIME) has exceeded an error time (TOUT). Upon determining that the measurement time (TIME) has not exceeded the error time (TOUT) (NO in step S110), the control unit 45 returns the process to step S107.

On the other hand, upon determining that the measurement time (TIME) has exceeded the error time (TOUT) (YES in step S110), that is, if a sheet leading edge is not detected by the pre-registration sensor 32 even if the measurement time (TIME) has reached the error time (TOUT), the control unit 45 advances the process to step S111. That is, it is determined that although the pickup roller 4 is moved to the take-in position and rotated, a sheet leading edge is not detected even if reaching the error time, that is, a sheet feeding error has occurred (for example, jam has occurred).

The control unit 45 moves the pickup roller 4 to the retreat position (step S111), stops the rotation of the pickup roller 4 (step S112), and error-ends the processing of the flowchart.

On the other hand, upon determining in step S107 that the pre-registration sensor 32 detects a sheet leading edge (YES in step S107), the control unit 45 advances the process to step S108.

The control unit 45 moves the pickup roller 4 to the retreat position (step S108), stops the rotation of the pickup roller 4 (step S109), and advances to step S113.

In addition, upon determining in step S102 that the pre-registration sensor 32 detects a sheet leading edge (YES in step S102), the control unit 45 advances to step S113. In this case, the pickup roller 4 does not move to the contact position and remains at the retreat position. That is, in this situation, a sheet leading edge reaches the pre-registration sensor 32 even if the pickup roller 4 is not driven. This situation is a situation in which after a sheet has reached the feed roller 6 due to a friction or static electricity generated between the sheet and a precedingly fed sheet, the previously fed sheet passes through the feed roller 6, is conveyed by the feed roller 6, and reaches at least a point before the pre-registration sensor 32. At this time, feed by the pickup roller 4 is unnecessary. To prevent damage caused by bringing the pickup roller 4 into contact with the sheet, the pickup roller 4 is kept at the retreat position.

Upon determining, in step S102 or S107, that the leading edge of a sheet is detected by the pre-registration sensor 32, the control unit 45 advances the process to step S113. In step S113, the control unit 45 issues an image reading instruction to the image reading sensors 14 and 15 at a predetermined timing after the leading edge of the sheet is detected by the post-registration sensor 34, and causes the image reading sensors 14 and 15 to perform a sheet reading operation. During this time, the control unit 45 monitors sheet trailing edge detection by the pre-registration sensor 32 (step S114). Upon determining that the pre-registration sensor 32 does not detect the sheet trailing edge (NO in step S114), the control unit 45 returns the process to step S113.

On the other hand, upon determining that the pre-registration sensor 32 detects the sheet trailing edge (YES in step S114), the control unit 45 advances the process to step S115. Note that the control unit 45 ends the reading operation in step S113 at a predetermined timing after the post-registration sensor 34 detects the leading edge of the sheet.

In step S115, the control unit 45 checks whether a sheet exists on the sheet stacker 1. Upon determining that a sheet exists on the sheet stacker 1 (YES in step S115), that is, if a next sheet exists, the control unit 45 returns the process to step S101.

On the other hand, upon determining that no sheet exists on the sheet stacker 1 (NO in step S115), that is, if a next sheet does not exist, the control unit 45 ends the processing of the flowchart. Note that it is preferable that before the end, if a sheet is detected by the pre-registration sensor 32 after waiting for a time equal to or more than the specific time (TS), the process advances to step S113, and if no sheet is detected, the processing is ended.

Figure 4:
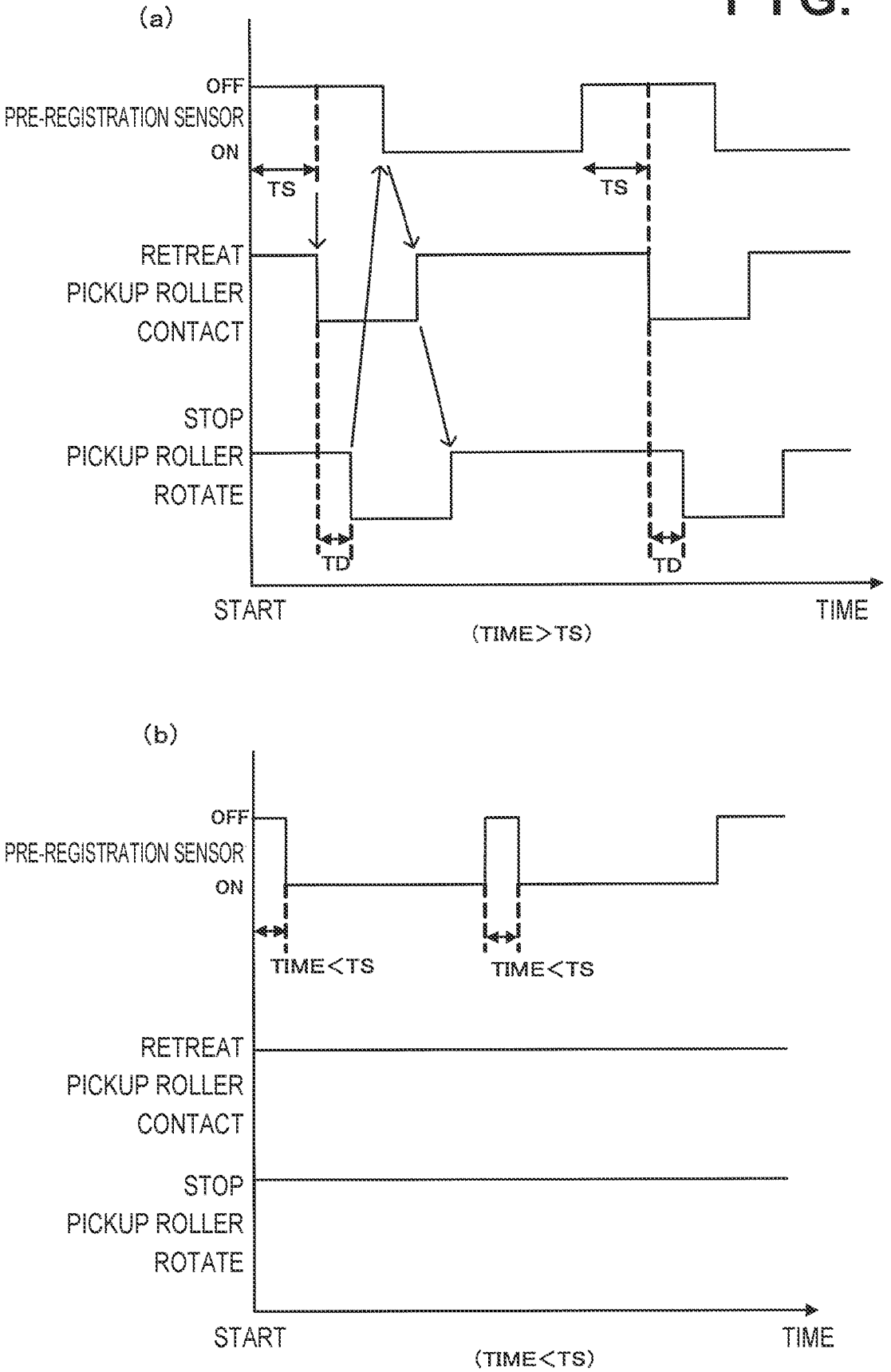
FIG. 4 shows timing charts showing examples of the operations of a pre-registration sensor and a pickup roller according to the first embodiment.

FIG. 4 shows timing charts showing examples of the operations of the pre-registration sensor 32 and the pickup roller 4 according to the first embodiment.

FIG. 4(*a*) corresponds to an example in a case in which the pre-registration sensor 32 does not detect the leading edge of a sheet even if the measurement time (TIME) has exceeded the specific time (TS) (TIME>TS). In this case, the pickup roller 4 moves to the contact position, and after the specific time (TD), rotates to feed the sheet to the feed roller 6. This prevents the occurrence of j am caused by the contact pressure of the pickup roller 4.

FIG. 4(*b*) corresponds to an example in a case in which the pre-registration sensor 32 detects the leading edge of a sheet when the measurement time (TIME) is within the specific time (TS) (TIME<TS). In this case, the pickup roller 4 does not move to the contact position and remains at the retreat position. For this reason, jam caused by the contact pressure of the pickup roller 4 does not occur. Note that in FIG. 4(*b*), the output of the pre-registration sensor 32 before counting of the measurement time (TIME) starts is OFF. This indicates that before counting of the measurement time (TIME) starts, the pre-registration sensor 32 itself is not driven, and the output is OFF. On the other hand, if the pre-registration sensor 32 is always driven, the next sheet may reach the pre-registration sensor 32 before counting of the measurement time (TIME) starts, and the output of the pre-registration sensor 32 is assumed to be ON. In this case, this may be confirmed before the start of counting of the measurement time (TIME), and it may be determined as YES in step S102 of FIG. 3. Note that the pre-registration sensor 32 detects a sheet by receiving, by a light receiving portion, irradiation light that is output from a light source arranged on one side (as an example, the lower guide plate 41) of the conveyance path and returned to the one side again by a light guide member arranged on the facing other side (as an example, the upper guide plate 40). Hence, if a sheet exists at the sensor position, the irradiation light is shielded. Hence, the light receiving level in the light receiving portion is L level. In this embodiment, the output becomes ON when the light receiving level is L level. On the other hand, if no sheet exists at the sensor position, the irradiation light returns without being shielded. Hence, the light receiving level in the light receiving portion is H level. In this embodiment, the output becomes OFF when the light receiving level is H level. This also applies to other sensors in this embodiment.

Note that in this embodiment, the specific time (TS) is set to, for example, 1 sec in consideration of shortening of the feed time in FIG. 4(*a*) and reliability of sheet detection in FIG. 4(*b*). However, the specific time (TS) is not limited to 1 sec.

Figure 5:
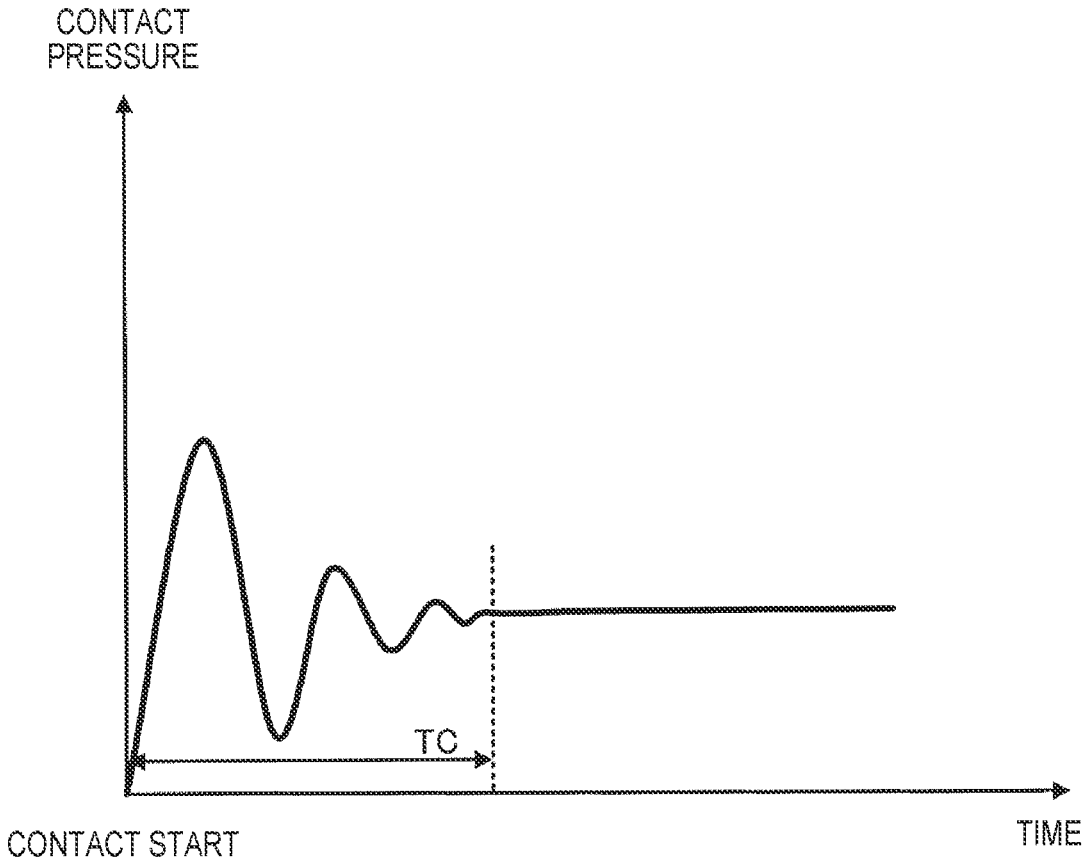
FIG. 5 is a graph showing a change in a contact pressure to a sheet after the pickup roller is brought into contact with the sheet.

FIG. 5 is a graph showing a change in a contact pressure to a sheet after the pickup roller 4 is brought into contact with the sheet.

As shown in FIG. 5, until a time TC elapses from the start of contact of the pickup roller 4 to the sheet, the contact pressure of the pickup roller 4 to the sheet changes. When the contact pressure is high, the frictional force between sheets also increases. Hence, if the rotation of the pickup roller 4 is started before the elapse of the time TC, a sheet is readily conveyed together, and feed jam readily occurs.

On the other hand, in this embodiment, as the specific time (TD) after the pickup roller is brought into contact with the sheet until the pickup roller is rotated, a time longer than the contact pressure change time (TC) shown in FIG. 5 is set, and rotation is started. The time is set to, for example, 0.2 sec. However, the specific time (TD) is not limited to 0.2 sec.

Note that in steps S108 and S109 or steps S111 and S112 in FIG. 3 and in FIG. 4, control is done to move the pickup roller 4 to the retreat position and then stop rotation. However, the retreat operation and the rotation stop may be simultaneously performed. The order may be changed to stop rotation and then perform the retreat operation. However, during the time from the stop of rotation to the retreat, the frictional force between sheets is increased by the pressing pressure of the pickup roller 4, and a sheet is readily conveyed together. Hence, the jam preventing effect becomes high when rotation is stopped after the retreat position, or the retreat and the rotation stop are simultaneously performed.

As described above, the first embodiment is characterized in that if the pre-registration sensor does not detect the leading edge of a next sheet after the elapse of the standby time (TS) after detecting the trailing edge of a previously separated and fed sheet, the pickup roller is moved to a position to contact a sheet stacked on the sheet stacker, after the elapse of TD, the pickup roller is rotated, and after the pre-registration sensor detects the leading edge of the sheet, the pickup roller is retreated to a position not to contact a sheet, and rotation is stopped. With this configuration, as a jam measure for a sheet such as thin paper, the timings of sheet contact and rotation start of the pickup roller are controlled, and a further jam measure is applied, thereby making jam less likely to occur in feeding even if the sheet to be fed is thin paper or the like with low stiffness.

Note that the movement and rotation of the pickup roller 4 may be controlled using the middle-registration sensor 33 in place of the pre-registration sensor 32. That is, if the leading edge of the next sheet is not detected even after the elapse of the standby time (TS) after the middle-registration sensor 33 detects the trailing edge of the previously separated and fed sheet, the pickup roller 4 may be moved to the position to contact a sheet stacked on the sheet stacker, after the elapse of TD, the pickup roller 4 may be rotated, and after the middle-registration sensor 33 detects the leading edge of the sheet, the pickup roller 4 may be retreated to the position not to contact a sheet, and rotation may be stopped.

Note that the sheet conveyance apparatus 200 according to this embodiment has a normal paper mode (to be also referred to as a "normal conveyance mode" hereinafter) different from the above-described thin paper mode, and can selectively set these modes from an operation panel (not shown) or an information processing apparatus (for example, a personal computer) connected to the sheet conveyance apparatus 200. When continuously feeding a plurality of sheet in a state in which the normal paper mode different from the thin paper mode is set, the control unit 45 controls to continuously feed the plurality of sheets by rotating and stopping the pickup roller 4 while keeping the pickup roller 4 in contact with the sheet stacked on the sheet stacker 1.

<Catch Measure for Pickup Roller>

If the conveyance of thin paper is started by the sheet feeder 101 described in this embodiment, a sheet may be caught by the feed roller 6 to cause jam of the sheet on the feed roller 6. In particular, when the thin paper mode is applied, thin paper with low stiffness is readily caught by the feed roller 6. Effective control for preventing this will be described below.

Figure 6:
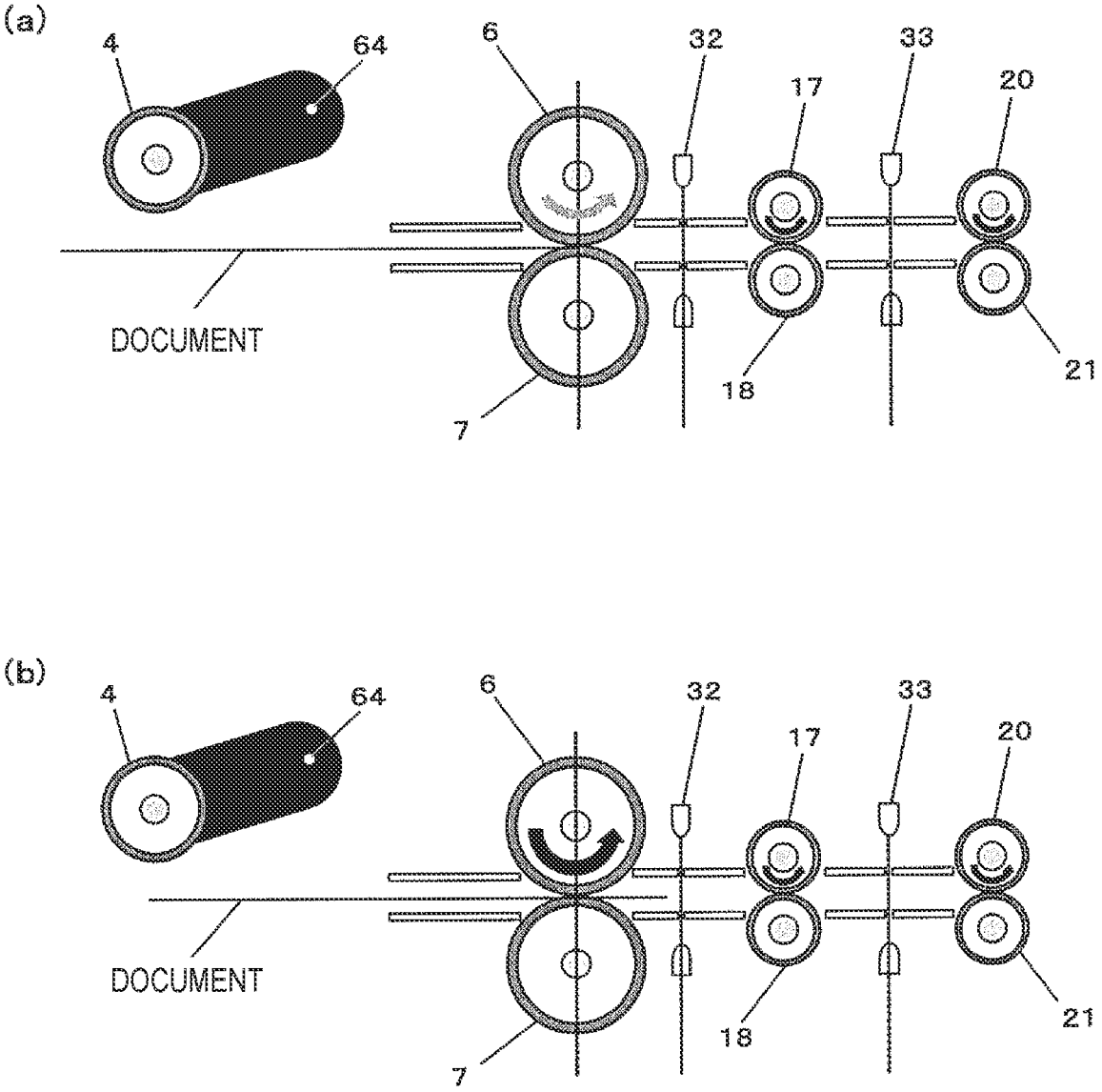
FIG. 6 shows schematic views showing an example of the positional relationship between the leading edge of a fed document and a feed roller pair according to the first embodiment.

FIG. 6 shows schematic views showing an example of the positional relationship between the leading edge of a fed document and a feed roller pair according to the first embodiment.

FIG. 6(*a*) shows a state in which the document leading edge has reached a nip portion formed between the feed roller 6 and the separation roller 7.

FIG. 6(*b*) shows a state in which the document leading edge has passed through the nip portion formed between the feed roller 6 and the separation roller 7.

Figure 7:
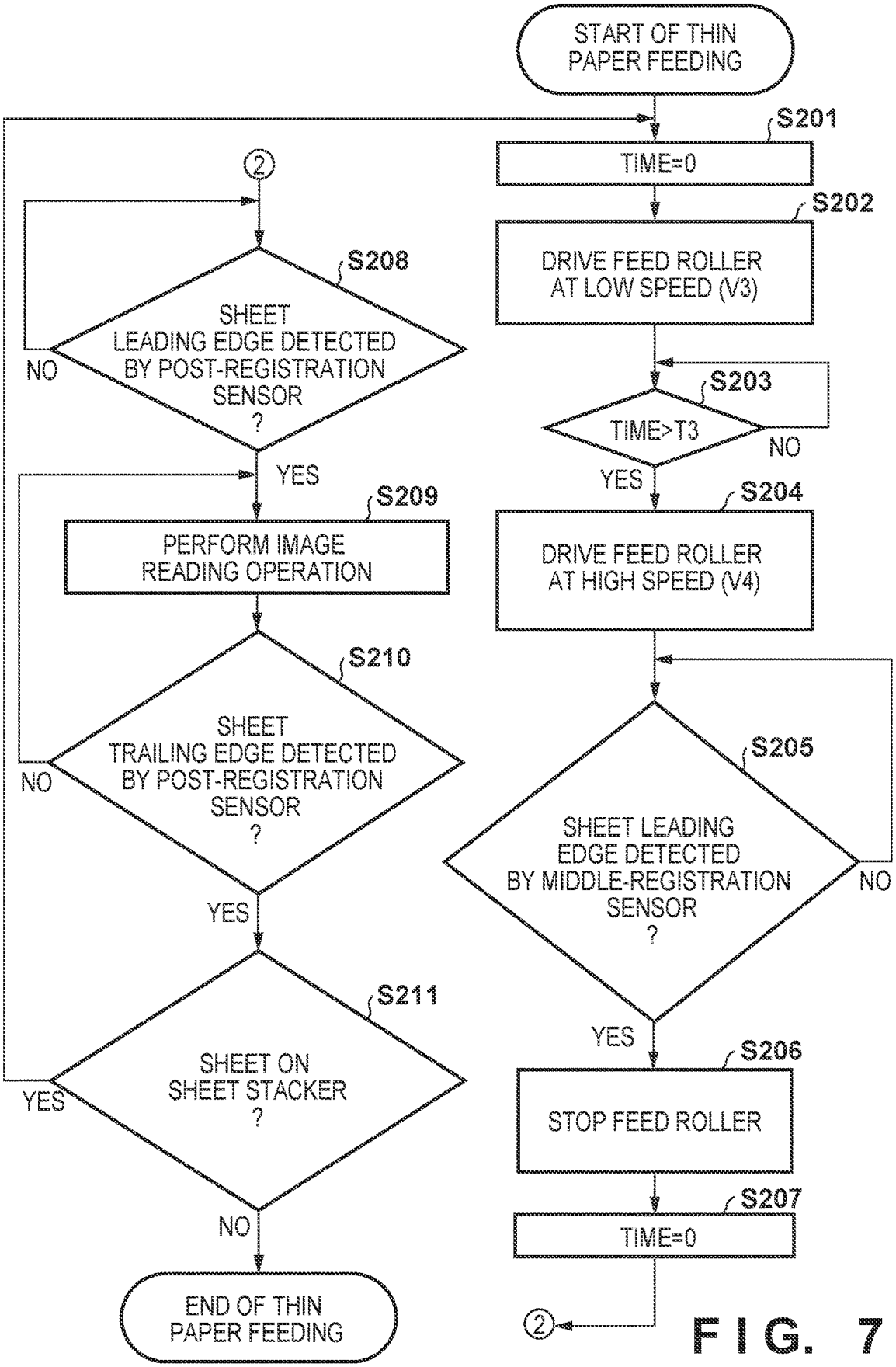
FIG. 7 is a flowchart for explaining the control operation of the feed roller in the thin paper mode according to the first embodiment.

FIG. 7 is a flowchart for explaining an example of a feeding control operation in the thin paper mode, which is performed by the control unit 45 according to the first embodiment. This control aims at preventing the leading edge of a sheet from being caught by the feed roller 6 when thin paper with low stiffness has reached the feed roller 6. The processing shown in this flowchart is implemented when the CPU (not shown) of the control unit 45 executes a program stored in the ROM. Note that the control shown in FIG. 7 and the control shown in FIG. 3 described above are performed in one feeding operation.

The control unit 45 drives the conveyance rollers when the feeding operation in the thin paper mode is started. The conveyance rollers are controlled to be continuously driven from then on.

Next, the control unit 45 starts measuring time (measurement time (TIME)=0) (step S201).

The control unit 45 drives the feed roller 6 at a first feeding speed V3 (low speed) at which the sheet is not caught by the feed roller 6 (step S202). The control unit 45 continuously drives the feed roller 6 at the first feeding speed V3 during the time after the leading edge of the sheet is fed from the sheet stacker 1 until a predetermined time T3 in which the leading edge passes through the nip portion formed between the feed roller 6 and the separation roller 7 elapses (TIME<T3).

The control unit 45 waits for the elapse of the predetermined time T3 (step S203).

Upon determining that the predetermined time T3 has elapsed (YES in step S203), the control unit 45 judges that the leading edge of the sheet has passed through the nip portion formed between the feed roller 6 and the separation roller 7, and drives the feed roller 6 by switching the feeding speed to a second feeding speed V4 (high speed) (step S204). The second feeding speed V4 (high speed) is higher than the first feeding speed V3 (low speed). The second feeding speed V4 is, for example, a speed equal to the conveyance speed to drive the registration rollers 17, 18, 20, and 21 or almost the same speed approximate to the conveyance speed.

After that, the control unit 45 monitors whether it is detected that the sheet leading edge has reached the middle-registration sensor 33 (step S205). Upon determining that it is not detected that the sheet leading edge has reached the middle-registration sensor 33 (NO in step S205), the control unit 45 continues monitoring in step S205. Upon determining that it is detected that the sheet leading edge has reached the middle-registration sensor 33 (YES in step S205), the control unit 45 advances the process to step S206.

The control unit 45 stops driving feed motor 8 (step S206), returns the count TIME for driving control of the feed roller 6 to "0", and stops measuring time (step S207).

Next, the control unit 45 monitors whether it is detected that the sheet leading edge has reached the post-registration sensor 34 (step S208). If the post-registration sensor 34 does not detect that the sheet leading edge has reached (NO in step S208), the control unit 45 continues monitoring in step S208.

If it is detected that the sheet leading edge has reached the post-registration sensor 34 (YES in step S208), the control unit 45 starts the image reading operation by the image reading sensors 14 and 15 at a predetermined timing (step S209).

After that, the control unit 45 monitors whether the sheet trailing edge has reached the post-registration sensor 34 (step S210). If the post-registration sensor 34 does not detect the reaching of the sheet trailing edge (NO in step S210), the control unit 45 continues the image reading operation in step S209.

If the post-registration sensor 34 detects the reaching of the sheet trailing edge (YES in step S210), the control unit 45 advances the process to step S211.

In step S211, the control unit 45 checks whether a sheet exists on the sheet stacker 1. Upon determining that a sheet exists on the sheet stacker 1 (YES in step S211), that is, if the next sheet exists, the control unit 45 returns the process to step S201.

On the other hand, upon determining that no sheet exists on the sheet stacker 1 (NO in step S211), that is, if the next sheet does not exist, the control unit 45 ends the processing of the flowchart.

As described above, when resuming driving of the feed roller 6 after the reaching of the trailing edge of the sheet is detected by the post-registration sensor 34, the feed roller 6 is controlled to the first feeding speed. Furthermore, upon determining that the leading edge of the sheet has passed through the nip between the feed roller 6 and the separation roller 7, the feed roller 6 is controlled to the second feeding speed higher than the first feeding speed. With this control, even if the sheet to be fed is thin paper or the like with low stiffness, jam in which, for example, a sheet is caught by the feed roller in feeding can be made less likely to occur.

Note that in step S210, instead of detecting the reaching of the sheet trailing edge by the post-registration sensor 34, when the middle-registration sensor 33 or the pre-registration sensor 32 detects the reaching of the sheet trailing edge, the process may advance to step S211. In these cases, the sheet interval can be made small as compared to a case in which the reaching of the sheet trailing edge is detected by the post-registration sensor 34.

Additionally, in this embodiment, a configuration in which the middle-registration sensor 33 and the post-registration sensor 34 are provided, and the above-described control is performed using these has been described. However, the above-described control may be performed by one sensor. For example, the middle-registration sensor 33 may be omitted, and the above-described control may be done using the post-registration sensor 34. In this case, in step S205, if the post-registration sensor 34 detects the sheet leading edge, the process advances to step S206, and the process of step S208 is omitted.

A method of deciding the time (T3) to drive the feed motor 8 such that the feed roller 6 is driven at the first feeding speed V3 (low speed) will be described below with reference to FIG. 8.

Figure 8:
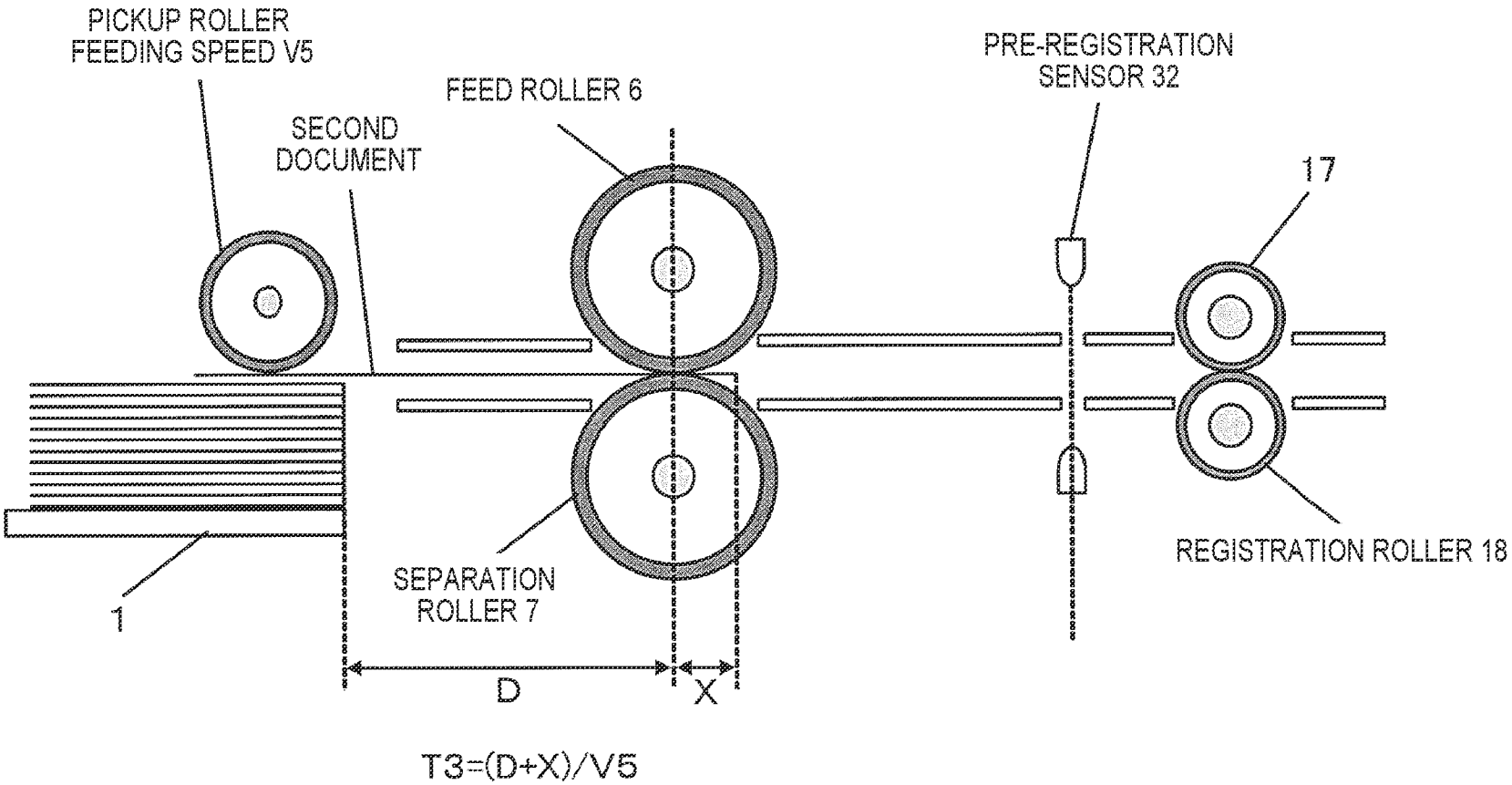
FIG. 8 is a view for explaining the relationship between sheets on a sheet stacker, the feed roller, the positions of the leading edge portions of documents, and the feeding speed of the pickup roller according to the first embodiment.

FIG. 8 is a view for explaining the relationship between sheets (documents) on the sheet stacker 1, the feed roller 6, the positions of the leading edge portions of the documents, and the feeding speed of the pickup roller 4.

When a document is fed at a feeding speed V5 by the pickup roller 4, the maximum time of the predetermined time T3 corresponding to a time necessary for the leading edge portion (a portion of a length X from the leading edge of a document) of a document to pass through the nip portion formed between the feed roller 6 and the separation roller 7 is calculated as follows. Letting D be the distance from the leading edges of the documents stacked on the sheet stacker 1 to the feed roller 6, as shown in FIG. 8, the predetermined time T3 can be calculated by "T3=(D+X)/V5". The length X of the leading edge portion of the document may be, for example, about ¼ of the peripheral diameter of the feed roller 6. Note that the position of the nip portion between the feed roller 6 and the separation roller 7 is set here as the center position of the shaft of the feed roller 6.

In the above description, a configuration in which the driving speed of the feed roller 6 is changed from V3 to V4 at a timing at which it is detected that T3 has elapsed from detection of the trailing edge of a preceding sheet by the post-registration sensor 34 has been described. However, as another example of the elapse of the predetermined time T3, if driving pulses of the feed motor 8 to perform sheet conveyance by the feed roller 6 only in "D+X" shown in FIG. 8 are counted, it may be determined that the predetermined timing has elapsed, and the driving speed of the feed roller 6 may be changed from V3 to V4.

Note that the first feeding speed V3 (low speed) is, for example, a set speed at which the peripheral speed of the feed roller 6 becomes almost the second feeding speed V4 (high speed) even if an overshoot occurs at the rising of the feed motor 8 that rotationally drives the feed roller 6. Note that the set speed is obtained in advance by experiments and the like.

In addition, the first feeding speed V3 and the feeding speed V5 by the pickup roller 4 may be set equal.

Note that in a state in which the normal paper mode is set, the control unit 45 controls the feed roller 6 to the second feeding speed V4 (high speed) at the start of driving of the feed roller 6.

Note that in some cases, a plurality of stacked documents may simultaneously be fed due to friction between the documents and passed through the pickup roller 4, resulting in a so-called "fed-together" state in which a document scheduled to be fed next already exists at a position close to the nip portion between the feed roller 6 and the separation roller 7. In this case, if the speed change is executed with the predetermined time T3, as described above, the leading edge portion of the document immediately passes through the nip portion between the feed roller 6 and the separation roller 7. That is, in this case, even if the leading edge portion of the document passes through the nip portion, and the speed can be switched to the speed V4, feeding may be continued at the speed V3 until the predetermined time T3 elapses, and throughput may lower.

Another aspect of this embodiment considering this point will be described below.

Figure 9:
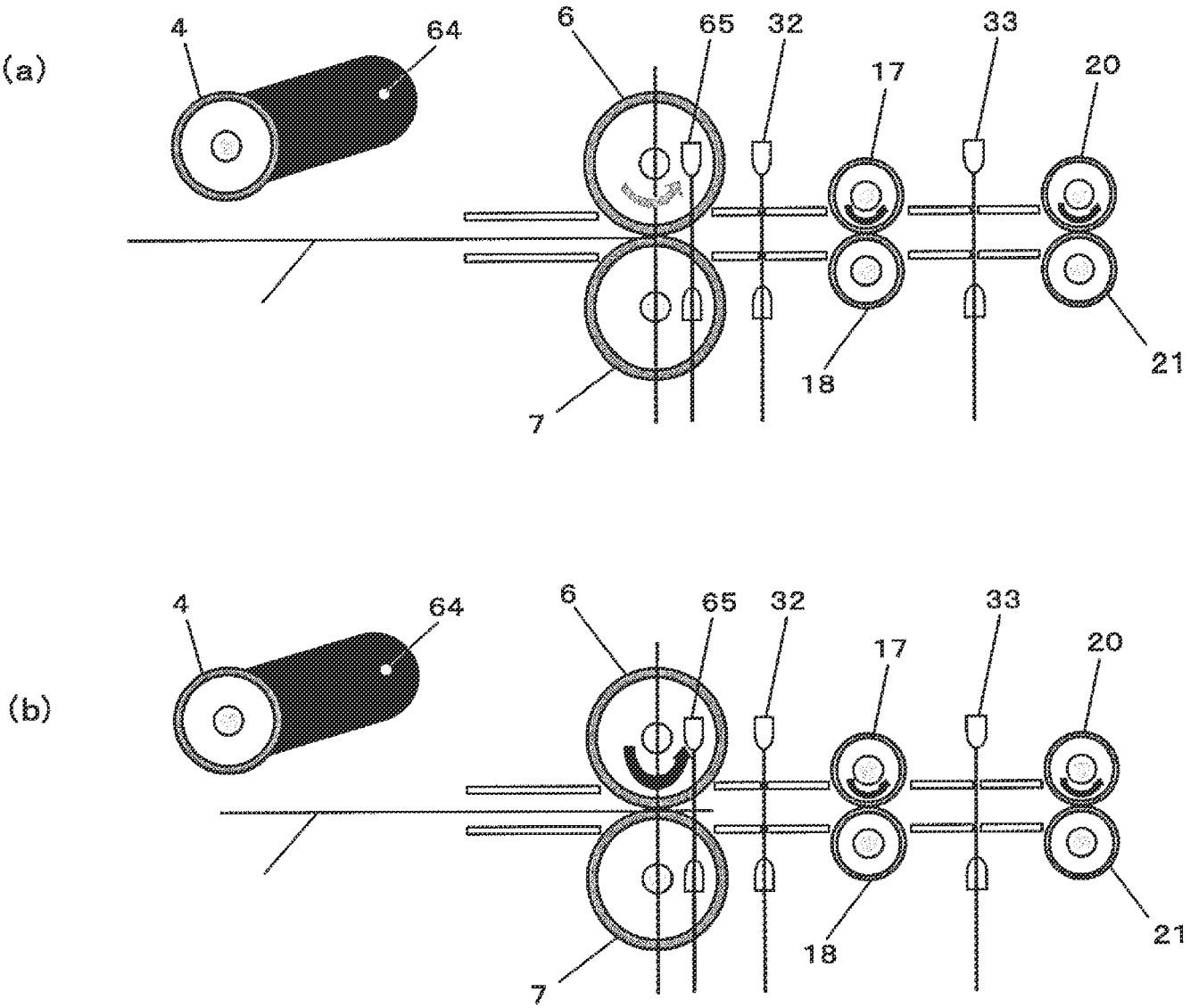
FIG. 9 shows views for explaining the positional relationship between the feed roller and an optical sensor for the thin paper mode according to another aspect of the first embodiment.

FIG. 9 shows views showing a configuration in which a thin paper conveyance registration sensor 65 (second sheet detection sensor) that is an optical sensor for the thin paper mode is arranged at a position parallel to the feed roller 6 in the conveyance direction of the document.

FIG. 9(*a*) shows a state in which the document leading edge has reached the nip portion formed between the feed roller 6 and the separation roller 7.

FIG. 9(*b*) shows a state in which the document leading edge has passed through the nip portion formed between the feed roller 6 and the separation roller 7 and reached the thin paper conveyance registration sensor 65.

Figure 10:
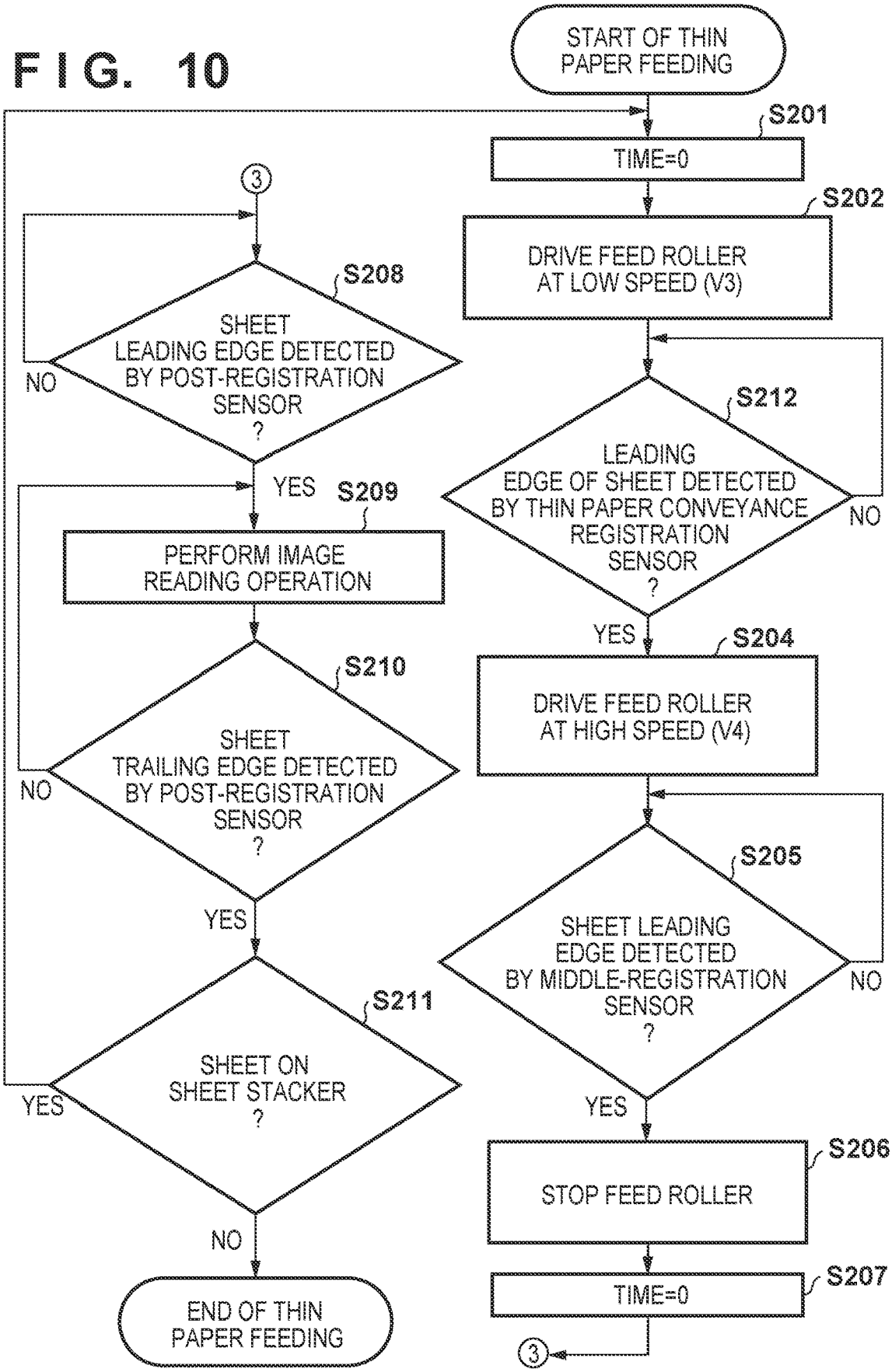
FIG. 10 is a flowchart for explaining the control operation of the feed roller in the thin paper mode according to another aspect of the first embodiment.

A feeding control operation according to this aspect is shown in FIG. 10.

FIG. 10 is a flowchart for explaining an example of a feeding control operation in the thin paper mode, which is performed by the control unit 45 in the other aspect of the first embodiment. The processing shown in this flowchart is implemented when the CPU (not shown) of the control unit 45 executes a program stored in the ROM. Note that the same step numbers as in FIG. 7 denote the same steps. Note that the control shown in FIG. 10 and the control shown in FIG. 3 described above are performed in one feeding operation.

In this aspect, the timing at which the document passes through the feed roller 6 can correctly be detected by the thin paper conveyance registration sensor 65. In FIG. 10, the control unit 45 drives the feed roller 6 at the first feeding speed V3 (low speed) (step S202), and then advances the process to step S212.

In step S212, the control unit 45 monitors whether the thin paper conveyance registration sensor 65 detects the leading edge of the document. Upon determining that the thin paper conveyance registration sensor 65 has not detected the leading edge of the document yet (NO in step S212), the control unit 45 continues monitoring in step S212.

On the other hand, upon determining that the thin paper conveyance registration sensor 65 has detected the leading edge of the document (YES in step S212), the control unit 45 advances the process to step S204. Processing from step S204 is the same as in FIG. 7, and a description thereof will be omitted.

Based on the detection of the leading edge of the document by the thin paper conveyance registration sensor 65, the control unit 45 changes the driving speed of the feed roller 6 from the first feeding speed V3 to the second feeding speed V4. With this configuration, speed control for thin paper conveyance can more effectively be executed. Note that preferably, to detect, by the optical sensor, that the leading edge portion of the document has passed through the normal paper mode formed by the feed roller 6 and the separation roller 7, the detection position of the optical sensor is preferably located on the downstream side of the position of the nip portion formed by the feed roller 6 and the separation roller 7.

In addition, the thin paper conveyance registration sensor 65 may be a detection sensor other than an optical sensor. For example, even if a tracking sensor (movement detection sensor) capable of detecting the moving amount of a document is arranged in the feeding unit to detect the leading edge of the document, the same effect as described above can be obtained.

Note that in step S212, the driving speed of the feed roller 6 may be changed from V3 to V4 in accordance with not the detection of the document leading edge by the thin paper conveyance registration sensor 65 but the detection of the document leading edge by the pre-registration sensor 32.

Alternatively, the driving speed of the feed roller 6 may be changed from V3 to V4 in accordance with not the detection of the document leading edge by the thin paper conveyance registration sensor 65 but the detection of the document by the multiple feed detection sensor 30.

In an apparatus including skew sensors (for example, formed by a plurality of optical sensors arranged in two lines in the document conveyance direction) on both sides of the conveyance path on the downstream side of the separation roller pair 42, the feeding speed may be switched when a document is detected by the skew sensors.

That is, the feeding speed may be switched when a document is detected by one of the sensors provided on the downstream side of the separation roller pair 42. As for the type of sensors, sensors of any detection type can be used.

The aspect shown in FIGS. 6 to 8 and the other aspect shown in FIGS. 9 and 10 may be combined. For example, the control unit 45 may change the driving speed of the feed roller 6 from the V3 to V4 at an earlier timing of the timing from the detection of the trailing edge of the preceding sheet by the post-registration sensor 34 to the elapse of T3 and the timing of the detection of the subsequent sheet by the thin paper conveyance registration sensor 65.

Second Embodiment

The second embodiment of the present invention will be described next. In the second embodiment, an embodiment in which driving of a feed roller 6 (separation roller 7) is turned on/off will be described. Note that driving of a registration roller pair (17 and 18) may be turned on/off at the timing of turning on/off driving of the feed roller 6 (separation roller 7). Even concerning a case in which driving of the feed roller 6 and the separation roller 7 is turned on/off, this will be referred to as "driving of the feed roller 6 is turned on/off" hereinafter.

Figure 11:
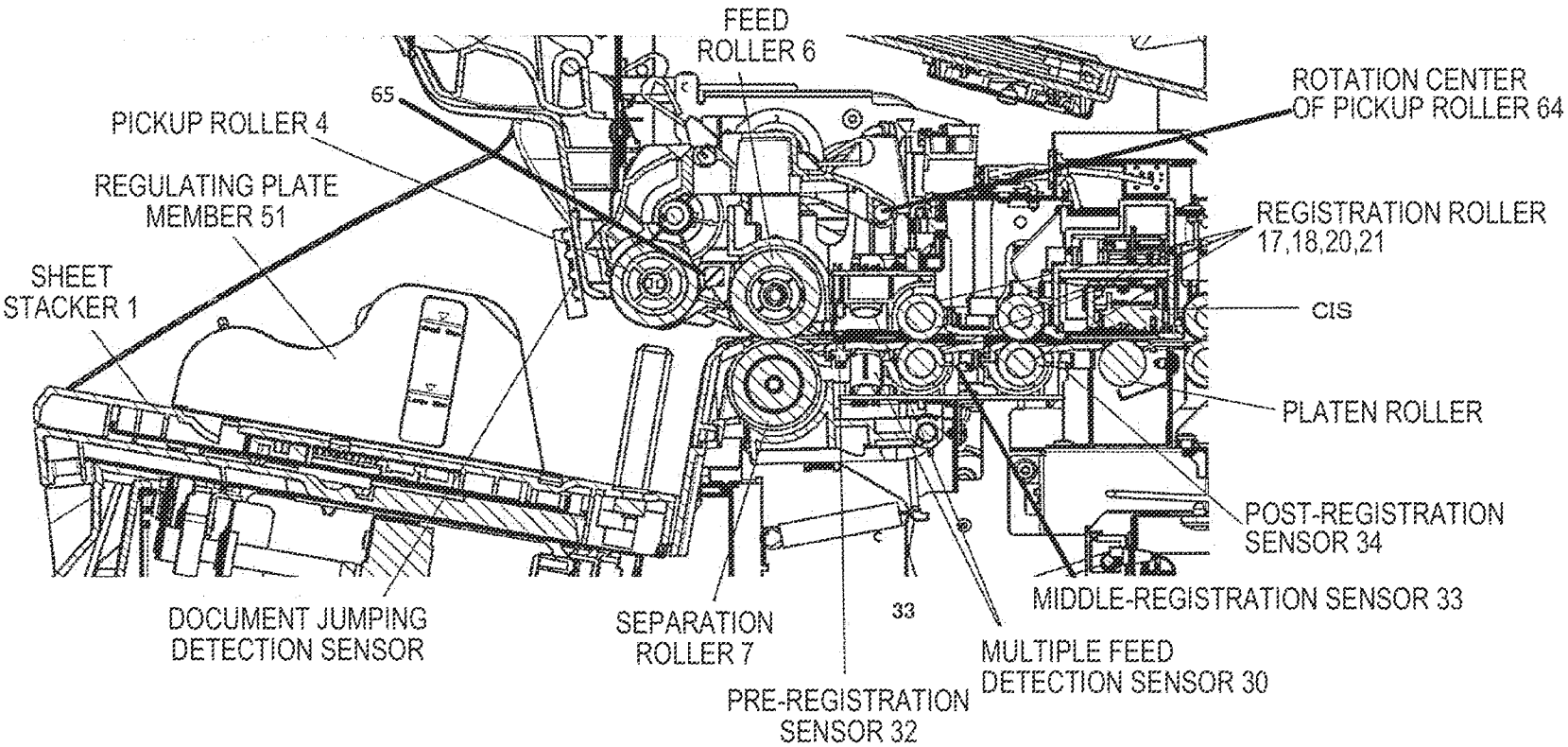
FIG. 11 is a partial sectional view schematically showing a part of the configuration of a sheet conveyance apparatus to which a sheet feeder according to the second embodiment can be applied.

FIG. 11 is a partial sectional view schematically showing a part of the configuration of a sheet conveyance apparatus (image reading apparatus) to which a sheet feeder according to the second embodiment of the present invention can be applied. Note that the same reference numerals as in FIG. 1 and the like denote the same components.

Referring to FIG. 11, a registration roller pair (20 and 21) is disposed on the downstream side of a registration roller pair (17 and 18). A middle-registration sensor 33 (third sheet detection sensor) is disposed on the downstream side of the registration roller pair (17 and 18) and on the upstream side of the registration roller pair (20 and 21), and detects a conveyed sheet. A post-registration sensor 34 is disposed on the downstream side of the conveyance path (20 and 21) and on the upstream side of image reading sensors 14 and 15, and detects a conveyed sheet.

Figure 12:
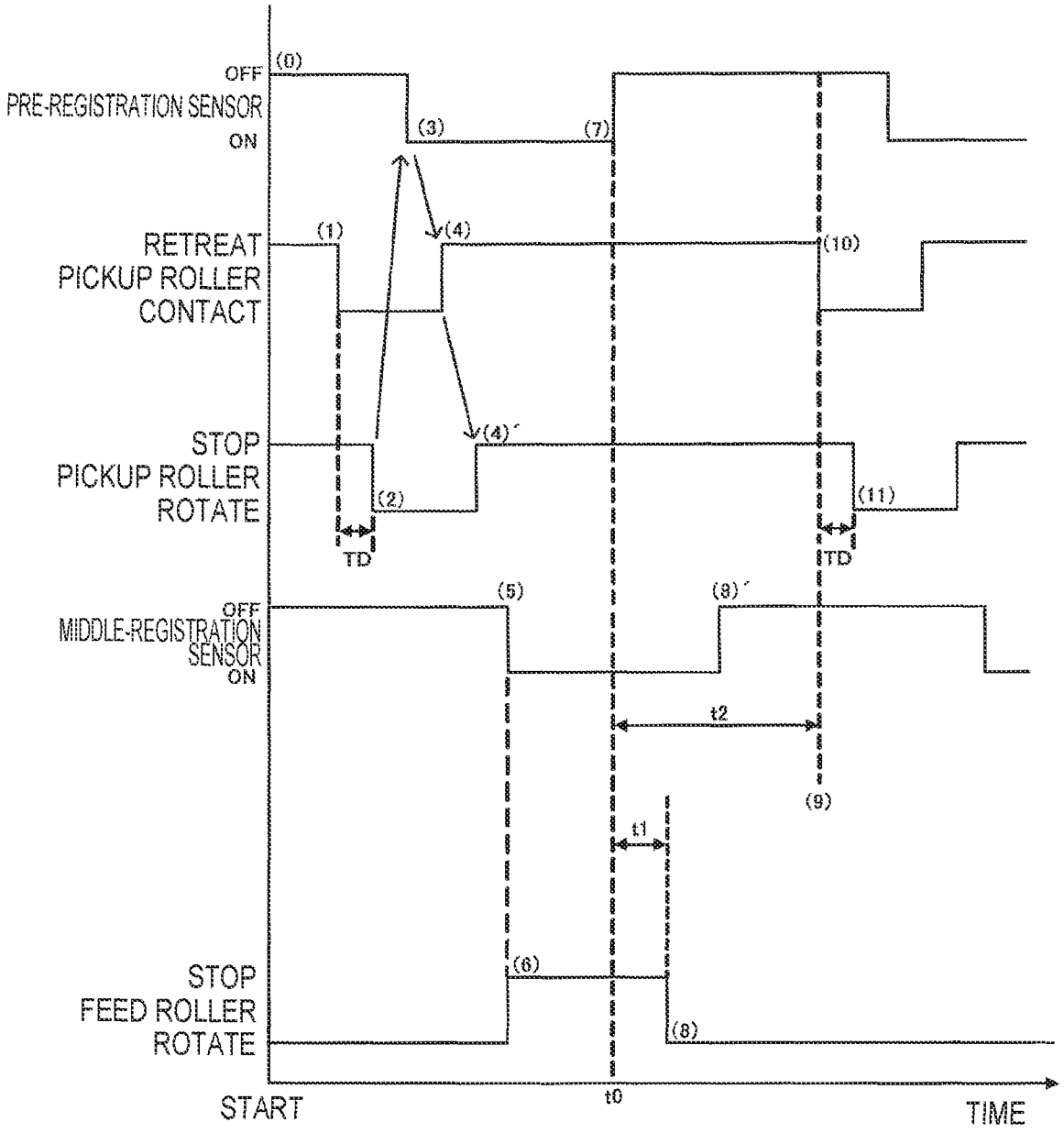
FIG. 12 is a timing chart showing an example of the relationship between the operations of a pickup roller, a feed roller, and registration roller pairs and the detection states of a pre-registration sensor and a middle-registration sensor according to the second embodiment.

FIG. 12 is a timing chart showing an example of the relationship between the operations of a pickup roller, a feed roller (and the registration roller pairs) and the detection states of a pre-registration sensor and the middle-registration sensor according to the second embodiment.

FIGS. 13 to 16 are schematic views showing an example of the relationship between the operations of the pickup roller, the feed roller, and the registration roller pairs and the detection states of the pre-registration sensor and the middle-registration sensor according to the second embodiment. Note that the same reference numerals as in (0) to (11) of FIG. 12 denote the same states. A series of procedures will be described below.

Figure 13:
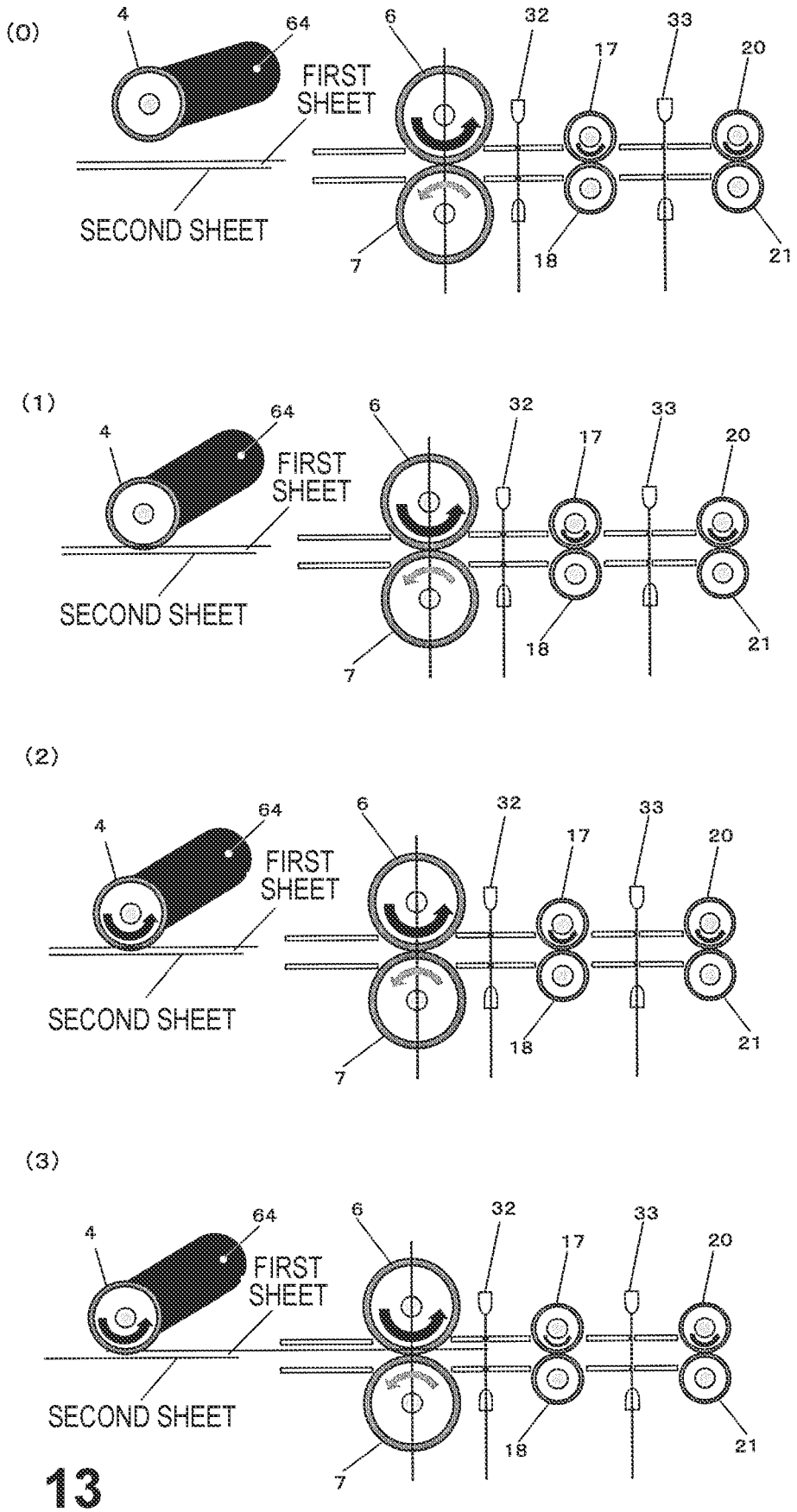
FIG. 13 shows schematic views showing an example of the relationship between the operations of the pickup roller, the feed roller, and the registration roller pairs and the detection states of the pre-registration sensor and the middle-registration sensor according to the second embodiment.
Figure 20:
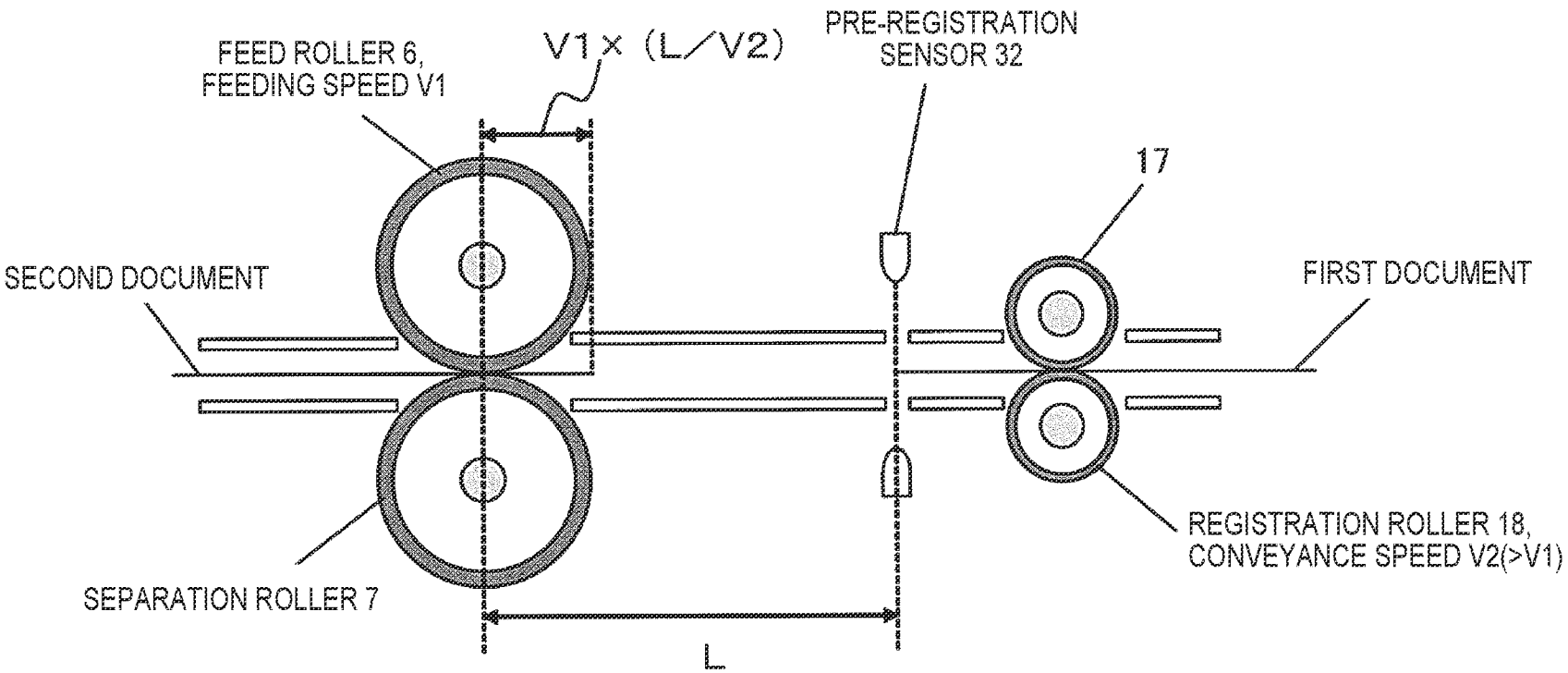
FIG. 20 is a view for explaining the relationship between the positions of the feed roller, the pre-registration sensor, and the registration rollers, the feeding speed of the feed roller, and the conveyance speed of the registration rollers.

First, the feed roller 6 and the registration rollers (17, 18, 20, and 21) are driven ((0) of FIG. 13), and a pickup roller 4 is moved to the contact position ((1) of FIG. 13) and rotated after the elapse of a specific time (TD) ((2) of FIG. 13), thereby feeding a sheet to the feed roller 6. When the sheet leading edge reaches a pre-registration sensor 32 ((3) of FIG. 13), the pickup roller 4 is moved to the retreat position ((4) of FIG. 14), and the rotation is stopped ((4)' of FIG. 14). When the sheet leading edge reaches the middle-registration sensor 33 ((5) of FIG. 14), the feed roller 6 is stopped ((6) of FIG. 14). The sheet trailing edge passes through the pre-registration sensor 32 ((7) of FIG. 15) (the time is defined as "t0"), and after the elapse of t1 ((8) of FIG. 15), the feed roller 6 is rotated. After that, the sheet trailing edge passes through the middle-registration sensor 33 ((8)' of FIG. 15). In addition, after the elapse of time t0 to t2 (preferably, t2>t1+L/V1) ((9) of FIG. 15), the pickup roller 4 is moved to the contact position ((10) of FIG. 15) and rotated after the elapse of the specific time (TD) ((11) of FIG. 16), thereby feeding the next sheet to the feed roller 6. Note that as shown in FIG. 20 to be described later, letting V1 be the sheet conveyance speed by the feed roller 6, and L be the distance from the feed roller 6 to the pre-registration sensor 32, the above-described time t2 is preferably "t2>t1+L/V1".

Figure 14:
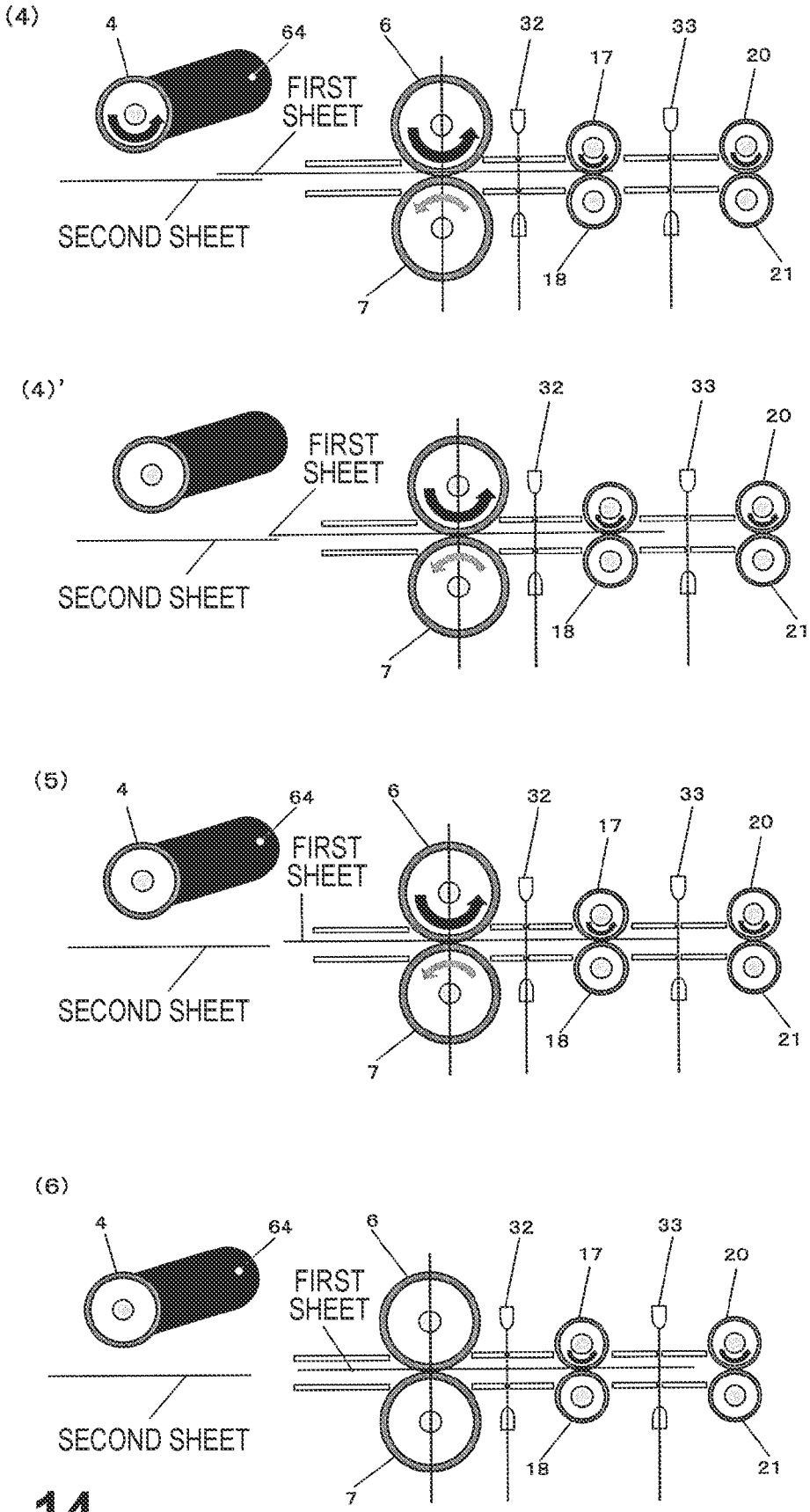
FIG. 14 shows schematic views showing an example of the relationship between the operations of the pickup roller, the feed roller, and the registration roller pairs and the detection states of the pre-registration sensor and the middle-registration sensor according to the second embodiment.
Figure 15:
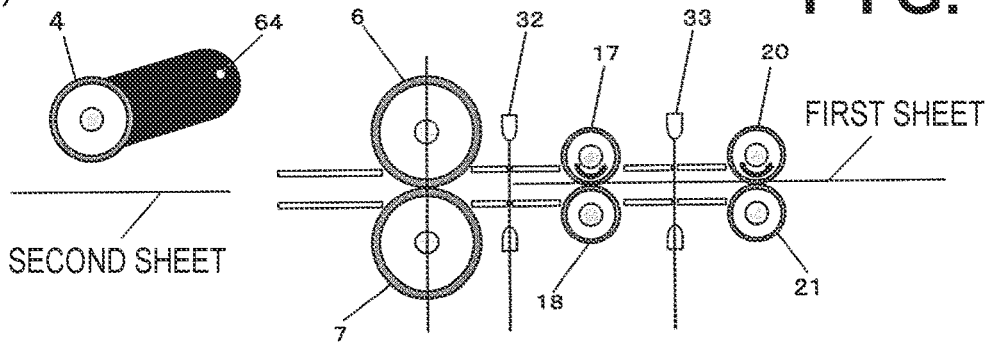
FIG. 15 shows schematic views showing an example of the relationship between the operations of the pickup roller, the feed roller, and the registration roller pairs and the detection states of the pre-registration sensor and the middle-registration sensor according to the second embodiment.
Figure 15:
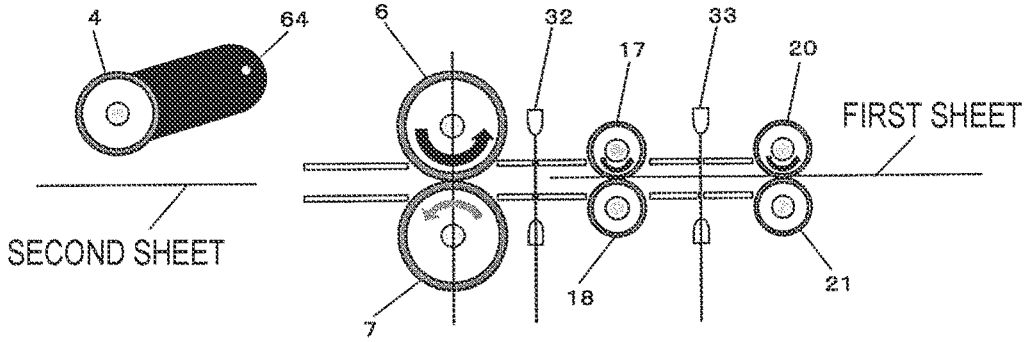
Figure 15:
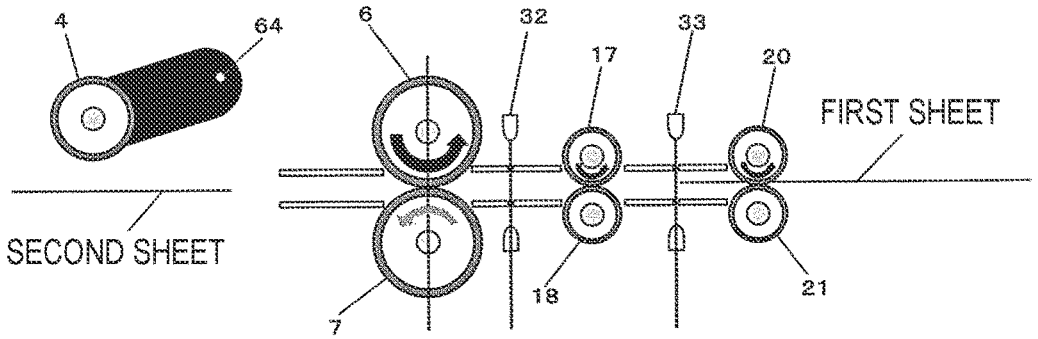
Figure 15:
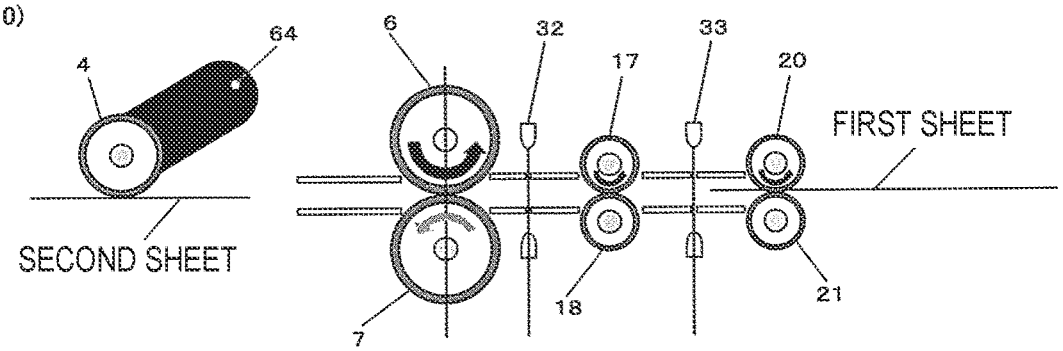
Figure 16:
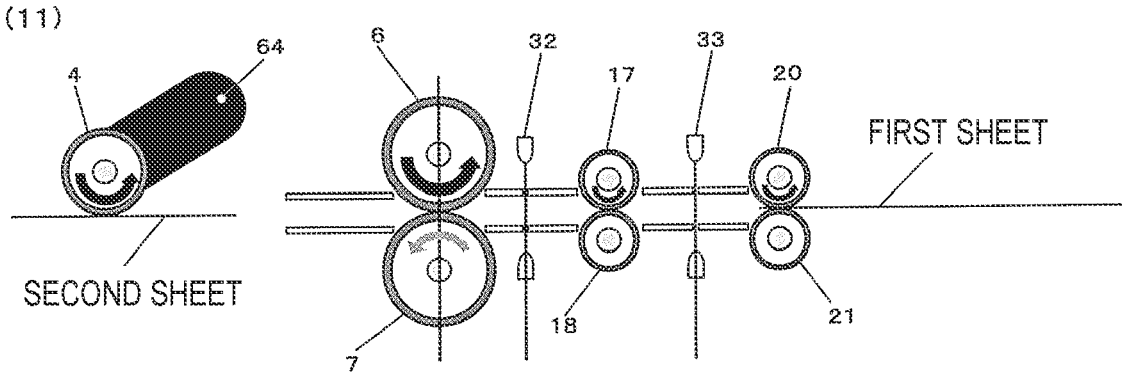
FIG. 16 is a schematic view showing an example of the relationship between the operations of the pickup roller, the feed roller, and the registration roller pairs and the detection states of the pre-registration sensor and the middle-registration sensor according to the second embodiment.

Note that if the pre-registration sensor 32 detects the leading edge of the next sheet during the time (from (8) to (9)) until t2 elapses after the elapse of t1 described above, the process waits until the sheet leading edge reaches the middle-registration sensor 33 as shown in ((5) of FIG. 14) without moving the pickup roller 4 to the contact position. This example will be described below in detail with reference to FIGS. 17 to 19.

Figure 17:
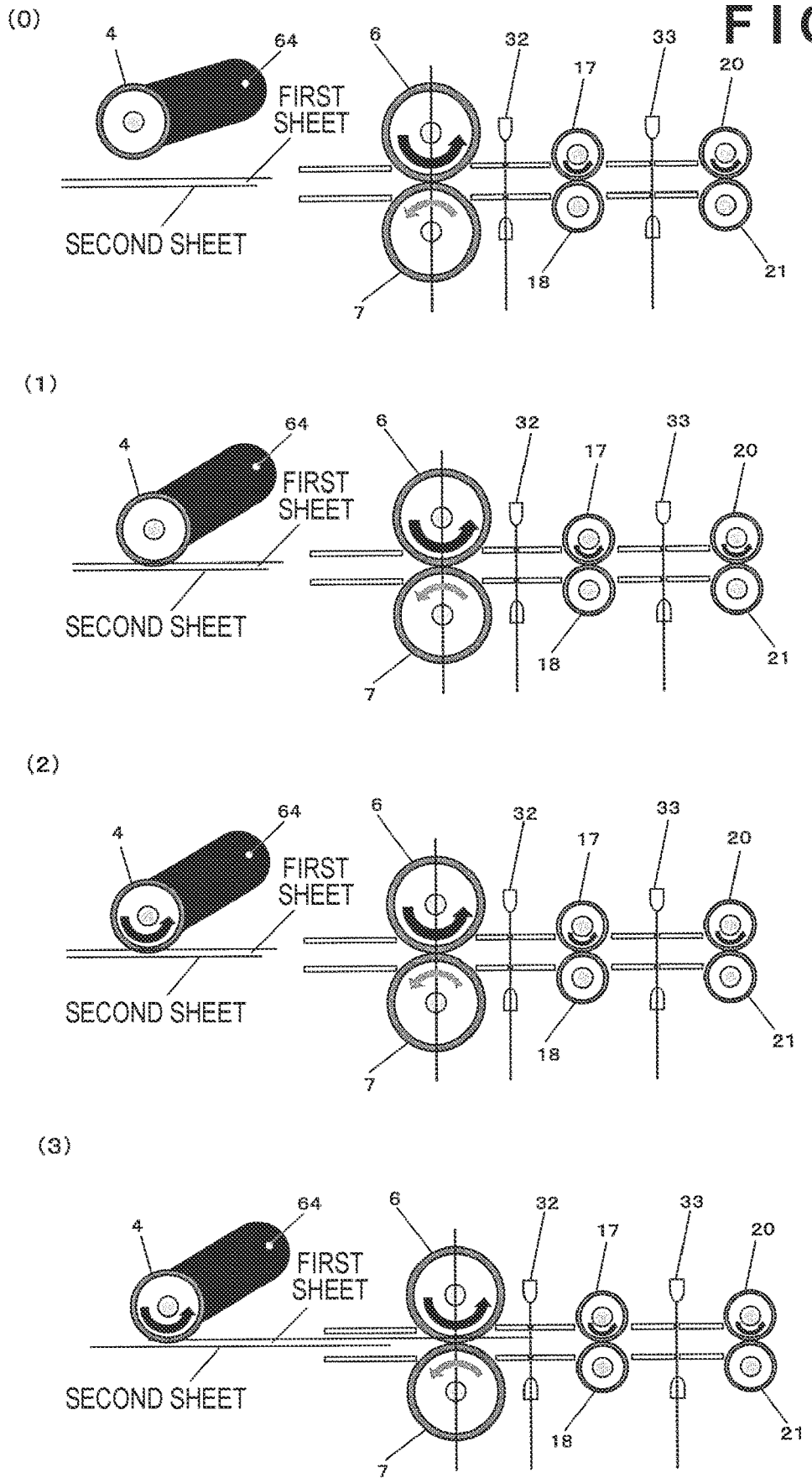
FIG. 17 shows schematic views showing an example of the relationship between the operations of the pickup roller, the feed roller, and the registration roller pairs and the detection states of the pre-registration sensor and the middle-registration sensor according to the second embodiment.
Figure 18:
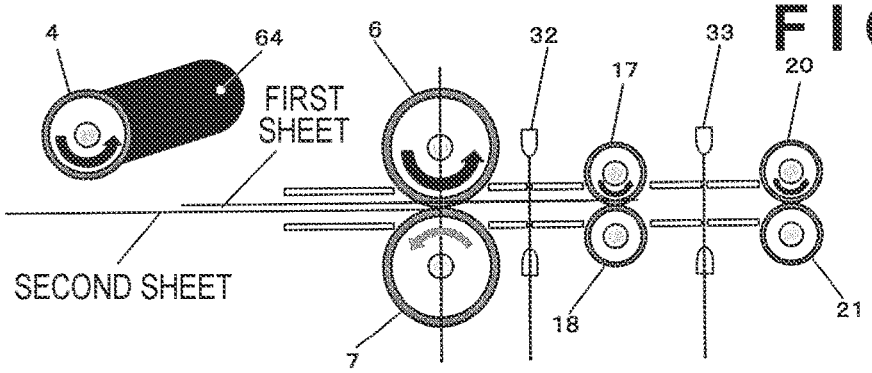
FIG. 18 shows schematic views showing an example of the relationship between the operations of the pickup roller, the feed roller, and the registration roller pairs and the detection states of the pre-registration sensor and the middle-registration sensor according to the second embodiment.
Figure 18:
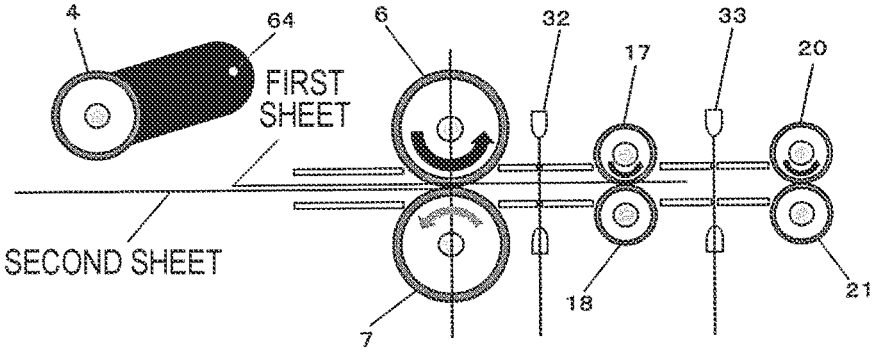
Figure 18:
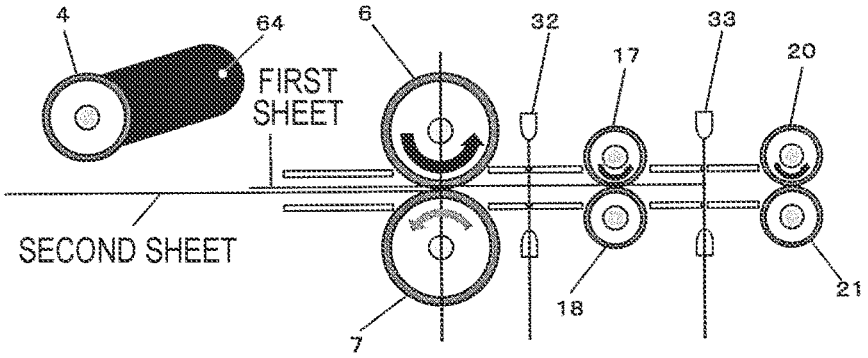
Figure 18:
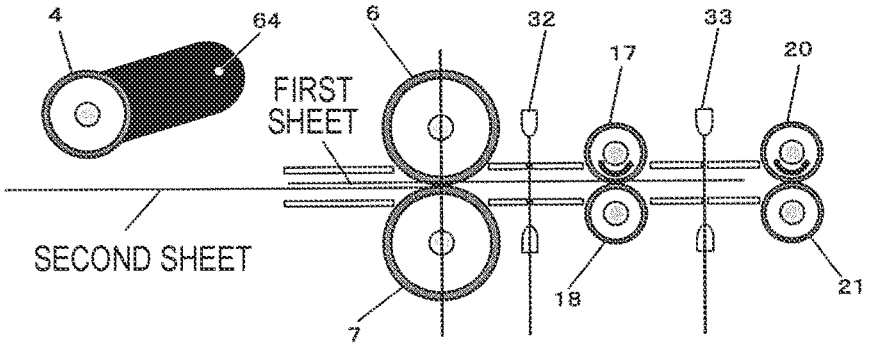
Figure 19:
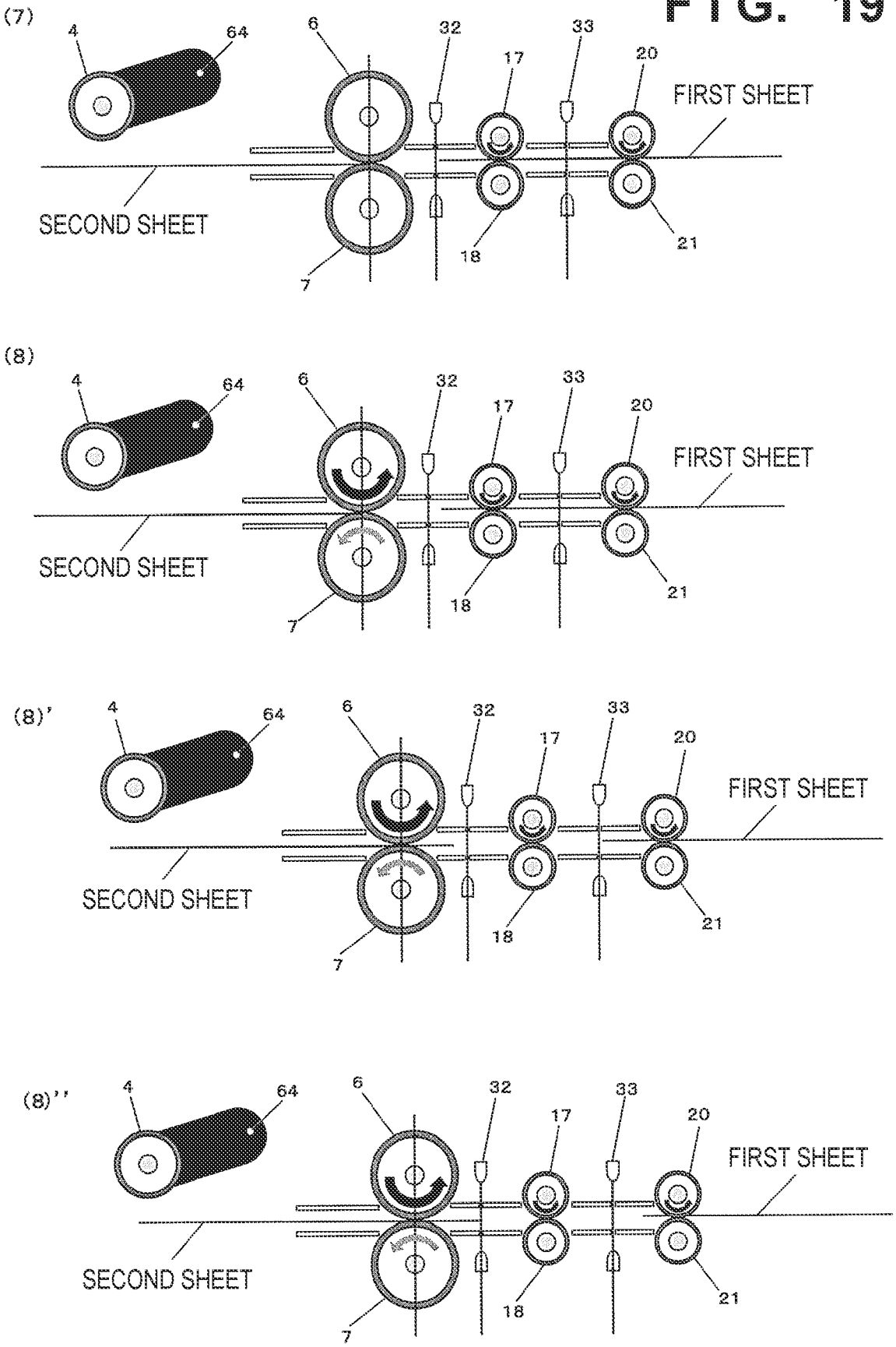
FIG. 19 shows schematic views showing an example of the relationship between the operations of the pickup roller, the feed roller, and the registration roller pairs and the detection states of the pre-registration sensor and the middle-registration sensor according to the second embodiment.

FIGS. 17 to 19 are schematic views showing an example of the relationship between the operations of the pickup roller, the feed roller, and the registration roller pairs and the detection states of the pre-registration sensor and the middle-registration sensor according to the second embodiment. These drawings correspond to a case in which the leading edge of the next sheet is detected by the pre-registration sensor 32 before the elapse of t2.

As in the example shown in FIGS. 13 to 16 described above, as shown in FIGS. 17 to 19, first, the feed roller 6 and the registration rollers (17, 18, 20, and 21) are driven ((0) of FIG. 17), and the pickup roller 4 is moved to the contact position ((1) of FIG. 17) and rotated after the elapse of the specific time (TD) ((2) of FIG. 17), thereby feeding the first sheet to the feed roller 6. When the leading edge of the first sheet reaches the pre-registration sensor 32 ((3) of FIG. 17), the pickup roller 4 is moved to the retreat position ((4) of FIG. 18), and the rotation is stopped ((4)' of FIG. 18). Note that this example corresponds to a case in which at the point of time of (4), the second sheet is fed together with the first sheet due to a friction or static electricity between the sheets, and reaches the nip portion of the feed roller 6, as shown in FIG. 18. However, the first sheet and the second sheet are separated by the separation roller 7 so multiple feed does not occur. After that, when the leading edge of the first sheet reaches the middle-registration sensor 33 ((5) of FIG. 18), the feed roller 6 is stopped ((6) of FIG. 18). Furthermore, the trailing edge of the first sheet passes through the pre-registration sensor 32 ((7) of FIG. 19) (the time is defined as "t0"), and after the elapse of t1 ((8) of FIG. 19), the feed roller 6 is rotated. Feeding of the second sheet is thus started by the feed roller 6. After that, the trailing edge of the first sheet passes through the middle-registration sensor 33 ((8)' of FIG. 19). Also, in this example, the leading edge of the second sheet is detected by the pre-registration sensor 32 before the elapse of time t0 to t2 ((8)" of FIG. 19). In this case, operation control is performed such that the process waits until the leading edge of the second sheet reaches the middle-registration sensor 33 in ((5) of FIG. 18) without moving the pickup roller 4 to the contact position.

As shown in FIGS. 12, 13 to 16, and 17 to 19, when the feed roller 6 is stopped until the predetermined time (t1) elapses after the sheet passes through the middle-registration sensor 33 and the sheet trailing edge passes through the pre-registration sensor 32, the conveyance interval between the previously fed sheet and the sheet to be fed next can be ensured. Hence, even if the discharge speed of the previously fed sheet becomes low, a sheet interval to prevent the sheet from being hit by the sheet to be fed next can be ensured. In this case, this example is merely an example and, for example, as the timing of stopping the feed roller 6, the feed roller 6 may be stopped after waiting for a predetermined timing from the time at which the sheet leading edge reaches d the middle-registration sensor 33. That is, the feed roller 6 is stopped at a timing capable of obtaining a desired sheet interval.

Note that in a configuration in which the feed roller 6 is not stopped, the time t2 after the sheet trailing edge passes through the pre-registration sensor 32 until the movement of the pickup roller 4 to the contact position starts can be set to t2', for example, "t2'>(L−V1×(L/V2))/V1". That is, the time can be made slightly shorter than "t2>t1+L/V1" in the above-described case in which the feed roller 6 is stopped.

FIG. 20 is a view for explaining the relationship between the positions of the feed roller 6, the pre-registration sensor 32, and the registration rollers 17 and 18, the feeding speed of the feed roller 6, and the conveyance speed of the registration rollers.

If the feed roller 6 is always rotating, the minimum condition of the wait time until the pickup roller 4 is lowered to the subsequent sheet is as follows.

If the second sheet reaches the feed roller 6 together with the feeding of the first sheet, the second sheet exists at a position ahead of the position of the feed roller 6 by "V1×(L/V2)" at the point of time when the first sheet passes through the pre-registration sensor 32. Hence, if the process waits for only the time "(L−V1×(L/V2))/V1" in which the second sheet is fed from that position to the position of the pre-registration sensor 32 at the feeding speed V1, the above-described second sheet should reach the pre-registration sensor 32. Hence, the time "(L−V1×(L/V2))/V1" can be set as the minimum condition of the wait time until the pickup roller 4 is lowered to the subsequent sheet.

Note that the configurations of the above-described various kinds of data and their contents are not limited to these, and the data may have various configurations and contents in accordance with the application purpose or object.

The embodiments have been described above. However, the present invention can take an aspect of, for example, a system, an apparatus, a method, a program, or a storage medium. More specifically, the present invention is applicable to a system formed by a plurality of devices, or an apparatus formed by a single device.

In addition, all configurations that combine the above-described embodiments are also incorporated in the present invention.

Other Embodiments

The present invention can also be implemented by supplying a program configured to implement one or more functions of the above-described embodiments to a system or apparatus via a network or a storage medium and causing one or more processors in the computer of the system or apparatus to read out and execute the program. The present invention can also be implemented by a circuit (for example, ASIC) that implements one or more functions.

In addition, the present invention may be applied to a system formed by a plurality of devices, or an apparatus formed by a single device.

The present invention is not limited to the above-described embodiments, various modifications (including organic combinations of the embodiments) can be made based on the gist of the present invention, and these are not excluded from the scope of the present invention. That is, all configurations that combine the above-described embodiments and their modifications are also incorporated in the present invention.

In the present invention, for example, as indicated by step S206 in FIG. 7, control is performed to stop the feed motor 8 when the leading edge of the sheet reaches the middle-registration sensor 33. However, the present invention is not limited to this. The feed roller 6 can be configured to rotate with the document by the function of a one-way clutch or the like attached inside. However, when conveying, for example, a long document, if the feed motor 8 is stopped, the feed roller that rotates together serves as a resistance, and the document is readily damaged in some cases. In this case, when the leading edge of the sheet has reached the middle-registration sensor 33, the feed roller 6 is controlled to the same speed (higher than V4) as the registration rollers 20 and 21, thereby reducing the load from the feed roller 6 to the long document. In this case, the feed motor may be stopped to stop the rotation of the feed roller 6 when the pre-registration sensor 32 or the thin paper conveyance registration sensor 65 detects the trailing edge of the sheet.

Note that concerning the sheet feeder 101 shown in FIGS. 1 and 2, a configuration in which the pickup roller arranged above the sheet stacker comes, from the upper side, into contact with a sheet stacked on the sheet stacker capable of moving up and down, and supplies sheets sequentially from the upper side of the sheet bundle to the feed roller has been described. However, the present invention can also be applied even to a sheet feeder having a configuration in which, for example, a pickup roller arranged below a sheet stacker comes, from the lower side, into contact with a sheet stacked on the sheet stacker with a tilt, and supplies sheets sequentially from the lower side of the sheet bundle to a feed roller.

In the following embodiments, a document conveyance apparatus that detects the conveyance state of a sheet using a tracking sensor (movement detection sensor) will be described in detail.

Third Embodiment

A document conveyance apparatus according to the third embodiment of the present invention will be described below.

Figure 21:
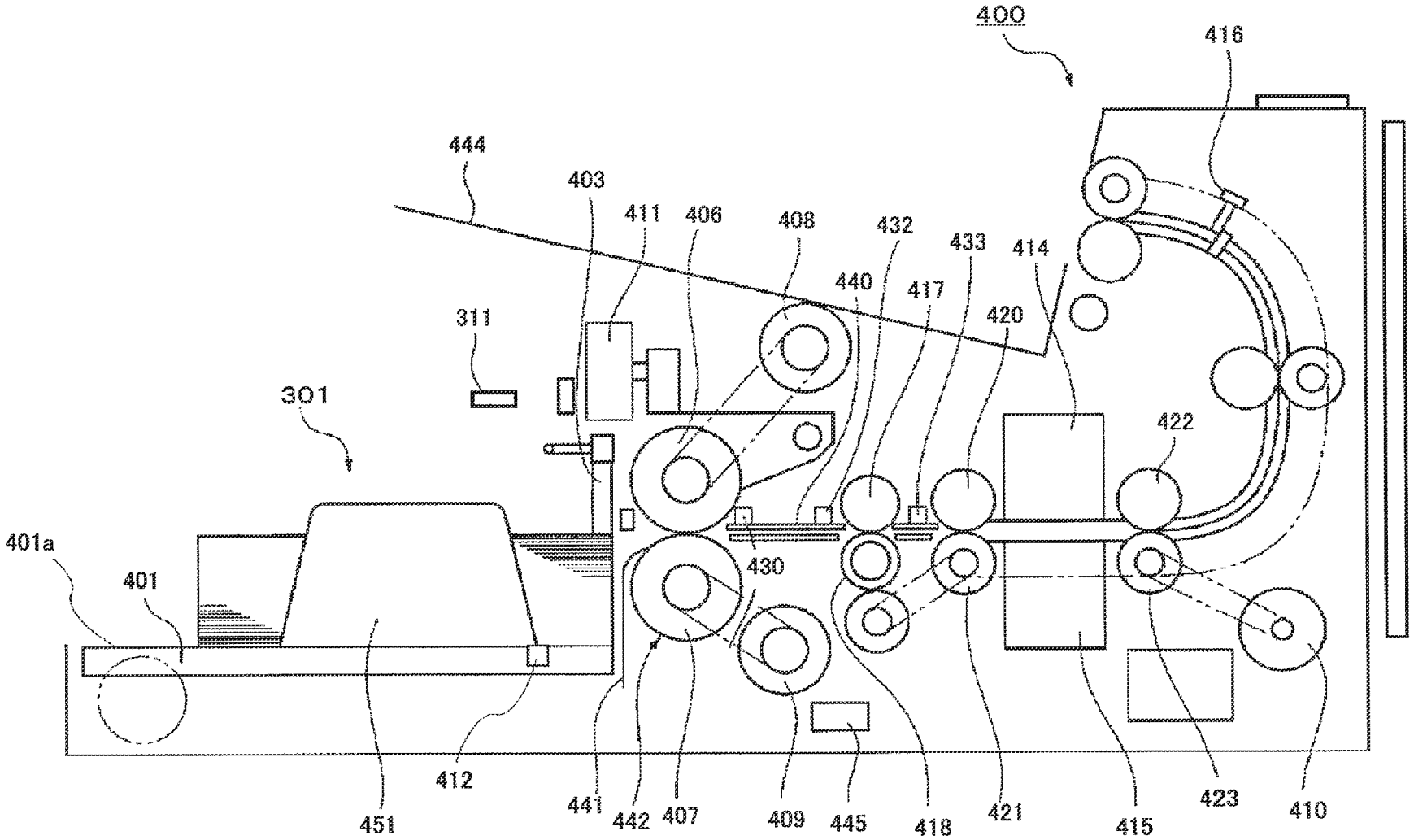
FIG. 21 is a partial sectional view schematically showing the configuration of a document conveyance apparatus according to the third embodiment of the present invention.
Figure 22:
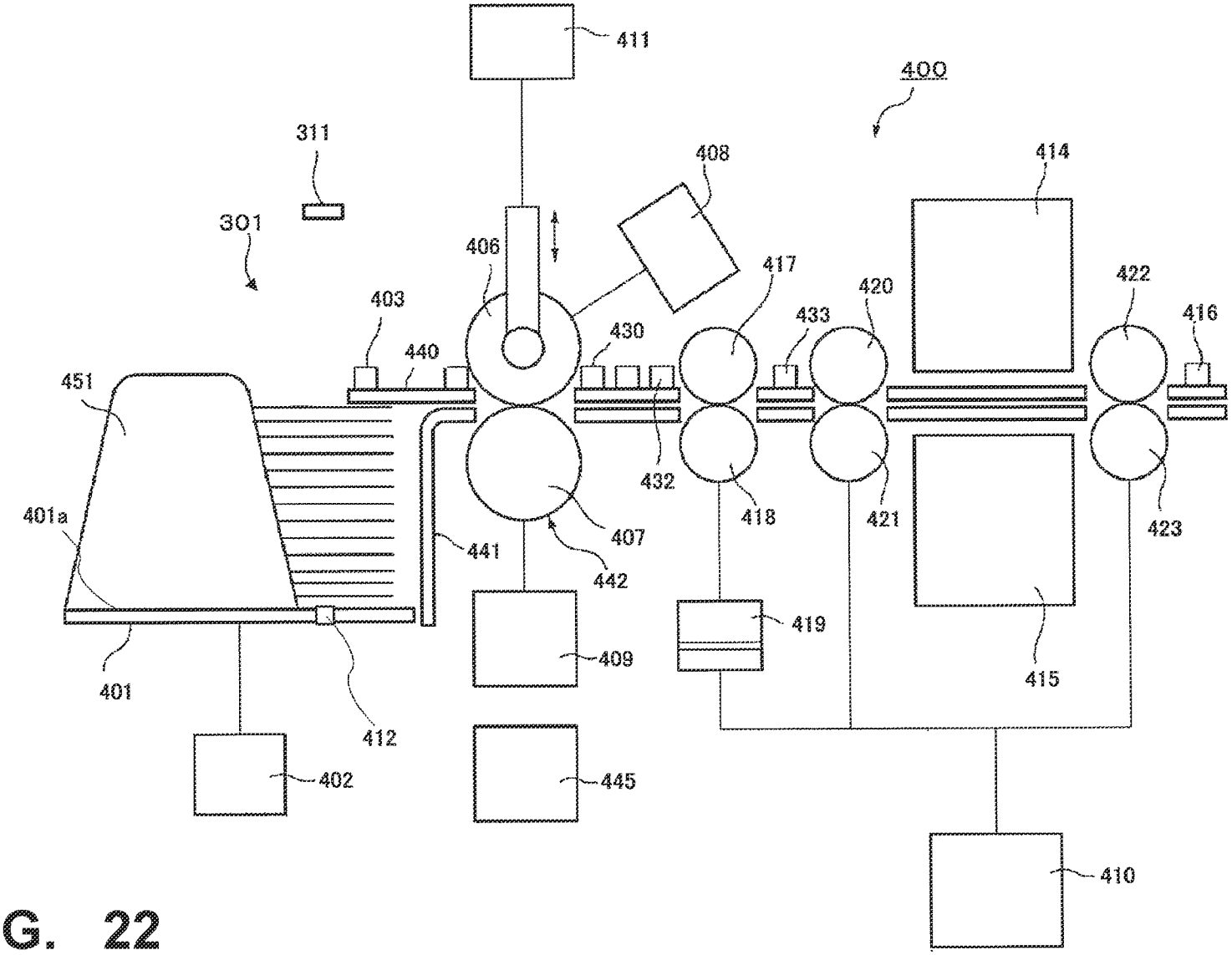
FIG. 22 is a view schematically showing the configuration of the main part of the document conveyance apparatus shown in FIG. 21.

FIG. 21 is a partial sectional view schematically showing the configuration of a document conveyance apparatus (image reading apparatus) according to the third embodiment of the present invention. FIG. 22 is a view schematically showing the configuration of the main part of the document conveyance apparatus shown in FIG. 21.

In FIGS. 21 and 22, a document conveyance apparatus 400 includes a sheet take-in device 301. A plurality of sheets are stacked on a sheet stacker (sheet placement table) 401, and the sheet stacker 401 is configured to move up and down. A sheet stacker drive motor 402 moves the sheet stacker 401 up and down. A sheet detection sensor 403 detects that a sheet stacked on the sheet stacker 401 is located at a sheet take-in position. A sheet stacking detection sensor 412 detects that a sheet is stacked on a sheet stacking surface 401*a* of the sheet stacker 401.

A feed roller 406 as an example of a document pickup unit is driven by a feed motor 408 to rotate in a direction to feed a sheet to the downstream side in the conveyance direction. A separation roller 407 always receives a rotating force of rotating in a direction of pushing back the sheet to the upstream side in the conveyance direction from a separation motor 409 via a torque limiter (slip clutch) (not shown).

When one sheet exists between the feed roller 406 and the separation roller 407, the rotating force in a direction of feeding the sheet to the downstream side by the frictional force between the separation roller 407 and the sheet fed to the downstream side by the feed roller 406 is larger than the upper limit value of the rotating force transmitted by the above-described torque limiter in the direction in which the separation roller 407 pushes back the sheet to the upstream side. For this reason, the separation roller 407 rotates following the feed roller 406 (rotates together).

On the other hand, if a plurality of sheets exist between the feed roller 406 and the separation roller 407, the separation roller 407 receives, from the roller shaft, rotation in the direction of pushing back the sheets to the upstream side, thereby preventing sheets other than the sheet at the uppermost position from being conveyed to the downstream side.

In this way, by the function of the feed roller 406 to feed a sheet to the downstream side and the function of the separation roller 407 to prevent a sheet from being conveyed to the downstream side, even if sheets are fed in an overlapping state to the nip portion between the feed roller 406 and the separation roller 407, only the sheet at the uppermost position is fed to the downstream side, and the remaining sheets are not conveyed to the downstream side. Hence, the sheets in the overlapping state are separated and fed. The feed roller 406 and the separation roller 407 thus form a pair of separation roller pairs 442 (sheet separation portion). Note that in this embodiment, the separation roller pair 442 is used. Instead of the separation roller pair 442, a separation belt/roller pair formed by changing one of the separation roller and the feed roller to a belt may be used. Alternatively, the separation roller may be replaced with a separation pad, and the pad may be brought into contact with a sheet to prevent a plurality of sheets from being conveyed to the downstream side.

A conveyance motor 410 drives other rollers (sheet conveyance unit) to convey the separated sheet to an image reading position where the image of the document is read by image reading sensors 414 and 415 and further convey the sheet to a discharge position. Also, the conveyance motor 410 drives the rollers to change the sheet conveyance speed in accordance with a speed optimum for sheet reading and settings such as the resolution of the sheet.

A nip gap adjusting motor 411 adjusts the gap between the feed roller 406 and the separation roller 407 or a contact force of the feed roller 406 contacting the separation roller 407 via a sheet. This can adjust the gap adapted for the thickness of the sheet or the contact force and separate the sheet.

A registration clutch 419 transmits the rotation driving force of the conveyance motor 410 to a registration roller 418 (sheet conveyance unit) or blocks the transmission. By stopping the rotation of a pair of registration rollers 417 and 418, the leading edge of the fed sheet is made to abut against the nip portion of the pair of registration rollers 417 and 418 to correct skewing of the sheet.

A pair of conveyance rollers 420 and 421, a pair of conveyance rollers 422 and 423, and a pair of rollers on the downstream side shown in FIG. 21 convey the sheet to a discharge stacking unit 444. A discharge sensor 416 detects the passing of the sheet on the upstream side of the discharge stacking unit 444. Two guide plates including an upper guide plate 440 and a lower guide plate 441 guide the sheet conveyed by the separation roller pair 442, the pair of registration rollers 417 and 418, the pair of conveyance rollers 420 and 421, the pair of conveyance rollers 422 and 423, and the pair of rollers on the downstream side.

A pre-registration sensor 432 is arranged on the upstream side of the pair of registration rollers 417 and 418, and detects the conveyed sheet. A post-registration sensor 433 is arranged on the downstream side of the pair of registration rollers 417 and 418, and detects the conveyed sheet.

Details of the main part of the embodiment of the present invention will be described here with reference to FIGS. 23 and 24. A board 300 on which an optical sensor 311 capable of detecting the behavior of a conveyed document is implemented is attached at a position facing the sheet stacker 401 in parallel to the sheet stacker 401. That is, the board is attached such that the imaging surface of the optical sensor 311 becomes parallel to the surface (opposing surface) of the sheet stacker 401. Here, an area image sensor is used as the optical sensor 311. In this embodiment, "the imaging surface of the optical sensor 311 is set parallel to the surface of the sheet stacker 401" has the same meaning as "the board 300 on which the optical sensor 311 is implemented becomes parallel to the surface of the sheet stacker 401".

In this embodiment, the image of a conveyed document is acquired using the optical sensor 311 as an image capturing element, and the moving amount is detected based on the image information, thereby detecting the behavior of the document. The optical sensor 311 is arranged to be apart, by a predetermined distance, from an image capturing reference surface in the conveyance path through which the document is conveyed. The image capturing reference surface is a surface that faces the optical sensor 311 serving as an image capturing element and serves as the reference of image capturing by the optical sensor 311. In this embodiment, the surface of the conveyance path (sheet stacker 401) through which the document (sheet) as an image capturing target is conveyed is defined as the image capturing reference surface. In a situation in which a plurality of documents are placed on the sheet stacker 401, a position corresponding to the surface of a conveyed document serves as the image capturing reference surface. That is, the surface of the sheet stacker 401 at the uppermost position within the up-and-down moving range of the sheet stacker 401 when feeding a document almost matches the image capturing reference surface. When the optical sensor 311 is arranged apart from the image capturing reference surface by a predetermined distance D0, the image of the document can be acquired at an appropriate interval without depending on the type of the document or the position where the optical sensor 311 is arranged. Hence, as the optical sensor 311, a sensor capable of placing an imaging focal point on a document that is apart by the predetermined distance D0 is preferably used. In this embodiment, the optical sensor 311 is arranged apart from the image capturing reference surface by the predetermined distance D0 of about 20 mm to 30 mm.

In this embodiment, the image of the document is acquired by the optical sensor 311, and images at a predetermined time interval (or images based on a predetermined moving amount interval) are compared by an IC provided on the board 300 on which the optical sensor 311 is implemented, thereby determining the moving amount. The IC implemented on the board 300 operates as a moving amount detection unit. However, the images acquired by the optical sensor 311 may be transmitted to an external apparatus, and the moving amount determination may be done on the external apparatus. In this case, it can be said that the moving amount detection unit is constituted including the external apparatus. In this case, the document conveyance apparatus according to this embodiment is constituted including the portion that performs moving amount determination in the external apparatus.

Figure 23:
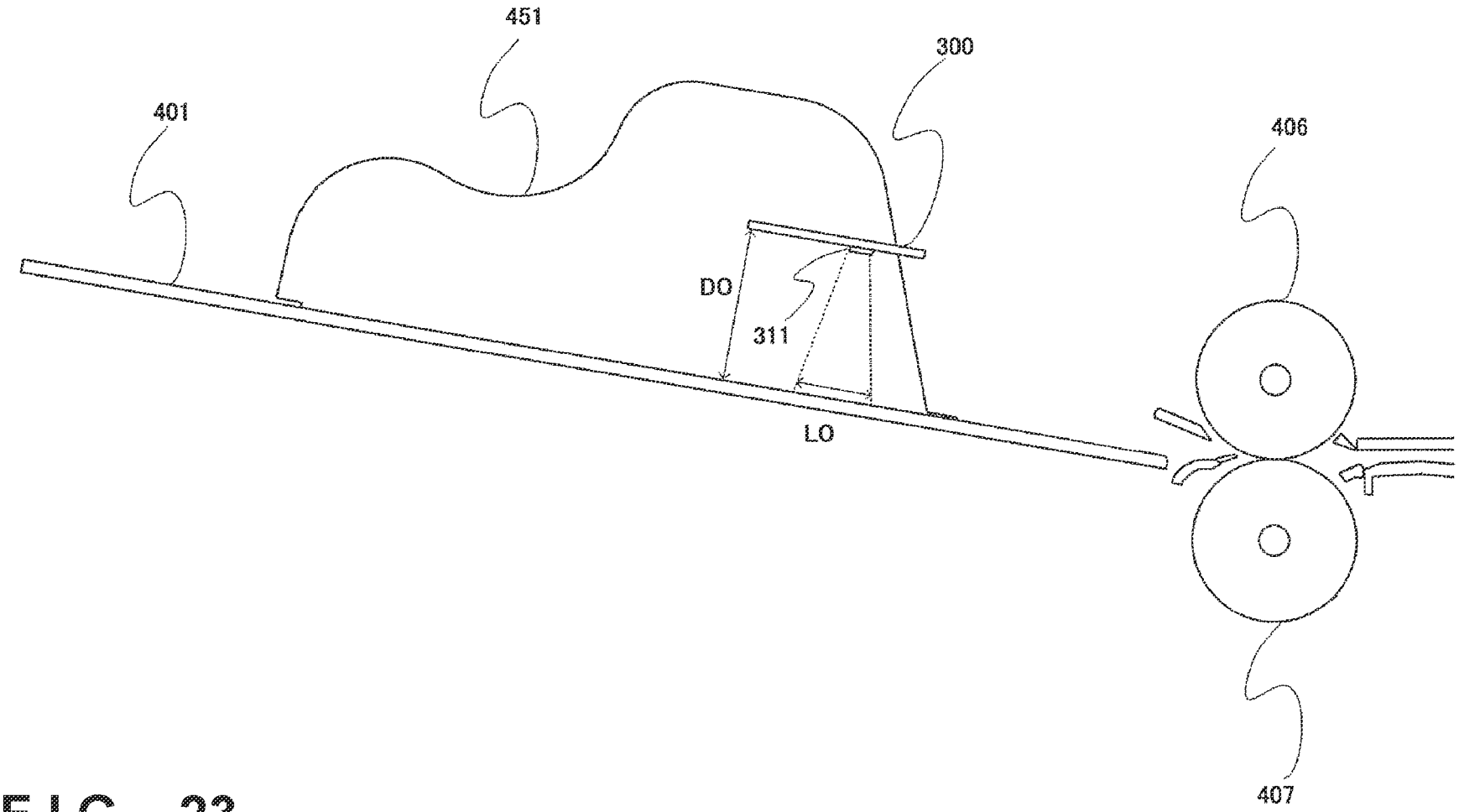
FIG. 23 is a partial sectional view schematically showing the arrangement of an optical sensor according to the third embodiment of the present invention.

Note that as shown in FIG. 23, regulating members 451 capable of moving to end sides in the widthwise direction with respect to the conveyance direction are provided on the sheet stacker 401 to regulate the widthwise direction of a sheet. By moving the regulating members 451 in the widthwise direction in correspondence with the width of a conveyed document, the sheet can be prevented from skewing during conveyance. In this embodiment, the optical sensor 311 may be attached to the regulating member 451 or may be attached to the exterior of the main body.

Figure 24:
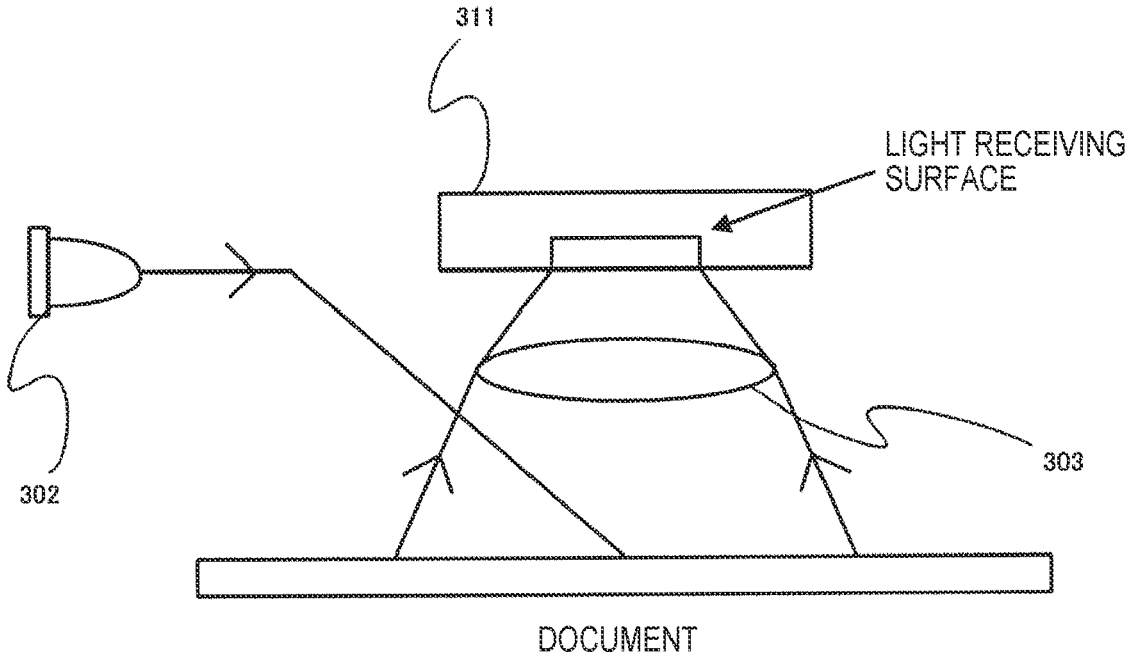
FIG. 24 shows views schematically showing the configuration of the optical sensor.
Figure 24:
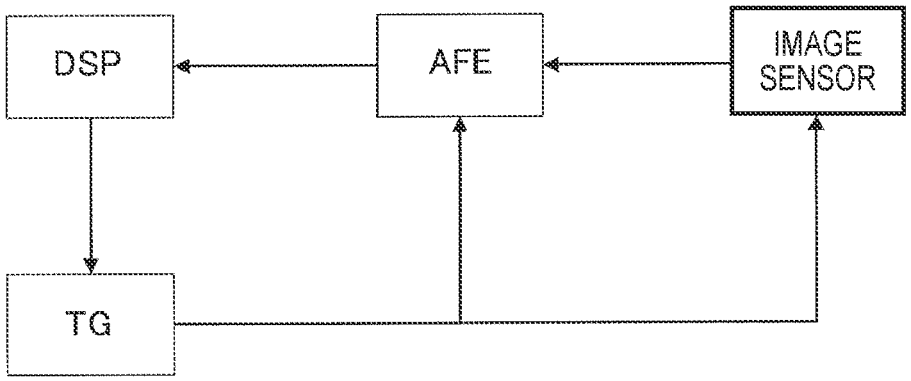

The optical sensor 311 is arranged such that the amount of light received by the optical sensor 311 is maximized when an optical member 303 such as a prism or a lens is arranged in front of the optical sensor 311, and the optical sensor 311 is made to face the document on the opposite side, as shown in FIG. 24(*a*). If there is no problem in operation, these optical members can be omitted giving preference to size reduction and cost.

A case in which the optical sensor 311 is a sensor capable of detecting the moving amount of a document in the embodiment of the present invention will be described.

In this case, the optical sensor 311 includes a moving amount detection unit (not shown) capable of detecting the moving amount or moving direction of an image capturing target. An area image is acquired by the optical sensor 311, and an image obtained by converting the image into a digital signal by an A/D conversion unit (not shown) is sequentially compared by the moving amount detection unit, thereby detecting the moving amount or moving direction of the image capturing target (a sheet in this embodiment).

The optical sensor 311 according to this embodiment preferably acquires the surface image of a document by irradiating an infrared laser beam by a laser or using light emission by an LED, and receiving light reflected by the document or the like. In particular, the laser method is preferably used because the moving amount of the document can more specifically be detected. Note that when the laser method is used, the wavelength of the laser beam is appropriately selected, thereby reducing lowering of the moving amount detection accuracy caused by fluttering of the document during conveyance. For example, it is experimentally obvious that when the distance D0 from the document conveyance surface to the optical sensor 311 is 20 mm concerning a document conveyed through a conveyance path having a height of about 2 mm, an infrared laser beam having a wavelength of about 850 nm is used, thereby maintaining the moving amount detection accuracy even if fluttering occurs in the document during conveyance.

In this embodiment, an image sensor is driven by a TG (Timing Generator) in the optical sensor 311 to acquire an image signal, A/D conversion and image signal analysis are performed, and the moving amount or moving direction of an image capturing target is detected. For example, as shown in FIG. 24(*b*), the optical sensor 311 includes an image sensor, a TG, an AFE (Analog Front End), and a DSP (Digital Signal Processor). The TG acquires an image of an image capturing target by the image sensor, the AFE executes A/D conversion for the acquired image signal, and the DSP detects the moving amount of the image capturing target based on the digital image signal (a so-called system on chip (SoC) is formed). That is, the DSP functions as the moving amount detection unit. As another case, a configuration may be employed in which the optical sensor 311 performs only acquisition of an image signal, an image signal processing device (not shown) exists as another device, and A/D conversion and image signal analysis are performed by the image signal processing device, and the moving amount or moving direction of the image capturing target is detected. In this embodiment, acquisition of an image signal by the optical sensor 311 is performed by irradiating a document with light, receiving reflected light by a light receiving portion, and photoelectrically converting the light.

Figure 25:
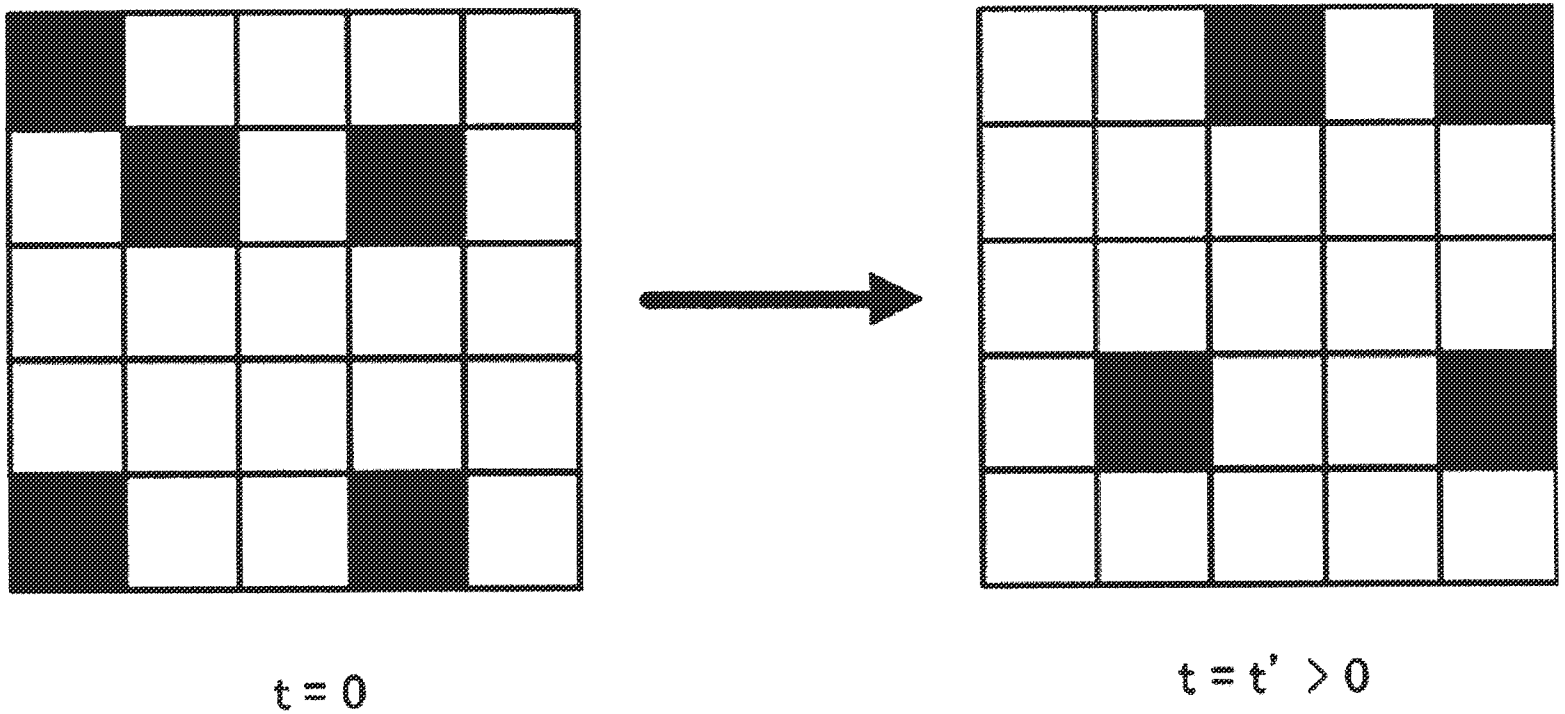
FIG. 25 is a view schematically showing an image obtained by executing signal processing for an image obtained from the optical sensor.

FIG. 25 is a schematic view of an image obtained by executing signal processing for an image obtained from the optical sensor 311. A point extracted as a feature point from an image captured at a certain time (t=0) is represented by a solid square. Here, as an example, 1 square=1 pixel (that is, the number of pixels of the optical sensor 311 is 5×5=25 squares). However, one square may be formed representatively after calculating the average value of a plurality of pixels or performing a specific calculation. As an example, bright or dark points as compared to other squares are extracted as feature points. As a feature point, unevenness or a flaw on the document surface can be extracted. At a point of time after the elapse of t' from the time in this state, the optical sensor 311 acquires an image again. Black squares are extracted, comparison is performed to check how the black squares (feature points) move, and the moving amount from time 0 to time t' is calculated. In the example shown in FIG. 25, it is determined that the image has moved by one square to the right side and one square to the upper side. Note that the calculation of the moving amount may be performed by the DSP in the optical sensor 311, as described above, or may be performed by an image signal processing device provided separately from the optical sensor 311.

Figure 29:
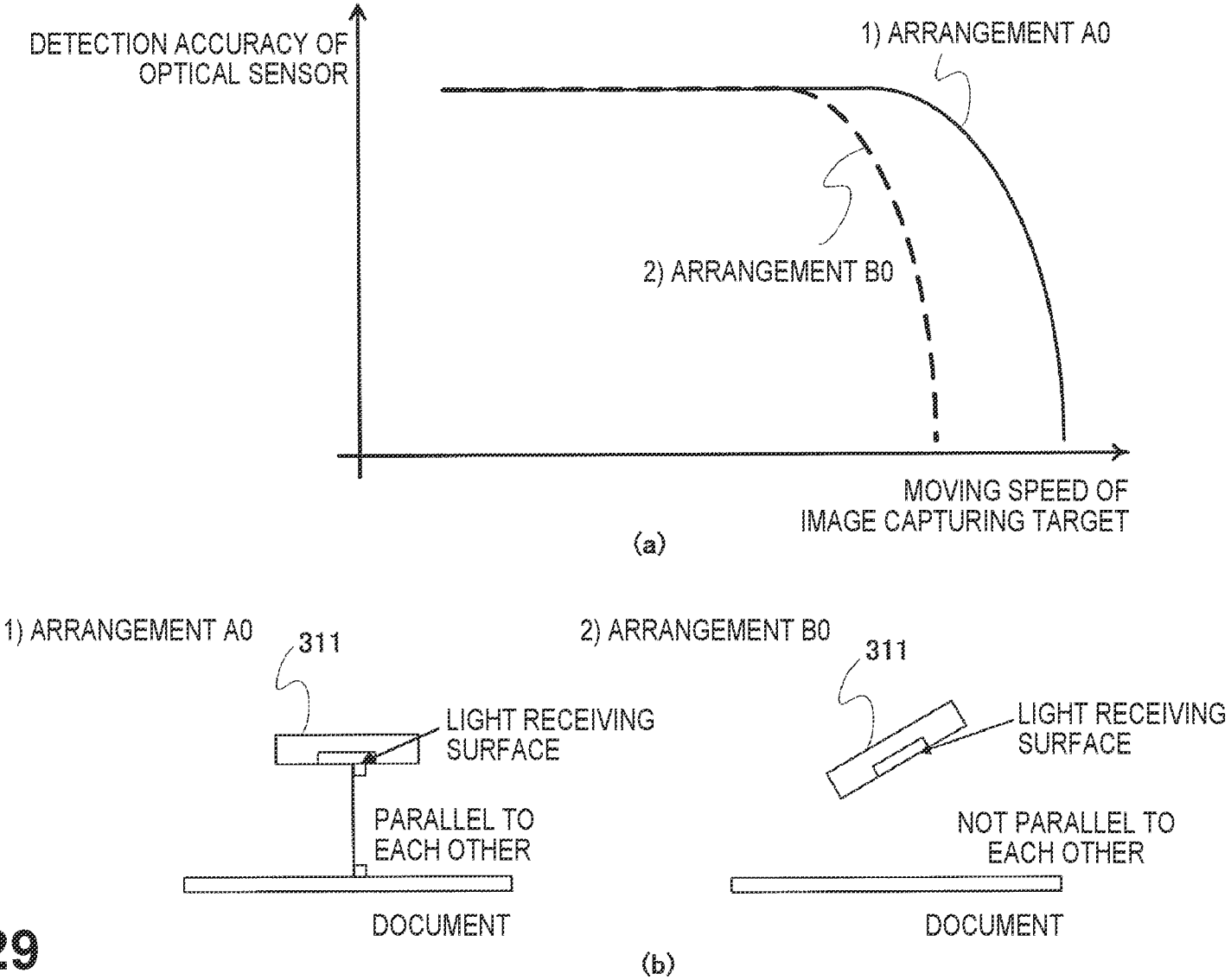
FIG. 29 shows schematic views showing the characteristics of moving speed of an image capturing target and the detection accuracy of the optical sensor.

Here, as described above, the imaging surface (light receiving surface) of the optical sensor 311 and the surface of the document are arranged in parallel to each other. The characteristic of the optical sensor will be described with reference to FIG. 29. As the characteristic of the optical sensor used in this embodiment, generally, when the light receiving surface of the optical sensor and the document are parallel to each other as shown in FIG. 29(*a*) (left side in FIG. 29(*b*)), the moving speed of the document as the image capturing target can be followed to a faster range, as compared to a case in which the light receiving surface tilts with respect to the document (right side in FIG. 29(*b*)).

Details of the arrangement of the optical sensor 311 will be described next again with reference to FIG. 23.

As for the distance D0 between the optical sensor 311 and the sheet stacker 401, letting L0 be the image capturing range in the conveyance direction in the image capturing region of the optical sensor 311, T be the image acquisition interval time of the sensor, and V be the maximum value of the conveyance speed of the document conveyance unit, the distance D0 is adjusted such that $L0 \geq T \times V$ is satisfied. Note that L0 is also referred to as an image capturing region. Note that the image capturing region indicates the viewing angle of the optical sensor 311 on the image capturing reference surface of the optical sensor 311. If the image capturing target (document) exists on the image capturing reference surface, the image in the image capturing region can be acquired. The conveyance direction here is not a direction to actually convey the document (sheet) but a direction to convey by the apparatus, that is, a direction along the rotation direction of the feed roller or the conveyance roller (a direction perpendicular to the shafts of the rollers). Note that although the image acquisition interval time of the sensor is defined as T, actually, it is only necessary that a moving amount detection unit configured to detect the moving amount of a sheet based on an image acquired by the optical sensor 311 is provided, and the moving amount acquisition interval in the moving amount detection unit is T. That is, as the image acquisition interval time of the sensor, moving amount detection by the moving amount detection unit is performed at the interval T while an image is acquired at an interval shorter than T. Other acquired data may be ignored, or input itself to the moving amount detection unit may be inhibited. The following description will be made assuming that the image acquisition interval time of the sensor is T for the descriptive convenience. This is the same as described here, and the image acquisition interval time can be replaced with the moving amount acquisition interval time T.

When the angle of view (viewing angle) of the optical sensor 311 and the optical member becomes large, the region that can be captured at one time becomes large, and therefore, L0 has a large value. In addition, since the optical sensor 311 has a certain viewing angle, L0 can have a large value by increasing the distance D0.

The image acquisition interval time T has a small value if the time needed for the optical sensor 311 to acquire an image is short. More specifically, if the image reading clock of the optical sensor 311 is fast, the time needed for the optical sensor 311 to read an image signal is short. In addition, if the number of pixels of the optical sensor 311 is small, the time needed to read an image signal becomes short accordingly. However, if the number of pixels is small, it also affects the value of L0 described above (L0 becomes small).

As for the document moving amount detection as described above, if a plurality of images obtained from the optical sensor 311 need to be averaged to detect the moving amount, time until detection is necessary. In this case, it is necessary to replace the image acquisition interval time T with a moving amount detection interval time T' and adjust the distance D0 between the optical sensor 311 and the sheet stacker 401 to satisfy $L0 \geq T' \times V$.

Since $L0 \geq T \times V$ (or $L0 \geq T' \times V$) is a minimum condition, a more optimum arrangement will be mentioned in the present invention. For example, in a case in which an optical sensor including 5×5 pixels shown in FIG. 25 is used, when the optical sensor reads an image once, if the displacement amount of a document is equal to or less than one pixel, very accurate detection can be performed. That is, $L0 \geq T \times V \times 5$ need only be satisfied. From the expression, as an upper limit value Vmax of the document conveyance speed for accurate detection, L0/5T is obtained.

Figure 30:
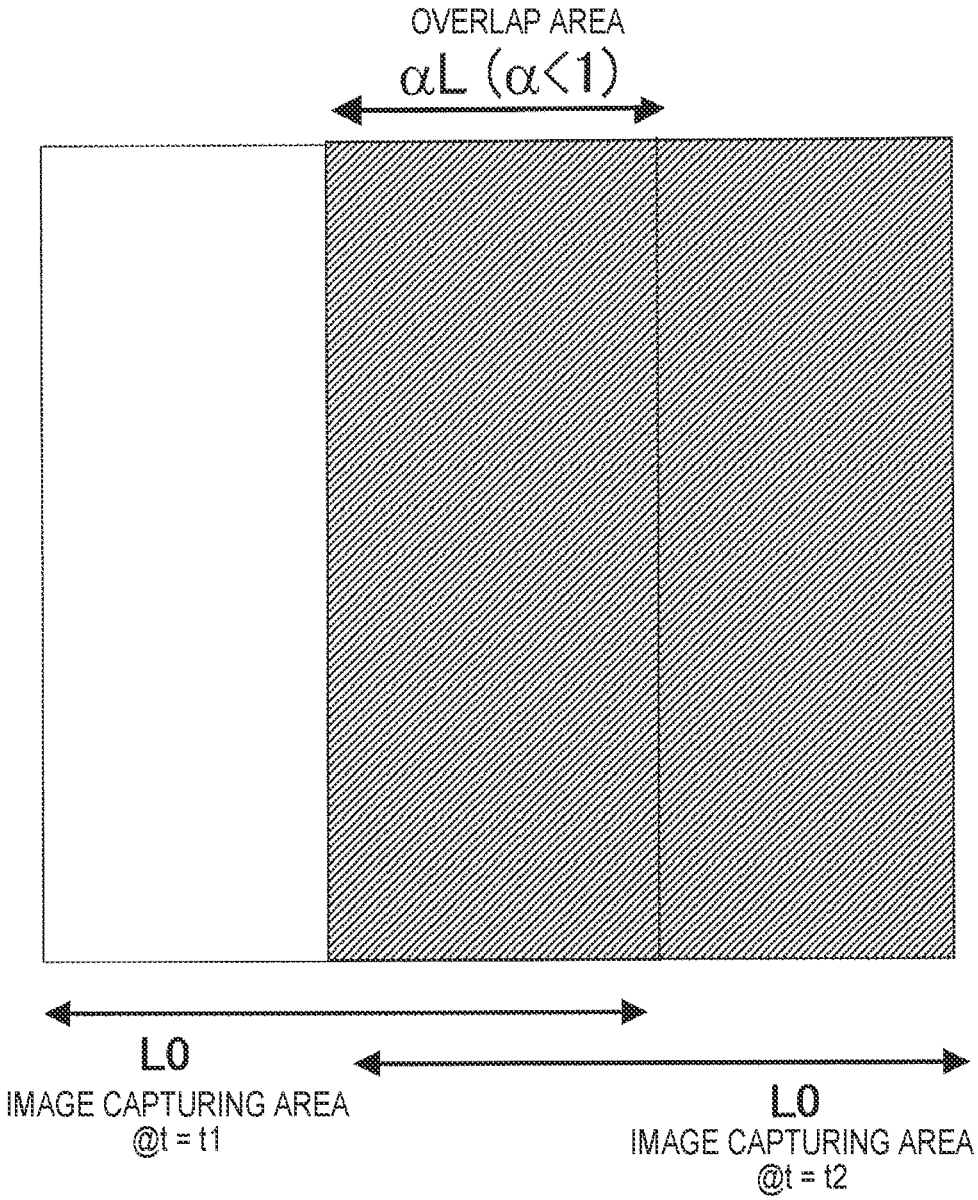
FIG. 30 is a schematic view showing an overlap of an image capturing target that has moved.

Assuming a case in which an operation with the upper limit value Vmax is difficult, another form will be described with reference to FIGS. 30 and 31. FIG. 30 schematically shows the degree of overlap (overlap ratio) between the image capturing regions of a document at certain time t1 and another time t2 (>t1). The larger the overlap region between images in regions captured by the optical sensor 311 at time t1 and time t2 is, the larger the number of feature points described above, which can be detected and traced, is. It is therefore possible to more correctly detect the moving amount. In this case, using $\alpha L0$ (a represents the degree of overlap of the image capturing regions; $\alpha<1$) in FIG. 30, the optical sensor 311 is arranged, and a conveyance speed V is set such that $\alpha L0 \geq T \times V$ is satisfied. That is, from this expression, as the upper limit value Vmax of the document conveyance speed, $\alpha L0/T$ is obtained.

Figure 31:
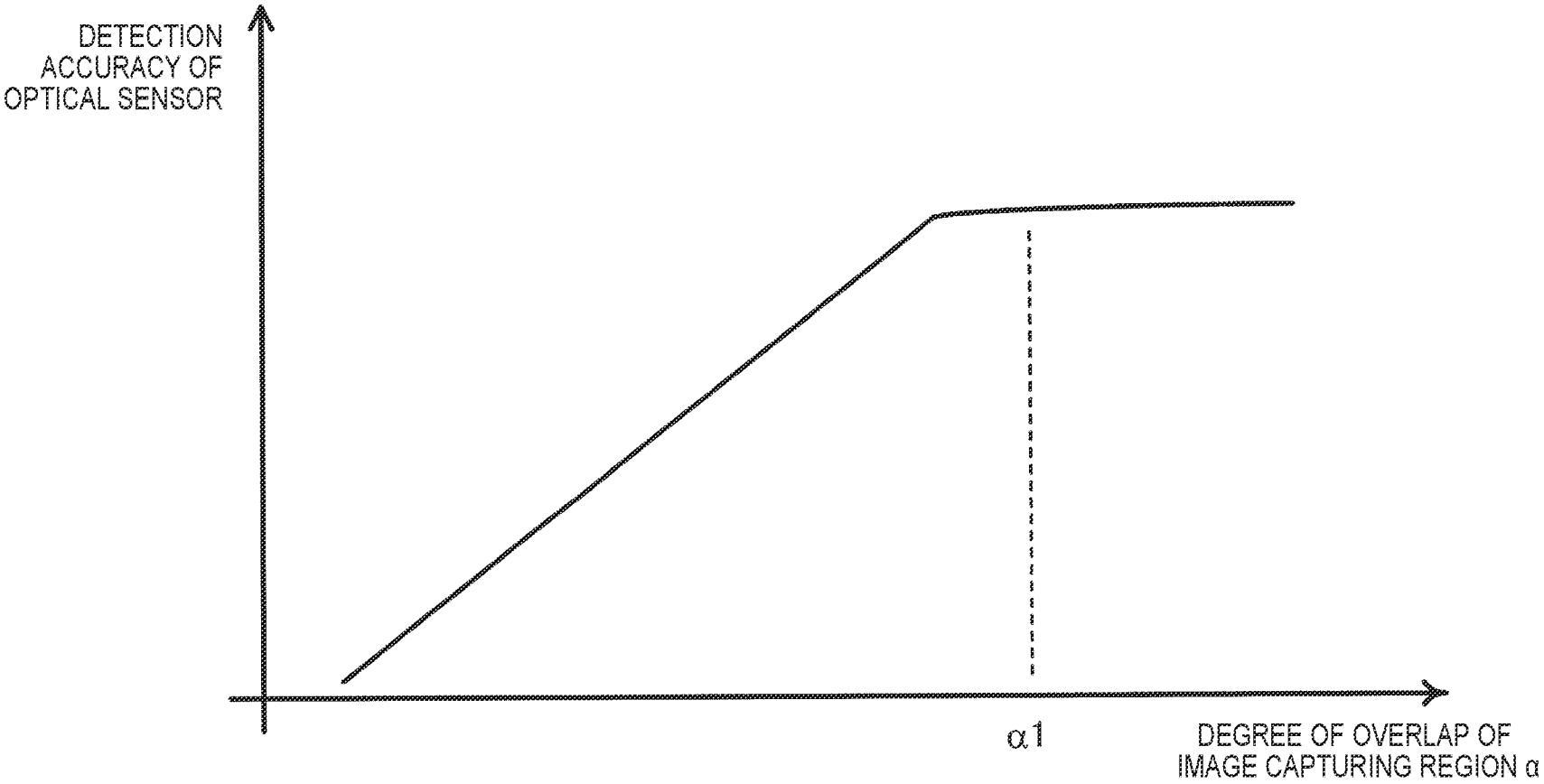
FIG. 31 is a schematic view showing the characteristic of the detection accuracy of the optical sensor with respect to the degree of overlap of an image capturing region.

As shown in FIG. 31, as the degree of overlap between the image capturing regions is raised, the detection accuracy of the optical sensor exhibits a rising characteristic. If the detection algorithm is configured such that the detection accuracy is saturated with a degree $\alpha 1$ of overlap of predetermined image capturing regions, Vmax is set such that the degree of overlap of the image capturing regions becomes $\alpha 1$.

As an example, assume that to obtain a moving amount detection accuracy of a certain level, the overlap area $\alpha L0$ is preferably N or more in terms of image capturing pixels. In this case, in the optical sensor, if the number of pixels in the conveyance direction is L0, the number of overlapping pixels in the conveyance direction need only be $\alpha L0$. In this case, $L0-V \times T \geq N(=\alpha L0)$ holds. Hence, in this case, the conveyance speed is set to satisfy $V \leq (L0-N)/T$, thereby accurately detecting the moving amount. As a detailed example, when the optical sensor shown in FIG. 25 is used, the overlap area needs to have four or more pixels ($\alpha=4/5=0.8$). Then, the conveyance speed V is set to satisfy V (5−4)/T=1/T.

In this embodiment, as shown in FIG. 31, the detection accuracy rises to a saturation level when the degree $\alpha 1$ of overlap becomes about 0.8. The moving amount detection itself is performed every image acquisition interval time, and the detection need not always successfully continuously be done. When the conveyance speed is set such that the moving amount can be almost detected, that is, the degree of overlap becomes $\alpha 1$ as a first threshold, the throughput of conveyance can be improved. In this embodiment, when $\alpha=\alpha 1=0.6$ (overlap ratio: 60%) is set, satisfactory detection is possible, and a load to the processing unit can be suppressed. In this case, since $N=\alpha L0=0.6 \times 5=3.0$, $V \leq 2/T$.

Note that the above description is merely an example, and the characteristic of the detection accuracy changes depending on the optical sensor to be used. It is preferable to set the degree $\alpha 1$ of overlap of the image capturing regions at which the detection accuracy starts saturating or slightly saturates. In this embodiment, $\alpha=0.6$, but it may be an approximate value.

The conveyance speed V is a speed at which the document conveyance apparatus conveys a document. Hence, the speed rises stepwise (or continuously depending on the type of motor) from the start of document conveyance until the speed reaches a predetermined speed. Conversely, at the time of stop of document conveyance, the speed decreases stepwise (or continuously depending) from a predetermined speed to a stop state (V=0).

As the set value of the above-described conveyance speed V, a speed V1 at the point of time when the conveyance speed has reached a predetermined speed after the start of document conveyance is set to satisfy the above-described expression. Even if the speed is lower than V1 at the rising or falling, the detection accuracy of the optical sensor never lowers, and the moving amount can suitably be detected.

Here, for example, if there is no space in the apparatus, it can be considered that an optical member having a large angle of view is arranged in front of the optical sensor 311 to increase the image capturing region L0 in the conveyance direction. This configuration makes it possible to cope with a higher conveyance speed V.

The image acquisition interval time T of the optical sensor 311 may be changed in synchronism with a change in the conveyance speed V. The imaging overlap region $\alpha L0$ as a target is determined, and the above-described TG controls the image acquisition interval time T such that the imaging overlap region always becomes constant even if the conveyance speed V changes. With this control, even if the conveyance speed V changes, the detection accuracy of the optical sensor is always constant.

Similarly, in this embodiment, the image acquisition interval time T may be adjusted, instead of setting the conveyance speed V, as described above, thereby adjusting the degree α of overlap of the image capturing regions to a predetermined value. When the degree α of overlap is set to α1, the detection accuracy of the optical sensor can efficiently be improved. However, the present invention is not limited to this, and the image acquisition interval time T capable of maintaining the degree α of overlap to some extent suffices.

As for the output of the optical sensor, the output may be done for an IC or the like, which processes the output at the predetermined image acquisition interval time T. Another example will be described below.

For example, a case in which conveyance of 150 A4 documents/min is performed using an optical sensor configured to output a moving amount when the moving amount detection amount of the optical sensor exceeds a predetermined value will be described. The conveyance speed V is about 1,000 mm/sec even in consideration of a document interval distance. In this case, as an example of the image acquisition interval time T, if the resolution of the optical sensor is set to 1,500 cpi, that is, if the optical sensor outputs 1,500 counts per inch, one count is output when a movement of $1/1{,}500$ inches per count, that is, about 0.017 mm is made. When conveyance speed V=1,000 mm/sec, 1,000/0.017≈60,000 counts is output per sec, that is, one count is output in $1/60{,}000$ sec.

The optical sensor has a characteristic that it cannot exhibit the set resolution performance at a predetermined conveyance speed or more, as shown in FIG. 29(*a*) (the detection accuracy lowers). On the other hand, to provide the same detection accuracy for the conveyance speed settable by the document conveyance apparatus, the resolution is set to about 1,500 cpi. In this case, for the condition of conveyance speed V=1,000 mm/sec to be actually used, the optical sensor can be used while maintaining a predetermined detection accuracy without lowering the resolution. In particular, as described with reference to FIG. 29(*b*), when the surface of the document and the imaging surface of the optical sensor are arranged in parallel (left side of FIG. 29(*b*)), the set resolution performance can easily be exhibited. That is, even if the conveyance speed is increased, the set resolution performance can be maintained, and the detection accuracy of the optical sensor can be maintained.

As the optical sensor, a sensor having a resolution of 5,000 cpi or more exists. When the resolution is raised, the detection accuracy of the optical sensor improves. However, the optical sensor needs to be operated at a high speed, and the operating clock frequency in the optical sensor rises. Hence, the load on the IC that processes the output of the optical sensor and power consumption increase. Considering the document conveyance state shown here, when the resolution is set to about 1,500 cpi, a sufficient detection accuracy can be ensured for the conveyance speed V of about 100 sheets/min required as the conveyance speed, and the load on processing and the like can be suppressed.

According to the configuration of this embodiment, since the document conveyance state can be detected by one optical sensor, it is possible to provide an apparatus without making the apparatus bulky or expensive.

Fourth Embodiment

The schematic view is the same as in the third embodiment. Hence, as for detailed of this embodiment, only portions different from the third embodiment will be described with reference to FIGS. 21 to 23.

In this embodiment, an optical sensor 311 is arranged on the upstream side of the conveyance path with respect to a feed roller 406 and a separation roller 407 in the apparatus main body. With the arrangement at this position, if a conveyance failure has occurred immediately after the start of document conveyance, the optical sensor 311 can early detect the occurrence of the failure. In addition, since the position is close to the feed roller 406, the movement of a document can satisfactorily be detected even if the document is small.

A conveyance failure here means a situation in which a document is conveyed with a skew at the time of document conveyance by the document conveyance unit (for example, the feed roller 406), or documents bound by stapling or the like are conveyed to the separation roller 407, and the documents cannot actually be separated although a separating effect acts.

In any case, if document conveyance is continued in a state in which a conveyance failure has occurred, the document is damaged. Hence, the optical sensor 311 is arranged on the upstream side of the conveyance path with respect to the feed roller 406 and the separation roller 407 to detect a conveyance failure early and perform conveyance control, thereby preventing damage to the document. More specifically, if a conveyance failure is detected, control is performed to stop conveyance by the document conveyance unit or decelerate. In addition, the user may be notified that a conveyance failure is detected.

According to the configuration of this embodiment, the document conveyance state can be detected by one optical sensor. In addition, a conveyance state after a document is fed into the apparatus main body and regulated in the widthwise direction can also be detected. For this reason, since the document conveyance state can be detected without executing additional processing, the processing time is not increased.

It is therefore possible to provide an apparatus that does not unnecessarily increase the processing time without making the apparatus bulky or expensive.

Fifth Embodiment

The schematic view is the same as in the third embodiment. Hence, as for details of this embodiment, only portions different from the third embodiment will be described with reference to FIGS. 21 to 23.

In this embodiment, a light source unit 302 is provided for the purpose of increasing the amount of light received by an optical sensor 311, as shown in FIG. 24(*a*). Note that in this embodiment, the light source unit 302 is provided as a device different from the optical sensor 311. However, the optical sensor 311 and the light source unit 302 may be integrated into one device.

Light emitted by the light source unit 302 that is arranged separately from the optical sensor 311 incorporating a light emitting unit and a light receiving unit as units, more specifically, arranged to perform light irradiation from a direction different from the irradiation direction of the optical sensor 311 is reflected by a document portion surface. When this reflected light enters the optical sensor 311, the optical sensor captures the document surface portion. A lens 303 may be arranged in front of the optical sensor to more efficiently condense light.

According to the configuration of this embodiment, since the document conveyance state can be detected by one optical sensor, it is possible to provide an apparatus without making the apparatus bulky or expensive.

Sixth Embodiment

Figure 26:
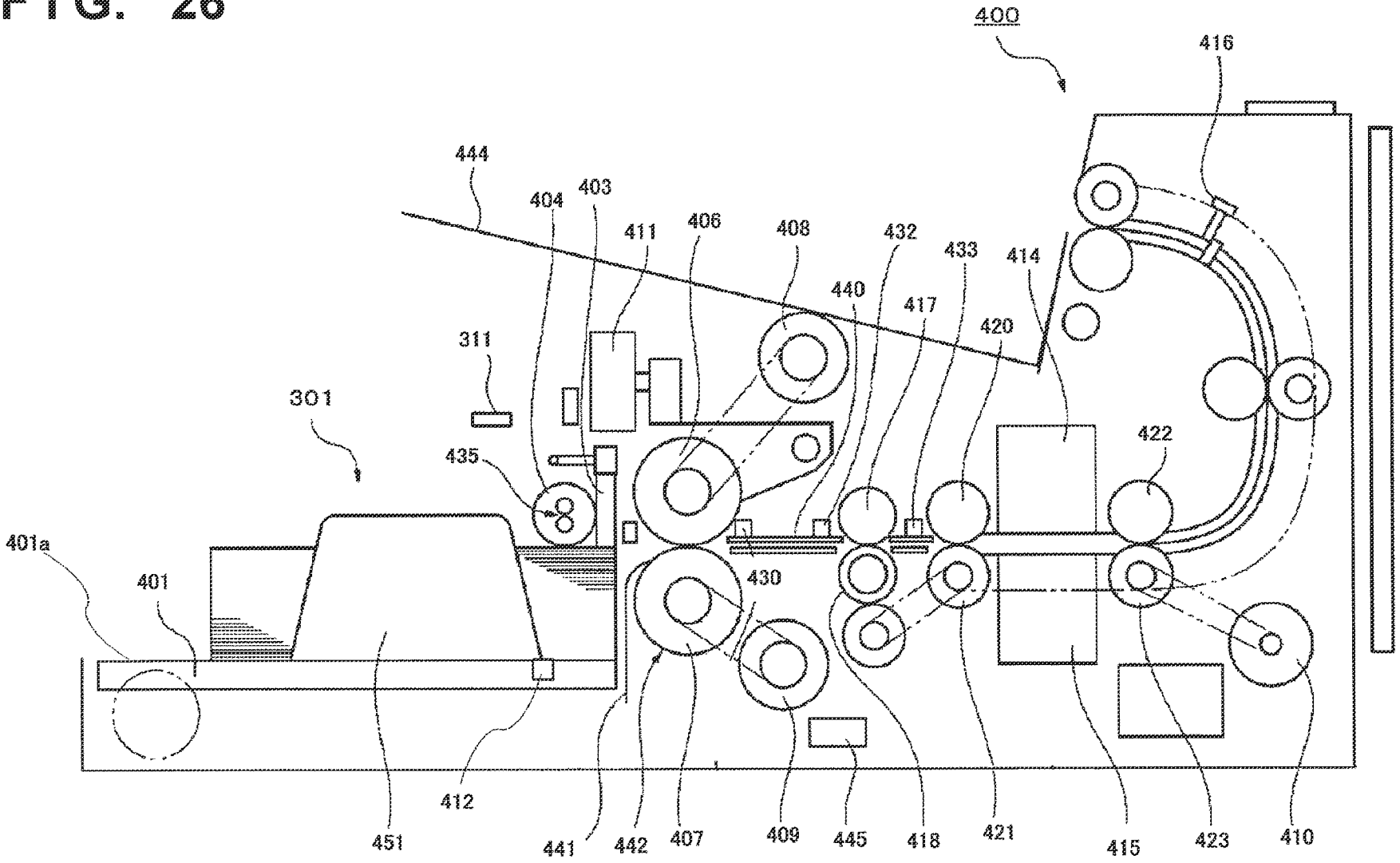
FIG. 26 is a partial sectional view schematically showing the configuration of a document conveyance apparatus according to the sixth embodiment of the present invention.
Figure 27:
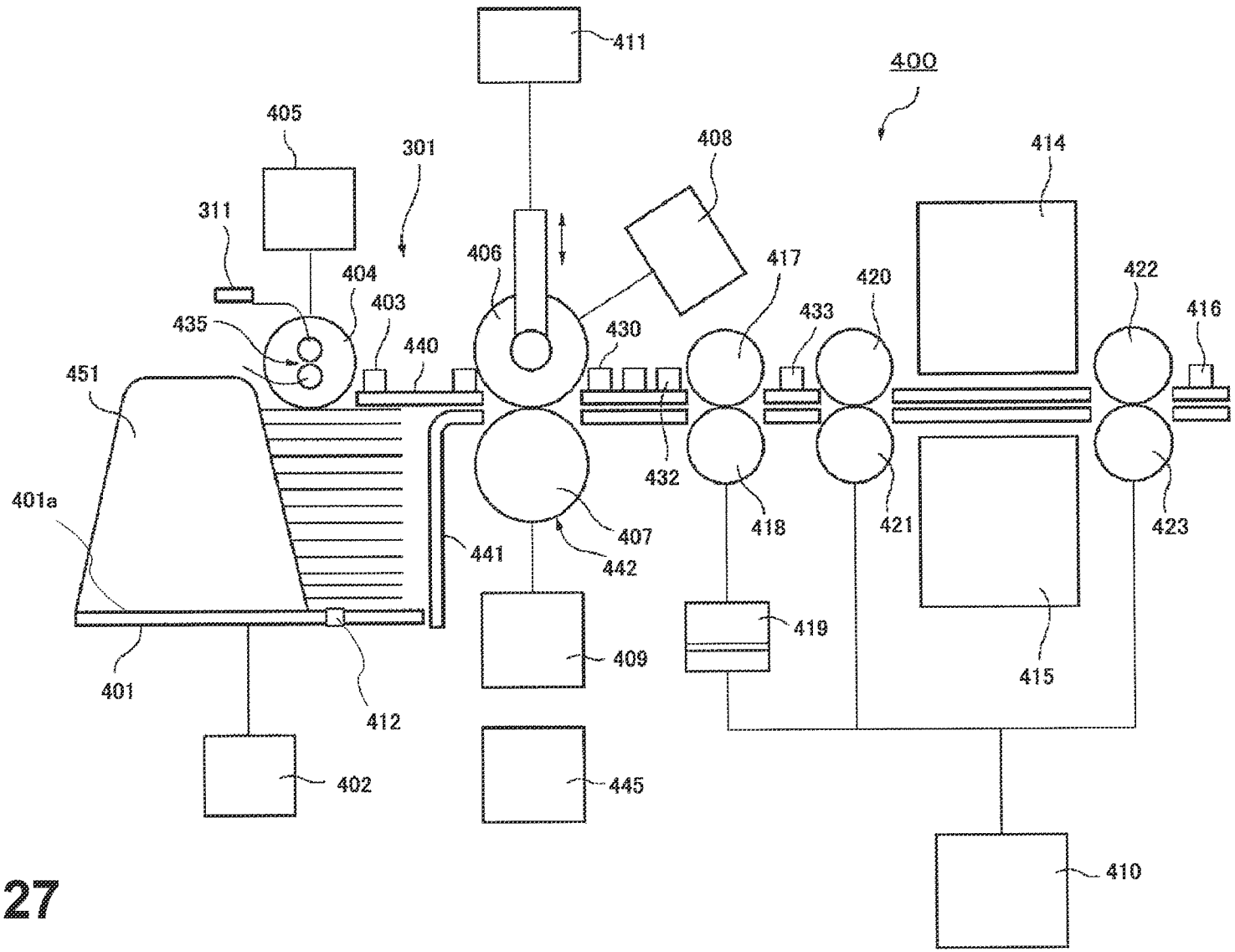
FIG. 27 is a view schematically showing the configuration of the main part of the document conveyance apparatus shown in FIG. 26.

A document conveyance apparatus according to the sixth embodiment will be described first. FIG. 26 is a partial sectional view schematically showing the configuration of a document conveyance apparatus according to this embodiment. FIG. 27 is a view schematically showing the configuration of the main part of the document conveyance apparatus shown in FIG. 26.

Since the basic configuration is the same as in the third embodiment, only different portions will be described.

A pickup roller 404 (take-in means) as an example of a document pickup unit feeds a sheet on a sheet stacker 401 from the sheet stacker 401. A pickup roller drive motor 405 rotates the pickup roller 404. FIG. 27 shows a state in which the sheet upper surface is located at the sheet take-in position, and the take-in of the sheet starts when the pickup roller 404 is rotated. In addition, the pickup roller 404 can be moved by driving means (not shown) to the sheet take-in position and a retreat position on the upper side of the sheet take-in position. The pickup roller 404 is moved to the sheet take-in position when taking a sheet in, and moved to the retreat position when the take-in is ended.

Figure 28:
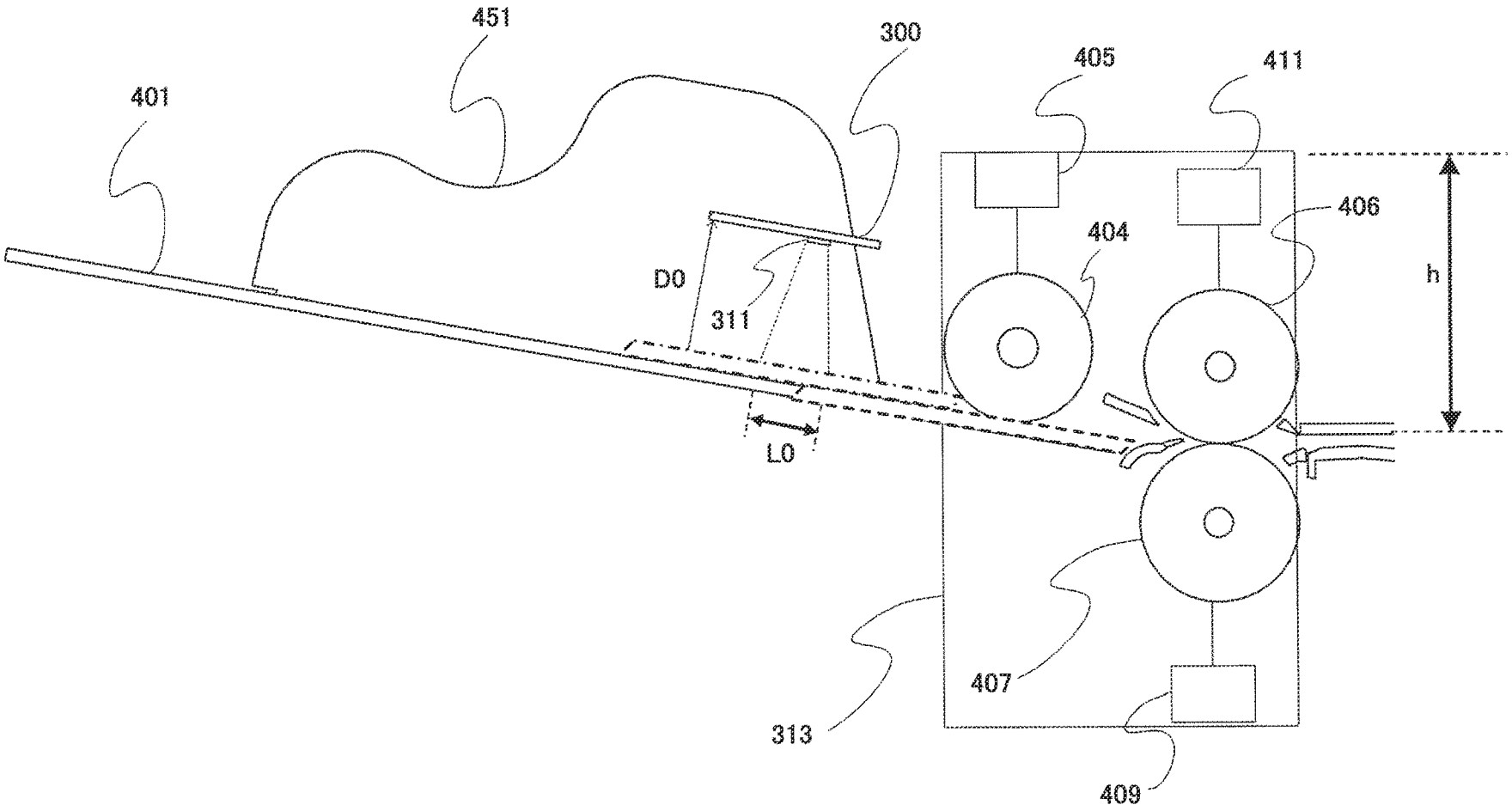
FIG. 28 is a partial sectional view schematically showing the arrangement of an optical sensor according to the sixth embodiment of the present invention.
Figure 32:
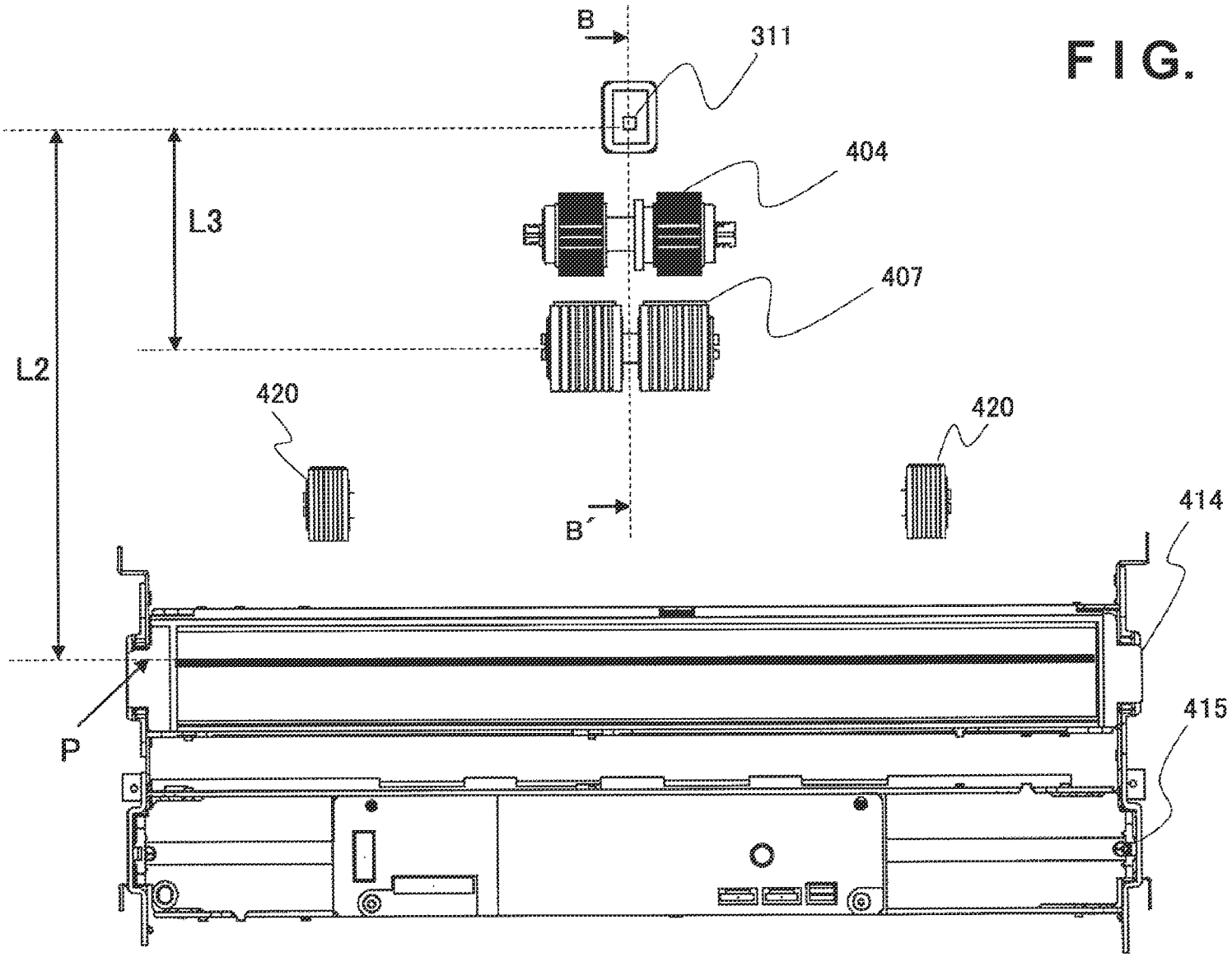
FIG. 32 is a plan view showing an example of the arrangement of the optical sensor, a pickup roller, a separation roller, and image reading sensors.
Figure 33:
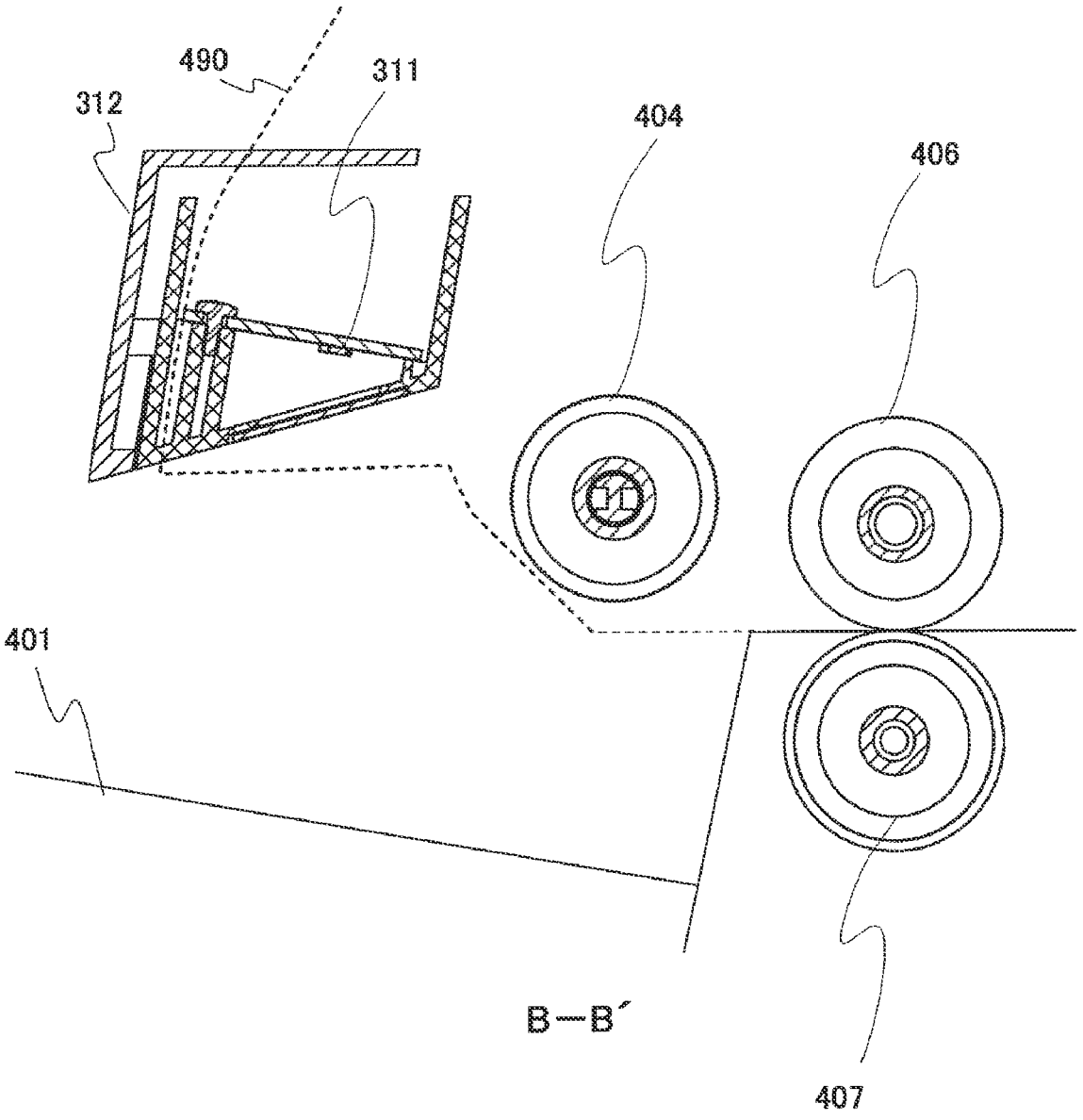
FIG. 33 is a sectional view showing an example of the arrangement of the optical sensor and a case body that covers its periphery.

Here, FIG. 28 is a view showing details of the main part of this embodiment. An optical sensor 311 is arranged at a position lower than a height h of a feeding unit portion 313, which is formed by the pickup roller 404 and the pickup roller drive motor 405, a feed roller 406 and a nip gap adjusting motor 411, and finally a separation roller 407 and a separation motor 409, from the conveyance path. In the configuration of the feeding unit, the optical sensor 311 can be arranged without an influence on the size of the housing in the height direction. Details of the arranging method of the optical sensor 311 will be described with reference to FIGS. 32 and 33. FIG. 32 is a view showing the document conveyance apparatus in a direction to face the feeding surface, in which the optical sensor 311, the pickup roller 404, and the separation roller 407 are extracted. In this embodiment, a member holding the pickup roller 404 is extended to hold the optical sensor 311. FIG. 33 is a sectional view taken along a line B-B' concerning the structure shown in FIG. 32, and shows an example in which the optical sensor 311 is covered with a case body 312, as will be described later with reference to FIG. 34. For example, as shown in FIG. 33, the case body 312 that holds the optical sensor 311 is provided to partially project from a housing 490 of an image reading apparatus 400. An optical sensor board 300 on which the optical sensor 311 is implemented is fixed in the case body 312, thereby fixing the optical sensor 311 on the upstream side of the pickup roller 404. For the purpose of extending the detection region of the optical sensor 311 to the maximum, the optical sensor 311 is preferably arranged in a direction not to capture the pickup roller 404 and capture only the document (if a region other than the document exists in a part of the image capturing region, an information amount needed to detect the moving amount or the moving direction becomes small, resulting in lowering of the detection accuracy).

However, if only the document can be included in the detection region of the optical sensor 311 even if the optical sensor 311 is arranged in a direction opposite to the direction shown in FIG. 33 in which the optical sensor 311 is arranged such that, of the wall surfaces of the case body 312 covering the periphery of the optical sensor 311, the wall surface whose distance to the feeding surface is shorter is arranged on the upstream side, that is, even if the optical sensor 311 is arranged such that, of the wall surfaces of the case body 312, a wall surface whose distance to the feeding surface is shorter is arranged on the downstream side, the optical sensor 311 is preferably arranged such that the wall surface whose distance to the feeding surface is shorter is arranged on the downstream side in consideration of generation of paper powder on the pickup roller 404 or the separation roller 407. With this arrangement, sticking of paper powder to the surface (a light transmitting surface 312*c* in FIG. 34) facing the optical sensor 311 can be reduced.

Assuming a case in which sheets are fed one by one from a document bundle placed on the sheet stacker 401, the position of a document to be conveyed to the feeding unit portion 313 will be described next. In FIG. 28, a document that should originally be located at a position indicated by an alternate long and short dashed line sometimes moves to the side of the feeding unit portion 313 (a position indicated by a dotted line) when an immediately preceding document is conveyed due to a frictional force generated between the surfaces of the immediately preceding document and the next document. In this case, if at least a part of a document with a minimum size conveyable by the document conveyance apparatus is captured in a region captured by the optical sensor 311 (in a region corresponding to the image capturing range L0 in the third embodiment), the optical sensor 311 can detect a conveyance failure for all document types.

In FIG. 28, the optical sensor 311 is arranged at a position at which the trailing edge of the document with the minimum size, which is located at the position indicated by the dotted line, that is, the document with the minimum size, which has entered the feed unit portion 313 due to the friction to the preceding document and is located at a position where the leading edge abuts against the conveyance path, is included in the image capturing range L0 of the optical sensor 311. As the document with the minimum size, a calling card size or the like can be used, although it depends on the apparatus. In this case, the optical sensor 311 is arranged at a position close to the pickup roller 404, and in some cases, may be provided in the feeding unit portion 313.

That is, when the optical sensor is provided at a position where a plurality of documents can simultaneously pass when continuously conveying a document bundle placed on the sheet stacker 401 to the document supply port provided on the upstream side of the conveyance path, that is, at the position where the trailing edge of a paper sheet indicated by the dotted line in FIG. 28 can be captured, trailing edge detection can be performed by capturing the trailing edge of the conveyed document. Note that in this embodiment, as the detection of the trailing edge of the document, a variation in the output, which is caused when the trailing edge of the preceding document forms a shadow to the next document, is used.

As a detailed arrangement of the optical sensor 311, the optical sensor 311 is arranged slightly on the upstream side of the distal end of the position where the sheets are stacked on the sheet stacker 401. That is, the position faces the sheet stacker 401 on the side of the distal end of the sheet stacker 401. In addition, when the optical sensor 311 is arranged to be lower than the height of the feeding unit portion 313 including the pickup roller 404 and the feed roller 406, an increase in the size of the apparatus main body can be suppressed.

According to the configuration of this embodiment, the document conveyance state can be detected by one optical sensor, and the conveyance state after the document is regulated is detected. For this reason, since the document conveyance state can be detected without executing additional processing, the processing time is not increased.

It is therefore possible to provide an apparatus that does not unnecessarily increase the processing time without making the apparatus bulky or expensive.

An example of the optical sensor 311 whose periphery is covered with a mold member and a light transmitting plate will be described here.

Figure 34:
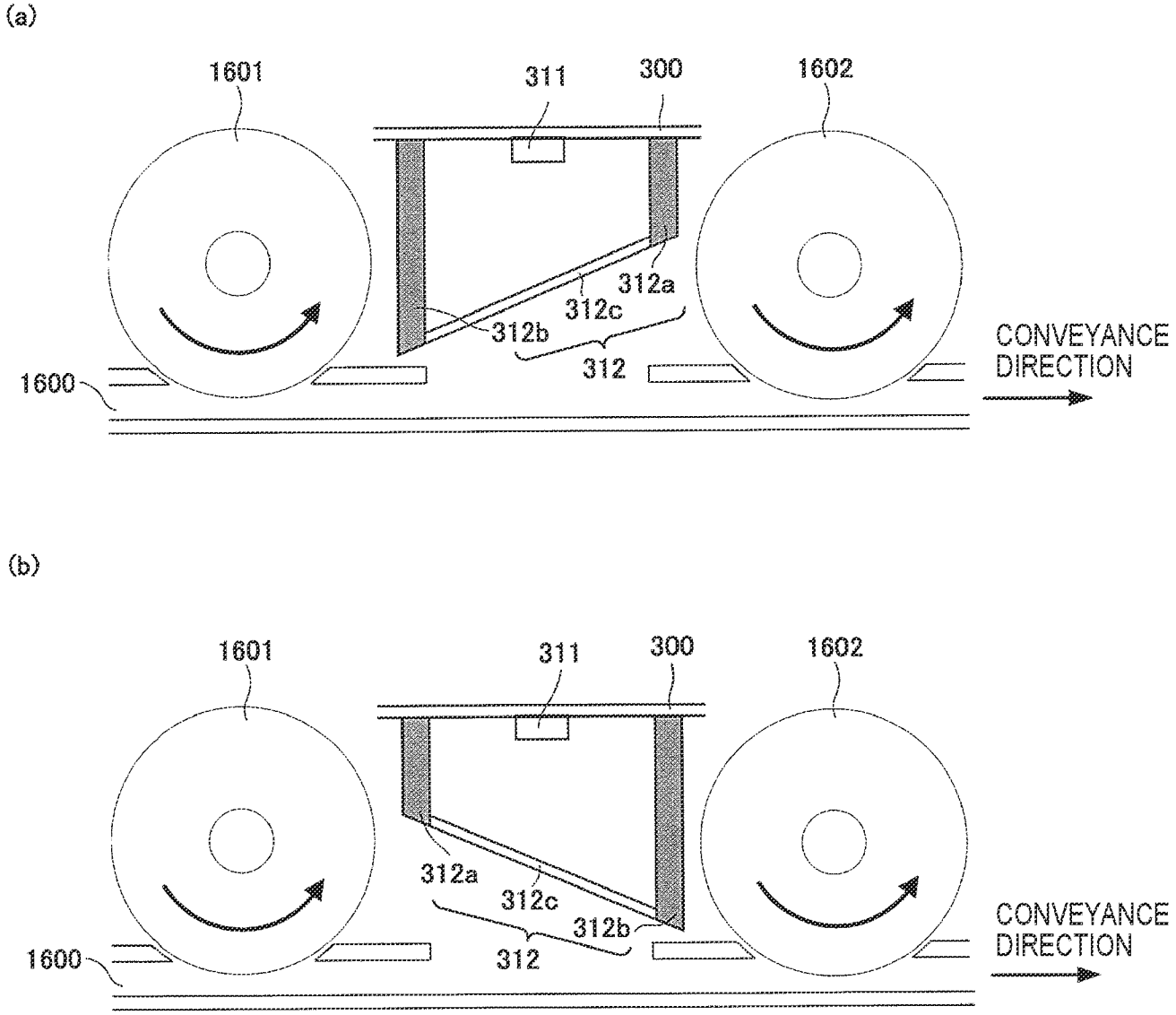
FIG. 34 shows sectional views showing an example of the arrangement of the optical sensor in the middle of a sheet conveyance path.

FIG. 34 shows sectional views showing an example of the configuration of the optical sensor 311 whose periphery is covered with a mold member and a light transmitting plate. In the example shown in FIG. 34, the optical sensor 311 is implemented on the board 300, and is formed by a sensor element including a light emitting element (laser source) configured to output, for example, an infrared laser beam and a light receiving element configured to receive the reflected light of the light output from the light emitting element. The light emitting element and the light receiving element are arranged at adjacent positions on the optical sensor 311. Mold members 312*a* and 312*b* and a light transmitting plate 312*c* shown in FIG. 34 form a part of the case body 312 that covers the periphery of the optical sensor 311. The mold members 312*a* and 312*b* form walls perpendicular to the board 300. The light transmitting plate 312*c* is connected to the ends of the mold members 312*a* and 312*b* on the opposite wide of the ends on the side of the board 300. In the arrangement shown in FIG. 34, the wall formed by the mold member 312*b* is longer than the wall formed by the mold member 312*a* such that the light transmitting plate 312*c* tilts with respect to the surface of the board 300 or the above-described image capturing reference surface.

The light transmitting plate 312*c* passes light output from the light emitting element of the optical sensor 311 and moving toward the document. The light passed through the light transmitting plate 312*c* and reflected by the document passes through the light transmitting plate 312*c* and is received by the light receiving element of the optical sensor 311. With the configuration of the optical sensor 311, it is possible to prevent paper powder from directly sticking to the optical sensor 311 and also prevent paper powder from being extracted erroneously as a feature point. Note that as for the wavelength of the light emitted by the optical sensor 311 (light emitting element), light in the near infrared region with a wavelength of about 850 nm is preferably used. As the light transmitting plate 312*c*, a filter capable of transmitting light in the band is preferably used. In addition, a material having a reflectance r2 (r1>r2) lower than a reflectance r1 of the light transmitting plate 312*c* may be employed for the mold members 312*a* and 312*b* in preparation of the case that reflected light is generated by the light transmitting plate 312*c*. This can effectively reduce extra reflected light reflected by the inner walls of the mold members 312*a* and 312*b* and moving toward the optical sensor 311. This is a measure against a detection error of the moving amount of a sheet (document) caused by reflected light that enters the optical sensor 311, as described above.

The optical sensor 311 (FIG. 34) whose periphery is covered with the case body 312 may be arranged not at a position facing the sheet stacker 401, as shown in FIGS. 21 to 23, but in the middle of the conveyance path. FIG. 34(*a*) shows an example of the arrangement of the optical sensor 311 in the middle of a conveyance path 1600. The optical sensor 311 is arranged at a position between a conveyance roller 1601 and a conveyance roller 1602 in the middle of the conveyance path 1600. For example, the conveyance rollers 1601 and 1602 can be the feed roller 406 and the registration roller 417, respectively.

In FIG. 34(*a*), of the walls (mold members) 312*a* and 312*b* that form the case body 312, the long wall 312*b* is arranged on the upstream side in the conveyance direction of a sheet, and the short wall 312*a* is arranged on the downstream side in the conveyance direction of a sheet. This arrangement is effective because the influence of external light that moves from the outside of the case body 312 to the inside is suppressed. Note that as shown in FIG. 34(*b*), the short wall 312*a* may be arranged on the upstream side in the conveyance direction of a sheet, and the long wall 312*b* may be arranged on the downstream side in the conveyance direction of a sheet. Since, for example, the rotation speed of the conveyance roller 1602 arranged on the downstream side is higher than that of the conveyance roller 1601, this arrangement is effective because the influence of paper powder is suppressed in a case in which paper powder is readily scattered by the conveyance roller 1602.

In the third to sixth embodiments, a description has been made above by showing various examples. However, the gist and scope of the present invention are not limited to a specific description in this specification, and these can also be combined. In addition, the following aspects are also incorporated, as a matter of course. The aspects will be described below.

[First Aspect]

A document conveyance apparatus characterized by comprising:

a document placement table on which a document is placed;

an image capturing element configured to receive light reflected by the document and perform photoelectric conversion;

a moving amount detection unit configured to detect a moving amount of the document based on an image of the document acquired by the image capturing element; and a document conveyance unit configured to convey the document along a conveyance path, wherein the image capturing element is arranged at a position apart from an image capturing reference surface by the image capturing element by a predetermined distance such that an image capturing region for the document in a conveyance direction becomes larger than a product of a moving amount acquisition interval time of the moving amount detection unit and a conveyance speed of the document conveyance unit.

[Second Aspect]

The document conveyance apparatus according to the first aspect, characterized in that the document is conveyed by the document conveyance unit such that a degree of overlap between images captured at the moving amount acquisition interval time in the image capturing element becomes not less than a first threshold.

[Third Aspect]

The document conveyance apparatus according to the first or second aspect, characterized in that the first threshold is 60%.

[Fourth Aspect]

The document conveyance apparatus according to any one of the first to third aspects, characterized in that the image capturing element is arranged such that the document placed on the document placement table and an imaging surface of the image capturing element become parallel.

[Fifth Aspect]

The document conveyance apparatus according to any one of the first to fourth aspects, characterized by comprising a document separation unit configured to convey a plurality of documents to be conveyed one by one, wherein the image capturing element is arranged on an upstream side of the document separation unit in the conveyance direction.

[Sixth Aspect]

The document conveyance apparatus according to any one of the first to fifth aspects, characterized in that the image capturing element comprises a light source unit formed by one of a laser and an LED, receives light that is emitted by the light source unit and reflected by a document surface, and performs photoelectric conversion.

[Seventh Aspect]

The document conveyance apparatus according to the fifth or sixth aspect, characterized in that the image capturing element is arranged at a position lower than a height of both the document separation unit and a document pickup unit configured to convey the document stacked on the document placement table to document feeding, where when a plurality of documents are stacked on the document placement table and continuously conveyed, the plurality of documents can simultaneously pass through the image capturing region of the image capturing element.

Conventionally, for the purpose of detecting whether a document is normally being conveyed in a document conveyance apparatus configured to convey a paper sheet by a predetermined amount, to know the conveyance direction of the document, using an encoder configured to detect the moving amount of the document in the conveyance direction and an optical sensor configured to measure a displacement amount in a specific detection direction (first detection direction) that is not orthogonal to the conveyance direction, the displacement amount in the conveyance direction is obtained from the optical sensor, and a skew amount is obtained from the displacement amounts in the first detection direction and a second detection direction, and the displacement amount in the conveyance direction is obtained using the skew amount and the displacement amount from the encoder (related art 1: Japanese Patent Laid-Open No. 2013-209196).

Alternatively, using a laser light source, a conveyance speed is calculated from an image obtained by the laser light source in a system that almost perpendicularly irradiates the laser light source. After the conveyance speed is calculated, a filter in a predetermined band is provided, and components other that the conveyance direction are removed by filter processing, thereby accurately calculating the conveyance speed (related art 2: Japanese Patent Laid-Open No. 2014-119432).

For related art 1, however, since the encoder is provided in addition to the optical sensor to know the displacement amount of the conveyed document, a space to arrange each device is needed, resulting in a bulky apparatus. At the same time, since devices are added, the cost increases.

For related art 2, of a speed component in the conveyance direction and a component perpendicular to the conveyance direction, only the speed component in the conveyance direction is extracted from the image obtained by the laser light source. Since a filter is set after image analysis and applied to the image to decompose the speed component, there is a fear of an increase in the processing time.

On the other hand, in the third to sixth embodiments of the present invention, with the configurations described above, it is possible to suppress an increase in the size of the apparatus, cost, and processing time, and accurately detect the conveyance state of a document.

In the seventh to ninth embodiments, a new mechanism configured to detect a sheet moving state when separating and feeding a sheet at the lowermost position on the sheet placement table side will be described below.

Seventh Embodiment

The seventh embodiment will be described first with reference to FIGS. 35 to 43.

Figure 35:
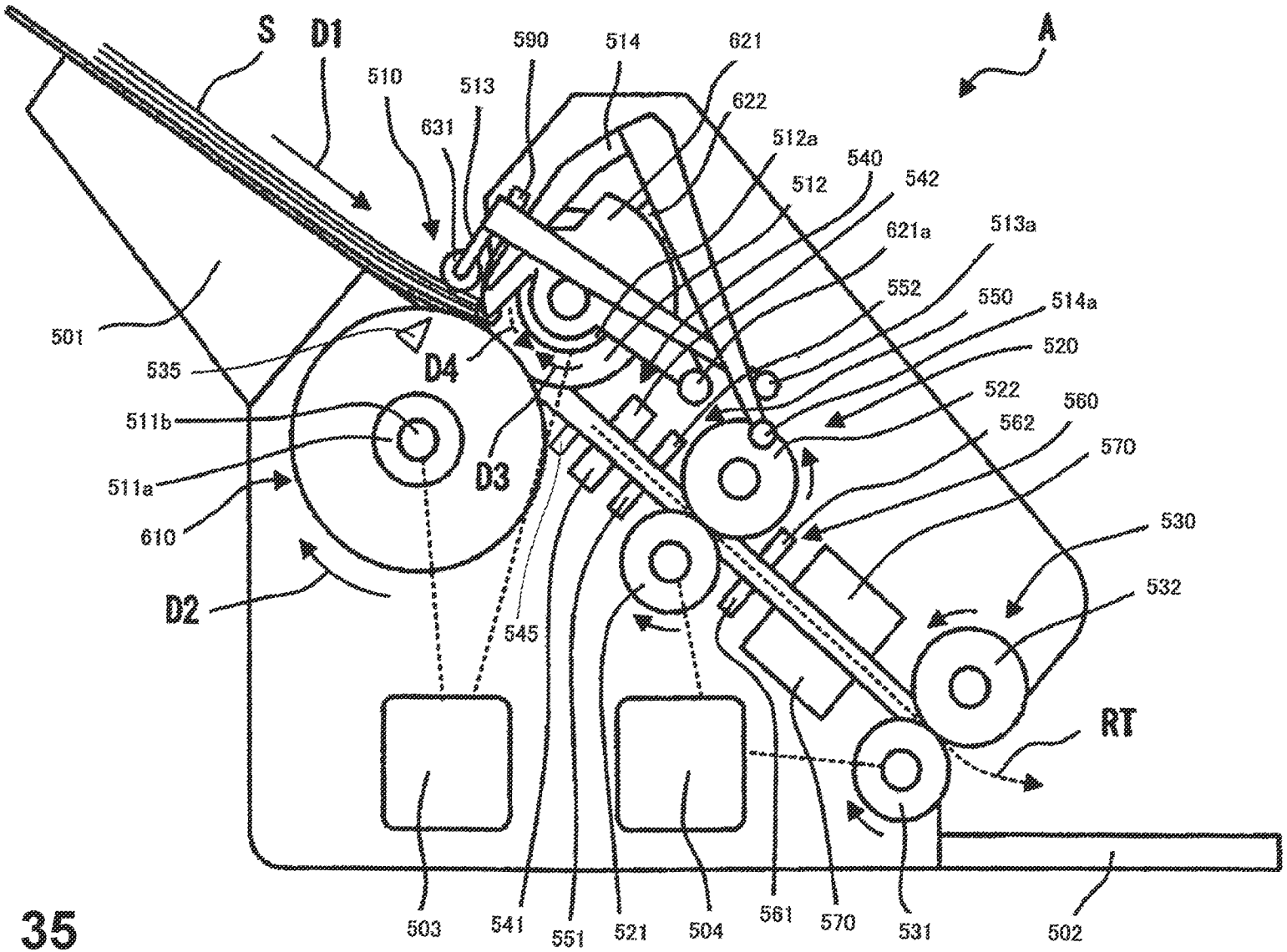
FIG. 35 is a schematic sectional view of a sheet feeder according to the seventh embodiment (conveyance state)

FIG. 35 is a schematic view of a sheet feeder A according to an embodiment of the present invention.

<Configuration of Apparatus>

The sheet feeder A can be applied to an apparatus including a document conveyance system, such as an image reading apparatus (scanner) configured to read an image of a document, a printing apparatus (printer or the like) for printing on a document, and a multi-function peripheral that combines these. In this embodiment, an example in which the sheet feeder A is applied to an image reading apparatus will be described.

The sheet feeder A according to this embodiment is a device that conveys one or a plurality of documents S stacked on a placement table 501 (a part of a placement portion) provided at the upper end portion on the rear side of a device main body A1 one by one into the device via a path RT tilting with respect to a horizontal surface (the installation surface of the device main body A1), reads an image, and discharges the document to a discharge tray 502 provided at the lower end portion on the front side of the device main body A1. The document S to be read is, for example, a sheet such as OA paper, a cheque, a calling card, or a card, and may be a thick sheet or a thin sheet. Cards can include, for example, a health insurance card, a license, and a credit card. In this embodiment, the placement table 501 is detachably provided on the device main body A1. However, the placement table 501 may be provided integrally with the device main body A1. Since this eliminates a step difference formed by the joint between the device main body A1 and the placement table 501, the document on the placement table can smoothly be moved, and the document feeding quality can be improved.

<Feeding Unit>

As shown in FIG. 35, a first conveyance unit 510 serving as a feeding mechanism configured to feed the document S along the path RT of the device main body A1 is provided. In this embodiment, the first conveyance unit 510 includes a feed roller 610, and a separation roller 512 arranged to face the feed roller 610, and sequentially conveys the document S arranged on the stacking surface side on the placement table 501 one by one in a feeding direction D1.

Figure 36:
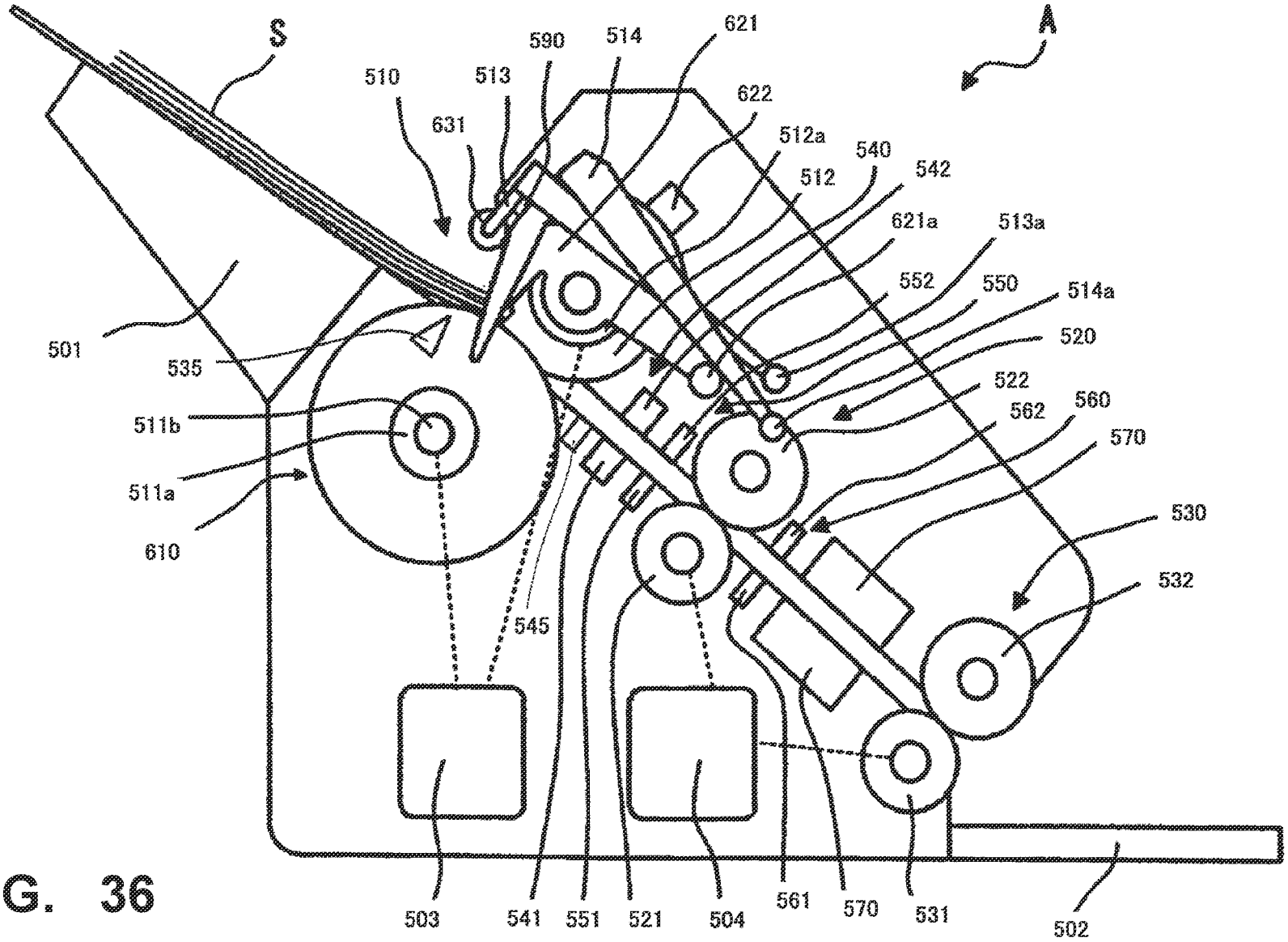
FIG. 36 is a schematic sectional view of the sheet feeder according to the seventh embodiment (standby state)
Figure 37:
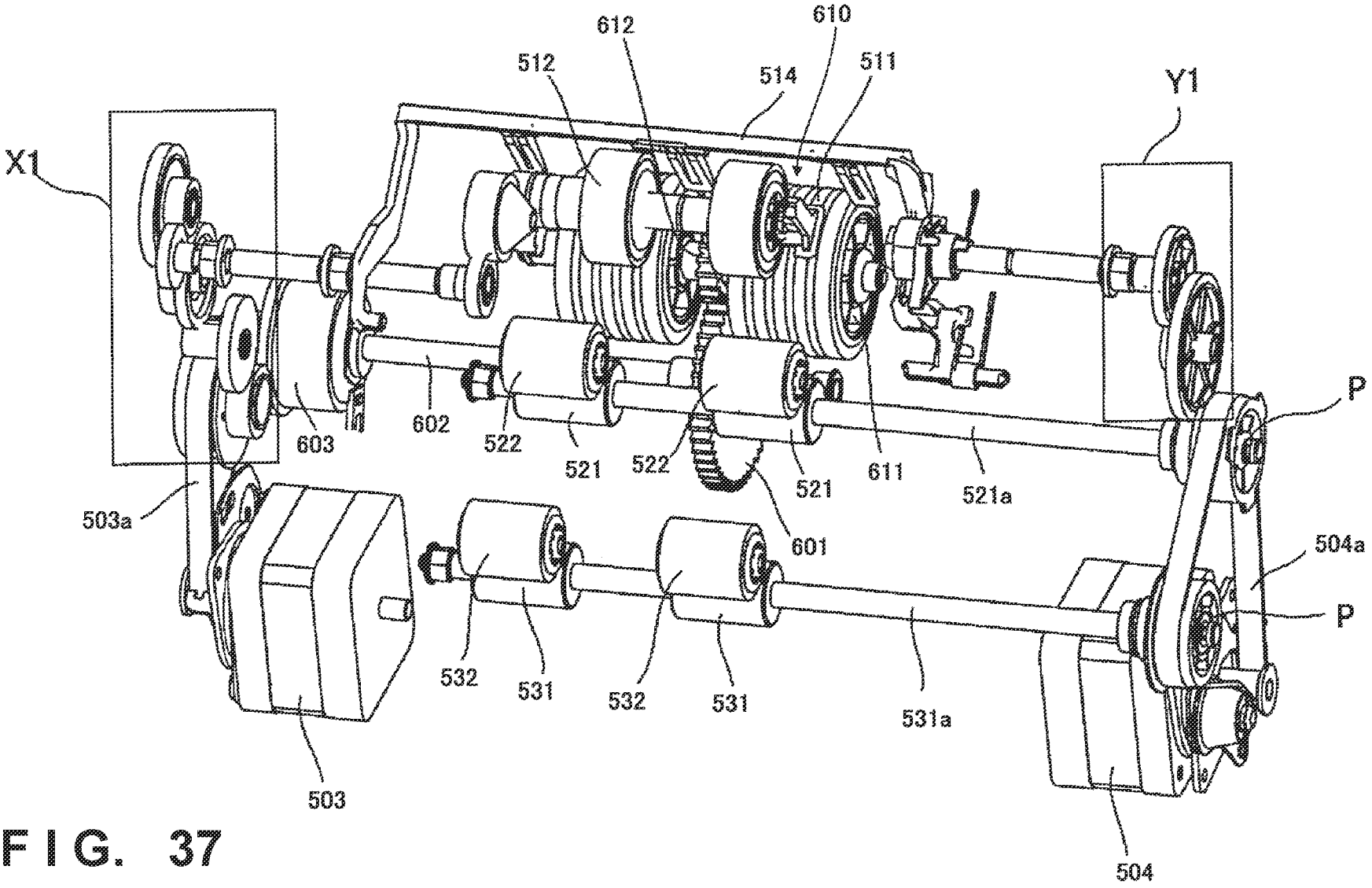
FIG. 37 is a structural drawing of drive transmission of the sheet feeder according to the seventh embodiment.
Figure 38:
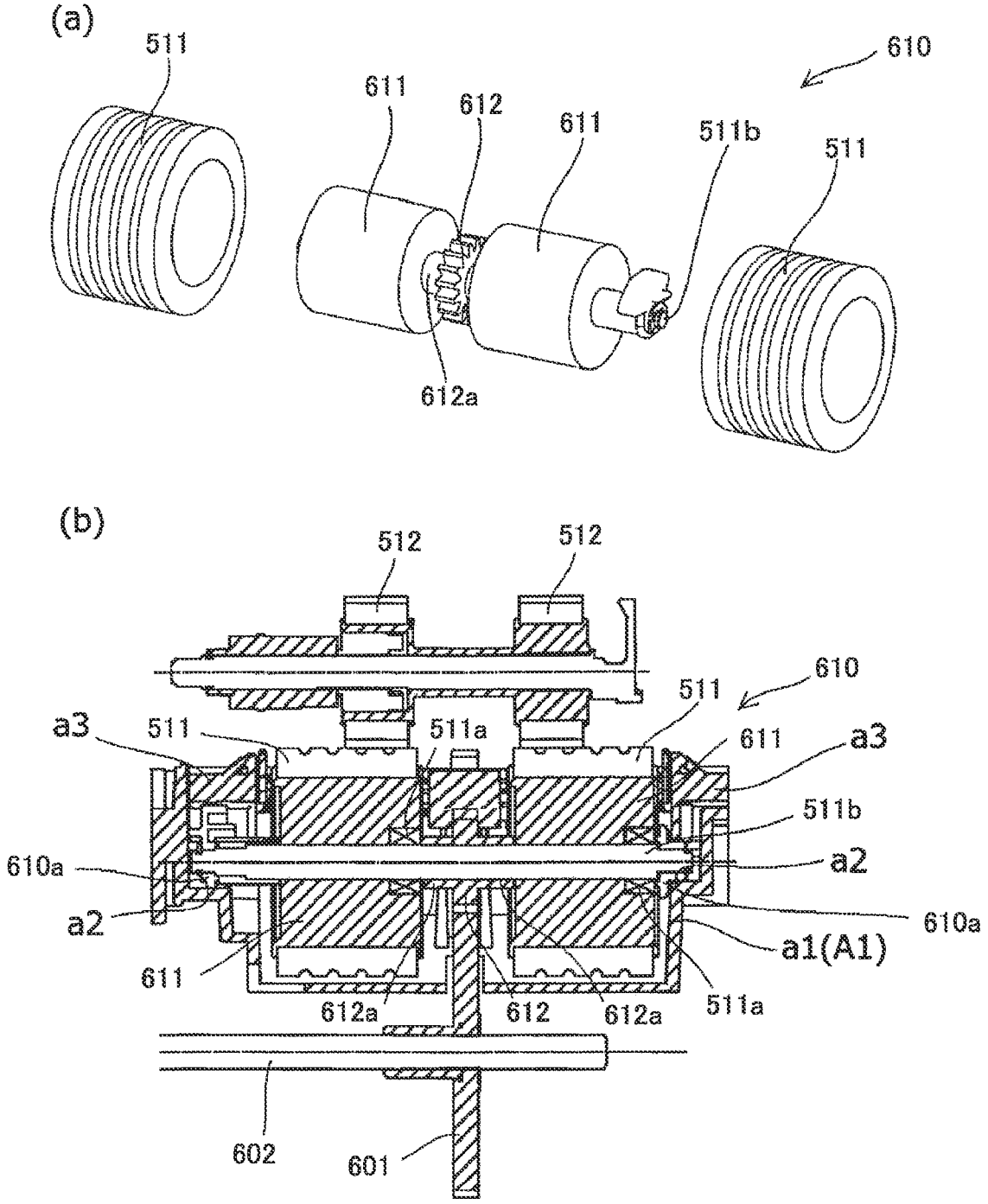
FIG. 38 shows enlarged views of the main part of the feeding unit of the sheet feeder according to the seventh embodiment.
Figure 39:
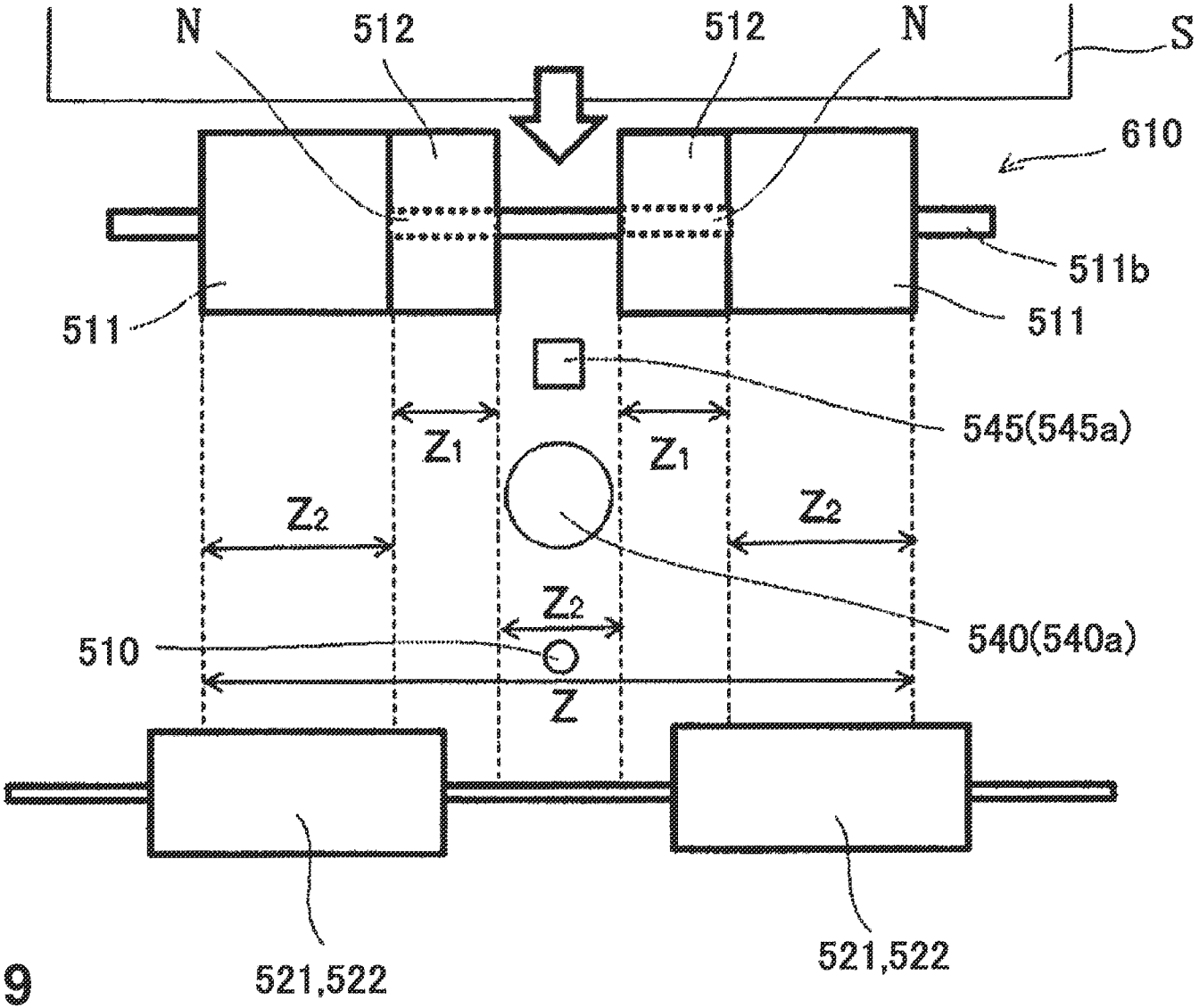
FIG. 39 is a schematic view of the feeding/conveyance unit of the sheet feeder according to the seventh embodiment.
Figure 40:
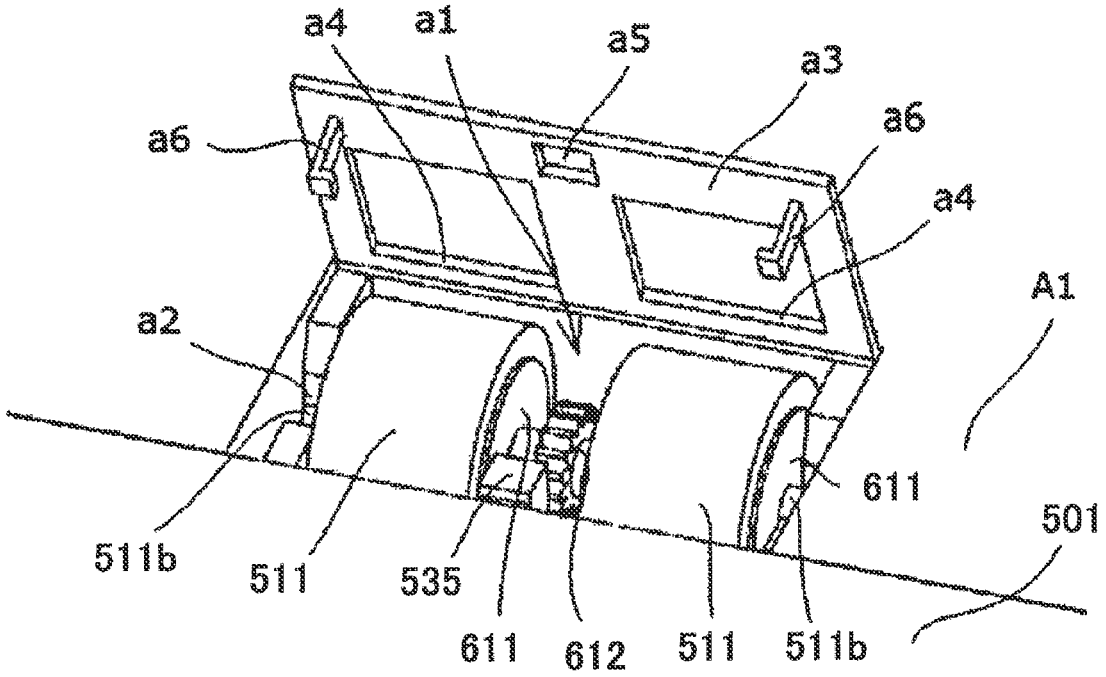
FIG. 40 shows enlarged views of the main part of the feeding unit of the sheet feeder according to the seventh embodiment.
Figure 40:
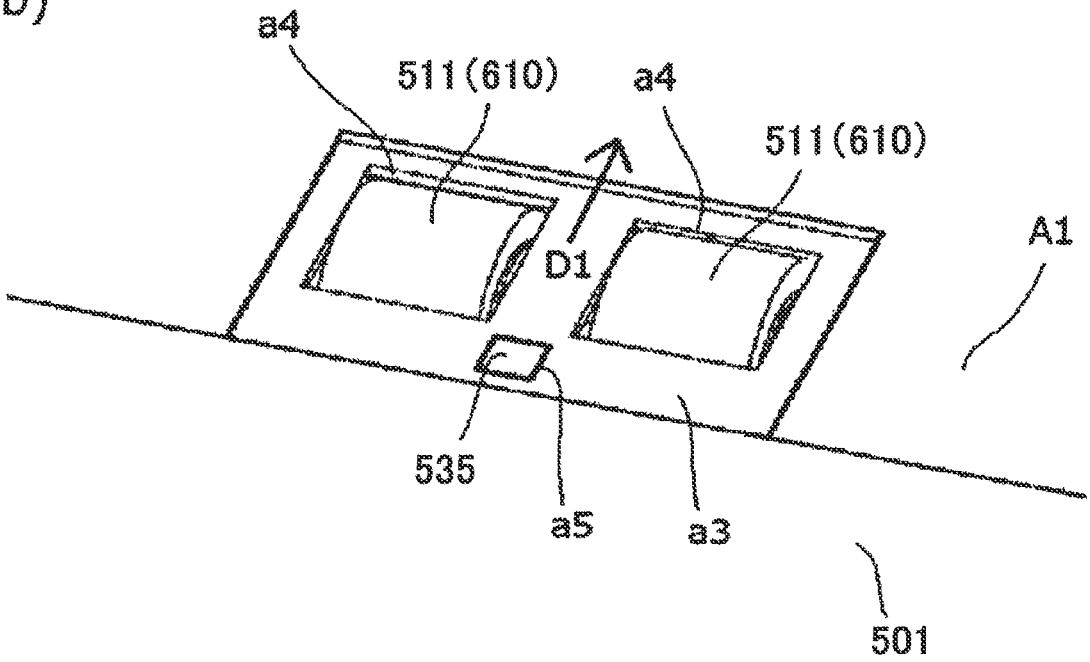

Note that FIG. 35 shows a conveyance state, and FIG. 36 shows a standby state. FIG. 37 shows the drive transmission structure of the entire device, FIG. 38 shows enlarged views of the main part of the feeding unit, FIG. 39 shows an enlarged view of the main part of the feeding/conveyance unit, and FIG. 40 shows enlarged perspective views of the main part of the feeding unit. In this embodiment, the feeding direction D1 is provided while tilting at a predetermined angle with respect to the placement surface of the sheet feeder A, and the document S placed on the placement table 501 is supplied to the feeding mechanism by the weight of the document itself.

In this embodiment, the upper end portion of the device main body A1 is provided as a placement portion on which the leading edge side of the document S or a document bundle placed on the placement table 501 is placed. That is, the document S or the document bundle is placed not only the placement table 501 but also on the placement portion provided at the upper end portion of the device main body A1. A roller attachment portion a1 that is a concave portion configured to attach the feed roller 610 to abut against the document S at the lowermost position on the placement portion side is provided at the upper end portion of the device main body A1. Note that in this embodiment, as shown in FIGS. 38 and 40, a cover member a3 that covers the periphery of the feed roller 610 attached in the roller attachment portion a1 is provided at an end of the roller attachment portion a1 to be opened/closed. The cover member a3 is provided with through holes a4 that individually surround feed roller portions 511. In a state in which the cover member a3 is opened, the feed roller 610 is detachable from the roller attachment portion a1. That is, in this embodiment, a part of the cover member a3 forms the placement portion. That is, the placement portion on which a document is placed is formed including a portion on the upstream side of a portion on which the separation roller 512 of the feed roller 610 is pressed against the upper surface of the cover member a3.

In the feed roller 610, as shown in FIGS. 38 and 40, the two feed roller portions 511 (a first roller portion and a second roller portion) 511 made of, for example, a rubber material are individually attached to wheel portions 611. The wheel portions 611 are individually supported by a feed roller shaft (rotating shaft) 511*b* via one-way clutches 511*a*. That is, the one-way clutches 511*a* according to this embodiment include a first one-way clutch portion and a second one-way clutch portion that are independent and are individually provided for the plurality of feed roller portions 511 separately provided on the left and right sides.

<Movement Detection Unit>

In this embodiment, two movement detection sensors (movement detection units) configured to detect the movement of a document are provided at two points of the device main body A1. A first movement detection sensor 535 that is one of the movement detection sensors is provided at the upper end portion of the device main body A1 on the side of the placement table 501 with respect to a nip portion N between the feed roller 610 and the separation roller 512, as shown in FIG. 40. A second movement detection sensor 545 that is the other movement detection sensor is provided in the conveyance path, as shown in FIG. 39 described above. That is, in this embodiment, the first movement detection sensor 535 detects the movement of a document before separation as a detection target, and the second movement detection sensor 545 detects the movement of a document immediately after separation as a detection target.

Here, in this embodiment, the first movement detection sensor 535 installed in front (upstream side) of the separation/feeding unit is a sensor completed in one package. The first movement detection sensor 535 is a tracking type optical sensor (tracking sensor) that irradiates a document with light from a light source in one detection region, acquires, at a predetermined sampling period, an image (sheet image) obtained by receiving reflected light from the document by the image capturing portion, tracks the movement of the tracking target region included in the image, and detects the moving amount or the moving direction of the document based on the result.

For example, in this embodiment, the first movement detection sensor 535 is a sensor that is located before separation and, more particularly, on the upstream side of a document detection sensor 590 and installed to detect the movement of the document at the lowermost position on the side of the document placement table 501, tracks a change in a document image obtained by capturing the document at the lowermost position, which moves after the start of separation/feeding, and detects the change in the document image as the movement of the document halfway through separation. The first movement detection sensor 535 detects the movement of the document after the start of feeding by the feed roller 610. If an abnormality determination unit (a CPU 81 shown in FIG. 41 to be described later) configured to determine, based on the detection result of the first movement detection sensor 535, whether abnormal feeding has occurred determines abnormal feeding, a driving control unit (a control unit 80 to be described later) configured to control driving of the feeding unit temporarily stops driving of the feed roller 610. Since this can detect abnormal feeding and quickly perform stop control of the feeding operation, document damage can effectively be reduced.

Here, the first movement detection sensor 535 according to this embodiment is provided in the roller attachment portion a1 of the device main body A1 and covered with the cover member a3 together with the feed roller 610. As shown in FIG. 40, the cover member a3 is provided with a window portion a5 extending through in the thickness direction. The window portion a5 faces the first movement detection sensor 535 when the cover member a3 is in a closed state with respect to the roller attachment portion a1.

For this reason, the first movement detection sensor 535 can detect the movement of the document on the upper surface side of the cover member a3 through the window portion a5 of the cover member a3. When the first movement detection sensor 535 is thus arranged on the opening peripheral edge portion of the roller attachment portion a1, the first movement detection sensor 535 can be installed near the nip portion N that separates the document. Hence, the movement of the document that sequentially moves to the nip portion N can be detected by the first movement detection sensor 535.

For example, if a document is fed while skewing, whether the moving direction of a characteristic image region (to be referred to as a tracking target region hereinafter) extracted from the document image is different from a reference direction can be identified as the detection result of the first movement detection sensor 535. If the moving direction is different from the reference direction, it can be judged that an abnormal separation pattern (skewing abnormality) when the document has a skew has occurred.

The "reference direction" used to judge abnormal separation is a direction defined based on the feeding direction in the device main body A1. For example, the first movement detection sensor 535 may be incorporated in the device main body A1 such that a normal feeding direction when feeding a document straight without a skew matches the sensor reference direction in the first movement detection sensor 535.

Additionally, for example, if the moving direction of the tracking target region of the document is different from the reference direction, and the moving speed is higher than a threshold, if a rotation component is included, or if neither the above-described skewing abnormality nor non-feed abnormality to be described later has occurred, it can be judged or estimated that an abnormal separation pattern (abnormal stapling) when documents bound by stapling or the like are separated has occurred.

Furthermore, if the feed roller 610 cannot reliably come into contact with a document and idles, the feeding force is not properly transmitted to the document. If the moving speed of the tracking target region decrease during movement, the moving amount is smaller than a threshold, or the document does not move at all, it can be judged that an abnormal separation pattern (non-feed abnormality) in a case of non-feed of a document has occurred.

Note that of the three abnormal separation patterns, for example, the skewing and abnormal stapling patterns may be handled as one abnormal separation pattern. That is, if the moving direction of the tracking target region is oblique with respect to the reference direction, it may immediately be judged that abnormal separation (abnormal feeding) has occurred without discriminating between skewing abnormality and abnormal stapling. Since this can shorten the time needed to discriminate abnormal separation and reduce the processing load and can also quicken error processing after that, damage to the document in abnormal separation can effectively be reduced.

In addition, the present invention is not limited to abnormality detection of the above-described patterns. For example, if it is judged that the moving direction of the tracking target region of a document is not the reference direction, and the moving speed (or moving amount) does not satisfy a predetermined condition, all the skewing abnormality, abnormal stapling, and non-feed abnormality may be handled as one abnormal pattern (abnormal feeding) without discriminating these. In this case, since it is possible to reduce the time and the processing load necessary for the abnormality detection and also quicken error processing after that, document damage in abnormal separation can more effectively be reduced.

<Description of Block Diagram>

Figure 41:
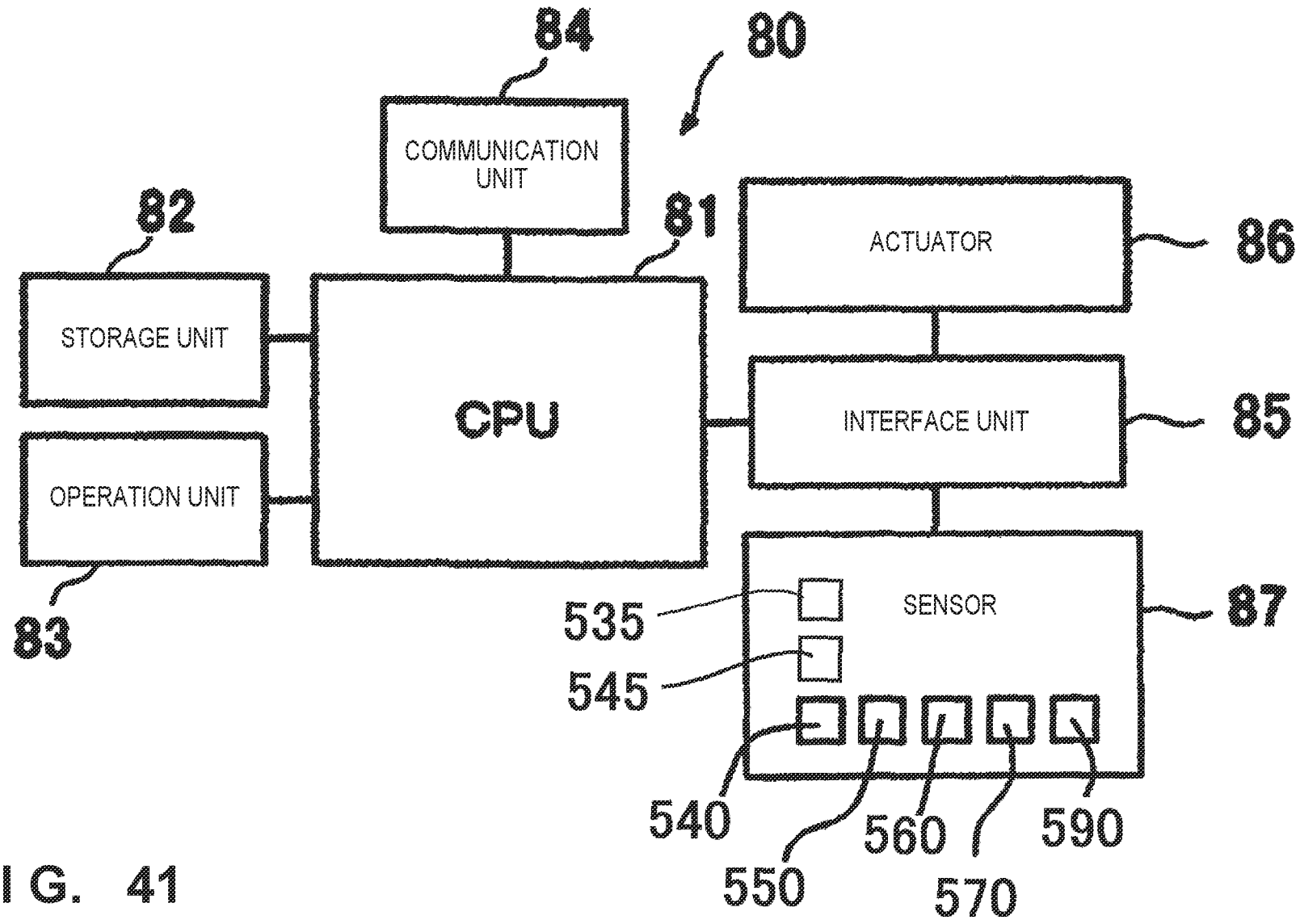
FIG. 41 is a block diagram of a control unit according to the seventh embodiment.

The control unit 80 will be described with reference to FIG. 41. FIG. 41 is a block diagram of the control unit 80 of the sheet feeder A.

The control unit 80 includes the CPU 81, a storage unit 82, an operation unit 83, a communication unit 84, and an interface unit 85. The CPU 81 executes programs stored in the storage unit 82, thereby controlling the entire sheet feeder A. The storage unit 82 is formed by, for example, a RAM, a ROM, and the like. The operation unit 83 is formed by, for example, a switch, a touch panel, and the like, and accepts an operation from an operator. The CPU 81 also functions as an abnormality determination unit configured to accept the detection result of the first movement detection sensor 535 and determine, based on the detection result, whether abnormal feeding has occurred, and also functions as a driving control unit configured to control driving of an actuator 86 and stop driving of the feed roller 610.

The communication unit 84 is an interface configured to perform information communication with an external apparatus. If a PC (Personal Computer) is assumed as the external apparatus, as the communication unit 84, for example, a USB interface or a SCSI interface can be used. In addition to the interface of wired communication, the communication unit 84 may be an interface of wireless communication, and may include both the interfaces of wired communication and wireless communication.

The interface unit 85 is an I/O interface configured to perform data input/output to the actuator 86 or a sensor 87. The actuator 86 includes a motor 3, a motor 4, and the like. The sensor 87 includes the first movement detection sensor 535, a multiple feed detection sensor 540, the second movement detection sensor 545, medium detection sensors 550 and 560, an image reading unit 570, the document detection sensor 590, and the like.

<Driving by Receiving Start Instruction from PC>

The basic operation of the sheet feeder A will be described. Upon receiving an image reading start instruction from, for example, an external personal computer connected to the sheet feeder A, the control unit 80 starts driving the first conveyance unit 510 to a third conveyance unit 530. The documents S stacked on the placement table 501 are conveyed one by one from the document S located at the lowermost position. The image reading start instruction may be executed by pressing a start button provided on the sheet feeder A <Start of Reading according to Output of Registration Sensor>

The control unit 80 starts reading, by the image reading unit 570, an image of the document S conveyed by the second conveyance unit 520 at a timing based on the detection result of the medium detection sensor 560, temporarily stores the read image, and sequentially transmits it to the external personal computer. The document S that has undergone image reading is discharged by a third conveyance unit 530 to the discharge tray 502, and the image reading processing of the document S is ended.

Figure 42:
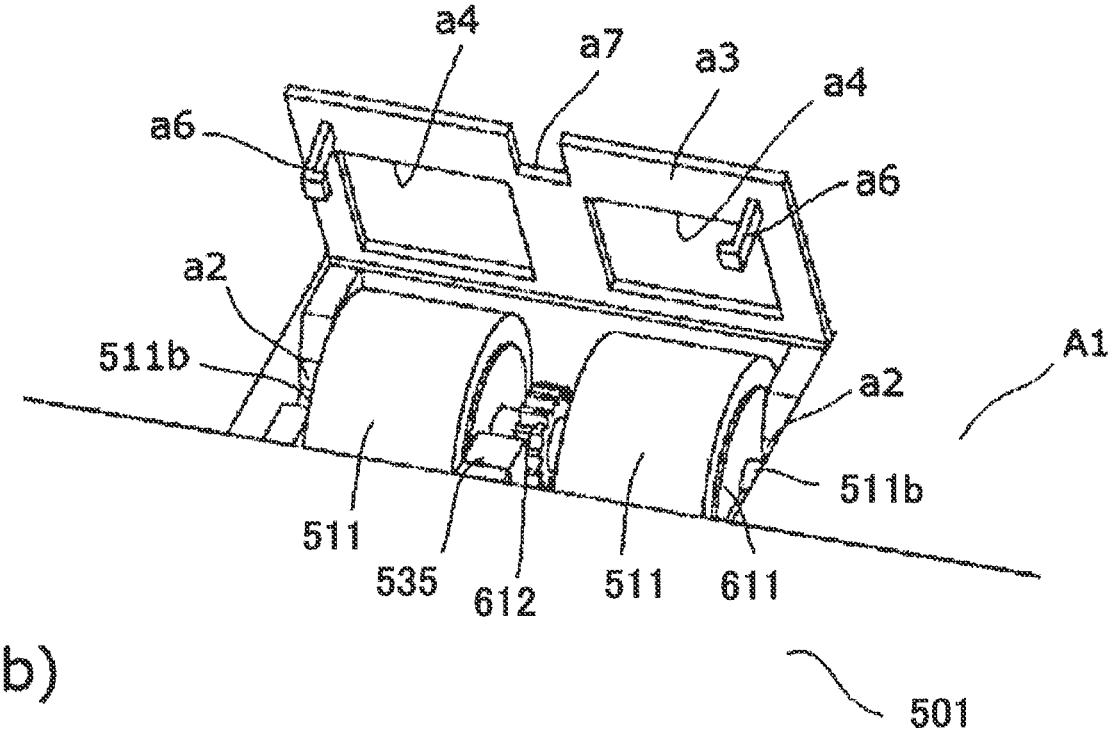
FIG. 42 shows enlarged views of the main part of the feeding unit of the sheet feeder.
Figure 42:
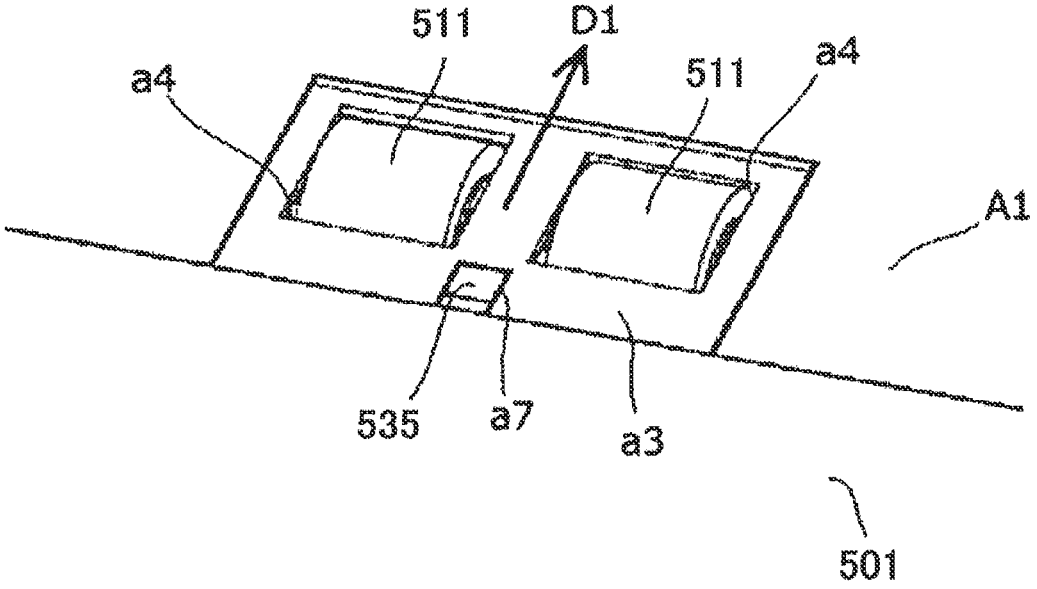

Note that in the above-described seventh embodiment, a case in which the first movement detection sensor 535 is stored in the cover member a3, as shown in FIG. 40, has been described. However, the present invention is not limited to this, as a matter of course. As shown in FIG. 42, the movement detection sensor 535 may be provided on the placement portion of the device main body A1, and the cover member a3 may be provided to surround while avoiding the installation place of the movement detection sensor 535. In this case, since the window portion need not be provided in the cover member a3, the structure can be simplified. Note that in FIGS. 40 and 42, a retreat portion configured to avoid interference with the movement of the distal end of the document detection sensor 590 is omitted.

In addition, in the above-described embodiment, a case in which the transmission of the feeding force is done by the feed roller 610 has been described. However, the present invention is not limited to this, as a matter of course. For example, as shown in FIG. 43, the feeding unit configured to feed a document on the placement table side may be formed by the feed rollers 610 pressed against the separation portion, and pick rollers 610A provided on the placement table side with respect to the feed rollers 610.

Figure 43:
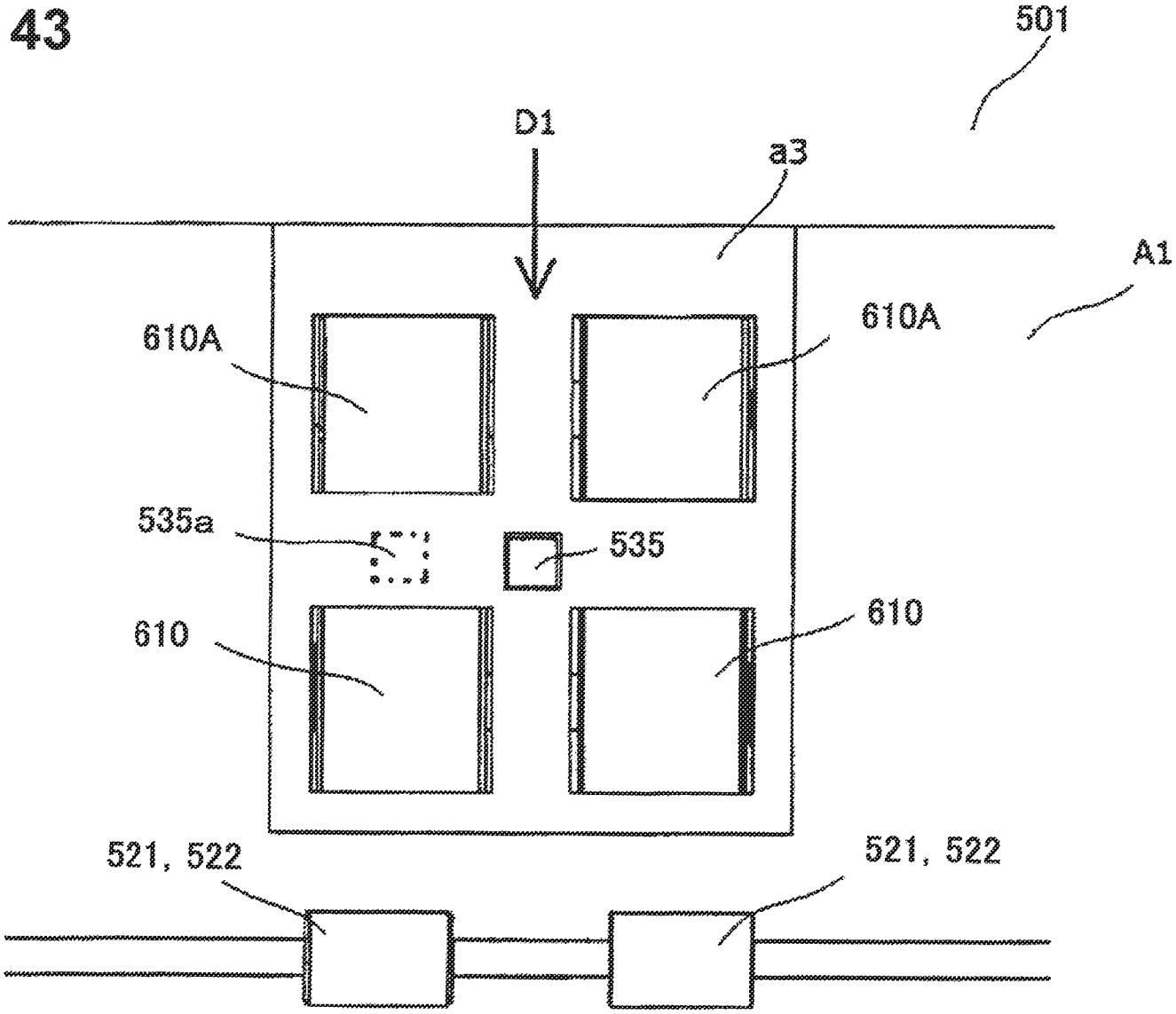
FIG. 43 is an enlarged view of the main part of the feeding unit of the sheet feeder.

In the configuration shown in FIG. 43, entry of a document to the nip portion formed by separation rollers (not shown) pressed against the feed rollers 610 can be assisted by the pick rollers 610A installed on the side of the placement table 501 with respect to the feed rollers 610. Even in this configuration, when the movement detection sensor 535 is arranged between the feed rollers 610 and the pick rollers 610A, non-feed of a document or abnormal feeding between the feed rollers 610 and the pick rollers 610A can be detected.

Note that as the sensor installation place of the movement detection sensor 535, the sensor may be provided at the center corresponding to a portion between the rollers, that is, the feed rollers 610 and the pick rollers 610A, or may be provided in a portion 535*a* indicated by a dotted line in FIG. 43, that is, in the gap between the roller portion of the pick roller 610A and the roller portion of the feed roller 610 in the feeding direction D1. In any sensor installation place, since the posture of the document is stable because of the roller, stable document movement detection can be performed by the movement detection sensor 535.

Additionally, in the configuration shown in FIG. 43, a structure that covers the feed rollers 610 and the pick rollers 610A by the cover member a3 formed by one plate member is employed. At this time, the window portion is provided in the cover member a3 to face the movement detection sensor 535. Even in a state in which the cover member a3 is closed, the movement of a document on the cover member a3 can be detected by the movement detection sensor 535 through the window portion.

Eighth Embodiment

In the seventh embodiment, a structure in which the second movement detection sensor 545 is provided on the upstream side of the multiple feed detection sensor 540 in the feeding direction, and the second movement detection sensor 545 and the multiple feed detection sensor 540 are arranged in one line has been described. The eighth embodiment is an example in which a second movement detection sensor 545 is provided in another region, as shown in FIGS. 44(*a*) and 44(*b*).

Figure 44:
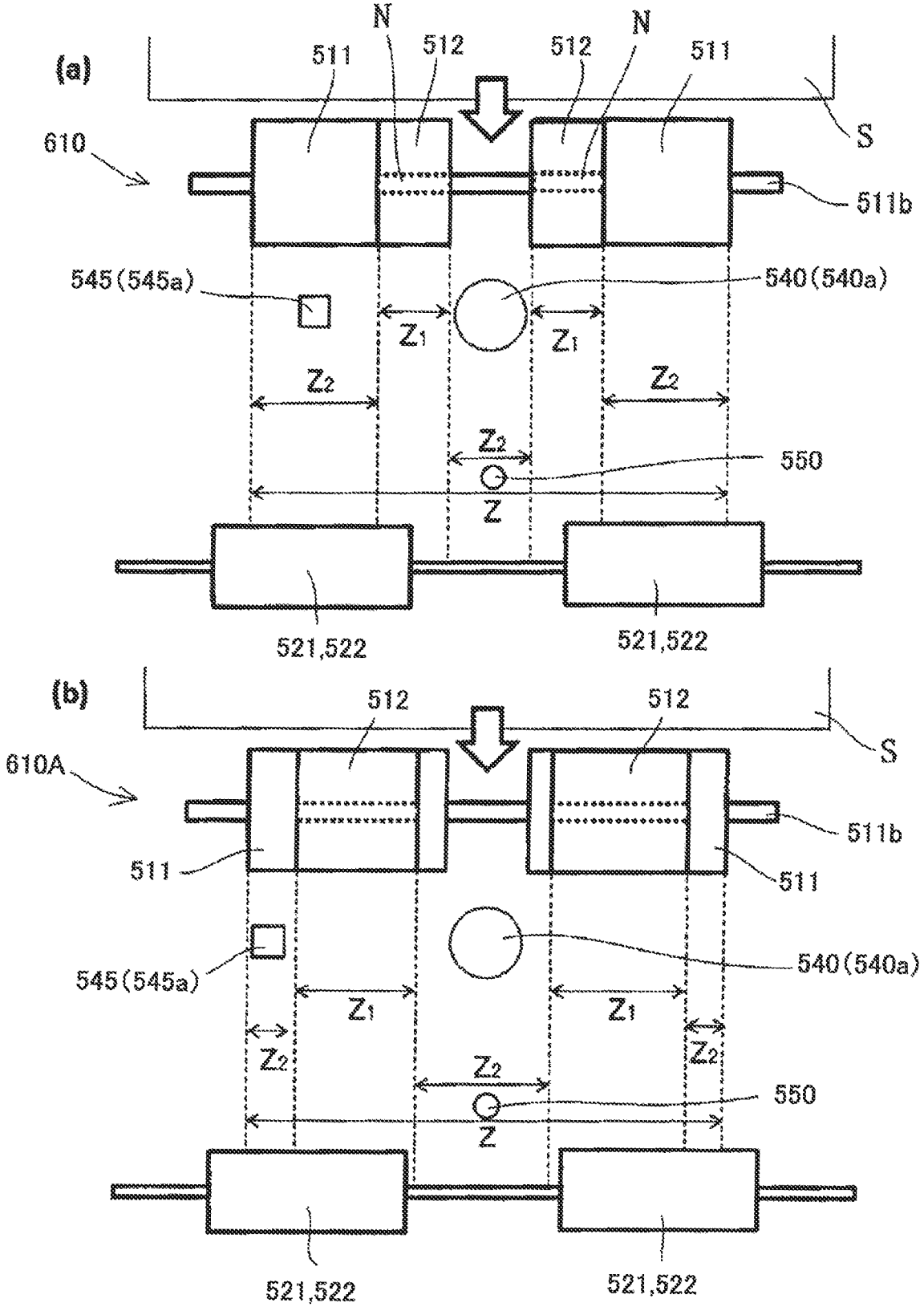
FIG. 44 shows schematic views of a feeding/conveyance unit according to the eighth embodiment.

For example, as shown in FIG. 44(*a*), on both sides in the axial direction of a feed roller shaft 511*b* of feed rollers 610, the second movement detection sensor 545 may be provided on one side of downstream regions $Z_2$ on the downstream side in the feeding direction from portions where feed roller portions 511 and separation rollers 512 are not pressed against each other, that is, portions other than nip portions N. This makes it possible to arrange a multiple feed detection sensor 540 close to the side of the nip portions N and detect multiple feed at an early stage. In this case, the second movement detection sensor 545 may be provided not only on one side of the downstream region $Z_2$ but also on the other side, that is, on both sides of downstream regions $Z_1$, and the movement of a document may be tracked and detected on the left and right sides.

Additionally, as shown in FIG. 44(*b*), when the separation/feeding unit is formed such that the nip portion N between the feed roller portion 511 and the separation roller 512 of a feed roller 610A is arranged at the center of the feed roller portion 511, and the feed roller portion 511 and the separation roller 512 are not pressed against each other on both sides of the nip portion, the space to arrange the multiple feed detection sensor 540 can be provided wide in the gap between the feed roller portions 511. In this case, as shown in FIG. 44(*b*), the second movement detection sensor 545 may be provided as in FIG. 44(*a*) on one side in the axial direction of the feed roller shaft 511*b* of the feed roller 610A. In this case as well, the second movement detection sensor 545 may be provided not only on one side of the downstream region $Z_2$ but also on the other side, that is, on both sides of the downstream regions $Z_1$, and the movement of a document may be tracked and detected on the left and right sides.

Figure 45:
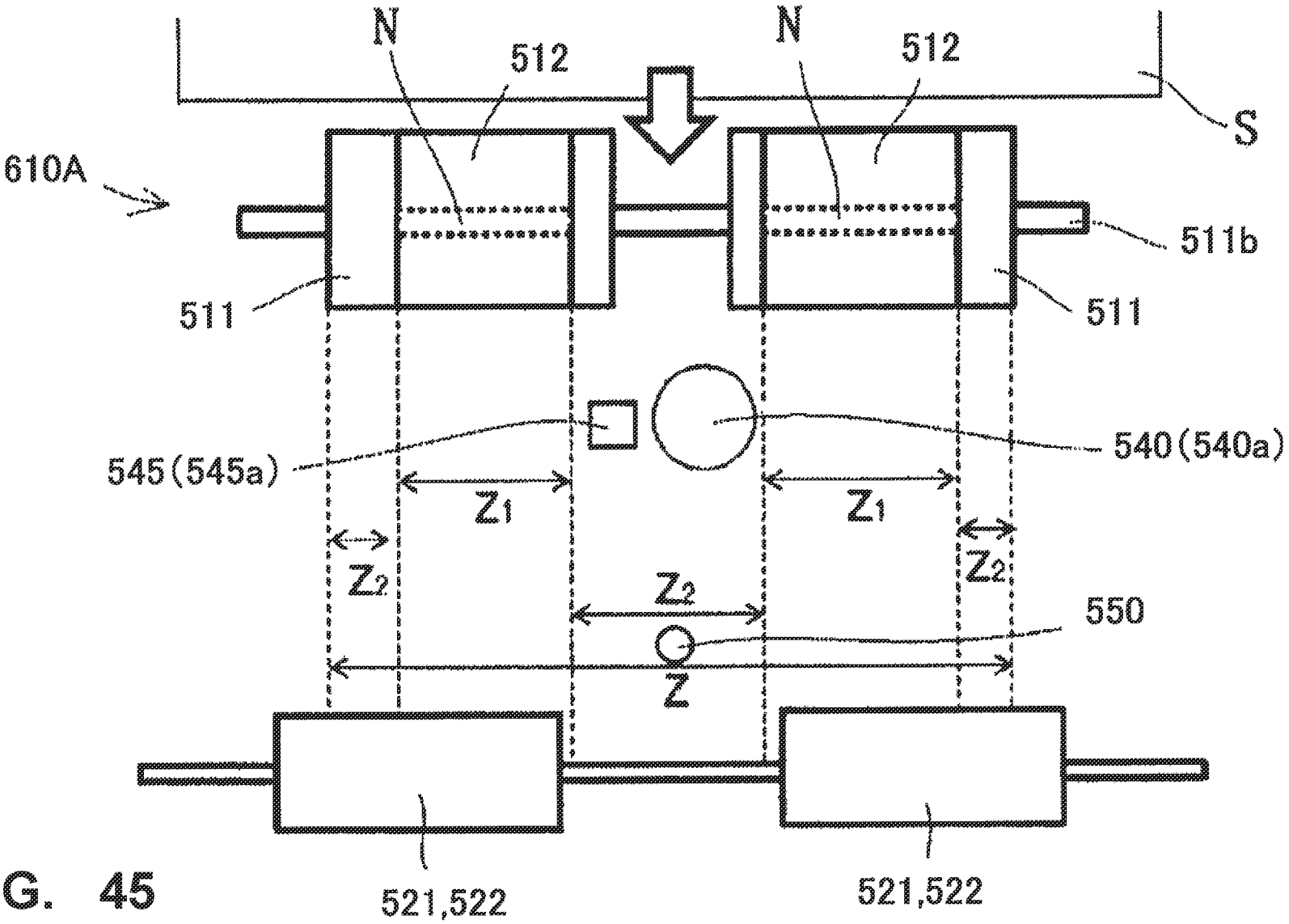
FIG. 45 is a schematic view of another feeding/conveyance unit according to the eighth embodiment.

Note that the present invention is not limited to this, as a matter of course. As shown in FIG. 45, when a portion where the separation roller 512 is not pressed is provided on the side of the gap between the feed roller portions 511, the gap between the feed roller portions 511 can be widened. For this reason, since the downstream region $Z_2$ on the downstream side can be formed wide from the gap between the feed roller portions 511, as shown in FIG. 45, the multiple feed detection sensor 540 and the second movement detection sensor 545 may be provided side by side for the downstream region $Z_2$ in the widthwise direction orthogonal to the feeding direction.

When installing the multiple feed detection sensor 540 and the second movement detection sensor 545 as shown in FIG. 45, the separation roller 512 may be pressed against up to the roller end portions on both outer sides of each feed roller portion 511 of the feed roller 610A in the axial direction of the feed roller shaft 511*b*.

Ninth Embodiment

Figure 46:
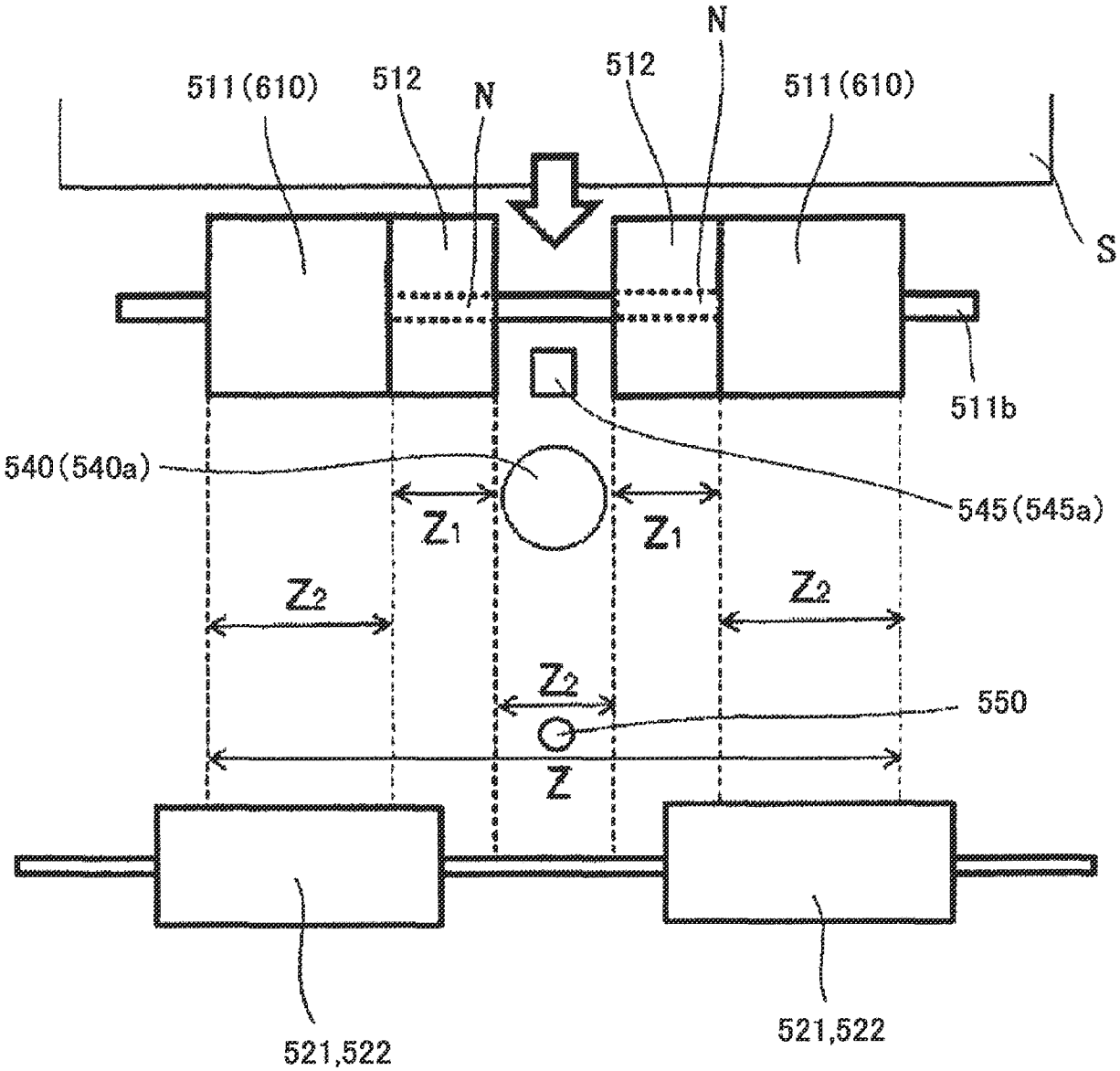
FIG. 46 is a structural drawing of drive transmission of a sheet feeder according to the ninth embodiment.

In this embodiment, as shown in FIG. 46, a second movement detection sensor 545 may be arranged to face the gap between feed roller portions 511 in feed rollers 610. In this case, since the movement (skewing) of a document can be detected in a place immediately after nip portions N formed by the feed roller portions 511 and separation rollers 512, where the influence of paper powder is small, the separation/feeding operation can temporarily be stopped immediately at the time of an abnormality such as skewing in separation/feeding of a bound document. In addition, if the above-described skewing detection can be performed before reaching a multiple feed detection sensor 540, control to turn off the detection of the multiple feed detection sensor 540 may be performed.

Note that in this embodiment, a cover member a3 configured to cover the feed rollers 610 is arranged. In this case, a window portion (not shown) is provided through the cover member a3. When the cover member a3 is closed, the window portion provided in the cover member a3 is made to face the second movement detection sensor 545 on the side of a device main body A1. This makes it possible to arrange the second movement detection sensor 545 in the gap between the feed roller portions 511 and trace and detect the movement of a document whose posture is relatively stable in the left and right nip portions by the second movement detection sensor 545 through the window portion.

Additionally, the detection region of the second movement detection sensor 545 is affected by paper powder little, and accurate tracking and detection can be performed. Also, the movement of a document immediately after the nip portions can be tracked, and abnormal feeding or the like can immediately be detected. For this reason, for example, before damage to the document occurs, subsequent processing such as temporary stop of the separation/feeding operation or error processing can appropriately be performed. Note that in this case, when the first movement detection sensor and the second movement detection sensor are arranged before and after the nip portions, movement of various documents can be detected, and abnormal movement of a document can be found at an early stage.

Note that in the above-described embodiment, an example of a structure in which the first movement detection sensor 535 is installed for the movement of a document before separation as a detection target, and the second movement detection sensor 545 is installed for the movement of a document immediately after separation as a detection target has been described. However, the present invention is not limited to this, as a matter of course, and only one of the first movement detection sensor 535 and the second movement detection sensor 545 may be provided.

For example, a sheet conveyance apparatus including no second movement detection sensor but only the first movement detection sensor may be formed. In addition, instead of setting the detection period of the first movement detection sensor immediately after the start of feeding, control of continuously performing detection until the trailing edge of a document passes through the first movement detection sensor may be performed to omit the second movement detection sensor.

In the above-described embodiment, a configuration including the document detection sensor 590 has been described. If the presence of a document is detected by the document detection sensor 590, and the absence of a document is detected by another document detection sensor, it is the timing when the document trailing edge of last paper has passed through the other document detection sensor. Hence, the control unit that controls the document conveyance apparatus performs stop control of light emission of the first movement detection sensor at that timing, thereby ending document movement detection by the first movement detection sensor. Even if the document of the past paper passes above the first movement detection sensor, it is possible to perform stop control of light irradiation from the first movement detection sensor before the document passes the region facing the first movement detection sensor. It is therefore possible to prevent unnecessary light emission from the first movement detection sensor.

In the seventh to ninth embodiments, a description has been made above by showing various examples. However, the gist and scope of the present invention are not limited to a specific description in this specification, and these can also be combined. In addition, the following aspects are also incorporated, as a matter of course. The aspects will be described below.

[Eighth Aspect]

A sheet feeder characterized by comprising:

a placement portion on which a sheet is placed;

a feeding unit configured to feed the sheet on a side of the placement portion;

a separation portion configured to separate the sheet one by one to the feeding unit; and a movement detection unit configured to detect movement of the sheet on the placement portion.

[Ninth Aspect]

The sheet feeder according to the eighth aspect, characterized in that the movement detection unit comprises a movement detection sensor configured to track a change in a sheet image obtained by capturing the sheet on the side of the placement portion.

[10th Aspect]

The sheet feeder according to the eighth or ninth aspect, characterized in that a device main body including the feeding unit is provided with a driving control unit configured to control driving of the feeding unit, and the driving control unit stops the driving of the feeding unit based on a detection result of the movement detection unit after a start of sheet feed by the feeding unit.

[11th Aspect]

The sheet feeder according to the 10th aspect, characterized in that the device main body is provided with a roller attachment portion to/from which a feed roller constituting the feeding unit is attached/detached, and a cover member configured to open/close the roller attachment portion and cover a periphery of the feed roller attached to the roller attachment portion, and the movement detection unit detects the movement of the sheet fed on the cover member by the feed roller through a window portion provided in the cover member.

[12th Aspect]

The sheet feeder according to the 10th aspect, characterized in that the device main body is provided with a roller attachment portion to/from which a feed roller constituting the feeding unit is attached/detached, and a cover member configured to open/close the roller attachment portion and cover a periphery of the feed roller attached to the roller attachment portion, and the movement detection unit is provided in a portion of the device main body, which is an opening peripheral edge portion of the roller attachment portion covered with the cover member and on which the sheet is placed.

[13th Aspect]

The sheet feeder according to any one of the eighth to 12th aspects, characterized in that the feeding unit includes the feed roller pressed against the separation portion, and a pick roller provided on the side of the placement portion with respect to the feed roller, and the movement detection unit is provided between the feed roller and the pick roller.

[14th Aspect]

The sheet feeder according to any one of the eighth to 13th aspects, characterized in that another document detection sensor configured to detect absence of the sheet on the placement portion is arranged on a side of the placement portion opposite to the side of the feeding unit of the movement detection unit, and movement detection of the sheet by the movement detection unit is ended based on a result of detecting the absence of the sheet on the placement portion by the other document detection sensor.

[15th Aspect]

The sheet feeder according to any one of the eighth to 14th aspects, characterized in that the feeding unit includes first and second roller portions pressed against the separation portion, a rotating shaft configured to rotate the first and second roller portions, a first one-way clutch portion provided between the first roller portion and the rotating shaft, and a second one-way clutch portion provided between the second roller portion and the rotating shaft.

[16th Aspect]

The sheet feeder according to any one of the eighth to 15th aspects, characterized in that at least a part of the placement portion is formed by a placement portion detached from the device main body.

[17th Aspect]

A sheet conveyance apparatus comprising a sheet feeder described in any one of the eighth to 16th aspects, characterized in that the movement detection unit is provided in a conveyance abnormality determination sensor in a conveyance path in which a sheet is conveyed.

[18th Aspect]

An image reading apparatus characterized by comprising a sheet conveyance apparatus described in the 17th aspect.

As a conventional sheet conveyance apparatus, there is known an apparatus that separates and feeds documents one by one between a feed roller and a retard roller to take in the documents one after another from the document at the lowermost position on the side of the document table (related art 3: Japanese Patent Laid-Open No. 2014-45256). In the seventh to ninth embodiments of the present invention, a new mechanism configured to detect a sheet moving state at the time of separation/feeding from the sheet at the lowermost position on the sheet placement table side has been described.

According to the seventh to ninth embodiments of the present invention, by the above-described configurations, it is possible to provide a new mechanism configured to detect a sheet moving state at the time of separation/feeding from the sheet at the lowermost position on the sheet placement table side. It is therefore possible to implement a sheet feeder and a sheet conveyance apparatus, which can detect a sheet moving state at the time of separation/feeding from the sheet at the lowermost position on the sheet placement table side, and an image reading apparatus.

In the 10th embodiment, a configuration in a case in which a tracking sensor (movement detection sensor) is attached to a multiple feed base will be described.

10th Embodiment

The 10th embodiment will be described with reference to FIGS. 47 to 51.

Figure 47:
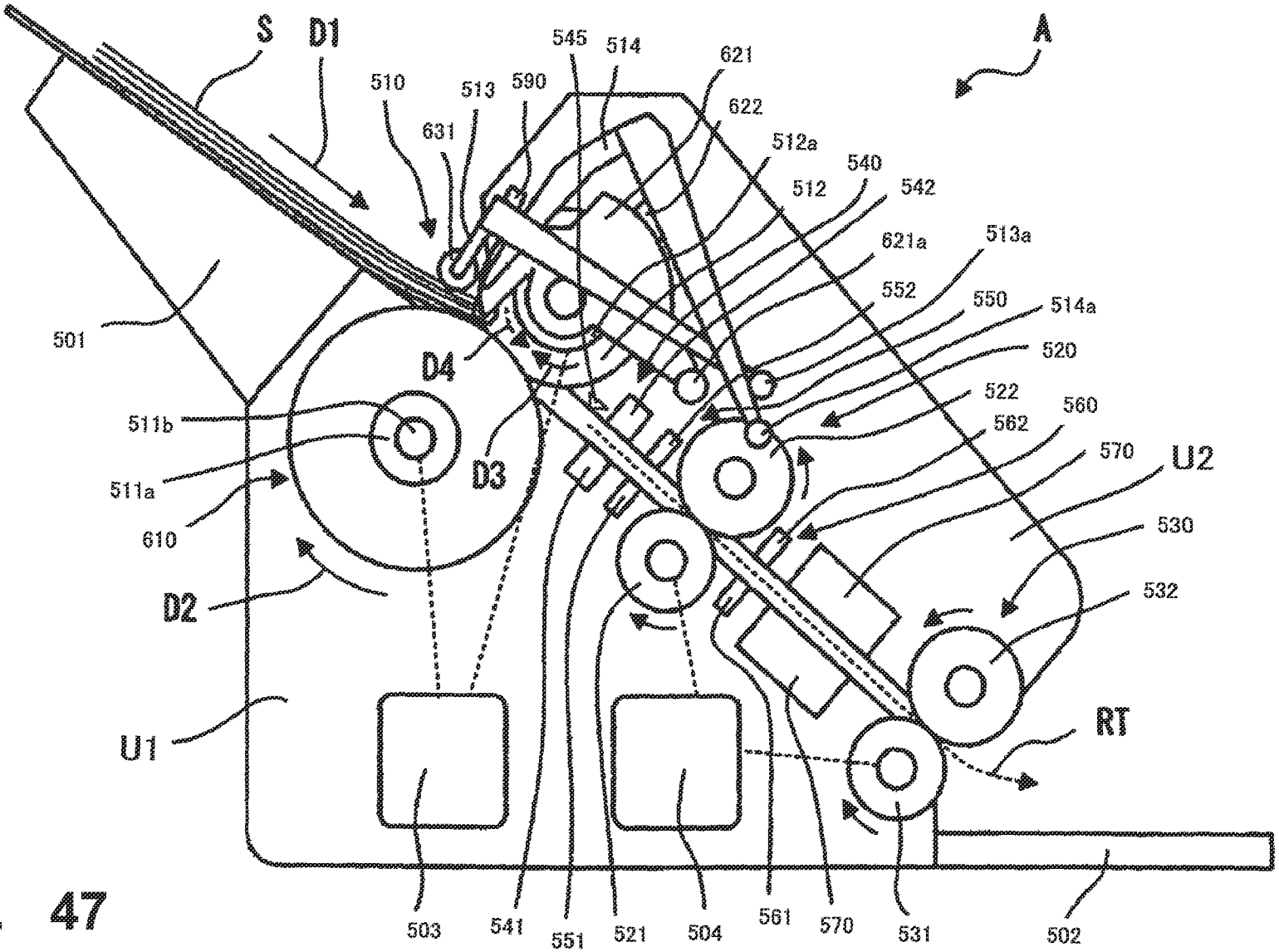
FIG. 47 is a schematic sectional view of a document feeder according to the 10th embodiment (conveyance state)
Figure 48:
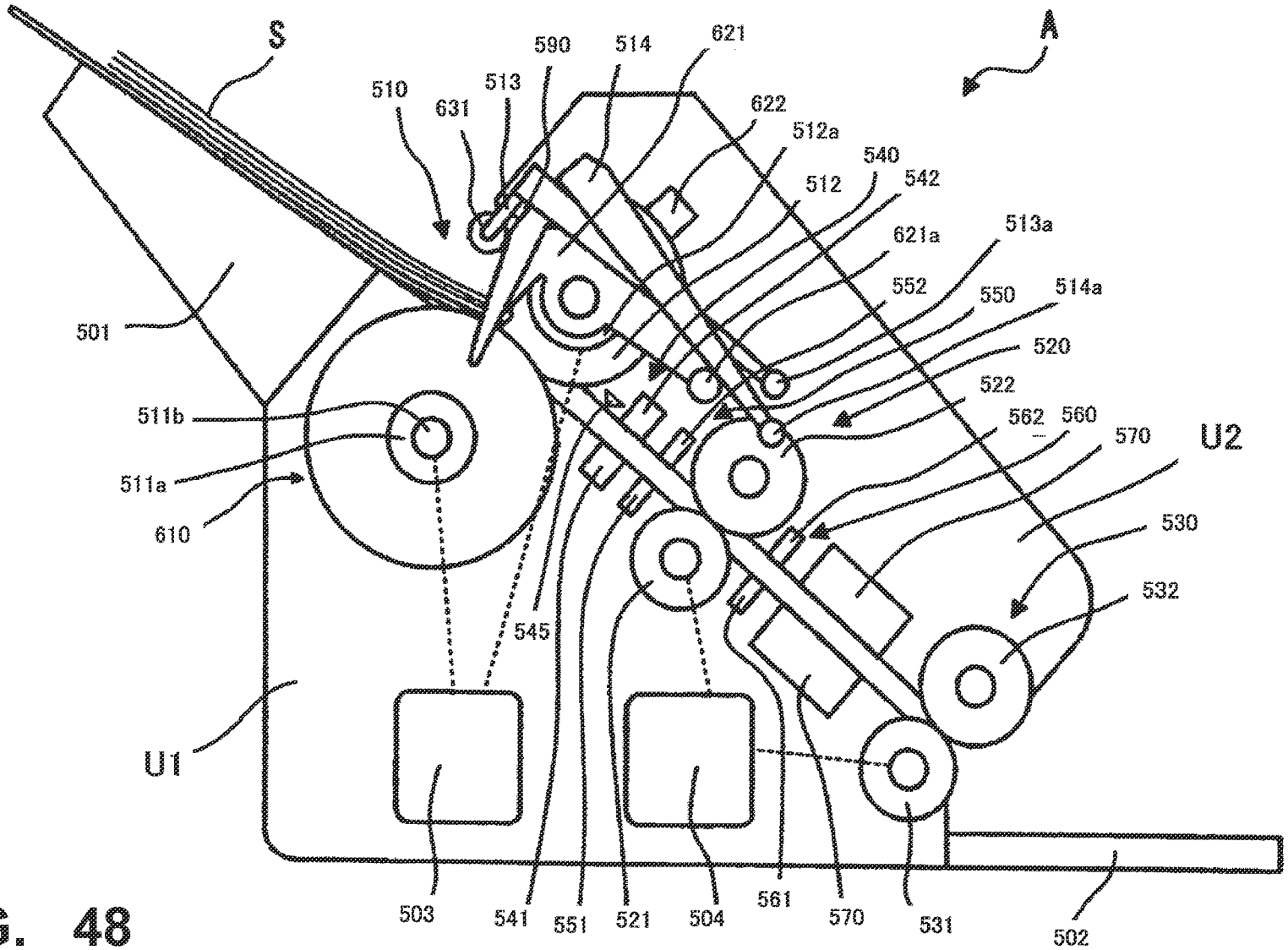
FIG. 48 is a schematic sectional view of the document feeder according to the 10th embodiment (standby state)

FIGS. 47 and 48 are schematic views of a sheet conveyance apparatus A according to an embodiment of the present invention. Note that FIG. 47 shows a conveyance state, and FIG. 48 shows a standby state. In addition, the same reference numerals as in FIGS. 35 and 36 denote the same components.

As shown in FIGS. 47 and 48, a device main body A1 according to this embodiment is formed by a first housing (lower unit) U1 including an installation surface, and a second housing (upper unit) U2 pivotally connected to the first housing U1 via a hinge or the like. In this embodiment, a path RT in which a document S is conveyed is formed by the tilting surface of the first housing U1 on the upper side in the vertical direction and the tilting surface of the second housing U2 on the lower side in the vertical direction.

<Multiple Feed Detection>

As shown in FIGS. 47 and 48, a multiple feed detection sensor 540 arranged between a first conveyance unit 510 and a second conveyance unit 520 is an example of a sheet detection sensor (a sensor configured to detect the behavior or state of a document S) configured to detect a case in which the documents S such as paper adhere to each other by static electricity or the like and pass through the first conveyance unit 510 (that is, a multiple feed state in which documents are conveyed while overlapping).

Various kinds of sensors can be used as the multiple feed detection sensor 540. For example, in this embodiment, the multiple feed detection sensor 540 is an ultrasonic wave sensor formed by an ultrasonic wave transmitting portion 541 and a receiving portion 542, which are arranged to sandwich the path RT. The sensor detects multiple feed using a principle that the attenuation amount of an ultrasonic wave passing through the document S changes between a case in which multiple feed of the documents S such as paper has occurred and a case in which the documents S are conveyed one by one.

Here, the ultrasonic wave transmitting portion 541 is provided on the side of the first housing U1 of the device main body A1, and the ultrasonic wave receiving portion 542 is provided on the side of the second housing U2 to face the ultrasonic wave transmitting portion 541. More specifically, the ultrasonic wave transmitting portion 541 and the receiving portion 542 are implemented on different boards 601 and 602. The board 601 is embedded in the first housing U1, and the board 602 is embedded in the second housing U2. Note that if a function of performing ultrasonic wave driving and detection control is imparted to the side of the board 602 on which the receiving portion 542 is implemented, a small analog signal received by the ultrasonic wave receiving portion 542 can be amplified and input to a device (for example, a microcomputer including an A/D) at the shortest, resulting in improvement of multiple feed detection.

The multiple feed detection sensor 540 forms a multiple feed detection region 540*a* on the path RT in the portion sandwiched between the ultrasonic wave transmitting portion 541 and the receiving portion 542 (see FIG. 39). Note that a sound wave vibration occurs in the multiple feed detection region 540*a*. Hence, it can be considered that even if paper powder enters there, the paper powder is scattered by the sound wave vibration and prevented from remaining. However, the ultrasonic wave attenuation amount may vary due to the paper powder, and the accuracy of multiple feed detection may lower.

In this embodiment, the movement detection sensor 545 is provided on the side of the second housing U2. For this reason, the structure makes it difficult for paper powder to stick to the movement detection sensor 545. Hence, the movement detection sensor 545 can be arranged close to the feeding unit (nip portion) side. A document leading edge that has passed through the nip portion has a relatively stable posture. Hence, when the movement detection sensor 545 is arranged close to the nip portion, the tracking accuracy can be increased.

Figure 49:
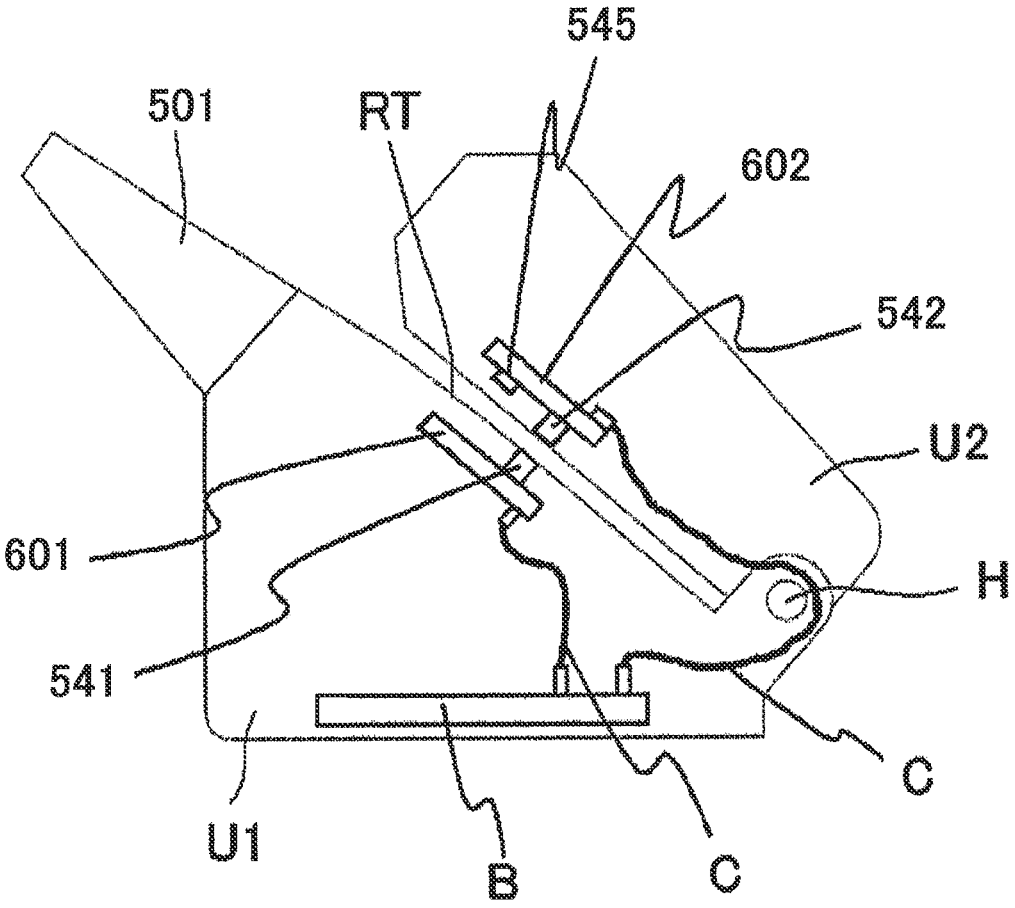
FIG. 49 is a schematic view of a board arrangement and a wiring path according to the 10th embodiment.

In addition, the movement detection sensor 545 according to this embodiment is arranged on the board 602 which is arranged on the side of the second housing U2 and on which the ultrasonic wave receiving portion 542 is implemented, as shown in FIG. 49. Furthermore, energization is performed from a main board B arranged on the side of the first housing U1 using a cable C connected to a connector provided on the board 602, and power supply and control instruction transmission/reception can be performed.

Hence, power supply to the movement detection sensor 545 (a light source and an image capturing portion) from the main board B can be performed at least via the board 602 of the receiving portion 542. This can omit a cable wiring for independent power supply from the main board B to the movement detection sensor 545 and simplify the wiring structure. In this embodiment, since wiring of the cable C is done via a hinge portion, the wiring space of the hinge portion can be made small.

Additionally, when the movement detection sensor 545 is arranged on the same board 602 as the ultrasonic wave receiving portion 542, as in this embodiment, the sensor can be implemented by a smaller number of boards. Since it is possible to simplify the structure of the entire device and decrease the number of components, the cost can be reduced. Also, when control of the ultrasonic wave sensor and control of the movement detection sensor are executed by the same device, the control systems can be integrated, resulting in cost reduction of the device. In this embodiment, the control board configured to control the sheet detection unit is formed by the board 601 and the board 602. However, the configuration is not necessarily limited to this.

A configuration in which the movement detection sensor 545 is arranged on the side of the second housing U2 has been described above. However, the present invention is not limited to this, and the movement detection sensor may be directly implemented on or connected to the board of the ultrasonic wave transmitting portion 541 arranged on the side of the first housing U1. If the movement detection sensor 545 is arranged on the side of the first housing U1 to track a document moving through the path RT, there is a region to which paper powder generated by separation in document feeding moves along the path RT along with document conveyance. It is preferable to arrange the sensor while avoiding a paper powder region $Z_1$ (see FIG. 39) as much as possible.

Hence, on one wall surface on the side of the conveyance path RT where a feed roller 610 is provided, the above-described movement detection sensor 545 is preferably arranged in correspondence with a downstream region $Z_2$ of a downstream region Z except the paper powder region $Z_1$, which extends to the downstream side in the document feeding direction with respect to the document separation/ feeding unit. Since the movement detection region (detection region) is set at a position apart from the paper powder region $Z_1$, the influence of paper powder can be reduced, and the accuracy of movement detection can be improved.

Furthermore, in this case, as shown in FIG. 39, concerning the relationship with the multiple feed detection sensor 540, the movement detection sensor 545 is provided on the upstream side of the multiple feed detection sensor 540 on the conveyance path RT. Also, since the sensors are arranged apart, through holes are individually formed in the conveyance path such that the detection targets of the sensors can be detected from the holes. Even if paper powder enters the multiple feed detection region 540*a* of the multiple feed detection sensor 540, and scattered to the outside by the ultrasonic vibration, the influence on the movement detection sensor 545 can be prevented by arranging the movement detection sensor 545 on the upstream side of the multiple feed detection sensor 540.

Note that when the configuration in which the multiple feed detection sensor 540 and the movement detection sensor 545 are arranged on the same board, as in this embodiment, is applied in combination with the seventh to ninth embodiments, the arrangement of the movement detection sensor 545 and the multiple feed detection sensor 540 as described in the seventh to ninth embodiments can easily be implemented.

Figure 50:
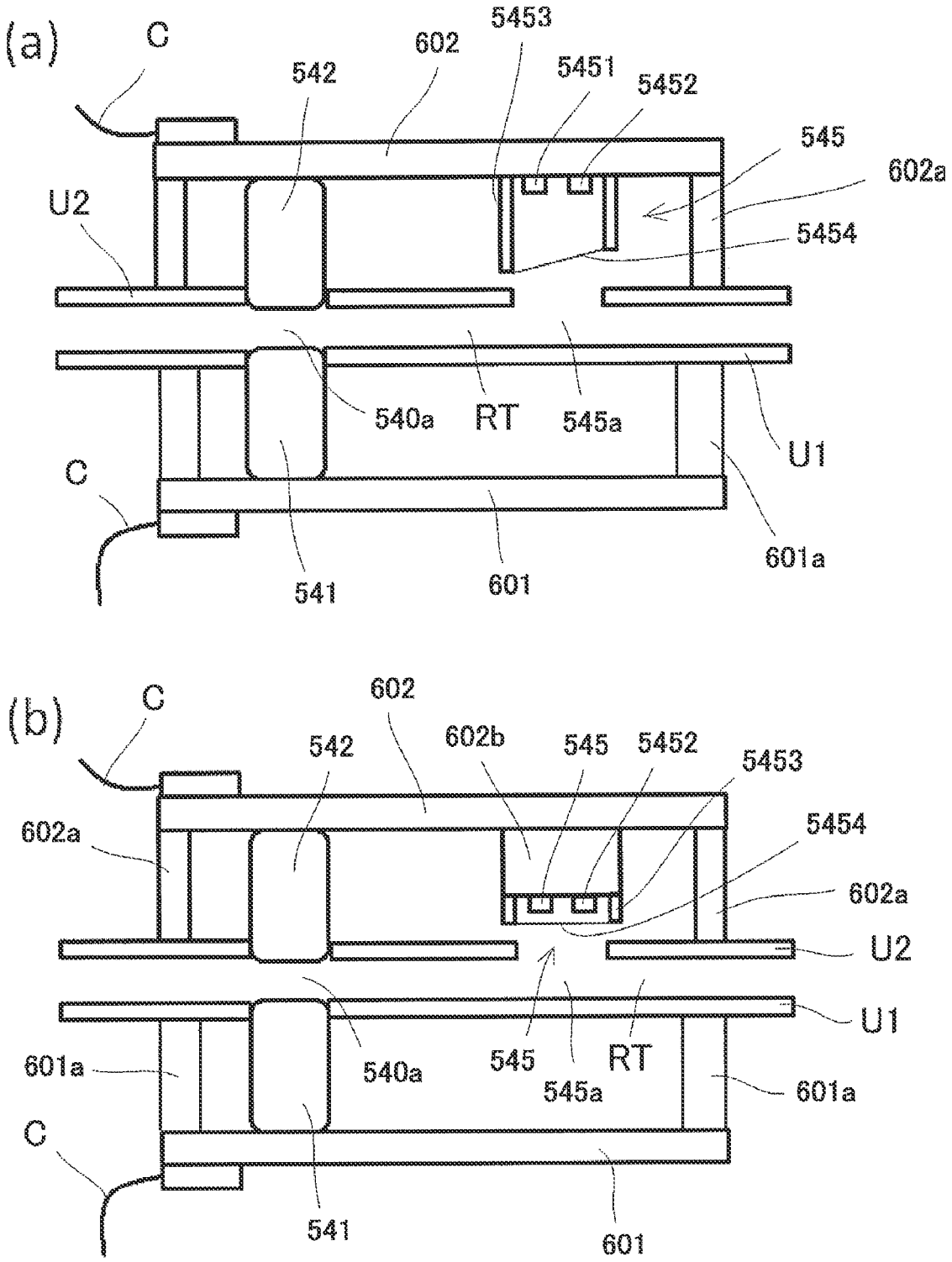
FIG. 50 shows enlarged sectional views of the main part of the document feeder according to the 10th embodiment.

As shown in FIG. 50(*a*), a light source 5451 and an image capturing portion 5452 provided in the movement detection sensor 545 are implemented on the upper surface of the board 602 on the side of the path RT, and energization is done via the cable C connected to the board 602. Additionally, in the movement detection sensor 545, a tubular member 5453 is arranged to surround the light source 5451 and the image capturing portion 5452 on the board 602, and a light transmitting member (an optical filter or a glass substrate) 5454 is provided on the opening of the tubular member 5453 while tilting with respect to the path RT.

The board 602 on which the movement detection sensor 545 is implemented is joined, via attachment members 602*a*, to the lower surface of the second housing U2 on the side opposite to the side of the path RT. At this time, through hole are provided in portions of the second housing U2 corresponding to the ultrasonic wave receiving portion 542 and the movement detection sensor 545. Hence, ultrasonic wave reception and document movement from the path RT can be detected on the board 602 attached to the second housing U2. Note that the board 601 on which the ultrasonic wave transmitting portion 541 is implemented is joined to the first housing U1 via attachment members 601*a*.

As another form, as shown in FIG. 50(*b*), a pedestal 602*b* may be provided on the board 602, and the movement detection sensor 545 may be provided on the upper surface of the pedestal 602*b*. This makes it possible to detect document movement in a place close to the path RT.

Note that as for the structure shown in FIG. 50, a structure in which the movement detection sensor 545 is provided on the side of the board 602 has been described. However, the movement detection sensor 545 may be provided on the board 601 on which the ultrasonic wave transmitting portion 541 is implemented. Alternatively, sensors may be provided on the boards 601 and 602 on both sides to sandwich the path RT. In the latter case, multiple feed can be detected based on the difference between the output values of the movement detection sensors 545. A document with a label is detected by the multiple feed detection sensor 540 as multiple feed. However, according to the movement detection sensors 545 on both sides, movement of overlapping documents can be detected separately. It is therefore possible to easily detect a multiple feed state.

Figure 51:
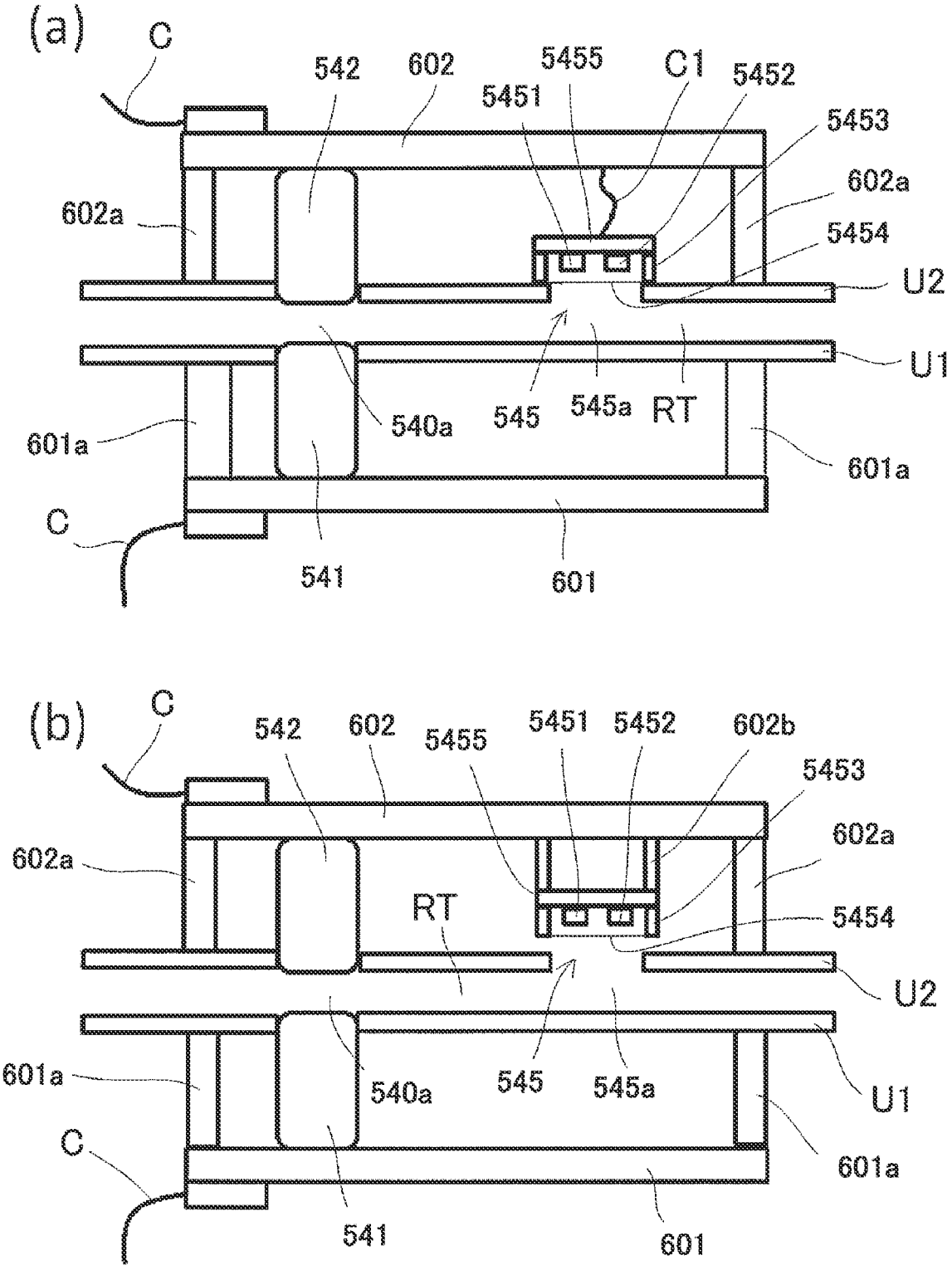
FIG. 51 shows enlarged sectional views of the main part of the document feeder according to the 10th embodiment.

As shown in FIG. 51(*a*), a sensor board (third board) 5455 on which the light source 5451 and the image capturing portion 5452 of the movement detection sensor 545 are implemented may be connected, via, for example, a cable C1 such as FFC or FPC, to the board 602 on which the ultrasonic wave receiving portion 542 is implemented such that communication or energization is possible. In this case, the sensor board 5455 is fixed to the peripheral portion of the through hole provided in the second housing U2 on the side opposite to the side of the path RT via the connecting member 5453. This makes it easy to detect the movement of a document by the movement detection sensor 545 near the path RT. Alternatively, as shown in FIG. 51(*b*), the sensor board 5455 may electrically be connected to one surface of the board 602 on the side of the path RT via the lead wires 602*b*.

Note that as shown in FIGS. 50(*a*), 50(*b*), and 51(*b*), the second housing U2 and the movement detection sensor 545 are not directly joined but arranged at a predetermined interval. This can prevent a vibration caused by driving of the feeding/conveyance system from being directly transmitted to the movement detection sensor 545 via the second housing U2.

In the 10th embodiment, a description has been made above by showing various examples. However, the gist and scope of the present invention are not limited to a specific description in this specification, and these can also be combined. In addition, the following aspects are also incorporated, as a matter of course. The aspects will be described below.

[19th Aspect]

A sheet conveyance apparatus characterized by comprising: a separation/feeding unit configured to separate and feed a sheet one by one;

a conveyance unit configured to convey, along a conveyance path, the sheet separated by the separation/feeding unit; and a sheet detection unit arranged on a downstream side of the separation/feeding unit in a sheet feeding direction and configured to detect the sheet, wherein the sheet detection unit includes a multiple feed detection sensor configured to detect multiple feed of the sheet, and a movement detection sensor configured to detect movement of the sheet based on one of a moving amount and a moving direction of a feature point included in a sheet image obtained by capturing the sheet passing through the conveyance path, the multiple feed detection sensor includes an ultrasonic wave transmitting portion and an ultrasonic wave receiving portion, which are arranged to face each other so as to sandwich the conveyance path, a control board configured to control the sheet detection unit includes a first board on which the ultrasonic wave transmitting portion is implemented, and a second board on which the ultrasonic wave receiving portion is implemented, and the movement detection sensor is driven by receiving energization from one of the first board and the second board.

[20th Aspect]

The sheet conveyance apparatus according to the 19th aspect, characterized in that the conveyance path is formed by a gap between a first housing including a device installation surface and a second housing pivotally connected to the first housing, one board of the first board and the second board is stored in the first housing, and the other board is stored in the second housing, and the movement detection sensor is provided on a side of the second housing and driven by energization from the other board.

[21st Aspect]

The sheet conveyance apparatus according to the 19th aspect, characterized in that the separation/feeding unit includes a feed roller with first and second roller portions provided at an interval on a rotating shaft, and a separation portion pressed against a part of the feed roller to form a nip portion with the feed roller, each of the multiple feed detection sensor and the movement detection sensor includes a sheet detection region in a region that extends from a portion other than the nip portion in the separation/feeding unit to the downstream side in the sheet feeding direction and is a downstream region before reaching the conveyance unit, the conveyance path is formed by a gap between a first housing including a device installation surface and a second housing pivotally connected to the first housing, one board of the first board and the second board is stored in the first housing, and the other board is stored in the second housing, and the movement detection sensor is provided on a side of the first housing and driven by energization from the one board.

[22nd Aspect]

The sheet conveyance apparatus according to the 19th aspect, characterized by comprising a third board configured to control the movement detection sensor, wherein the third board is implemented on one surface of one of the first board and the second board on the side of the conveyance path.

[23rd Aspect]

The sheet conveyance apparatus according to the 19th aspect, characterized in that first and second through holes extending through, in a thickness direction, one wall portion including a wall surface facing one surface of the conveyed sheet are provided in the conveyance path, the movement detection sensor is provided on a side of the first through hole opposite to the side of the conveyance path, and one of the ultrasonic wave transmitting portion and the ultrasonic wave receiving portion, which constitute the multiple feed detection sensor, is provided on a side of the second through hole opposite to the side of the conveyance path.

[24th Aspect]

The sheet conveyance apparatus according to the 19th aspect, characterized in that one through hole extending through, in a thickness direction, one wall portion including a wall surface facing one surface of the conveyed sheet is provided in the conveyance path, and one of the ultrasonic wave transmitting portion and the ultrasonic wave receiving portion, which constitute the multiple feed detection sensor, and the movement detection sensor are provided together on a side of the through hole opposite to the side of the conveyance path.

[25th Aspect]

An image reading apparatus characterized by comprising a sheet conveyance apparatus described in any one of the 19th to 24th aspects.

As a conventional sheet conveyance apparatus, there is known a medium supply apparatus including a feed roller, and a brake means pressed against the feed roller to apply a predetermined conveyance load to a medium that has entered between the brake means and the feed roller, wherein the medium is separated and fed one by one between the feed roller and the brake means (related art 4: Japanese Patent Laid-Open No. 2014-181109). In the medium supply apparatus as in related art 4, the medium is repetitively separated in a nip portion formed between the feed roller and the brake means. However, abnormal feeding such as multiple feed in which two or more media are not properly separated and fed in an overlapping state or skewing in which a medium is fed while tilting in an oblique direction may occur. For this reason, in the conventional apparatus, since, for example, a skewing detection sensor, a multiple feed detection sensor, and the like, which are formed by combining a plurality of optical sensors, are separately arranged as abnormal feeding detection sensors on the downstream side of the nip portion in the feeding direction, wiring for the sensors and the like are sometimes cumbersome.

On the other hand, in the 10th embodiment of the present invention, the movement detection sensor is attached to the multiple feed board on which the above-described multiple feed detection sensor is implemented. With this configuration, it is possible to provide a sheet conveyance apparatus in which a plurality of sensors configured to detect abnormal feeding are implemented by a simple configuration.

In the 11th to 14th embodiments, a configuration for detecting a deviation of the attachment angle of an image capturing portion used to detect a conveyance state of a document will be described.

[11th Embodiment]

A document conveyance apparatus according to the 11th embodiment will be described next. In the 11th embodiment, a detailed example of attachment angle correction of an optical sensor 311 will be described.

<Document Conveyance Apparatus 400>

Figure 52:
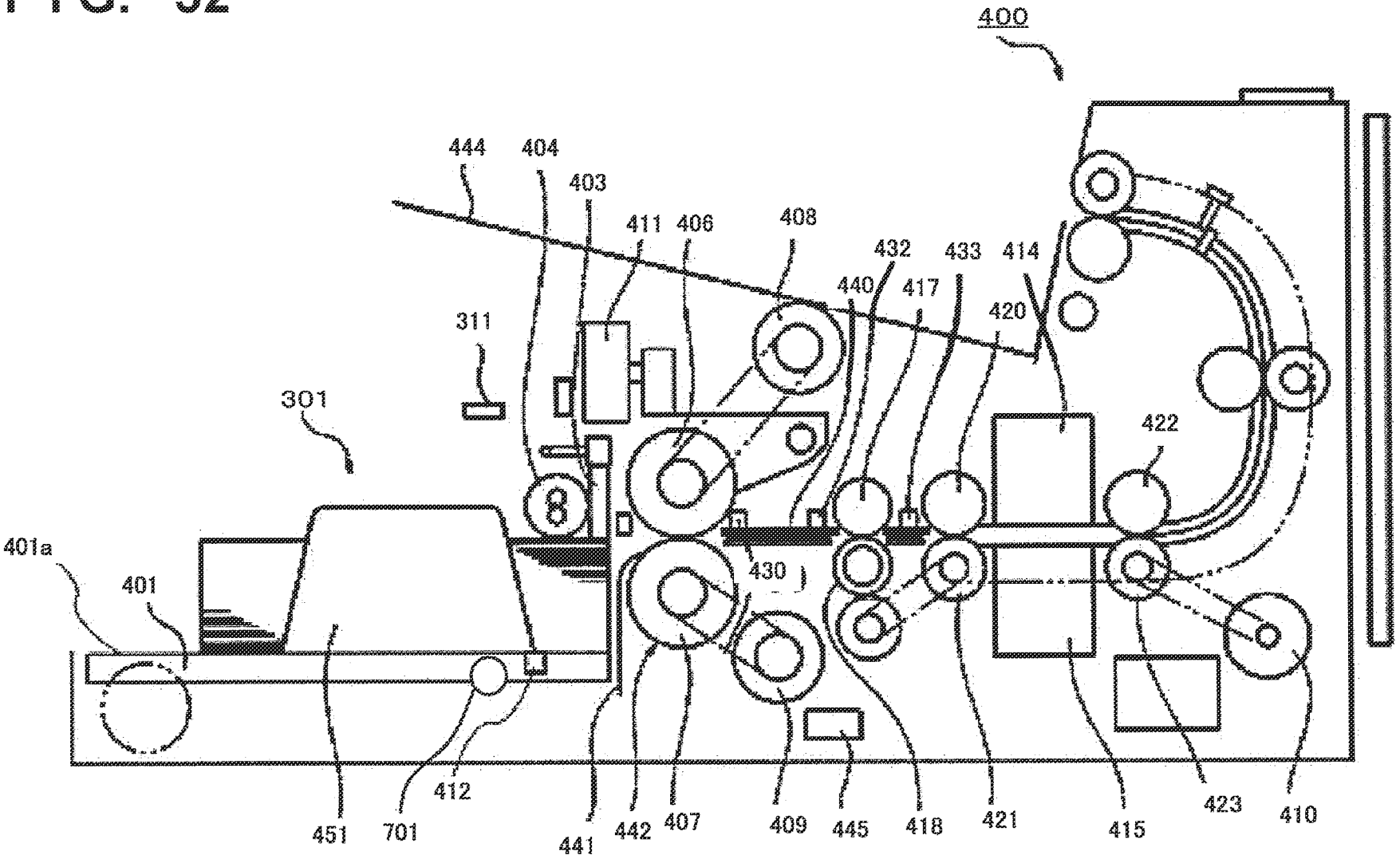
FIG. 52 is a sectional view schematically showing the configuration of a document conveyance apparatus according to the 11th embodiment.
Figure 53:
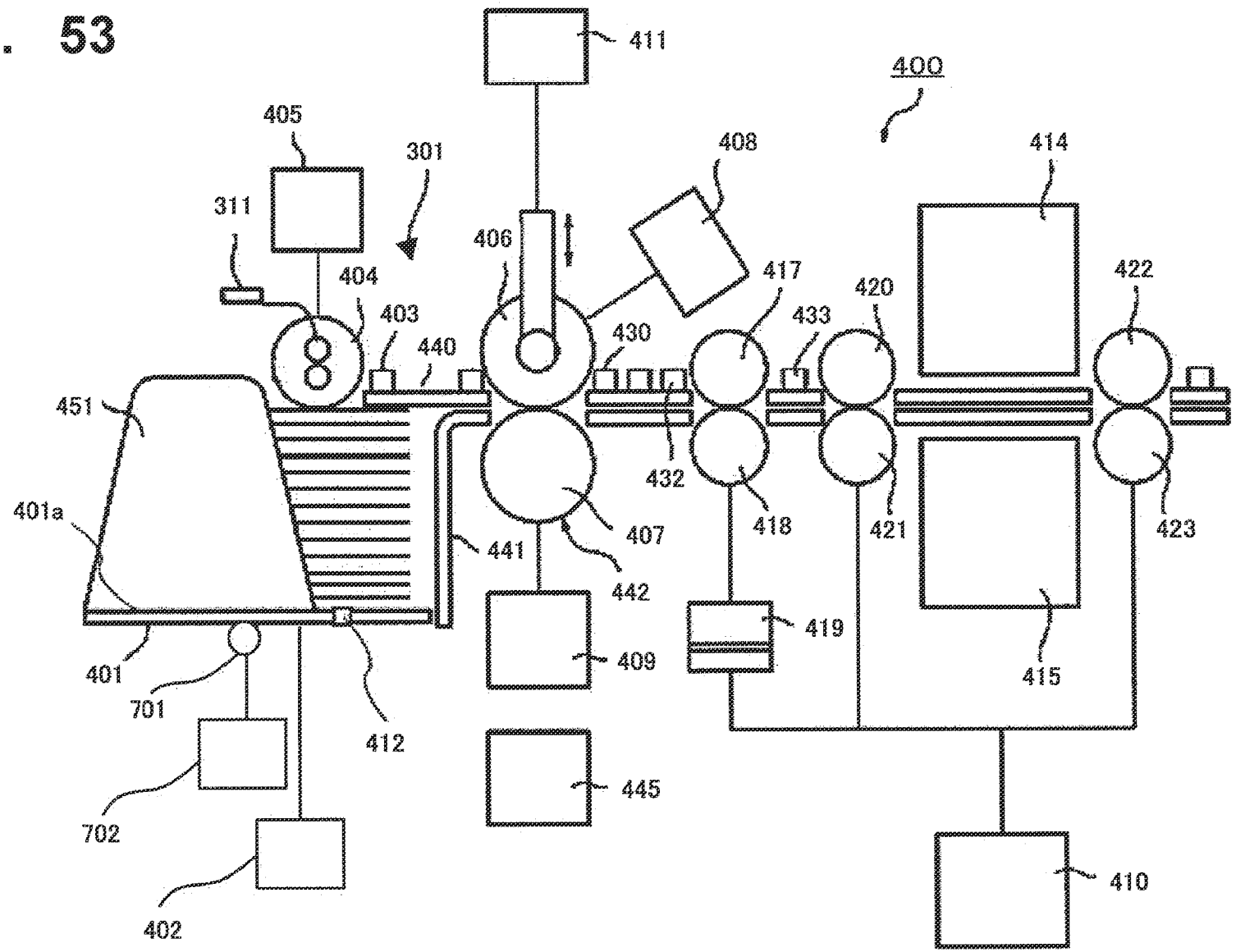
FIG. 53 is a view schematically showing the configuration of the main part of the document conveyance apparatus shown in FIG. 52.

FIG. 52 is a partial sectional view schematically showing the configuration of a document conveyance apparatus (image reading apparatus) according to the 11th embodiment, and FIG. 53 is a view schematically showing the configuration of the main part of the document conveyance apparatus shown in FIG. 52. Note that the same reference numerals as in FIGS. 26 and 27 denote the same components.

A document conveyance apparatus 400 according to this embodiment includes the optical sensor 311 that is a sensor configured to detect the behavior of a conveyed document, and a facing surface member (facing member) 701 arranged at a position facing the optical sensor 311. In this embodiment, as shown in FIGS. 52 and 53, the optical sensor 311 is arranged at a position facing a sheet stacker 401, and the facing surface member 701 is arranged on the sheet stacker 401 that is the facing surface of the optical sensor 311.

The facing surface member 701 can move when driven by a motor 702, and is used to detect the attachment angle (attachment state) of the optical sensor 311 in the document conveyance apparatus 400. A control unit 445 controls the motor 702, thereby controlling movement of the facing surface member 701. As will be described later, when no document intervenes between the optical sensor 311 and the facing surface member 701, the control unit 445 moves the facing surface member 701 relative to the optical sensor 311, and the optical sensor 311 detects the moving amount or the moving direction of the surface of the facing surface member 701 facing the optical sensor 311. Furthermore, the control unit 445 detects the attachment angle of the optical sensor 311 in the conveyance path in the document conveyance direction based on the detection result of the moving amount or the moving direction of the facing surface member by the optical sensor 311.

Another example of the document conveyance apparatus according to the 11th embodiment will be described next. Note that the same reference numerals as in FIGS. 52 and 53 denote the same components.

<Document Conveyance Apparatus 800>

Figure 54:
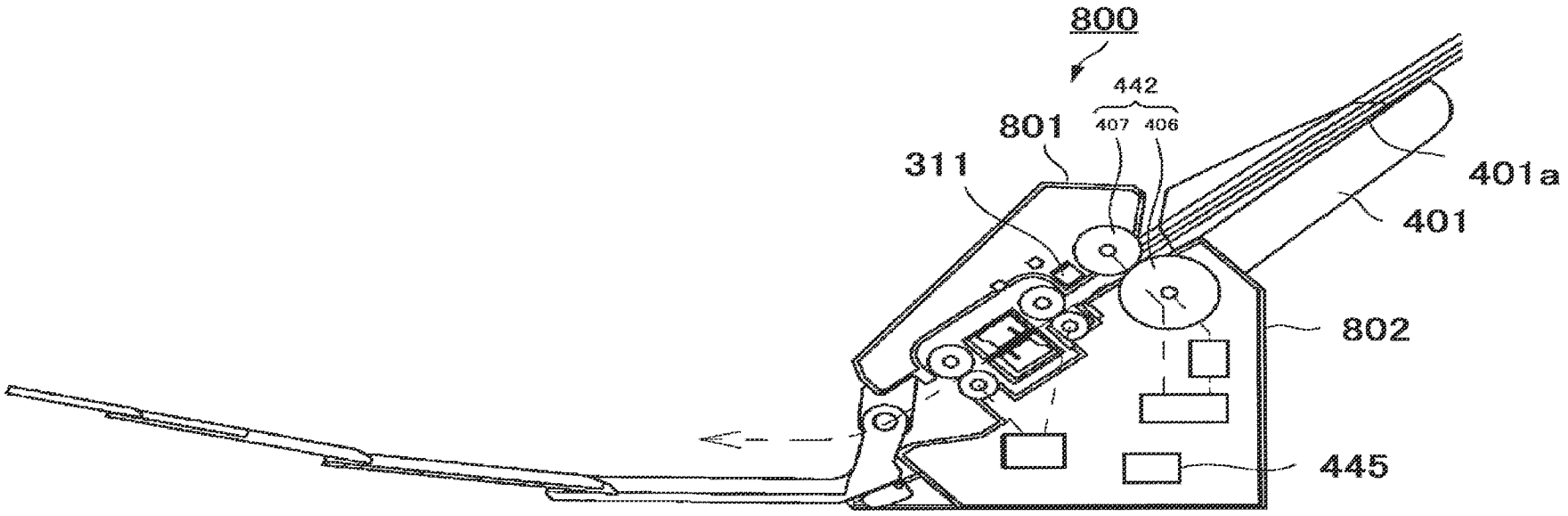
FIG. 54 is a sectional view schematically showing another example of the configuration of the document conveyance apparatus according to the 11th embodiment.
Figure 55:
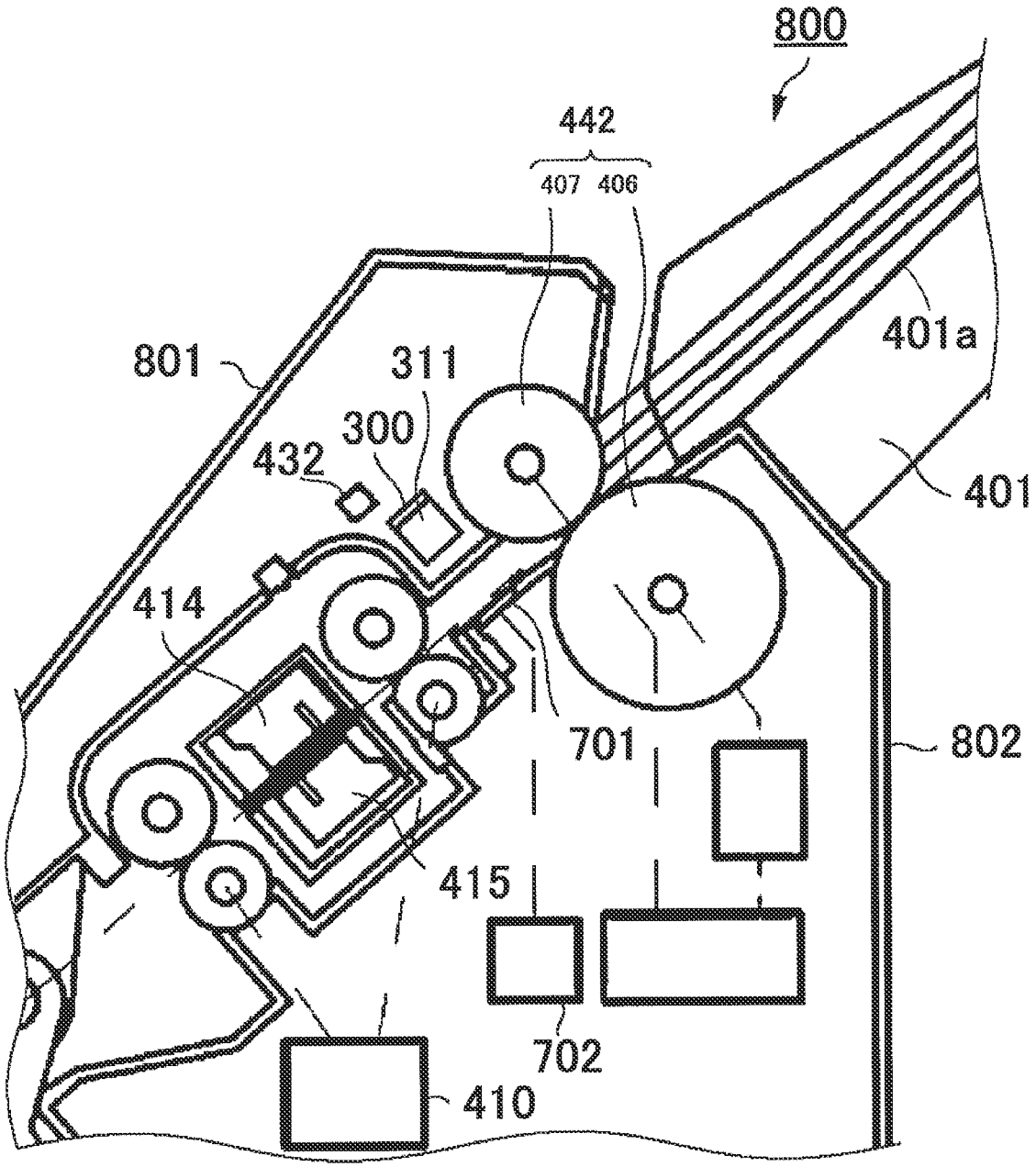
FIG. 55 is a view schematically showing the configuration of the main part of the document conveyance apparatus shown in FIG. 54.

FIG. 54 is a partial sectional view schematically showing the configuration of another example of a document conveyance apparatus (image reading apparatus) according to the 11th embodiment, and FIG. 55 is a view schematically showing the configuration of the main part of the document conveyance apparatus shown in FIG. 54.

As shown in FIG. 54, a document conveyance apparatus 800 of another example of this embodiment is roughly formed by the sheet stacker 401, an upper unit 801, and a lower unit 802. The document conveyance apparatus 800 basically has the same configuration as the above-described document conveyance apparatus 400 (FIGS. 52 and 53). However, the document conveyance apparatus 800 is different from the document conveyance apparatus 400 (FIGS. 52 and 53) particularly in that the optical sensor 311 is arranged on the downstream side of a separation roller pair 442 in the conveyance direction of a sheet (document). Points different from the above-described document conveyance apparatus 400 (FIGS. 52 and 53) will mainly be described below.

In the document conveyance apparatus 800, as shown in FIG. 54, a sheet stacking surface 401*a* of the sheet stacker 401 and the conveyance path are provided to tilt with respect to the installation surface of the document conveyance apparatus 800. Sheets stacked on the sheet stacker 401 are separated one by one by the separation roller pair 442 formed by a feed roller 406 and a separation roller 407 and provided on the downstream side of the sheet stacker 401 in the sheet conveyance direction, and taken into the conveyance path. Note that in the above-described document conveyance apparatus 400 (FIGS. 52 and 53), a plurality of sheets stacked on the sheet stacker 401 are taken into the conveyance path sequentially from the sheet placed on the upper side. On the other hand, in the document conveyance apparatus 800, a plurality of sheets stacked on the sheet stacker 401 are taken into the conveyance path sequentially from the sheet placed on the lower side.

As shown in FIG. 55, a board 300 on which the optical sensor 311 is implemented is attached in parallel to the sheet conveyance direction in the conveyance path. The optical sensor 311 is arranged on the downstream side of the separation roller pair 442 to detect the moving amount or the moving direction of the sheet conveyed in the conveyance path. In the document conveyance apparatus 800, the conveyance state of a document can be detected using the optical sensor 311, as in the above-described document conveyance apparatus 400 (FIGS. 52 and 53).

The document conveyance apparatus 800 includes the facing surface member 701 arranged in the conveyance path at a position facing the optical sensor 311. Note that the optical sensor 311 and the board 300 are arranged in the upper unit 801. However, an opening is provided in the upper unit 801 at a position facing the optical sensor 311 such that the facing surface member 701 can be viewed from the optical sensor 311.

In this embodiment, the facing surface of the facing surface member 701, which faces the optical sensor 311, forms a portion facing the conveyance path in the lower unit 802. The facing surface member 701 is formed by a member different from a member (for example, a metal plate) of the lower unit 802, which forms the conveyance path. As in the above-described document conveyance apparatus 400 (FIGS. 52 and 53), the facing surface member 701 can be driven by the motor 702 and move relative to the optical sensor 311, and is used to correct the attachment angle of the optical sensor 311.

<Execution Timing of Attachment Angle Correction>

In the document conveyance apparatus 400 (FIGS. 52 and 53) in which the optical sensor 311 is attached to a position facing the sheet stacker 401, as in this embodiment, if a document (sheet) exists on the sheet stacker 401, the facing surface member 701 cannot be captured by the optical sensor 311. Hence, the control unit 445 needs to execute attachment angle correction at a timing at which no document is stacked (placed) on the sheet stacker 401.

To execute attachment angle correction at such a timing, the document conveyance apparatus 400 (control unit 445) may have a dedicated calibration mode to execute attachment angle correction in accordance with a predetermined condition. For example, as such a calibration mode, attachment angle correction may be executed in accordance with an instruction of the user via the operation unit (not shown) of the document conveyance apparatus 400 when no document exists on the sheet stacker 401 (a sheet stacking detection sensor 412 is not detecting a sheet). Alternatively, attachment angle correction may be executed in accordance with opening/closing of the housing of the document conveyance apparatus 400.

In the document conveyance apparatus 800 (FIGS. 54 and 55) showing another example, not only at the timing when no sheet (document) is stacked on the sheet stacker 401 but also even if a sheet is stacked on the sheet stacker 401, image capturing of the facing surface member 701 by the optical sensor 311 is possible unless a document exists in the image capturing region of the optical sensor 311. That is, image capturing of the facing surface member 701 by the optical sensor 311 is possible in a state in which no sheet is being conveyed in the region of the conveyance path facing the optical sensor 311.

For example, the control unit 445 may execute attachment angle correction at the timing of starting reading (scan) of a document stacked on the sheet stacker 401 (before the first document is taken into the conveyance path by the separation roller pair 442). Before the first document is taken into the conveyance path by the separation roller pair 442, no document exists in the region facing the optical sensor 311, and image capturing of the facing surface member 301 by the optical sensor 311 is possible. More specifically, a document reading instruction is issued by an operation unit provided in the image reading apparatus or an information processing apparatus connected to the image reading apparatus, and attachment angle correction is executed before the separation roller pair 442 is driven.

Alternatively, the control unit 445 may execute attachment angle correction when passing of the trailing edge of a document conveyed from the sheet stacker 401 is detected by a pre-registration sensor 432 (that is, the trailing edge of the document is off the image capturing region of the optical sensor 311). For example, when a plurality of documents stacked on the sheet stacker 401 are continuously conveyed, the control unit 445 executes attachment angle correction immediately after the trailing edge of a document under conveyance passes through the position of the pre-registration sensor 432 (that is, between a document and a document).

Note that in the document conveyance apparatus (400 or 800) according to this embodiment, when executing attachment angle correction, the control unit 445 moves the facing surface member 701 relative to the optical sensor 311, and causes the optical sensor 311 to detect the moving amount or the moving direction of the facing surface member 701. Based on the detection result of the moving amount or the moving direction of the facing surface member 701, which is output from the optical sensor 311, the control unit 445 detects the attachment angle of the optical sensor 311 with respect to the document conveyance direction.

The document conveyance apparatus according to this embodiment may be the document conveyance apparatus 400 (FIGS. 52 and 53) or may be the document conveyance apparatus 800 (FIGS. 54 and 55). Attachment angle correction of the optical sensor 311 will be described below using the document conveyance apparatus 400 (FIGS. 52 and 53) as an example.

In the document conveyance apparatus 400, the facing surface member 701 moves up and down in accordance with up-and-down movement of the sheet stacker 401. In a state in which no document is stacked on the sheet stacker 401, the control unit 445 raises the sheet stacker 401 such that the facing surface member 701 is located in the image capturing region of the optical sensor 311. At this position, the facing surface member 701 repeats movement in a predetermined direction at a predetermined speed under the control of the control unit 445.

Figure 56:
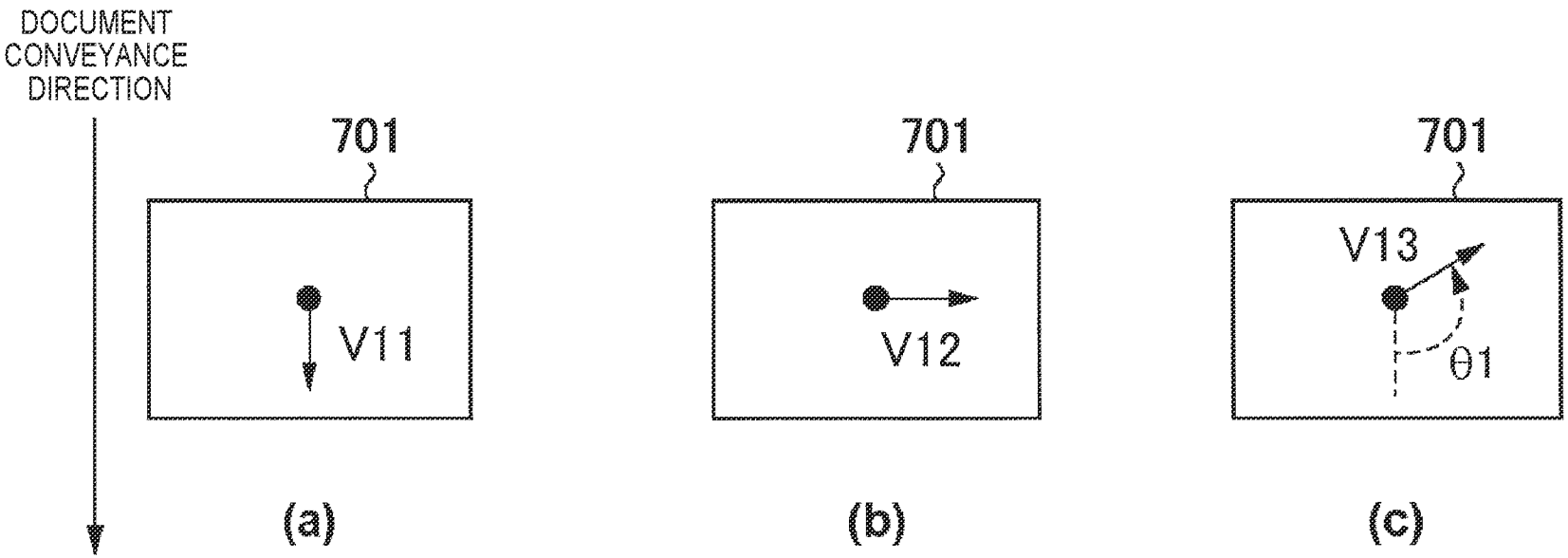
FIG. 56 shows conceptual views showing the moving direction and the moving speed of a facing surface member.

FIG. 56 shows conceptual views showing the moving direction and the moving speed of the facing surface member 701. As long as detection by the optical sensor 311 is possible in the image capturing region of the optical sensor 311, the moving direction and the moving speed of the facing surface member 701 are not limited. For example, the facing surface member 701 may move at a moving speed V11 in the document conveyance direction, as shown in FIG. 56(*a*), or may move at a moving speed V12 in a direction orthogonal to the conveyance direction, as shown in FIG. 56(*b*). Alternatively, the facing surface member 701 may move at a moving speed V13 in the direction of an arbitrary angle θ1 with respect to the document conveyance direction, as shown in FIG. 56(*c*).

As described above, when executing attachment angle correction of the optical sensor 311, the facing surface member 701 is driven by the motor 702 and moves relative to the optical sensor 311 at a predetermined speed in a predetermined direction. During this time, the optical sensor 311 detects the moving amount or the moving direction of the image capturing target (facing surface member 701) by a DSP (Digital Signal Processor) based on an image acquired by the image sensor (image capturing element).

As described above, the moving direction of the facing surface member 701 is determined in advance with respect to the document conveyance direction (that is, a moving direction relative to the document conveyance direction is predetermined). For this reason, the attachment angle of the optical sensor 311 with respect to the document conveyance direction can be acquired from the moving direction of the facing surface member 701 detected by the optical sensor 311 (movement amount detection unit).

Figure 57:
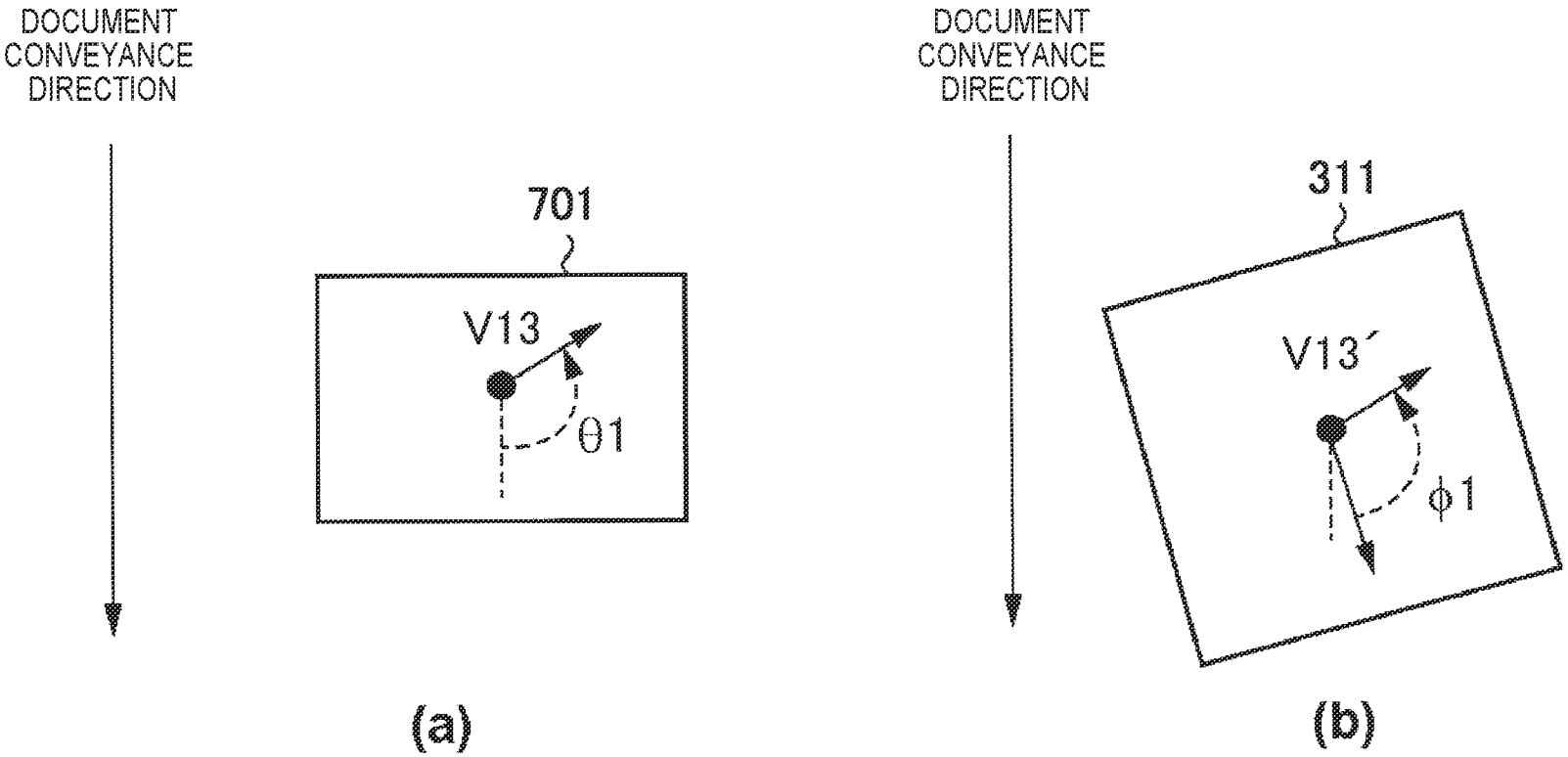
FIG. 57 shows conceptual views showing the moving direction and the moving speed of the facing surface member and the attachment angle shift of an optical sensor.

For example, as shown in FIG. 57(*a*), assume that the facing surface member 701 moves at the moving speed V13 in the direction of the angle θ1 with respect to the document conveyance direction. As shown in FIG. 57(*b*), the moving direction of the facing surface member 701 detected by the optical sensor 311 is assumed to be the direction of an angle θ1 with respect to an axis that should match the document conveyance direction if there is no deviation of the attachment angle of the optical sensor 311. In this case, the attachment angle deviation of the optical sensor 311 with respect to the document conveyance direction is (θ1-Φ1).

The control unit 445 drives the optical sensor 311 by a motor (not shown) for attachment angle correction to rotationally move the optical sensor 311 such that the above-described attachment angle deviation of (θ1-Φ1) is corrected. The attachment angle correction of the optical sensor 311 can thus be implemented.

Attachment angle correction may repetitively be executed. That is, after completion of execution of one attachment angle correction, attachment angle correction may be executed again. This can increase the correction accuracy of the attachment angle of the optical sensor 311. Additionally, when repetitively executing attachment angle correction, the moving direction and the moving speed of the facing surface member 701 may be different from those in the previous execution. The lower the moving speed of the facing surface member 701 is, the higher the detection accuracy of the moving speed of the facing surface member 701 by the optical sensor 311 is. Hence, for example, when attachment angle correction is executed in a state in which the facing surface member 701 is moved at a moving speed lower than that in the previous execution, the attachment angle of the optical sensor 311 can more effectively be corrected.

Figure 58:
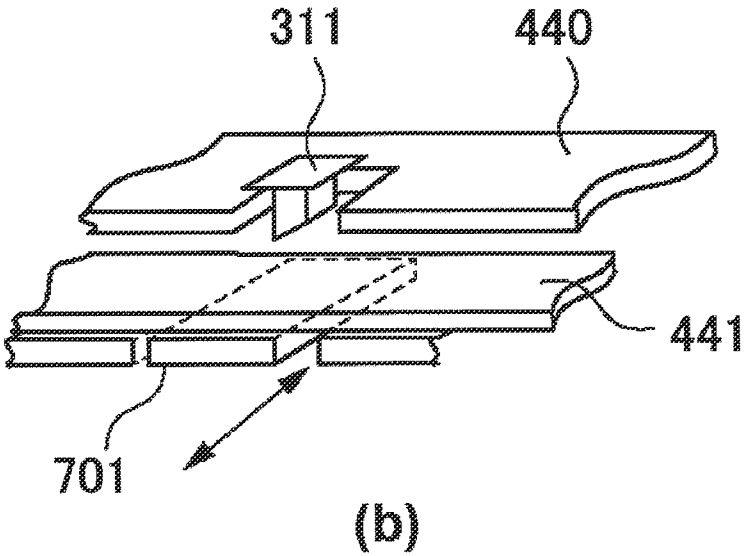
FIG. 58 shows views schematically showing an example of the configurations of the optical sensor and the facing surface member.
Figure 58:
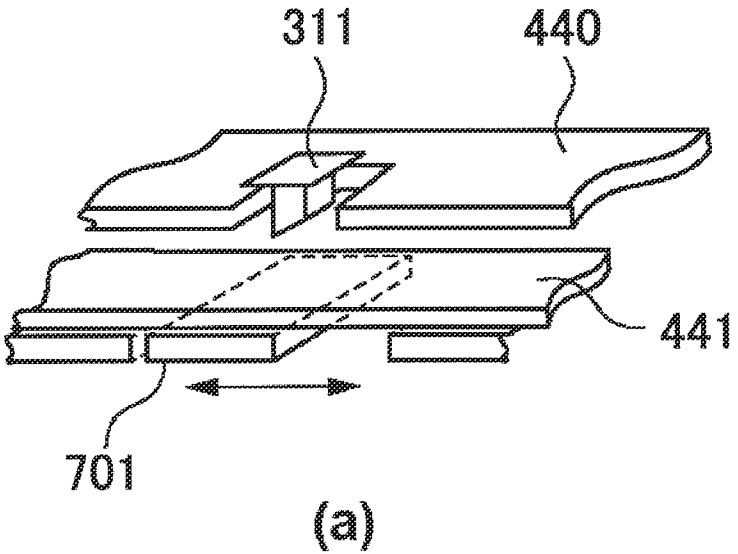

Note that the facing surface member 701 need not be in contact with the document at the time of document conveyance. For example, as shown in FIG. 58(*a*), the facing surface member 701 may be arranged via an optically transparent member that is in contact with the conveyed document. In addition, the moving direction of the facing surface member 701 may be the same as the document conveyance direction, as shown in FIG. 58(*a*), or may be a direction orthogonal to the document conveyance direction, as shown in FIG. 58(*b*). That is, as described above, as long as detection by the optical sensor 311 is possible in the image capturing region of the optical sensor 311, the moving direction of the facing surface member 701 is not limited.

In this embodiment, the moving amount or the moving direction of the facing surface member 701 is detected using the optical sensor 311 used to detect the conveyance state of a document, and the attachment angle of the optical sensor 311 with respect to the document conveyance direction is corrected based on the detection result. This can raise the detection accuracy of the document conveyance state using the optical sensor 311 at the time of document conveyance.

[12th Embodiment]

A document conveyance apparatus according to the 12th embodiment will be described next. In the 12th embodiment, another example concerning detection of the attachment angle of an optical sensor 311 will be described. Points different from the 11th embodiment will mainly be described below.

Figure 59:
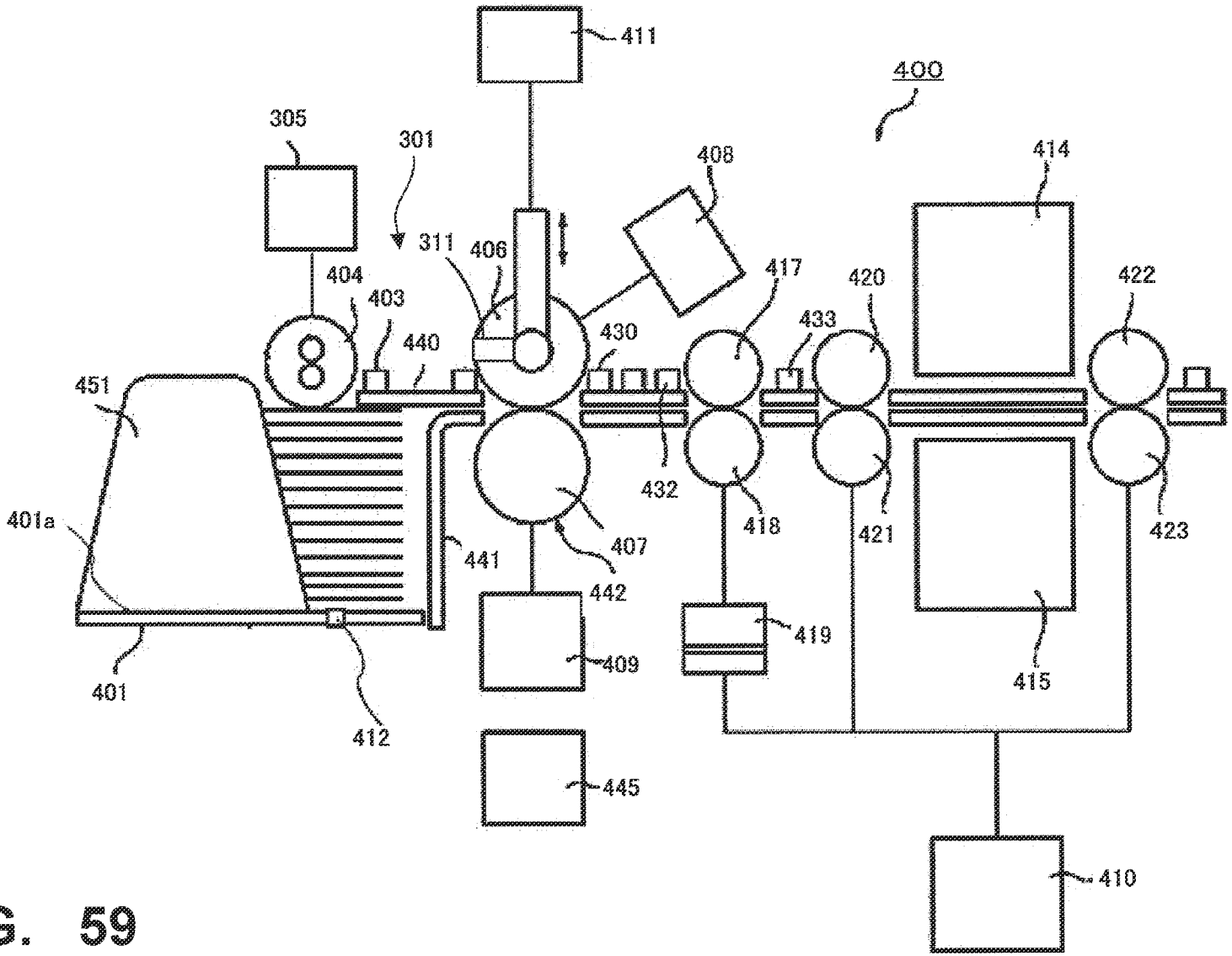
FIG. 59 is a view schematically showing the configuration of the main part of a document conveyance apparatus according to the 12th embodiment.
Figure 60:
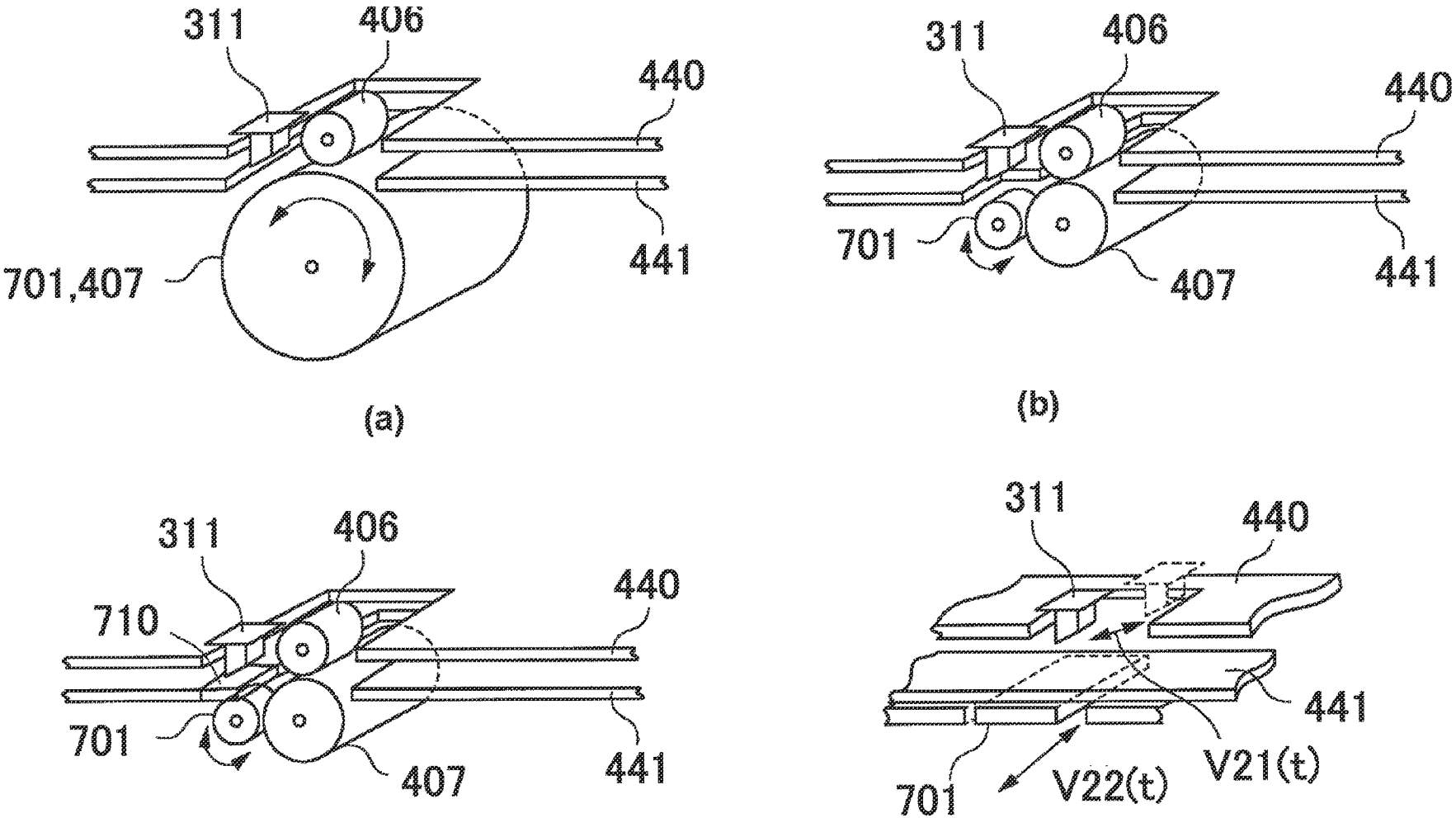
FIG. 60 shows views schematically showing an example of the configurations of an optical sensor and a facing surface member.

FIG. 59 is a sectional view schematically showing the configuration of the main part of a document conveyance apparatus according to this embodiment. FIG. 60(*a*) is a view schematically showing the configurations on the periphery of the optical sensor 311. A document conveyance apparatus 400 according to this embodiment basically has the same configuration as in the 11th embodiment. However, the position at which the optical sensor 311 is arranged is different. In this embodiment, the optical sensor 311 is arranged near a feed roller 406, as shown in FIGS. 59 and 60(*a*). In addition, the outer peripheral surface of a separation roller 407 is used as a facing surface member 701. Since the separation roller 407 is driven by a separation motor 409, a motor 702 configured to drive the facing surface member 701 is not provided in this embodiment.

Detection of the moving amount or the moving direction of the facing surface member 701 (that is, the outer peripheral surface of the separation roller 407) by the optical sensor 311 for attachment angle correction is performed at a timing when a document does not exist in the conveyance path. When executing attachment angle correction of the optical sensor 311, a control unit 445 detects the moving amount or the moving direction of the outer peripheral surface (facing surface member 701) of the separation roller 407 that is an image capturing target by the optical sensor 311 while rotating the separation roller 407 at a predetermined speed. Based on the detection result by the optical sensor 311, the control unit 445 performs attachment angle correction of the optical sensor 311 (rotational movement of the optical sensor 311) as in the above-described embodiment. Note that the rotation direction of the separation roller 407 corresponding to the facing surface member 701 when executing attachment angle correction may be clockwise or counterclockwise in FIG. 60(*a*).

In this embodiment, as shown in FIG. 60(*a*), a configuration in which the optical sensor 311 is arranged near the feed roller 406, and the diameter of the separation roller 407 is made larger than that of the feed roller 406 to use the separation roller 407 as the facing surface member 701 is employed. In general, a configuration in which the diameter of the feed roller 406 is larger than that of the separation roller 407 to allow the feed roller 406 to easily convey a sheet (document) is often employed. However, a configuration in which the diameter of the separation roller 407 is larger than that of the feed roller 406, as in this embodiment, can also be employed. In this configuration, if no sheet exists in the conveyance path, the separation roller 407 rotates together with the feed roller 406. If it is assumed that no slip occurs between the rollers, the separation roller 407 rotates at the same peripheral speed as the feed roller 406. Actually, since the rollers are in contact at a nip pressure to some extent, it is assumed that a slip rarely occurs between the feed roller 406 and the separation roller 407.

Figure 61:
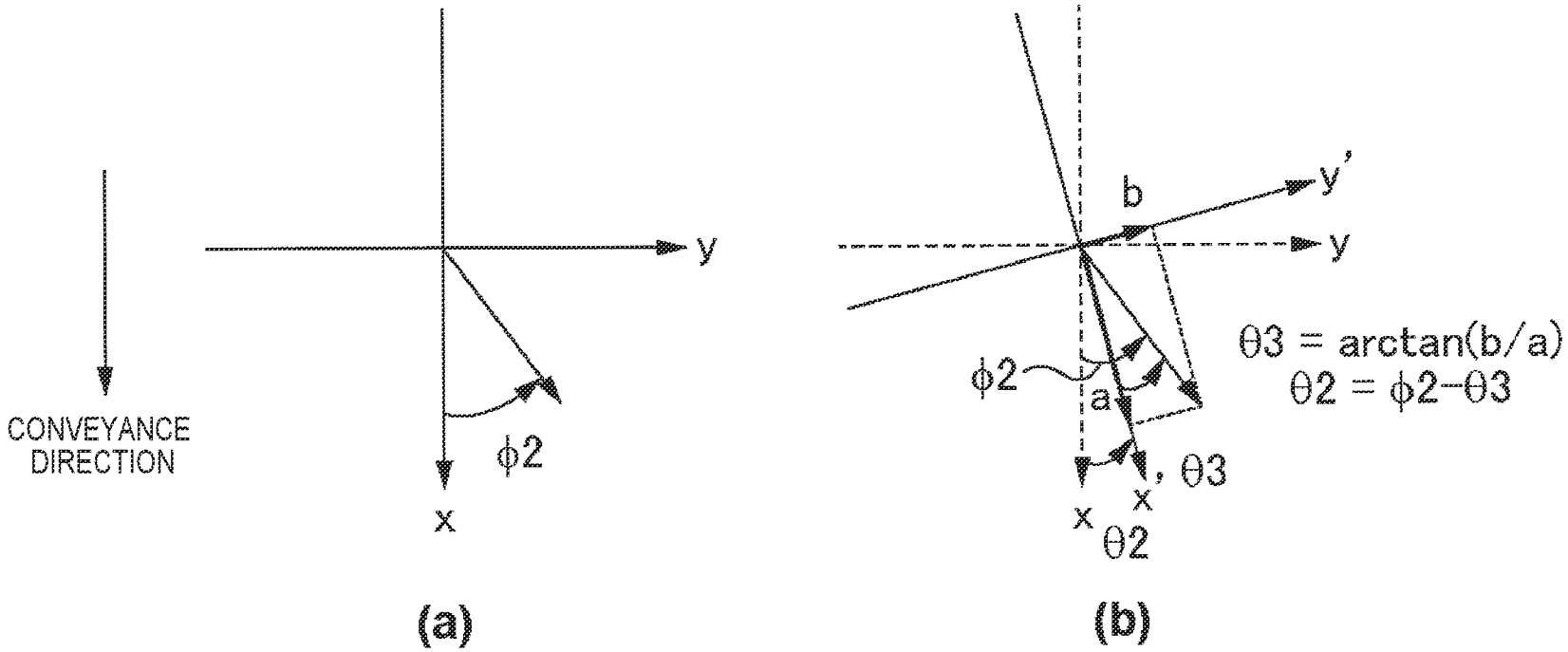
FIG. 61 shows views showing an example of the moving direction of the facing surface member and the attachment angle shift of the optical sensor.

Attachment angle correction of the optical sensor 311 will be described next in more detail. Here, as shown in FIG. 61(*a*), the document conveyance direction is defined as an x-axis, and an orthogonal coordinate system defined by the x-axis and a y-axis is used. In addition, as an orthogonal coordinate system on which the output of the optical sensor 311 can be obtained, an orthogonal coordinate system defined by a x'-axis and a y'-axis is used, as shown in FIG. 61(*b*). Note that the angle deviation between the x-axis and the x'-axis is defined as θ2. θ2 corresponds to the attachment angle deviation of the optical sensor 311 with respect to the document conveyance direction.

Assume that in a state in which the facing surface member 701 (the separation roller 407 in this embodiment) is moving in the direction of a predetermined angle φ2 with respect to the x-axis, (x', y')=(a, b) is obtained as the detection result of the moving amount by the optical sensor 311. In this case, letting θ3 be the angle of the separation roller 407 in the moving direction with respect to the x'-axis, θ3 is obtained by $$\theta 3=\arctan(b/a)$$

Furthermore, the angle deviation θ2 between the x-axis and the x'-axis is obtained by $$\theta 2=\varphi 2-\theta 3$$

Based on the detection result (x', y')=(a, b) of the moving amount of the facing surface member 701, which is acquired by the optical sensor 311, the attachment angle deviation θ2 of the optical sensor 311 with respect to the document conveyance direction (reference direction) can be acquired. Note that in this embodiment, the attachment angle deviation θ2 is acquired (calculated) by the control unit 445 of another document conveyance apparatus 800 based on the detection result of the moving amount of the facing surface member 701, which is acquired by the optical sensor 311.

Figure 62:
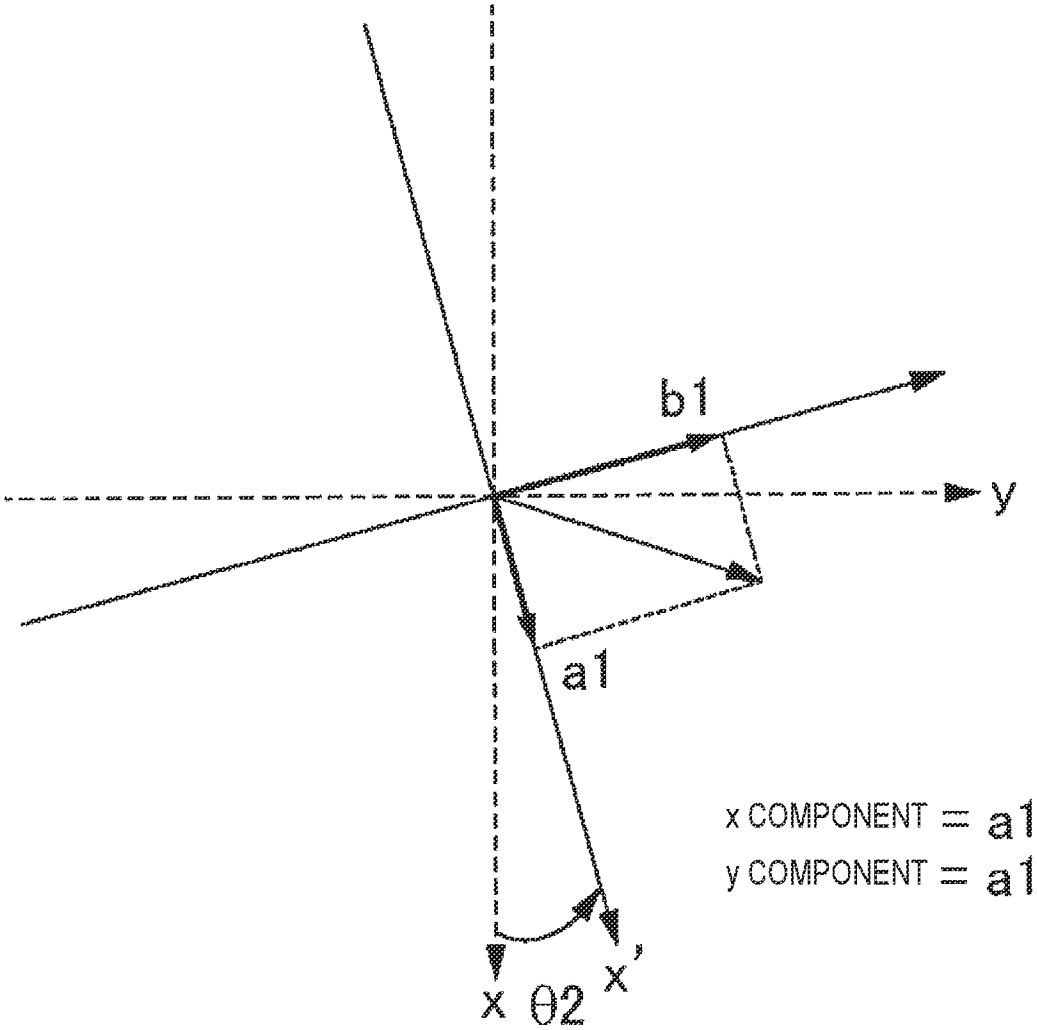
FIG. 62 is a view showing an example of coordinate conversion for correcting the attachment angle shift of the optical sensor.

When the attachment angle deviation θ2 obtained in the above-described way is used, moving amount data acquired by the optical sensor 311 at the time of document conveyance can be converted into moving amount data corresponding to the document conveyance direction on the coordinate system defined by the x-axis and the y-axis (that is, the moving direction of the document acquired at the time of document conveyance can be converted into a moving direction based on the document conveyance direction). This makes it possible to detect the behavior of the document at the time of document conveyance based on the moving amount data after conversion. More specifically, as shown in FIG. 62, moving amount data (x', y')=(a1, b1) acquired by the optical sensor 311 at the time of document conveyance can be converted (corrected) into moving amount data on the coordinate system defined by the x-axis and the y-axis, in which the attachment angle deviation θ2 of the optical sensor 311 is corrected. The coordinate conversion is performed by $$x\ \text{component}=a1\times\cos(\theta 2)-b1\times\sin(\theta 2)$$

$$y\ \text{component}=a1\times\sin(\theta 2)+b1\times\cos(\theta 2)$$

Note that instead of performing coordinate conversion of moving amount data every time the data is acquired by the optical sensor 311 at the time of document conveyance, coordinate conversion of data as a comparison target may be performed based on the attachment angle deviation θ2. More specifically, for example, the thresholds of the x component and the y component to be compared with the moving amount data acquired by the optical sensor 311 may be converted into thresholds on the coordinate system defined by the x'-axis and the y'-axis by coordinate conversion based on the attachment angle deviation θ2. When analyzing moving amount data acquired by the optical sensor 311, this can obviate the necessity of performing coordinate conversion of the moving amount data each time and reduce a processing amount needed to analyze the moving amount data.

In this embodiment, detection of (the deviation of) the attachment angle of the optical sensor 311 and attachment angle correction are performed using, as the facing surface member 701, the roller (the separation roller 407 in this example) that contributes to conveyance of a document. As a modification of the embodiment, for example, as shown in FIG. 60(*b*), another roller (rotating member) power-coupled by a power connection mechanism (not shown) with the roller (the separation roller 407 in this example) that contributes to conveyance of a document may be used as the facing surface member 701. The rotating member may be configured to contribute to conveyance of a document on the conveyance path, or may be power-coupled with the roller (the separation roller 407 in this example) that contributes to conveyance of a document only when detecting the attachment angle deviation. Alternatively, as shown in FIG. 60(*c*), the rotating member may be arranged outside the conveyance path via a transparent member 710 that forms a part of the conveyance path not to contribute to conveyance of a document. As described above, the facing surface member 701 may not contribute to conveyance of a document at the time of document conveyance, and there is no limit concerning the operation at the time of document conveyance.

Figure 63:
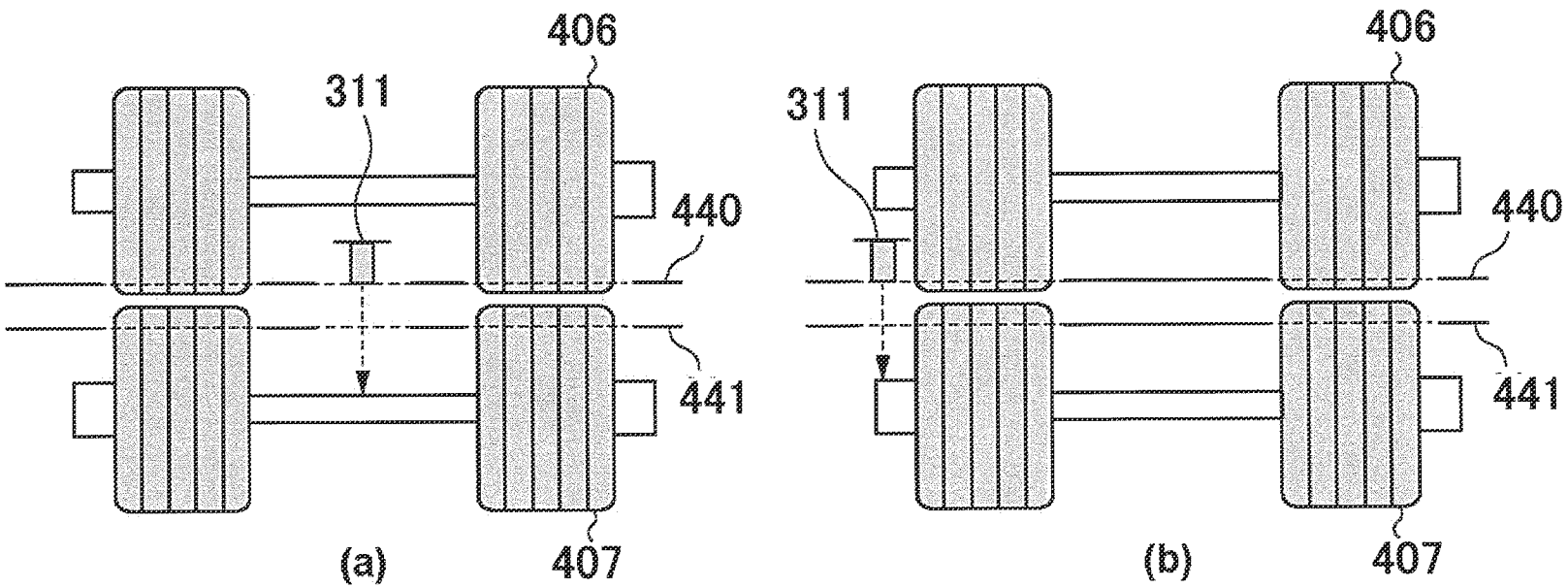
FIG. 63 shows views schematically showing an example of the configurations of the optical sensor and the facing surface member according to the 12th embodiment.

As another modification of the above-described embodiment, for example, as shown in FIG. 63, the rotating shaft of the separation roller 407 or a member connected to the rotating shaft may be used as the facing surface member 701. FIG. 63 shows schematic views showing the separation rollers 407, the feed rollers 406, and the optical sensor 311 viewed from the upstream side of the conveyance path (the near side of FIG. 63) to the downstream side (the far side of FIG. 63). In FIG. 63, a document is conveyed from the near side to the far side between an upper guide plate 440 and a lower guide plate 441. As shown in FIG. 63(*a*), the rotating shaft that rotates interlockingly with the separation rollers 407 can be used as the facing surface member 701. The arrangement shown in FIG. 63(*a*) is suitable from the viewpoint of reliably detecting the moving amount of a document because the document always passes between the two separation rollers 407 arranged along a direction orthogonal to the conveyance direction. Alternatively, as shown in FIG. 63(*b*), the outer peripheral surface of a rotating body that rotates interlockingly with the separation rollers 407 may be used as the facing surface member 701. In this case, for example, the optical sensors 311 may be arranged on the outer sides of both the two separation rollers 407, and a rotating body facing each optical sensor 311 may be used as the facing surface member 701.

According to this embodiment, a rotating member such as the separation roller 407 that contributes to conveyance of a document can be used as the facing surface member 701, and detection and correction of the attachment angle deviation of the optical sensor 311 can easily be repeated. Note that in the above-described embodiment, the separation roller 407 is used as the facing surface member 701. Similarly, the outer peripheral surface of the feed roller 406 or the like may be used as the facing surface member 701. In this case, the conveyance direction of a document conveyed by the feed roller 406 can suitably be made to match the moving direction of the facing surface member 701.

13th Embodiment

A document conveyance apparatus according to the 13th embodiment will be described next. In the above-described embodiment, the facing surface member 701 facing the optical sensor 311 is moved relative to the optical sensor 311 at a predetermined speed in a predetermined direction, and (the deviation of) the attachment angle of the optical sensor 311 is detected based on the detection result of the moving amount or the moving direction. On the other hand, in the 13th embodiment, an example in which an optical sensor 311 itself is also moved to detect and correct (the deviation of) the attachment angle of the optical sensor 311 will be described. Points different from the 11th and 12th embodiments will mainly be described below.

FIG. 60(*d*) is a view schematically showing the configuration on the periphery of the optical sensor 311. The optical sensor 311 according to this embodiment is configured to be driven by a driving mechanism (not shown) and move in a predetermined direction at a predetermined speed. For example, as shown in FIG. 60(*d*), to detect the deviation of the attachment angle of the optical sensor 311, the optical sensor 311 is controlled by a control unit 445 to move in a predetermined direction at a speed V21(t). On the other hand, a facing surface member 701 facing the optical sensor 311 is controlled by the control unit 445 to move in a predetermined direction at a speed V22(t). Note that the facing surface member 701 may be a member that moves horizontally with respect to the conveyance path surface, as shown in FIG. 60(*d*), or may be formed by a rotatable rotating member (for example, a separation roller 407), as in the above-described embodiment.

The above-described speeds V21(t) and V22(t) can be set to arbitrary speeds. For example, the relative speed of the facing surface member 701 to the optical sensor 311 is V(t)=V22(t)−V21(t). Based on this, the control unit 445 detects the deviation of the attachment angle of the optical sensor 311, as in the above-described embodiment. Also, the control unit 445 may correct the attachment angle of the optical sensor 311 based on the detected attachment angle deviation, as in the above-described embodiment. The control unit 445 may also perform coordinate conversion of moving amount data acquired by the optical sensor 311 at the time of document conveyance based on the detected attachment angle deviation.

Note that in this embodiment, the moving direction of the facing surface member 701 is not limited to the direction shown in FIG. 60(*d*), and can be set to an arbitrary direction as long as the movement of the facing surface member 701 can be detected by the optical sensor 311. FIG. 60(*d*) assumes that the facing surface member 701 moves (V22(t)≠0). However, the facing surface member 701 may be at rest or fixed (V22(t)=0).

In this embodiment, the moving direction of the facing surface member 701 is detected using the optical sensor 311 used to detect the conveyance state of a document, and the attachment angle of the optical sensor 311 with respect to the document conveyance direction is corrected based on the detection result, as in the above-described embodiment. This can raise the detection accuracy of the conveyance state of a document using the optical sensor 311 at the time of document conveyance.

14th Embodiment

A document conveyance apparatus according to the 14th embodiment will be described next. In this embodiment, as a modification of the above-described embodiments, an example in which a reference member 705 corresponding to the facing surface member 701 of the above-described embodiments can advance to and retreat from the image capturing region of an optical sensor 311 will be described. Points different from the 11th to 13th embodiments will mainly be described below.

Figure 64:
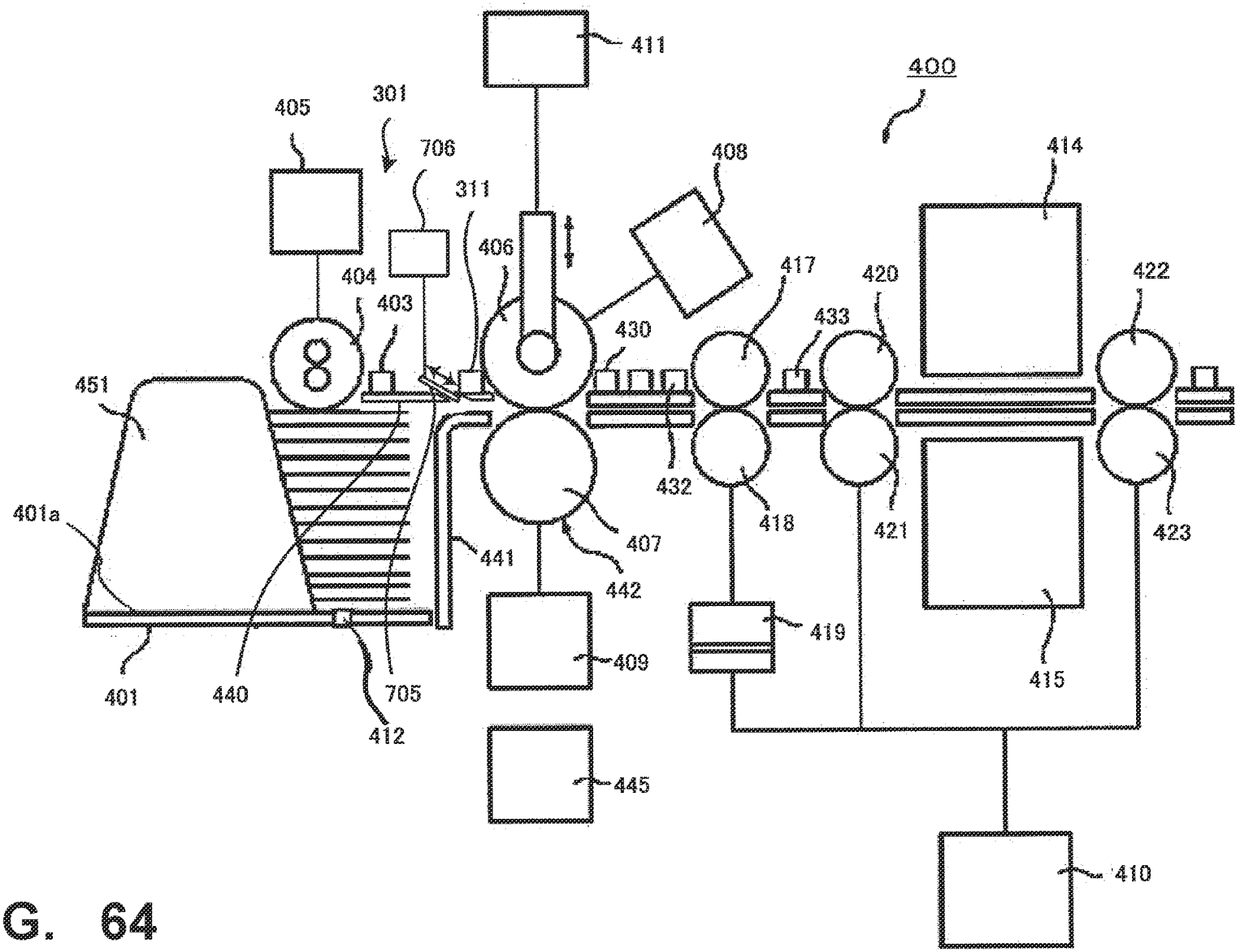
FIG. 64 is a view schematically showing the configuration of the main part of a document conveyance apparatus according to the 14th embodiment.
Figure 65:
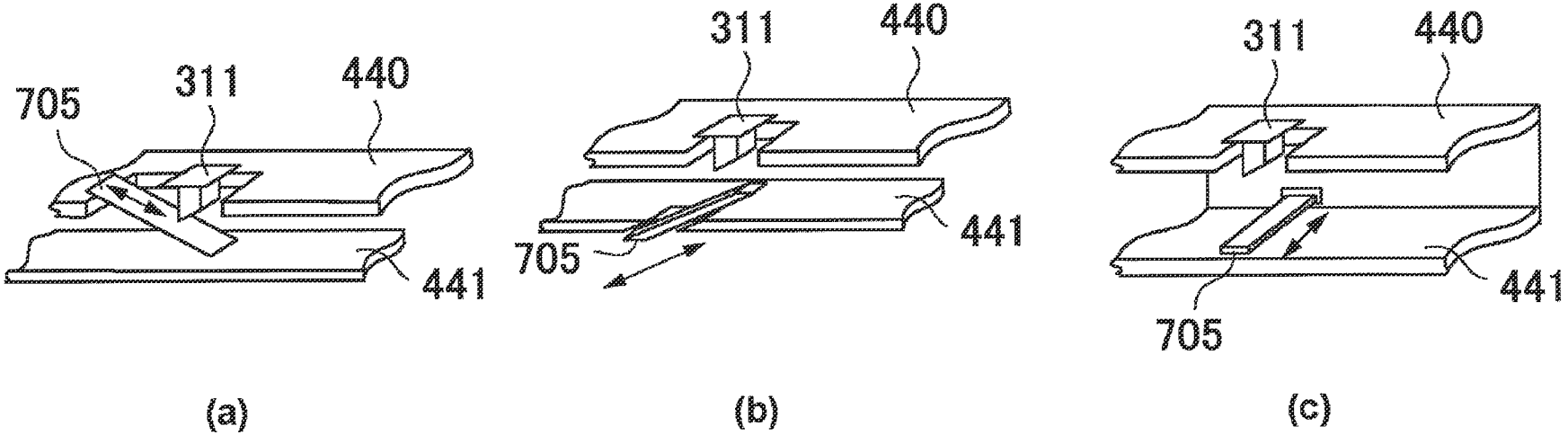
FIG. 65 shows views schematically showing examples of the configurations of an optical sensor and a facing surface member according to the 14th embodiment.

FIG. 64 is a sectional view schematically showing the configuration of the main part of a document conveyance apparatus according to this embodiment. FIG. 65(*a*) is a view schematically showing an example of the configuration and the operation of the reference member 705 corresponding to FIG. 64. In this embodiment, the reference member 705 serving as the reference of the attachment angle of the optical sensor 311, and a motor 706 configured to drive the reference member 705 are provided. The reference member 705 is driven by the motor 706 that operates in accordance with an instruction of a control unit 445. Note that the reference member 705 may be power-coupled with another motor in place of the motor 706 by a power coupling mechanism such as a power coupling clutch.

As shown in FIG. 65(*a*), the reference member 705 advances into the image capturing region of the optical sensor 311 to the downstream side in the conveyance direction in the conveyance path via an advance port provided in an upper guide plate 440 on the upstream side of the optical sensor 311 in the conveyance direction. The reference member 705 thus implements the same function as the facing surface member 701 in the above-described embodiments.

The optical sensor 311 is controlled to detect the moving amount or the moving direction of the reference member 705 to detect the deviation of the attachment angle at a timing when the reference member 705 advances into the image capturing region of the optical sensor 311 in the conveyance path. The control unit 445 detects the deviation of the attachment angle of the optical sensor 311 based on the detection result of the moving amount or the moving direction of the reference member 705 by the optical sensor 311, as in the above-described embodiments. Note that the control unit 445 may detect the deviation of the attachment angle of the optical sensor 311 based on the detection result of the moving amount or the moving direction of the reference member 705 not when the reference member 705 advances into the conveyance path but when the reference member 705 retreats out of the conveyance path. Detection of the deviation of the attachment angle of the optical sensor 311 and correction of the attachment angle may be performed both when the reference member 705 advances into the conveyance path and when the reference member 705 retreats out of the conveyance path. This can raise the attachment angle correction accuracy.

The reference member 705 may be a sheet-shaped member, as in FIG. 65(*a*), or may be a block-shaped member. The material and shape of the reference member 705 are not limited as long as it is formed by a member that enables feature point extraction when the optical sensor 311 captures the reference member 705.

As a modification of the example shown in FIG. 65(*a*), the reference member 705 may be configured to advance into the conveyance path from a lower guide plate 441 that forms the lower surface of the conveyance path, as shown in FIG. 65(*b*). Alternatively, the reference member 705 may be configured to advance into the conveyance path from a side surface of the conveyance path, as shown in FIG. 65(*c*). In this embodiment, an example in which the reference member 705 advances from the upstream side in the conveyance direction to the downstream side, as shown in FIG. 65(*a*), has been described. However, the reference member 705 may be configured to advance into the conveyance path from the downstream side in the conveyance direction to the upstream side. The reference member 705 need only be configured to be able to advance into the conveyance path and retreat out of the conveyance path and be located in the image capturing region of the optical sensor 311 when advancing into the conveyance path.

Note that as a modification of this embodiment, a document capable of advancing into the conveyance path and retreating out of the conveyance path may be used in place of the reference member 705 (facing surface member 701). The document need only be a medium conveyable by a document conveyance apparatus 400, and need not be a medium used to detect and correct the attachment angle of the optical sensor 311. In this case, a configuration that conveys the document even at the time of execution of attachment angle correction of the optical sensor 311, as in the normal document conveyance mode, to make the document corresponding to the reference member 705 advance into the conveyance path and retreat from the conveyance path can be used. As long as the moving amount or the moving direction can be detected by the optical sensor 311, the conveyance speed and the conveyance direction of the document serving as the reference member 705 are not limited. In this case, the conveyance direction and the conveyance speed of the document may be known in advance, or may be detected each time by image reading sensors 414 and 415. If the conveyance direction and the conveyance speed of the document are to be detected by the image reading sensors 414 and 415, the image reading sensors 414 and 415 and the optical sensor 311 may read the same document at the same timing. Furthermore, it is possible to raise the detection accuracy of the attachment angle deviation by acquiring the conveyance speed and the conveyance direction of the document by the image reading sensors 414 and 415, acquiring the moving amount and the moving direction of the document by the optical sensor 311, and detecting the deviation of the attachment angle of the optical sensor 311.

In this embodiment, the moving amount or the moving direction of the reference member 705 corresponding to the facing surface member 701 is detected using the optical sensor 311 used to detect the conveyance state of a document, and the attachment angle of the optical sensor 311 with respect to the document conveyance direction is corrected based on the detection result. This can raise the detection accuracy of the conveyance state of a document using the optical sensor 311 at the time of document conveyance.

The document conveyance apparatus according to the present invention has been described above in detail. However, the present invention is not limited to the above-described embodiments, and various improvements and modifications can be made without departing from the scope of the present invention. In addition, one or more of the above-described first to 14th embodiments can appropriately be combined.

Additionally, for example, when a member such as a roller configured to press a sheet conveyed in the conveyance path to the conveyance path side is used as the facing surface member 701, as described in the fifth embodiment or the like, the moving amount of the sheet can accurately be detected when the optical sensor 311 detects the moving amount of the sheet while suppressing fluttering of the conveyed sheet. In this case, it is preferable to provide a transparent member or the like at the position facing the facing surface member 701 to sandwich the sheet between these and perform detection by the optical sensor 311 at that position. As the facing surface member 701, the sheet may be held by the elasticity of a member itself, which forms the outer peripheral surface of a roller or the like. The roller that forms the facing surface member 701 may be movable when biased to the side of the optical sensor 311. The separation roller 407 according to the fifth embodiment is float-supported with respect to the feed roller 406, and has a structure close to that described here. In actuality, no nip is formed at the position of the separation roller 407 facing the optical sensor 311. However, in the vicinity, a nip is formed between the feed roller 406 and the separation roller 407, and fluttering of a sheet can be suppressed to some extent.

In the 11th to 14th embodiments, a description has been made above by showing various examples. However, the gist and scope of the present invention are not limited to a specific description in this specification, and these can also be combined. In addition, the following aspects are also incorporated, as a matter of course. The aspects will be described below.

[26th Aspect]

A document conveyance apparatus characterized by comprising:

a document table on which a document is placed;

a conveyance path in which the document placed on the document table is conveyed;

an image capturing element arranged at a position where the document conveyed from the document table can be captured and configured to receive light reflected by an image capturing target and perform photoelectric conversion;

a detection unit configured to detect a moving direction of the image capturing target based on an image acquired by the image capturing element; and a facing member arranged at a position facing the image capturing element and including a facing surface that can be captured by the image capturing element, the facing member including the facing surface configured to be movable relative to the image capturing element, wherein an attachment angle of the image capturing element with respect to a conveyance direction of the document in the conveyance path is detected based on the moving direction of the facing surface detected by the detection unit.

[27th Aspect]

The document conveyance apparatus according to the 26th aspect, characterized by further comprising a control unit configured to control the facing member such that the facing member moves in a predetermined direction at a predetermined speed relative to the image capturing element, wherein the detection unit detects the moving direction of the facing surface based on an image acquired by capturing the facing surface during movement by the image capturing element, and the control unit detects the attachment angle of the image capturing element based on the moving direction of the facing surface detected by the detection unit.

[28th Aspect]

The document conveyance apparatus according to the 26th or 27th aspect, characterized in that the facing surface is configured to be movable along the conveyance direction.

[29th Aspect]

The document conveyance apparatus according to the 28th aspect, characterized in that the facing member comprises a roller provided in the conveyance path and configured to come into contact with the document and convey the document, and the facing surface comprises an outer peripheral surface of the roller.

[30th Aspect]

The document conveyance apparatus according to the 28th aspect, characterized by further comprising a roller provided in the conveyance path and configured to come into contact with the document and convey the document, wherein the facing member comprises a rotating member capable of rotating interlockingly with the roller, and the facing surface comprises an outer peripheral surface of the rotating member.

[31st Aspect]

The document conveyance apparatus according to the 28th aspect, characterized by further comprising a roller provided in the conveyance path and configured to come into contact with the document and convey the document, wherein the facing member comprises a rotating shaft configured to rotate interlockingly with the roller, and the facing surface comprises an outer peripheral surface of the rotating shaft.

[32nd Aspect]

The document conveyance apparatus according to the 28th aspect, characterized by further comprising a roller provided in the conveyance path and configured to come into contact with the document and convey the document, wherein the facing member comprises a rotating body connected to a rotating shaft of the roller and configured to rotate interlockingly with the roller, and the facing surface comprises an outer peripheral surface of the rotating body.

[33rd Aspect]

The document conveyance apparatus according to any one of the 26th to 32nd aspects, characterized in that the image capturing element is configured to be movable relative to the facing surface when capturing the facing surface.

[34th Aspect]

The document conveyance apparatus according to the 33rd aspect, characterized in that when the image capturing element captures the facing surface, both the facing surface and the image capturing element move.

[35th Aspect]

The document conveyance apparatus according to the 26th or 27th aspect, characterized in that the facing member comprises a member configured to advance into an image capturing region where the image capturing element can perform image capturing and retreat from the image capturing region.

[36th Aspect]

The document conveyance apparatus according to the 27th aspect, characterized in that the control unit further rotationally moves the image capturing element based on the detection result of the attachment angle to correct the attachment angle of the image capturing element.

[37th Aspect]

The document conveyance apparatus according to the 36th aspect, characterized by further comprising a document separation unit configured to separate and convey a plurality of documents as a conveyance target one by one, wherein the image capturing element and the facing member are arranged on an upstream side of the document separation unit in the conveyance direction.

[38th Aspect]

The document conveyance apparatus according to the 37th aspect, characterized in that the control unit has a calibration mode used to execute attachment angle correction of the image capturing element at a timing when no document is placed on the document table.

[39th Aspect]

The document conveyance apparatus according to the 37th or 38th aspect, characterized in that upon detecting that a trailing edge of a last document of a plurality of documents placed on the document table has passed through the document separation unit, the control unit executes the attachment angle correction of the image capturing element.

[40th Aspect]

The document conveyance apparatus according to the 36th aspect, characterized by further comprising a document separation unit configured to separate and convey a plurality of documents as a conveyance target one by one, wherein the image capturing element and the facing member are arranged on a downstream side of the document separation unit in the conveyance direction.

[41st Aspect]

The document conveyance apparatus according to the 40th aspect, characterized in that when a start of conveyance of the document placed on the document table is instructed, the control unit executes the attachment angle correction of the image capturing element.

[42nd Aspect]

The document conveyance apparatus according to the 40th or 41st aspect, characterized by further comprising a sensor provided on the downstream side of the image capturing element in the conveyance path and configured to detect the conveyed document, wherein when a trailing edge of the conveyed document is detected by the sensor, the control unit executes the attachment angle correction of the image capturing element.

[43rd Aspect]

The document conveyance apparatus according to the 27th aspect, characterized in that the control unit further converts the moving direction detected by the detection unit concerning the document conveyed from the document table into a moving direction using the conveyance direction as a reference based on the detection result of the attachment angle.

[44th Aspect]

The document conveyance apparatus according to the 27th aspect, characterized in that concerning data of a coordinate system defined by an axis along the conveyance direction and an axis along a direction orthogonal to the conveyance direction, which is data to be compared with the detection result of the moving direction of the document by the detection unit, the control unit further performs coordinate conversion to a coordinate system corresponding to the detection result of the attachment angle.

[45th Aspect]

The document conveyance apparatus according to any one of the 26th to 44th aspects, characterized by further comprising an image reading unit provided, in the conveyance path, on the downstream side of the image capturing element in the conveyance direction and configured to read an image of the document.

There has conventionally been proposed a technique of detecting the moving amount of a document in the conveyance direction for the purpose of detecting whether the document is normally being conveyed in a document conveyance apparatus (related art 1 described above). In related art 1, using an encoder configured to detect the moving amount of the document in the conveyance direction and an optical sensor configured to measure a displacement amount in a specific first detection direction that is not orthogonal to the conveyance direction, the displacement amount in the conveyance direction is obtained from the optical sensor, and a skew amount is obtained from the displacement amounts in the first detection direction and a second detection direction. Furthermore, a displacement amount in the conveyance direction is obtained using the skew amount and the displacement amount from the encoder. However, in the technique of detecting the document conveyance direction using the optical image capturing element (optical sensor), as described above, if the attachment angle of the image capturing element with respect to the document conveyance direction includes a deviation, the detection accuracy of the document conveyance direction lowers. The deviation of the attachment angle of the image capturing element is often deviated from an attachment error at the time of attachment of the image capturing element. In addition, factors of the deviation of the attachment angle include a vibration applied to the apparatus by opening/closing a unit to which the image capturing element is attached or opening/closing another unit, expansion/contraction of a material caused by aging or a temperature change, and a change in the attachment angle, which occurs when the user touches the image capturing element.

On the other hand, in the 11th to 14th embodiments of the present invention, with the above-described configurations, in a document conveyance apparatus capable of conveying a document, the deviation of the attachment angle of an image capturing element used to detect a document conveyance state can be detected. It is therefore possible to correct the attachment angle of the image capturing element and more accurately detect the conveyance state of the document. To correct the attachment angle, the image capturing element itself is driven by a motor, or coordinate conversion is performed based on the attachment angle of the image capturing element.

In the following embodiment, the relationship between the optical sensor 311 and another optical sensor will be described.

15th Embodiment

<Close Arrangement of Optical Sensor 311 and Other Optical Sensors>

A document conveyance apparatus 400 according to this embodiment has the configuration shown in FIGS. 26 and 27.

An optical sensor 311 in the document conveyance apparatus 400 according to this embodiment has a periphery covered with a case body 312 formed by a mold member and a transparent plate, as shown in FIG. 34.

An example of the configuration of the optical sensor 311 in a case in which the optical sensor 311 and other optical sensors according to this embodiment are arranged close will be described next with reference to FIGS. 66 to 70.

In the document conveyance apparatus 400, not only the optical sensor 311 but also other optical sensors are sometimes mounted (implemented). For example, a sheet detection sensor 403, a pre-registration sensor 432, a middle-registration sensor, and a post-registration sensor 433 described in the above-described embodiments are examples of optical sensors different from the optical sensor 311. These sensors are sometimes implemented on the same board to reduce the size of the apparatus or suppress the cost. An example in which the optical sensor 311 is implemented on the same board as the other optical sensors will be described here.

Figure 66:
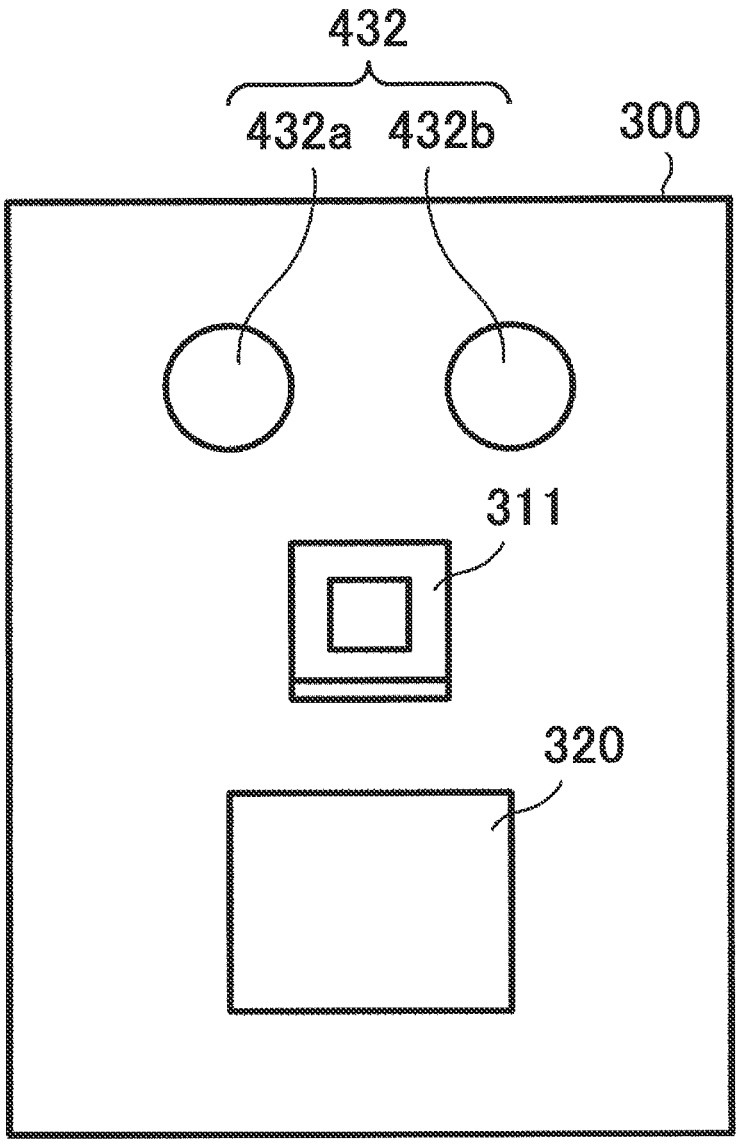
FIG. 66 is a plan view showing an example of the configuration of a board in a case in which a plurality of optical sensors according to the 15th embodiment are implemented on the same board.

FIG. 66 is a plan view showing an example of the configuration of a board in a case in which a plurality of optical sensors are implemented on the same board. In the example shown in FIG. 66, not only the optical sensor 311 but also the pre-registration sensor 432 and an MCU (Micro Controller Unit) 320 configured to control the sensors are implemented on a board 300. The pre-registration sensor 432 is formed by a light emitting element 432*a* and a light receiving element 432*b*. Note that in addition to the optical sensor 311, sensors other than the pre-registration sensor 432 may be implemented on the board 300, or a plurality of optical sensors may be implemented.

An optical sensor often handles analog signals and thus tends to be sensitive to noise. In this embodiment, to minimize the influence of noise, the sensors (the optical sensor 311 and the pre-registration sensor 432) are implemented on the same board as the MCU 320 that is a control circuit (control IC) configured to control the sensors. More specifically, to prevent document detection accuracy from lowering in a case in which an optical sensor having a configuration for outputting an analog signal is used as the pre-registration sensor 432, the MCU 320 and the pre-registration sensor 432 are implemented on the same board.

If the sensors are arranged on one board 300, the smaller the area of the board 300 is made, the shorter the distance between the optical sensors need to be. In this case, light output from the light emitting element of one optical sensor may be received by the light receiving element of another optical sensor, and an operation error may occur in the other optical sensor.

Figure 67:
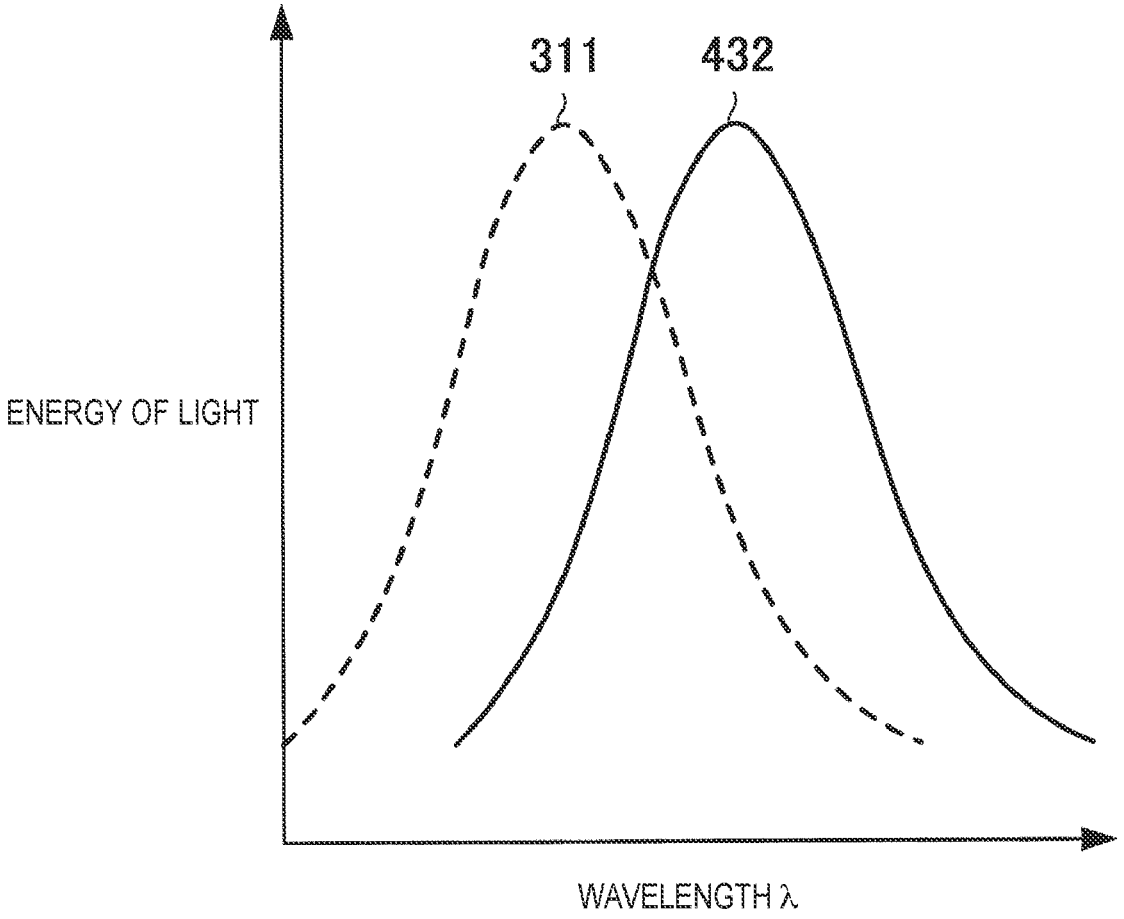
FIG. 67 is a view showing an example of the spectral characteristic of light of each of the optical sensor and a pre-registration sensor according to the 15th embodiment.

FIG. 67 shows an example of the spectral characteristic of light of each of the optical sensor 311 and the other optical sensor (the pre-registration sensor 432 in this example). The optical sensor 311 preferably uses light in the near infrared region with a wavelength of about 850 nm, as described above. On the other hand, the optical sensor used as the pre-registration sensor 432 also uses light in the near infrared region with a wavelength of about 800 to 950 nm in some cases. In this case, even if an optical sensor of a type different from the optical sensor 311 is used as the pre-registration sensor 432, the wavelengths used by the two optical sensors may be close, as shown in FIG. 67. As a result, light output from one of the two optical sensors (the optical sensor 311 and the pre-registration sensor 432 in this example) may be received by the other sensor (that is, interference occurs), and an operation error may occur in the other sensor.

<Configuration for Preventing Interference between Optical Sensors>

In this embodiment, an example of the configuration of a case body (housing) configured to cover the board 300 and prevent interference as described above from occurring between the optical sensor 311 and the other optical sensor (the pre-registration sensor 432 in this example) implemented on the same board 300 will be described.

Figure 68:
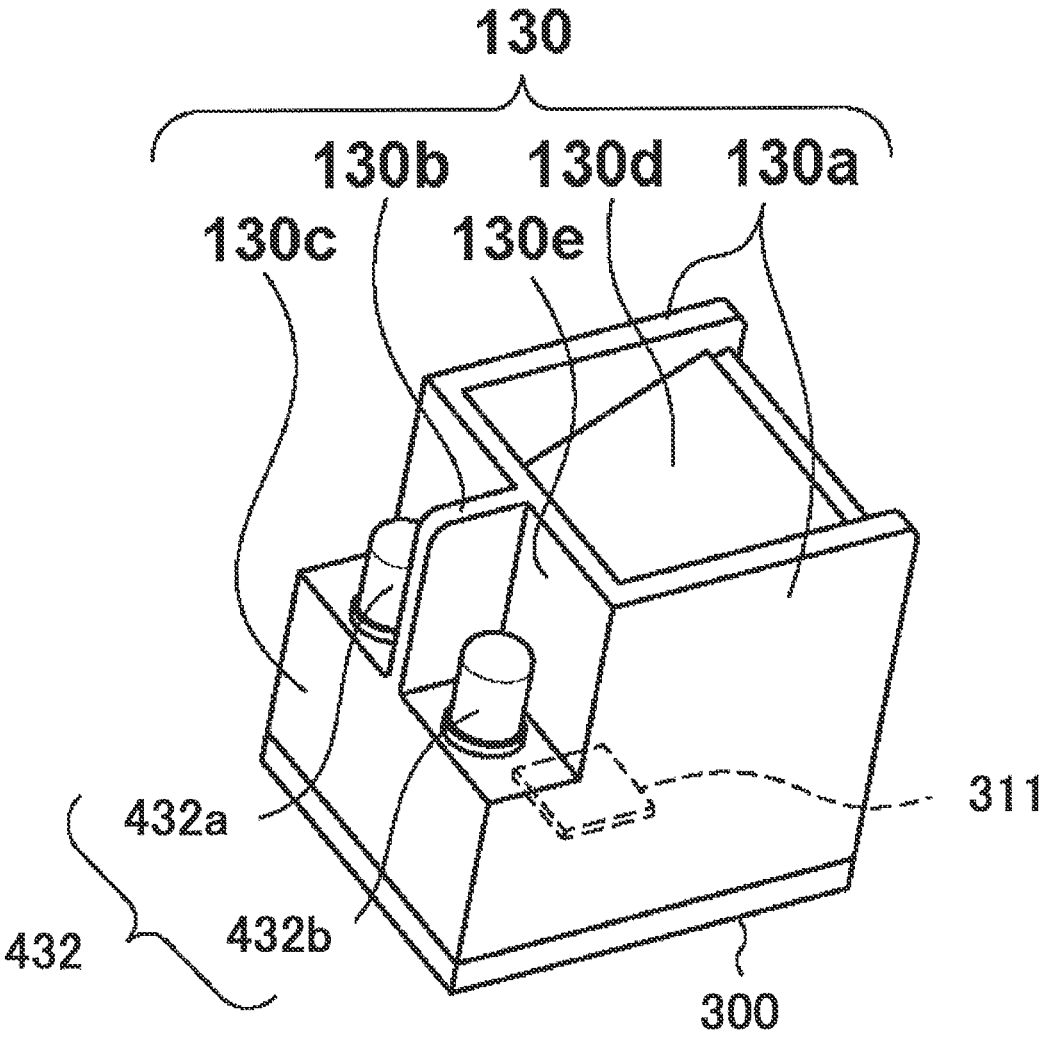
FIG. 68 is a perspective view showing an example of the configuration of a module including the optical sensor and the pre-registration sensor according to the 15th embodiment.

FIG. 68 is a perspective view showing an example of the configuration of a module including the optical sensor 311 and the pre-registration sensor 432 that is the other optical sensor. The pre-registration sensor 432 is formed by the light emitting element 432*a* and the light receiving element 432*b*. Reflected light of light output from the light emitting element 432*a* is received by the light receiving element 432*b*, and a signal corresponding to the light receiving amount of the reflected light is output from the light receiving element 432*b*. Note that a sensor having another configuration may be used as the pre-registration sensor 432.

As shown in FIG. 68, a case body 130 is attached to the board 300. The case body 130 has a configuration in which the function of the case body 312 shown in FIG. 34 and a light shielding mechanism between the optical sensors are integrated. A mold member 130*a* and a light transmitting plate 130*d*, which form parts of the case body 130, are portions corresponding to the case body 312 shown in FIG. 34 and cover the periphery of the optical sensor 311 implemented on the board 300. The mold member 130*a* forms walls that surround the optical sensor 311 on the board 300. The light transmitting plate 130*d* is provided at a position facing the optical sensor 311 to close a space surrounded by the mold member 130*a*. With this configuration, like the case body 312, it is possible to prevent paper powder from directly sticking to the optical sensor 311 and prevent paper powder from erroneously being detected as a feature point. When the case body 312 is fixed to the board 300, the optical sensor 311 and the pre-registration sensor 432 can be covered.

The case body 130 includes a mold member 130*c* arranged adjacent to the mold member 130*a*. The mold member 130*c* forms an arrangement surface configured to arrange the pre-registration sensor 432 (the light emitting element 432*a* and the light receiving element 432*b*). The arrangement surface extends from the mold member 130*a* to a lateral side, and has an area capable of arranging the pre-registration sensor 432. Note that the interior of the mold member 130*c* may be hollow. In addition, the mold member 130*c* may be formed integrally with the mold member 130*a*, or may be formed by connecting plate-shaped members. A portion of the mold member 130*a*, which is adjacent to the mold member 130*c*, forms a partition 130*e* between the pre-registration sensor 432 and the optical sensor 311, as will be described later. Note that the light emitting element 432*a* and the light receiving element 432*b* of the pre-registration sensor 432 may be implemented on the board 300 and arranged on the arrangement surface by extending through holes provided in the arrangement surface of the mold member 130*c*.

As shown in FIG. 68, the partition 130*e* (first light shielding wall) is located between the optical sensor 311 and the pre-registration sensor 432 to partition between the optical sensor 311 and the light emitting element 432*a* and the light receiving element 432*b* of the pre-registration sensor 432. The partition 130*e* is thus provided as a light shielding wall configured to shield light so light output from the light emitting element of one of the optical sensor 311 and the pre-registration sensor 432 does not enter the other sensor. For example, the partition 130*e* functions as a light shielding wall configured to prevent light output (emitted) from the light emitting element 432*a* of the pre-registration sensor 432 from being received by the optical sensor 311 (via the light transmitting plate 130*d*).

The partition 130*e* is formed to have, as a height from the surface of the board 300, a height more than the height to provide the light transmitting plate 130*d* (that is, a height more than the height to arrange the highest part of the light transmitting plate 130*d*) so as to have a height enough to shield light from the light emitting element 432*a*. In addition, side surfaces (side surfaces along a direction orthogonal to the array direction of the light emitting element 432*a* and the light receiving element 432*b*) that are parts of the mold member 130*a* adjacent to the partition 130*e* are also formed to have a height almost equal to the partition 130*e* to prevent unnecessary light from entering the optical sensor 311.

With this configuration, it is possible to position the pre-registration sensor 432 while preventing light output from the light emitting element 432*a* of the pre-registration sensor 432 from entering the optical sensor 311. It is also possible to prevent a part of light that is output from the light emitting element 432*a*, passes through a light guide body (not shown), and enters the light receiving element 432*b* from entering the optical sensor 311.

The case body 130 includes, on the mold member 130*a*, a mold member 130*b* (second light shielding wall) that forms a partition projecting from the mold member 130*a* to a lateral side between the light emitting element 432*a* and the light receiving element 432*b*. The mold member 130*b* is formed continuously from the partition 130*e* (in contact with the partition 130*e*) that is a part of the mold member 130*a*. The mold member 130*b* is provided as a light shielding wall configured to prevent light output from the light emitting element 432*a* from directly entering the light receiving element 432*b*.

The mold members 130*a*, 130*b*, and 130*c* are integrally formed (that is, formed by one mold member). This is effective to operate the sensors while preventing interference between the sensors even if the area of the board 300 on which the optical sensor 311 and the pre-registration sensor 432 are implemented is relatively small.

As described above, the case body 130 according to this embodiment forms a light shielding wall configured to prevent interference from the pre-registration sensor 432 arranged together with the optical sensor 311 on the board 300 to the optical sensor 311 while preventing unnecessary light from entering the optical sensor 311.

Figure 69:
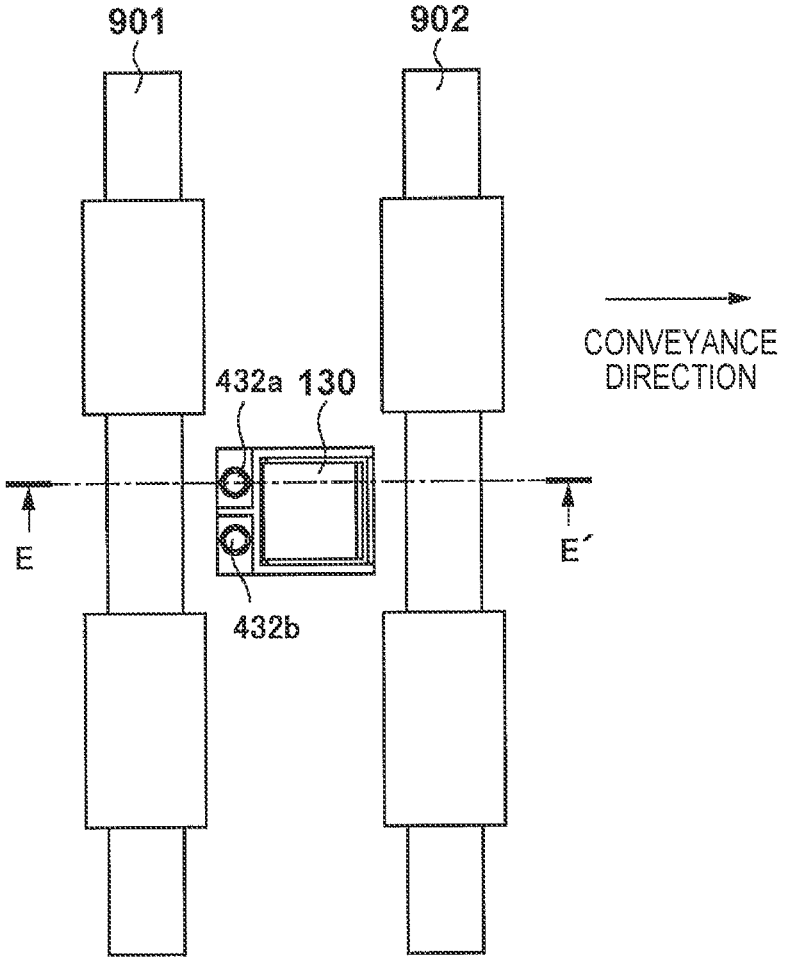
FIG. 69 shows a plan view and a sectional view showing an example of the arrangement of a module shown in FIG. 68 and conveyance roller.
Figure 69:
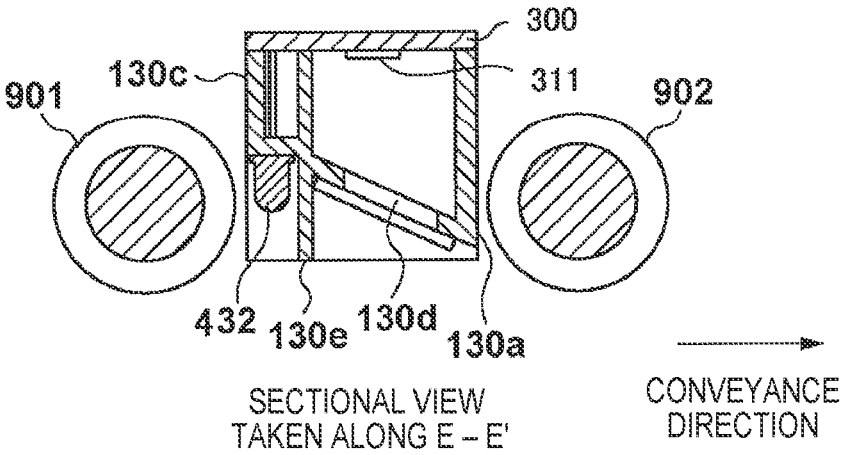

An example in which the module shown in FIG. 68 is arranged between a conveyance roller 901 and a conveyance roller 902 will be described next. FIG. 69(*a*) is a plan view showing an example of the arrangement of the module shown in FIG. 68 and the conveyance rollers 901 and 902 when the document conveyance apparatus 400 is viewed from the upper side. In this embodiment, a member that holds the conveyance roller 901 extends and holds the board 300 on which the optical sensor 311 and the pre-registration sensor 432 are mounted and the case body 130. The conveyance roller 901 arranged on the upstream side in the conveyance direction of a document (sheet) is, for example, a feed roller 406 or a separation roller 407. The conveyance roller 902 arranged on the downstream side is, for example, a registration roller 417 or 418.

FIG. 69(*b*) is a sectional view taken along a line E-E in the configuration shown in FIG. 69(*a*). In this example, the optical sensor 311 and the pre-registration sensor 432 are covered with the case body 130. The mold member 130*a* and the light transmitting plate 130*d*, which form a part of the case body 130, cover the optical sensor 311 in a state in which the shape of the case body 312 shown in FIG. 34(*b*) is maintained. The partition 130*e* implements shielding of light output from the pre-registration sensor 432 and moving toward the optical sensor 311. In addition, by the mold member 130*c*, it is possible to shield light output from the pre-registration sensor 432 and directly moving toward the optical sensor 311 and position the sensors.

Note that the other sensor implemented together with the optical sensor 311 on the board 300 may be an optical sensor other than the pre-registration sensor 432. In addition, a plurality of optical sensors may be implemented on the board 300 together with the optical sensor 311.

<Document Detection Processing>

According to the configuration example shown in FIGS. 68 and 69 described above, the pre-registration sensor 432 and the optical sensor 311 can be arranged close on a conveyance path 900 in the document conveyance apparatus 400. In this case, as will be described below, not only the presence/absence of a document (sheet) on the conveyance path 900 but also a document (sheet) such as an OHP sheet with high transparency can be discriminated using the two optical sensors. Based on the discrimination result, image processing suitable for the document with high transparency can be performed for image data obtained by document reading by image reading sensors 414 and 415. Note that in the following example, the conveyance roller 901 is formed by the feed roller 406 or the separation roller 407, and the conveyance roller 902 is formed by the registration roller 417 or 418.

Here, detection of the presence/absence of a document using the pre-registration sensor 432 can be done as follows. More specifically, the MCU 320 causes the light emitting element 432*a* to output light, monitors an output value from the light receiving element 432*b* corresponding to the light receiving amount, and detects the presence/absence of a document based on a result of comparison between the output value and a predetermined threshold. More specifically, in this embodiment, light emitted from the light emitting element 432*a* is guided by a light guide body provided at a position facing across the conveyance path, and the light receiving element 432*b* receives the light that has returned again across the conveyance path, thereby performing the detection. If a document exists in a region irradiated with the light emitted from the light emitting element 432*a*, the light is shielded by the document. Hence, the light receiving amount of the light receiving element 432*b* becomes small. The presence/absence of a document can be detected based on such a change in the light receiving amount of the light receiving element 432*b*. For example, in a case in which the light receiving element 432*b* has an output characteristic that the output value becomes small as the light receiving amount becomes large, if the light receiving amount is equal to or larger than a threshold, the MCU 320 determines that a document exists. If the light receiving amount is smaller than the threshold, the MCU 320 determines that no document exists.

However, if the transparency of the document is high (the document has transparency), the light output from the light emitting element 432*a* is not sufficiently shielded by the document, and the light receiving amount of the light receiving element 432*b* does not become small. For this reason, if a document with high transparency is irradiated with the light output from the light emitting element 432*a*, a determination result representing absence of a document is obtained from the output value of the light receiving element 432*b* depending on the setting of the above-described threshold. In this example, a document having high transparency is discriminated using the characteristic of the pre-registration sensor 432 and the optical sensor 311 arranged close.

As described above, based on a captured image acquired by the image capturing element, the optical sensor 311 detects the moving amount of a document using a feature point extracted from the image. When the optical sensor 311 is used, a fine flaw of the like on a document surface can be detected as a feature point even for a document with high transparency, and the document can be detected. Hence, when the above-described threshold is set not to detect a document with high transparency by the pre-registration sensor 432, a document with high transparency can be discriminated using the optical sensor 311.

Figure 70:
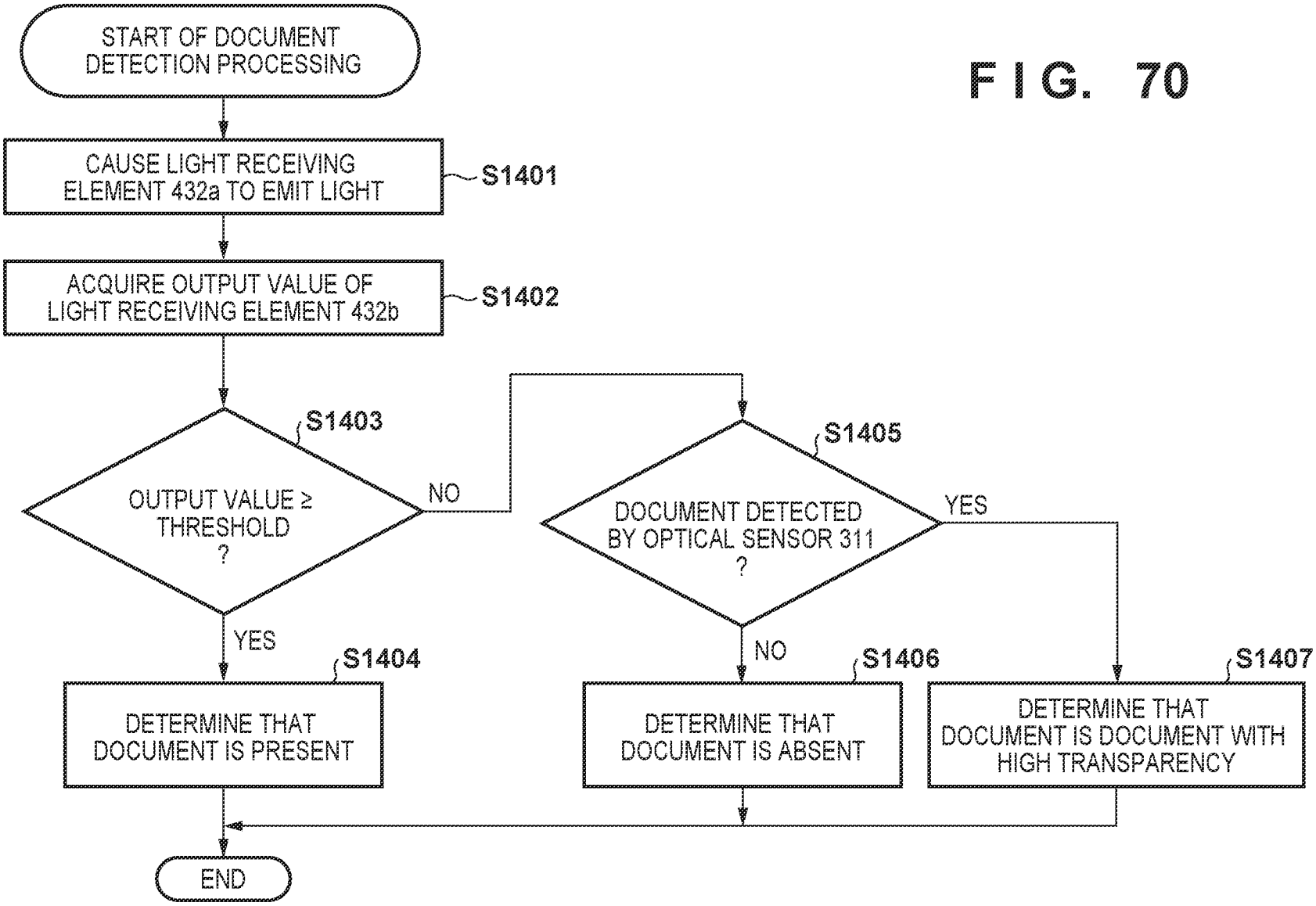
FIG. 70 is a flowchart showing the procedure of document detection processing including discrimination of a document with high transparency in the 15th embodiment.

FIG. 70 is a flowchart showing the procedure of document detection processing including discrimination of a document with high transparency in the document conveyance apparatus 400 according to this embodiment. The processes of steps in FIG. 70 can be executed by, for example, the MCU 320. Alternatively, one or more CPUs included in a control unit 445 may read out and execute a control program stored in a storage device (not shown), thereby implementing the processes in the document conveyance apparatus 400. In the following document detection processing, the MCU 320 determines, based on the detection result of a document by the pre-registration sensor 432 and the detection result of the moving amount of the document by the optical sensor 311, whether a document is a document with high transparency.

First, the MCU 320 causes the light emitting element 432*a* to perform light emission and output light in step S1401, and acquires the output value from the light receiving element 432*b* in step S1402. After that, in step S1403, the MCU 320 determines whether the acquired output value is equal to or larger than the threshold. If the output value is equal to or larger than the threshold, the MCU 320 advances the process to step S1404. In step S1404, the MCU 320 outputs a determination result representing the presence of a document and ends the processing. On the other hand, if the acquired output value is smaller than the threshold (that is, if a determination result representing the absence of a document is obtained based on the output value from the pre-registration sensor 432), the MCU 320 advances the process from step S1403 to step S1405.

In step S1405, the MCU 320 determines whether a document is detected by the optical sensor 311 (that is, whether movement of a document is detected). If a document is not detected by the optical sensor 311, the MCU 320 advances the process to step S1406, outputs a determination result representing the absence of a document, and ends the processing. On the other hand, if a document is detected by the optical sensor 311, the MCU 320 advances the process from step S1405 to step S1407, outputs a determination result representing that a document with high transparency is detected, and ends the processing. In this way, if a document is not detected by the pre-registration sensor 432 ("NO" in step S1403), and movement of a document is detected by the optical sensor 311 ("YES" in step S1405), the MCU 320 determines that it is a document with high transparency.

In the above-described example, document detection processing using a combination of the pre-registration sensor 432 and the optical sensor 311 has been described. However, an optical sensor other than the pre-registration sensor 432 can also be used. Alternatively, the optical sensor 311 configured to detect the moving amount of a document can be used in place of the pre-registration sensor 432. That is, regardless of whether a document has high transparency, the presence/absence of a document can be determined based on a moving amount detected using the optical sensor 311 in place of the pre-registration sensor 432. Note that in the arrangement as shown in FIGS. 68 and 69, the pre-registration sensor 432 and the optical sensor 311 are arranged adjacently. Hence, if a document is not detected by the pre-registration sensor 432, document detection by the optical sensor 311 can immediately be performed. Furthermore, the pre-registration sensor 432 and the optical sensor 311 are preferably arranged side by side in the conveyance direction. On the other hand, if the pre-registration sensor 432 and the optical sensor 311 are apart to some extent, the time of conveying a document in the interval may be calculated backward from the conveyance speed, and detection by the optical sensor 311 may be executed after waiting for the time.

Detailed Configuration Example

Figure 71:
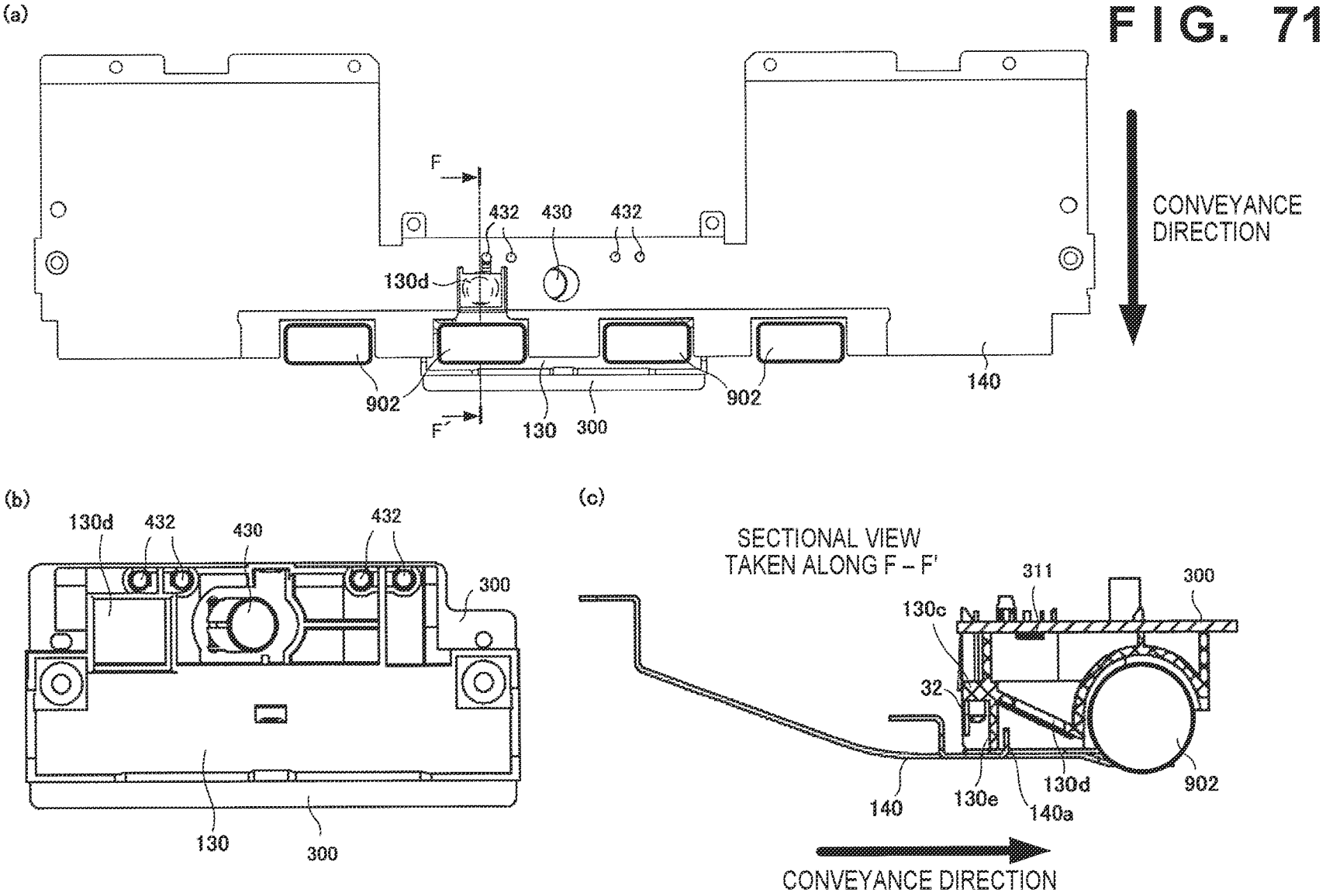
FIG. 71 shows a bottom view and a sectional view showing an example of the arrangement of a board and a case body in the conveyance path of the document conveyance apparatus according to the 15th embodiment.

A more detailed example of the configuration of the optical sensor 311 and the pre-registration sensor 432 implemented on the board 300 and the case body 130 will be described next with reference to FIG. 71. FIG. 71(*a*) is a bottom view showing an example of the arrangement of the board 300 and the case body 130 in the conveyance path of the document conveyance apparatus 400.

Referring to FIG. 71(*a*), a metal plate 140 that forms the conveyance path forms a part of an upper guide plate 440 shown in FIGS. 26 and 27. The conveyance roller 902 corresponds to the registration roller 417 shown in FIGS. 26 and 27. The board 300 and the case body 130 are arranged above the metal plate 140. FIG. 71(*b*) shows an example of the arrangement of the board 300 and the case body 130 shown in FIG. 71(*a*) and the sensors on the board 300, which are arranged above the metal plate 140. FIG. 71(*c*) is a sectional view taken along a line F-F' in the configuration shown in FIG. 71(*a*).

In the example shown in FIG. 71, the four pre-registration sensors 432 arranged in a direction orthogonal to the document conveyance direction, a multiple feed detection sensor 430 (transmitting portion), and the optical sensor 311 are implemented on the board 300. The multiple feed detection sensor 430 and the four pre-registration sensors 432 are aligned with opening portions provided in the metal plate 140, respectively. Note that in the configuration shown in FIG. 71, the pre-registration sensors 432 are arranged on the upstream side of the multiple feed detection sensor 430 in the conveyance direction, unlike FIGS. 26 and 27.

In the configuration shown in FIG. 71, the pre-registration sensor 432 and the optical sensor 311 are arranged close, like the configuration shown in FIGS. 68 and 69. Between these sensors, to prevent light output from the light emitting element of one sensor from entering the light receiving element of the other sensor (that is, to prevent interference between the sensors), the partition 130*e* is formed on the case body 130, as shown in FIG. 71(*c*).

The partition 130*e* is formed between the pre-registration sensor 432 and the optical sensor 311 to shield light from the light emitting element 432*a* of the pre-registration sensor 432 to the side of the optical sensor 311. In particular, in this example, the partition 130*e* is formed such that the end portion (distal end) of the partition abuts against the metal plate 140. The gap between the partition 130*e* and the metal plate 140 is thus closed not to pass light, and the light shielding effect can be enhanced. That is, the effect of preventing interference between the pre-registration sensor 432 and the optical sensor 311 can be enhanced. Additionally, as shown in FIG. 71(*c*), an end portion 140*a* (of a portion in contact with the partition 130*e*) of the metal plate 140 is bent in the direction of the board 300 (optical sensor 311) to overlap the partition 130*e* in the conveyance direction. This can further enhance the effect of preventing interference between the pre-registration sensor 432 and the optical sensor 311.

In the example shown in FIG. 71, the optical sensor 311 is adjacent to the conveyance roller 902 in the document conveyance direction, as in the example shown in FIG. 69. The light transmitting plate 130*d* (filter) configured to prevent paper powder generated by the conveyance roller 902 from directly sticking to the optical sensor 311 is arranged at a position facing the optical sensor 311. A side wall that partitions between the optical sensor 311 and the pre-registration sensor 432 and a side wall that partitions between the optical sensor 311 and the conveyance roller 902 are formed on the case body 130 such that the light transmitting plate 130*d* tilts with respect to the surface of the board 300 (or the above-described image capturing reference surface) in the conveyance direction.

In particular, the light transmitting plate 130*d* is arranged to tilt such that the height from the surface of the board 300 increases toward the conveyance roller 902 in the document conveyance direction. That is, the light transmitting plate 130*d* tilts such that the height of the light transmitting plate 130*d* from the board 300 becomes higher on the side of the conveyance roller 902 than on the side of the pre-registration sensor 432 in the conveyance direction. This can enhance the effect of preventing paper powder generated by the conveyance roller 902 arranged on the downstream side in the conveyance direction from sticking to the light transmitting plate 130*d*. That is, paper powder sticking to the light transmitting plate 130*d* can be prevented from affecting the document detection accuracy by the optical sensor 311.

As described above, the document conveyance apparatus 400 according to this embodiment includes the optical sensor 311 and the pre-registration sensor 432 implemented on the board 300, and the case body 130 that covers the board 300. The optical sensor 311 includes a light emitting element, receives light reflected by a document conveyed in the conveyance path, and performs photoelectric conversion, thereby acquiring an image to be used to detect the moving amount of the document. The pre-registration sensor 432 includes the light emitting element 432*a*, and detects the document conveyed in the conveyance path by light output from the light emitting element 432*a*. The case body 130 includes the partition 130*e* located between the optical sensor 311 and the pre-registration sensor 432 and configured to shield light and prevent light output from the light emitting element of one of the two sensors from entering the other sensor. When the partition 130*e* is formed on the case body 130 that covers the board 300 on which the optical sensor 311 and the pre-registration sensor 432 are implemented, it is possible to prevent interference between the optical sensors arranged close (between the optical sensor 311 and the pre-registration sensor 432).

Note that as a modification of the above-described embodiment, the multiple feed detection sensor 430 (or a case surrounding it (not shown)) may be arranged between the optical sensor 311 and the pre-registration sensor 432 to make the multiple feed detection sensor 430 function as a light shielding wall. More specifically, in FIGS. 71(*a*) and 71(*b*), the pre-registration sensor 432 is arranged at a position on the opposite side of the optical sensor 311 (located at a position overlapping the light transmitting plate 130*d*) with respect to the multiple feed detection sensor 430. The multiple feed detection sensor 430 may thus be caused to function as a light shielding wall between the optical sensor 311 and the pre-registration sensor 432.

In the 15th embodiment, a description has been made above by showing various examples. However, the gist and scope of the present invention are not limited to a specific description in this specification, and these can also be combined. In addition, the following aspects are also incorporated, as a matter of course. The aspects will be described below.

[46th Aspect]

A document conveyance apparatus characterized by comprising:

a document table on which a document is placed;

a conveyance path in which the document placed on the document table is conveyed;

a first sensor including a first light emitting element and configured to receive light reflected by the document conveyed in the conveyance path and perform photoelectric conversion, thereby acquiring an image to be used to detect a moving amount of the document;

a second sensor including a second light emitting element and configured to detect the document conveyed in the conveyance path by light output from the second light emitting element;

a board on which the first sensor and the second sensor are implemented; and a case body fixed to the board, wherein the case body includes a first light shielding wall provided between the first sensor and the second sensor and configured to shield light so the light output from the light emitting element of one sensor of the first sensor and the second sensor does not enter the other sensor.

[47th Aspect]

The document conveyance apparatus according to the 46th aspect, characterized in that the second sensor further includes a light receiving element configured to receive reflected light of the light output from the second light emitting element, and the case body further includes a second light shielding wall provided between the second light emitting element and the light receiving element and configured to shield light so the light output from the second light emitting element does not directly enter the light receiving element.

[48th Aspect]

The document conveyance apparatus according to the 47th aspect, characterized in that the second light shielding wall is formed continuously from the first light shielding wall.

[49th Aspect]

The document conveyance apparatus according to any one of the 46th to 48th aspects, characterized in that the case body includes:

a member configured to form a wall surrounding the first sensor implemented on the board; and a light transmitting plate provided at a position facing the first sensor to close a space surrounded by the member and configured to transmit the light from the first light emitting element to the document and transmit reflected light from the document, and a part of the member forms the first light shielding wall.

[50th Aspect]

The document conveyance apparatus according to the 49th aspect, characterized in that the first light shielding wall is formed to have, as a height from a surface of the board, a height more than a height to provide the light transmitting plate.

[51st Aspect]

The document conveyance apparatus according to the 49th or 50th aspect, characterized by further comprising a conveyance roller provided on a downstream side of the case body in a conveyance direction of the document in the conveyance path and configured to convey the document, wherein the first sensor is arranged on the downstream side of the second sensor in the conveyance direction, and the light transmitting plate tilts with respect to the surface of the board, and is arranged to tilt such that the height from the surface of the board increases toward the conveyance roller in the conveyance direction.

[52nd Aspect]

The document conveyance apparatus according to any one of the 46th to 51st aspects, characterized in that the first light shielding wall is formed such that an end portion of the first light shielding wall abuts against a metal plate that forms the conveyance path.

[53rd Aspect]

The document conveyance apparatus according to the 52nd aspect, characterized in that in the conveyance direction of the document in the conveyance path, an end portion of a portion of the metal plate, which abuts against the first light shielding wall, is bent in a direction of the board to overlap the first light shielding wall in the conveyance direction of the document.

[54th Aspect]

The document conveyance apparatus according to any one of the 46th or 53rd aspects, characterized by further comprising a control circuit configured to control the first sensor and the second sensor, wherein the control circuit is implemented on the board together with the first sensor and the second sensor.

[55th Aspect]

The document conveyance apparatus according to any one of the 46th to 54th aspects, characterized in that the first sensor is arranged on the downstream side of the second sensor in the conveyance direction of the document in the conveyance path, and the document conveyance apparatus further comprises:

a detection unit configured to detect the moving amount of the document in the conveyance direction based on the image acquired by the first sensor; and a determination unit configured to determine, based on a detection result of the document by the second sensor and a detection result of the moving amount by the detection unit, whether the document is a document with high transparency.

[56th Aspect]

The document conveyance apparatus according to the 55th aspect, characterized in that if the document is not detected by the second sensor, and movement of the document is detected by the detection unit, the determination unit determines that the document is a document with high transparency.

There has conventionally been proposed a technique of detecting the moving amount of a document in the conveyance direction for the purpose of detecting whether the document is normally being conveyed in a document conveyance apparatus (related art 1 described above). In related art 1, using an encoder configured to detect the moving amount of the document in the conveyance direction and an optical sensor configured to measure a displacement amount in a specific first detection direction that is not orthogonal to the conveyance direction, the displacement amount in the conveyance direction is obtained from the optical sensor, and a skew amount is obtained from the displacement amounts in the first detection direction and a second detection direction. Furthermore, a displacement amount in the conveyance direction is obtained using the skew amount and the displacement amount from the encoder. However, in the above-described document conveyance apparatus, in addition to the optical image capturing element (optical sensor) configured to detect the conveyance direction of the document, other optical sensor configured to detect the conveyed document is provided in some cases. In this case, if the optical sensors are arranged close to reduce the size of the apparatus or suppress the cost, interference between the optical sensors may occur in which light output from the light emitting element of one sensor is received by the other sensor. As a result, an operation error may occur in the other sensor.

On the other hand, in the 15th embodiment of the present invention, by the above-described configuration, interference between the optical sensors arranged close can be prevented in the document conveyance apparatus capable of conveying a document.

The document conveyance apparatus according to the present invention has been described above in detail. However, the present invention is not limited to the above-described embodiment, and various improvements and modifications can be made without departing from the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet feeder comprising:

a feed roller configured to feed a sheet along a conveyance path;

a separation roller configured to form a nip with the feed roller and separate the sheet fed by the feed roller from other sheets;

a first sheet detection sensor arranged on a downstream side of the feed roller in the conveyance path, and configured to detect that the sheet has reached the first sheet detection sensor;

a control unit configured to control rotation of the feed roller;

a first conveyance roller located on the downstream side of the feed roller in the conveyance path and on the upstream side of the first sheet detection sensor in the conveyance path, and configured to convey the sheet;

a second conveyance roller located on the downstream side of the first conveyance roller in the conveyance path and on the upstream side of the first sheet detection sensor in the conveyance path, and configured to convey the sheet; and a second sheet detection sensor located on the downstream side of the first conveyance roller in the conveyance path and on the upstream side of the second conveyance roller in the conveyance path, and configured to detect that the sheet has reached the second sheet detection sensor, wherein in a case where feeding of a subsequent sheet by the feed roller is started after a trailing edge of a preceding sheet is detected by the first sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed, and in a case where a sheet leading edge is detected by the second sheet detection sensor, the control unit stops the rotation of the feed roller.

2. The sheet feeder according to claim 1, wherein in a case where a predetermined time has elapsed after the trailing edge of the preceding sheet is detected by the first sheet detection sensor, the control unit determines that the leading edge of the subsequent sheet has passed through the nip.

3. The sheet feeder according to claim 1, wherein in a case where a time corresponding to a time after the subsequent sheet stacked on a sheet stacker is fed until the leading edge of the subsequent sheet passes through the nip has elapsed, the control unit controls the feed roller to rotate at the second feeding speed.

4. The sheet feeder according to claim 1, further comprising a third sheet detection sensor located on the downstream side of the nip in the conveyance path and on an upstream side of the first sheet detection sensor in the conveyance path, and configured to detect that the sheet has reached the third sheet detection sensor, wherein in a case where a sheet leading edge is detected by the third sheet detection sensor, the control unit controls the feed roller to rotate at the second feeding speed.

5. The sheet feeder according to claim 1, further comprising a pickup roller arranged above the sheet stacked on a sheet stacker and configured to supply the sheet to the feed roller.

6. A sheet feeder comprising:

a feed roller configured to feed a sheet along a conveyance path;

a separation roller configured to form a nip with the feed roller and separate the sheet fed by the feed roller from other sheets;

a first sheet detection sensor arranged on a downstream side of the feed roller in the conveyance path, and configured to detect that the sheet has reached the first sheet detection sensor;

a control unit configured to control rotation of the feed roller;

a first conveyance roller located on the downstream side of the feed roller in the conveyance path and on the upstream side of the first sheet detection sensor in the conveyance path, and configured to convey the sheet;

a second conveyance roller located on the downstream side of the first conveyance roller in the conveyance path and on the upstream side of the first sheet detection sensor in the conveyance path, and configured to convey the sheet; and a second sheet detection sensor located on the downstream side of the first conveyance roller in the conveyance path and on the upstream side of the second conveyance roller in the conveyance path, and configured to detect that the sheet has reached the second sheet detection sensor, wherein in a case where feeding of a subsequent sheet by the feed roller is started after a trailing edge of a preceding sheet is detected by the first sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed, and in a case where a sheet leading edge is detected by the third sheet detection sensor, the control unit controls the feed roller to rotate at a speed equivalent to the second conveyance roller.

7. A sheet feeder comprising:

a feed roller configured to feed a sheet along a conveyance path;

a separation roller configured to form a nip with the feed roller and separate the sheet fed by the feed roller from other sheets;

a first sheet detection sensor arranged on a downstream side of the feed roller in the conveyance path, and configured to detect that the sheet has reached the first sheet detection sensor;

a control unit configured to control rotation of the feed roller;

a pickup roller arranged above the sheet stacked on a sheet stacker and configured to supply the sheet to the feed roller;

a conveyance roller located on the downstream side of the feed roller in the conveyance path and on the upstream side of the first sheet detection sensor in the conveyance path, and configured to convey the sheet; and a second sheet detection sensor located on the downstream side of the feed roller in the conveyance path and on the upstream side of the conveyance roller in the conveyance path, and configured to detect that the sheet has reached the second sheet detection sensor, wherein in a case where feeding of a subsequent sheet by the feed roller is started after a trailing edge of a preceding sheet is detected by the first sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed, and in a case where, after the trailing edge of the preceding sheet is detected by the first sheet detection sensor and driving of the feed roller is resumed, the leading edge of the subsequent sheet is not detected by the second sheet detection sensor even after an elapse of a preset standby time, the control unit causes the pickup roller to supply the sheet, and in a case where the leading edge of the subsequent sheet is detected by the second sheet detection sensor before the elapse of the standby time, the control unit controls the pickup roller to not supply the sheet.

8. A sheet feeder comprising:

a feed roller configured to feed a sheet along a conveyance path;

a separation roller configured to form a nip with the feed roller and separate the sheet fed by the feed roller from other sheets;

a sheet detection sensor arranged on a downstream side of the feed roller in the conveyance path, and configured to detect that the sheet has reached the sheet detection sensor; and a control unit configured to control rotation of the feed roller, wherein in a case where feeding of a subsequent sheet by the feed roller is started after a trailing edge of a preceding sheet is detected by the sheet detection sensor, the control unit controls the feed roller to rotate at a first feeding speed, and upon determining that a leading edge of the subsequent sheet has passed through the nip, the control unit further controls the feed roller to rotate at a second feeding speed higher than the first feeding speed, the sheet feeder has a thin paper conveyance mode and a normal conveyance mode, during execution of the thin paper conveyance mode, the control unit controls the feed roller to rotate at the first feeding speed until a leading edge of a first sheet of a plurality of sheets to be sequentially fed by the feed roller passes through the nip, and after the leading edge of the first sheet has passed through the nip, the control unit controls the feed roller to rotate at the second feeding speed, and during execution of the normal conveyance mode, the control unit performs control at the second feeding speed at a start of driving of the feed roller.

9. A control method of a sheet feeder including a feed roller configured to feed a sheet along a conveyance path; a separation roller configured to form a nip with the feed roller and separate the sheet fed by the feed roller from other sheets; a sheet detection sensor arranged on a downstream side of the feed roller in the conveyance path, and configured to detect that a sheet has reached the sheet detection sensor; and a control unit configured to control rotation of the feed roller, the control method comprising:

in a case where feeding of a subsequent sheet by the feed roller is started after a trailing edge of a preceding sheet is detected by the first sheet detection sensor, controlling, by the control unit, the feed roller to rotate at a first feeding speed; and upon determining that a leading edge of the subsequent sheet has passed through the nip, controlling, by the control unit, the feed roller to rotate at a second feeding speed higher than the first feeding speed, wherein the sheet feeder has a thin paper conveyance mode and a normal conveyance mode, during execution of the thin paper conveyance mode, the control unit controls the feed roller to rotate at the first feeding speed until a leading edge of a first sheet of a plurality of sheets to be sequentially fed by the feed roller passes through the nip, and after the leading edge of the first sheet has passed through the nip, the control unit controls the feed roller to rotate at the second feeding speed, and during execution of the normal conveyance mode, the control unit performs control at the second feeding speed at a start of driving of the feed roller.

* * * * *